US011415308B1

(12) United States Patent
Haney

(10) Patent No.: US 11,415,308 B1
(45) Date of Patent: Aug. 16, 2022

(54) CURTAIN LIGHTS KIT AND CURTAIN LIGHTS DEVICE

(71) Applicant: Neil Haney, Gig Harbor, WA (US)

(72) Inventor: Neil Haney, Gig Harbor, WA (US)

( * ) Notice: Subject to any disclaimer, the term of this patent is extended or adjusted under 35 U.S.C. 154(b) by 0 days.

(21) Appl. No.: 17/725,298

(22) Filed: Apr. 20, 2022

Related U.S. Application Data

(60) Provisional application No. 63/292,428, filed on Dec. 22, 2021.

(51) Int. Cl.

| | |
|---|---|
| ***F21V 23/04*** | (2006.01) |
| ***F21V 23/06*** | (2006.01) |
| ***F21V 23/00*** | (2015.01) |
| ***F21S 4/24*** | (2016.01) |
| ***F21V 17/10*** | (2006.01) |
| ***F21V 23/02*** | (2006.01) |
| ***F21Y 115/10*** | (2016.01) |

(52) U.S. Cl.
CPC ..... *F21V 23/0435* (2013.01); *F21S 4/24* (2016.01); *F21V 17/105* (2013.01); *F21V 23/002* (2013.01); *F21V 23/023* (2013.01); *F21V 23/06* (2013.01); *F21Y 2115/10* (2016.08)

(58) Field of Classification Search
CPC .. F21V 23/0435; F21V 17/105; F21V 23/002; F21V 23/023; F21V 23/06; F21V 33/0016; F21Y 2131/20; F21Y 2115/10; F21W 2131/30; F21S 4/24
See application file for complete search history.

(56) References Cited

U.S. PATENT DOCUMENTS 5,162,696 A 11/1992 Goodrich
5,601,361 A 2/1997 Lawrence
(Continued)

OTHER PUBLICATIONS

Texas Instruments, WL18x1MOD, WL18x5MOD WiLink, 8 Single-Band Combo Module-WiFi, Bluetooth, and Bluetooth Low Engergy (LE), Publisher,Texas instrument product sheet, revised Apr. 2021, pp. 1-52, Texas, U.S. found at https://www.ti.com/lit/ds/symlink/wl1801mod.pdf?tS.

(Continued)

*Primary Examiner* — Peggy A Neils
(74) *Attorney, Agent, or Firm* — Elizabeth Reilly; Patentpending, PLLC

(57) ABSTRACT

A curtain lights kit including a curtain lights device including a set of two curtain lights assemblies each having a preformed bendable wireless fidelity/short range wireless light emitting diode light strip for displaying in a common window frame; roll of magnetic polarity-A tape; roll of magnetic polarity-B tape; pin light emitting diode female to female connector cables; pin light emitting diode female to female butterfly connector cables; mateable pin light emitting diode male connectors; first AC/DC power supply adapter; second AC/DC power supply adapter; quick reference codes; curtain lights kit/curtain lights device instruction manual; portable curtain lights storage case, a first curtain lights assembly including a first preformed curtain including a first wireless fidelity/short range wireless controller having a first wireless fidelity/short range wireless combination chip, and a second curtain lights assembly including a second preformed curtain including a second wireless fidelity/short range wireless combination chip.

39 Claims, 28 Drawing Sheets

(56) References Cited

U.S. PATENT DOCUMENTS

| | | | |
|---|---|---|---|
| 5,645,342 | A | 7/1997 | Chang |
| 5,860,731 | A | 1/1999 | Martinez |
| 5,915,827 | A | 6/1999 | Wang |
| 6,135,616 | A | 10/2000 | Rahman |
| 6,152,576 | A | 11/2000 | Mount |
| 6,302,562 | B1 | 10/2001 | Wu |
| 6,371,637 | B1 | 4/2002 | Atchinson et al. |
| 6,402,336 | B1 | 6/2002 | Reese |
| 6,431,730 | B1 | 8/2002 | Deutsch et al. |
| 6,528,954 | B1 | 3/2003 | Lys et al. |
| 6,536,916 | B1 | 3/2003 | Rahman |
| 6,572,238 | B1 | 6/2003 | Johnson |
| 6,783,259 | B1 | 8/2004 | Macedonio |
| 8,104,917 | B2 | 1/2012 | Link |
| 8,262,250 | B2 | 9/2012 | Li et al. |
| 9,057,504 | B2 | 6/2015 | Levante et al. |
| 9,539,932 | B2 | 1/2017 | Fay |
| 9,591,725 | B2 | 3/2017 | Radermacher |
| 9,697,447 | B2 | 7/2017 | Schory et al. |
| 9,967,960 | B2 | 5/2018 | Bora et al. |
| 10,050,952 | B2 | 8/2018 | Shi |
| 10,321,541 | B2 | 6/2019 | Bora et al. |
| 10,383,232 | B2 | 8/2019 | Heikkinen et al. |
| 10,443,918 | B2 | 10/2019 | Li et al. |
| 11,226,089 | B1 * | 1/2022 | McRae ..... F21V 23/0435 |
| 2009/0278464 | A1 | 11/2009 | Chung |
| 2011/0146923 | A1 | 6/2011 | Chen |

OTHER PUBLICATIONS

Inova Semiconductors, Smart LED Driver & Controller (Datasheet-ISELED), Publisher, Inova Semiconductors GMbH, 2020, pp. 1-35, Munich, Germany.

* cited by examiner

CURTAIN LIGHTS KIT AND CURTAIN LIGHTS DEVICE

CROSS-REFERENCE TO RELATED APPLICATION

The present application claims benefit to U.S. Provisional Application No. 63/292,428, filed Dec. 22, 2021, the entire disclosure of which is expressly incorporated herein by reference.

FIELD OF THE INVENTION

The present disclosure relates generally to the field of decorative lighting and, more particularly, to light emitting diode lighting device and kit controlled by a wireless fidelity/short range wireless controller.

BACKGROUND OF THE INVENTION

Decorative light strings comprising a plurality of decorative bulb and socket assemblies linked by insulated electrical wires are well known. Such decorative light strings are ordinarily sold with clear, white, or a variety of colors of lights, of various bulb sizes and various numbered count strings. Currently, doorways or windows have been decorated for seasonal holidays, seasonal celebrations, national holidays, special life events, school events, and sports events, with decorative white stringed lights, or color stringed lights, by removably attaching such decorative stringed lights around the peripheral edges of windows and doors using hooks, staples, eyehole screws, duct tape, hook and loop, and other types of removable fasteners. Generally, removably attaching the stringed lights to windows or doors allows for installation of only one or two strings of lights around the peripheral edges of windows and doors. Moreover, the installation of the stringed lights using hooks, staples, eyehole screws, duct tape, staples, hook and loop, and other types of removable fasteners can cause damage to the window frames and door frames.

The use of stranded lights as curtains in windows, and doorways is, also, currently used. Such strands, often made of strings of lighted beads, typically hang downward from the top of the window frame or door frame, and are parted by the user with brackets. The stranded lights are limited by the size of the window frames or the door frame.

The use of stranded lights as curtains in windows, and doorways is, also, currently used. Such strands, often made of strings of lighted beads, typically hang downward from the top of the window frame or door frame, and are parted by the user with brackets. The stranded lights are limited by the size of the window frames or the door frame.

Therefore, there remains a need, for a curtain lights kit and curtain lights device using light emitting diode lights implemented as a decorative lighting treatment for windows or doorways that comprises a curtain lights kit and curtain lights device of a plurality of wireless fidelity/short range wireless light emitting diodes of one or more preformed bendable wireless fidelity/short range wireless light emitting diode light strip wherein the plurality of wireless fidelity/short range wireless light emitting diodes are configured with a variety of colors, not limited to red, green, blue, white, and any variety of a mix of the variety of colors. There is a need for a curtain lights device having the preformed bendable wireless fidelity/short range wireless light emitting diode light strip is embedded within a waterproof substrate in a shape of a curtain controlled by an embedded wireless fidelity/short range wireless controller and can be implemented with a variety of window frame and door frame sizes. Further, there is a need for a curtain lights device that can be quickly and easily installed and then easily removed following use and stored in a portable curtain lights storage case.

Light emitting diodes are known which when disposed on an electrically conductive copper circuitry, accept electrical impulses from the electrically conductive copper circuitry and convert the impulses into light signals. Light emitting diodes are energy efficient where they give off virtually no heat, and they have a long lifetime. Light emitting diode strips are available in white, red, green and blue. Although most light emitting diodes in use are red, green, blue, or white, light emitting diodes may take any color. Moreover, a single light emitting diode may be configured and wired to change colors to any color in the color spectrum in response to changing controlling electric current and electrical signals controlled by a wireless fidelity/short range wireless controller.

Further, the present application relates to wireless communication, including coexistence of wireless fidelity network and a short range wireless network in a single wireless fidelity/short range wireless controller by mitigating the effects of electromagnetic signal interference in devices implementing two or more wireless protocols, such as wireless fidelity, also, known as wireless fidelity, also, known as WiFi® protocol, and short range wireless protocols, also, known as Bluetooth®.

Wireless technologies are becoming more and more popular around the world. Consumers appreciate the wireless lifestyle, relieving them of the well-known cable labyrinths that tend to grow under user's desks. Both our way of life and the global economy are highly dependent on the flow of information through wireless mediums like television and radio. Smart devices, including cell phones, pads, laptops, desktops, have become highly available during the last decade having wireless capabilities. During the last few years, IEEE 802.11 technologies have started to spread rapidly, enabling consumers to set up their own wireless networks. This constitutes an important change in how wireless communications are made available to consumers including light emitting diode light systems and personal area wireless networks.

Wireless communication systems are rapidly growing in usage. In recent years, wireless smart devices such as smart phones, and tablet computers, have become increasingly sophisticated. In addition, electronic devices are now expected to communicate using short range communication protocols with numerous other types of wireless devices, including user interface devices such as keyboards, mice, headsets, remote controls, sunglasses, glasses, and apparel. Additionally, different short range wireless communication technologies and standards are being used by these devices, such as Wireless Local Area Network (WLAN) or wireless fidelity (WiFi®) network, and short range wireless network (BLUETOOTH®), among others. Wireless fidelity networks are now being used in a host of new applications, including many peer to peer applications where the device is required to shift among different channels (frequencies) at a much higher rate than was previously required.

SUMMARY

Systems and methods of the present invention include use of wireless fidelity/short range wireless light emitting diodes as part of a curtain lights device to provide aesthetically appealing lighting effects. The wireless fidelity/short range wireless light emitting diodes of the present invention may be used in a number of technological fields in inventions, more particularly, in the particular disclosure, in providing illuminated preformed bendable wireless fidelity/short range wireless light emitting diode light strips embedded in a transparent non-conductive substrate of a preformed curtain for a common window frame.

The common window frame can include standard windows, sliding glass door windows, with a variety of heights and widths, sash sizes and sash depths. The curtain lights device can be implemented with a variety of sizes and types of window frames including: (1) Double hung and single hung standard windows dimensioned, 2 feet wide by 3 feet high; 2 feet wide by 4 feet, 4 inches high; 2 feet, 8 inches wide by 4 feet high; 2 feet, 8 inches wide by 5 feet, 2 inches high; and 4 feet wide by 6 feet high; (2) Sliding window standard sizes are always wider than they are tall or are square. Slider windows range from 36 inches to 84 inches wide. Heights range from 24 inches to 60 inches. Size combinations commonly found: 3 feet wide by 2 feet high; 3 feet wide by 3 feet wide; 5 feet wide by 3 feet high; 6 feet wide by 4 feet high; and 7 feet wide by 4 feet high. (3) Casement window standard sizes including widths of casement windows commonly start at 17 inches and range up to 41 inches. Common heights range from 16 inches up to 33 inches; 1-foot, 7 inches wide by 1-foot, 4 inches high; 1-foot, 7 inches wide by 2 feet, 5 inches high; 2 feet, 3 inches wide by 2 feet, 3 inches high; 2 feet, 9 inches wide by 2 feet, 9 inches high; and 3 feet, 5 inches wide by 2 feet, 5 inches high. (4) Custom window sizes where standard window sizes work for most homes, there may be common window frames that require windows that don't fall into these prescribed categories. Therefore, the curtain lights devices can be custom made to accommodate the size of the common window frame required by the user. The custom or special sizes that window manufacturers offer sometimes have a greater size range than with standard windows.

The present invention includes a curtain lights kit comprising a curtain lights device. The curtain lights device includes a set of two curtain lights assemblies, a first curtain lights assembly and a second curtain lights assembly to be draped on either side of a common window for an illuminated display of a first plurality of wireless fidelity/short range wireless diodes embedded in a first preformed curtain of the first curtain lights assembly, and a second plurality of wireless fidelity/short range wireless diodes embedded in a second preformed curtain of the second curtain lights assembly.

The curtain lights device, also, includes, a roll of magnetic polarity-A tape, a roll of magnetic polarity-B tape for releasably mounting each of the first curtain lights assembly and the second curtain lights assembly to the common window frame; one or more pin light emitting diode female to female connector cables; one or more mateable pin light emitting diode male connectors; a first AC/DC power supply adapter, a second AC/DC power supply adapter; a curtain lights kit/curtain lights device instruction manual having an instructor manual quick reference; and a portable curtain lights storage case including a variety of sizes of removable storage containers therein. The first curtain lights assembly includes a first preformed curtain which is formed from a first transparent non-conductive substrate having a first preformed bendable wireless fidelity/short range wireless light emitting diode light strip embedded within a first interior spatial area of the first transparent non-conductive substrate, and the second curtain lights assembly includes a second preformed curtain which is formed from a second transparent non-conductive substrate having a second preformed bendable wireless fidelity/short range wireless light emitting diode light strip embedded within a second interior spatial area of the second transparent non-conductive substrate. The first transparent non-conductive substrate and the second transparent non-conductive substrate are manufactured from a water-resistant material, thereby, rendering the first preformed curtain and the second preformed curtain waterproof protecting the first preformed bendable wireless fidelity/short range wireless light emitting diode light strip and the second preformed bendable wireless fidelity/short range wireless light emitting diode light strip embedded therein each of the first preformed curtain and the second preformed curtain, respectively.

A significant problem with present light emitting diode lighting systems is that current light emitting diode controllers either support a wireless fidelity network or a short range wireless network but not both where a wireless network is needed or a short range wireless network is needed to implement the lighting system. However, a user may only have an available short range wireless network available for use or the user may only have a wireless fidelity network for use to implement the light emitting diode light system. The present disclosure solves this significant problem by providing and embodiment having a wireless fidelity/short range wireless controller including a wireless fidelity/short range wireless combination chip that supports the coexistence of both a wireless fidelity network and the short range wireless network. In addition, the wireless fidelity/short range wireless controller integrates a radio frequency network.

Another significant problem with present light emitting diode lighting systems is that the light emitting diode light strips are connected to an external controller. In this situation, the light emitting diode light strip, often, is disconnected from the external controller where a pin male connector dislodges from a pin female connector disposed on the external connector and the user must mechanically tape the external controller to the light emitting diode light strip. The present invention solves this problem in which it discloses a first wireless fidelity/short range wireless controller embedded within a first interior space of a first transparent non-conductive substrate of a first preformed curtain where the first wireless fidelity/short range wireless controller is embedded congruent with an embedded first preformed bendable wireless fidelity/short range wireless light emitting diode light strip and, similarly, a second wireless fidelity/short range wireless controller is embedded within a second interior space of a second transparent non-conductive substrate of a second preformed curtain where the second wireless fidelity/short range wireless controller is embedded congruent with the embedded second preformed bendable wireless fidelity/short range wireless light emitting diode light strip.

Another significant problem is standard light emitting diode strips include a double sided adhesive where the double sided adhesive is utilized to mount the light emitting diode strip to an exterior surface. Often the adhesive surface wears and the light emitting diode strip is released from the surface partially or completely. Here, in the present invention, the first preformed bendable lighting emitting diode light strip is embedded within a first interior surface area of a first transparent non-conductive substrate of a first preformed curtain, similarly, the second preformed bendable light emitting diode light strip is embedded within a second interior spatial area of a second transparent non-conductive substrate of a second preformed curtain, and, similarly, in yet another embodiment, a wireless fidelity/short range wireless light emitting diode plate is embedded within an interior spatial area of a transparent silicone of a preformed curtain lights panel. Thereby, with this embodiment, each of the first preformed bendable wireless/fidelity light emitting diode light strip, the second preformed bendable light strip, and the wireless fidelity/short range wireless light emitting diode curtain lights plate is prevented from slipping because it is embedded within each of the interior spatial areas of the first transparent non-conductive substrate of a first preformed curtain, the second interior spatial area of a second transparent non-conductive substrate of a second preformed curtain, and the interior spatial area of the transparent silicone of the preformed wireless fidelity/short range wireless light emitting diode curtain lights plate, respectively.

Further, in this manner, the first transparent substrate of the first preformed curtain, the second transparent substrate of the second preformed curtain, and the transparent silicone of a preformed curtain lights panel provides for a waterproof curtain lights device. A water proof curtain lights device is highly desirable, for numerous applications, including for the decorative curtain lights device in exterior settings and/or interior settings where moisture is common. Light emitting diode devices exposed to moisture and/or extreme temperatures may be at risk for failure if water droplets are allowed to contact non-water proof lighting devices. The water can cause a short circuit or other electrical failure of the device, requiring repair and/or replacement of the failed components.

A curtain lights kit and a curtain lights device are provided herein that overcome many of the drawbacks of conventional illumination systems. The curtain lights kit and curtain lights device provides the first wireless fidelity/short range controller to control a controlling electric current moving through each of the first plurality of wireless fidelity/short range wireless light emitting diodes of the first preformed bendable wireless fidelity/short range wireless light emitting diode light strip of the first preformed curtain of the first curtain lights assembly; and a second wireless fidelity/short range wireless controller to control a controlling electric current moving through each of the second plurality of wireless fidelity/short range wireless light emitting diodes of the second preformed bendable wireless fidelity/short range wireless light emitting diode light strip of the second preformed curtain of the second curtain lights assembly. The user may use a smart device to communicate with a wireless fidelity network in coexistence with a short range wireless network and choose to integrate a radio frequency network to control the color and illumination of each of the first plurality of wireless fidelity/short range wireless light emitting diodes of the first wireless fidelity/short range wireless light emitting diode light strip of the first preformed curtain; and to each of the second plurality of wireless fidelity/short range wireless light emitting diodes of the second preformed bendable wireless fidelity/short range wireless light emitting diode light strip of the second preformed curtain. In addition, the user may use the radio frequency network to control the illumination of each of the first plurality of wireless fidelity/short range wireless light emitting diodes of the first preformed bendable wireless fidelity/short range wireless light emitting diode light strip. Further, the curtain lights kit, provides convenience to the user where all of the necessary elements of the curtain lights kit to be maintained and stored in one place in a portable curtain lights storage case.

In an embodiment of the present invention a curtain lights kit is disclosed for providing an efficient, wireless fidelity/short range wireless controller controlled first preformed bendable wireless fidelity/short range wireless light emitting diode light strip embedded in the first transparent non-conductive substrate of the preformed curtain or panel, and a second preformed bendable wireless fidelity/short range wireless light emitting diode light strip embedded in the second transparent non-conductive substrate of the second preformed curtain, capable of providing high performance and rapid color selection and change of multi-color illumination or white illumination as the first preform curtain and the second preformed curtain are mounted on the common window frame providing an aesthetically beautiful illuminated draped window.

Features that are described and/or illustrated with respect to one embodiment may be used in the same way or in a similar way in one or more other embodiments and/or in combination with or instead of the features of the other embodiments. It should be emphasized that the term "comprises/comprising" when used in this specification is taken to specify the presence of stated features, integers, steps or components but does not preclude the presence or addition of one or more other features, integers, steps, components or groups thereof due to the need to switch communications among different peer devices and an access point.

The features of novelty and various other advantages that characterized the invention are pointed out with particularity in the claims forming a part thereof. However, for a better understanding of the invention, its advantages, and the objects obtained by its use, reference should be made to the drawings that form a further part hereof, and to the accompanying descriptive subject matter, in that there is illustrated and described a preferred embodiment of the invention. The features and advantages of the present invention will be apparent to those skilled in the art. While numerous embodiments may be made by those skilled in the art, such modifications are within the spirit of the invention.

BRIEF DESCRIPTION OF THE DRAWINGS

These and further aspects of the disclosure will be explained in greater detail by way of example and with reference to the accompanying drawings. The figures are not drawn to scale. It is to be understood that both the foregoing general description and the following detailed description are exemplary and explanatory only and are not restrictive of the embodiments of the present disclosure, as claimed.

DETAILED WRITTEN DESCRIPTION

Figure 1:
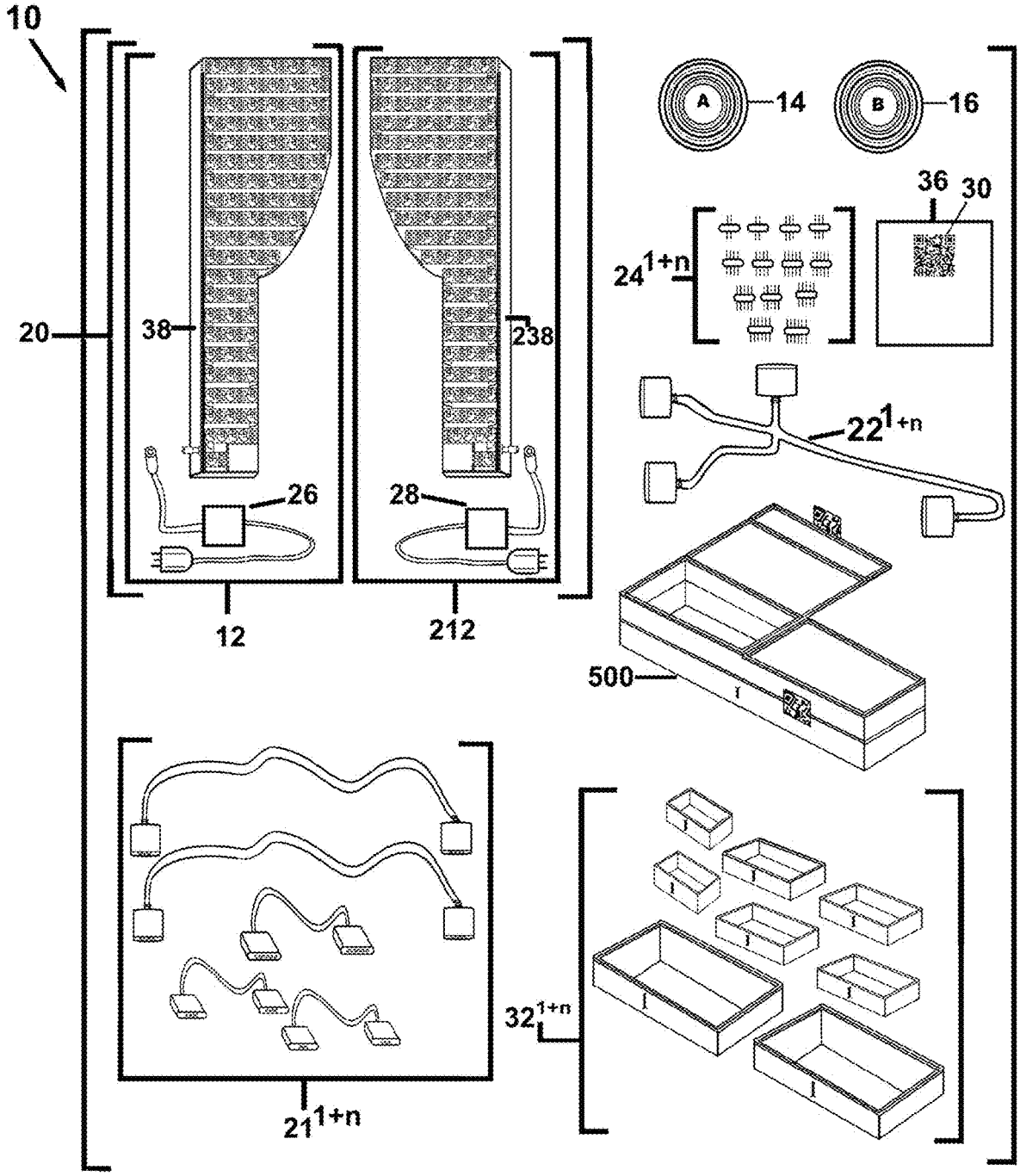
FIG. 1 illustrates a curtain lights kit, according to an embodiment of the present invention.

Detailed embodiments of the claimed structures and methods are disclosed herein, however, it can be understood that the disclosed embodiments are merely illustrative of the claimed structures and methods that may be embodied in various forms. This invention may, however, be embodied in many different forms and should not be construed as limited to the exemplary embodiments set forth herein. Rather, these exemplary embodiments are provided so that this disclosure will be thorough and complete and will fully convey the scope of this invention to those skilled in the art. Additionally, any features of any embodiments described herein are equally applicable to any other embodiment described herein or envisioned by one of ordinary skill in the art. Thus, the detailed description provided herein should not be construed to exclude in the description, details of well-known features and techniques may be omitted to avoid unnecessarily obscuring the presented embodiments.

References in the specification to "one embodiment", "an embodiment", "an example embodiment", indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

The term light emitting diode refers to a single light emitting diode having multiple semiconductor dies that are individually controlled and provides a source of illumination capable of producing a variety of colors including at least white, red, green, and blue. The term "illuminate" should be understood to refer to the production of a frequency of radiation by an illumination source. The term "color" should be understood to refer to any frequency of radiation within a spectrum; that is, a "color," as used herein, should be understood to encompass frequencies not only of the visible spectrum, but also frequencies in the infrared and ultraviolet areas of the spectrum, and in other areas of the electromagnetic spectrum.

The curtain lights devices embodied in the present invention are implemented with wireless fidelity networks, short range wireless networks, Zigbee wireless networks, and radio frequency.

The term wireless fidelity has the full breadth of its ordinary meaning, and at least includes a wireless communication network that is serviced by wireless local area network (WLAN) access points and which provides connectivity through these access points to the Internet. Most modern wireless fidelity networks (or WLAN networks) are based on IEEE 802.11 standards and are marketed under the name "Wi-Fi". During the last few years, IEEE 802.11 technologies have started to spread rapidly, enabling consumers to set up their own wireless networks. Wireless fidelity networks, short range wireless networks, and Zigbee protocols have spread spectrum techniques in the 2.4 GHz bandwidth.

The term short range wireless network is also known as Bluetooth®—The term "short term wireless" and short range wireless network has the full breadth of its ordinary meaning, and at least includes any of the various implementations of the Bluetooth standard, including Bluetooth Low Energy (BTLE) and Bluetooth Low Energy for Audio (BTLEA), among others. Bluetooth is an open standard for short range, low power, and low cost digital radio wireless communication. Bluetooth is a current industry standard for short-range wireless connectivity. It operates efficiently within the range of 20-25 ft in the environment without WLAN equipment. Bluetooth signals operate in the same frequency range of 24 GHz bandwidth.

The term Zigbee is a wireless personal network technology based on IEEE 802.15.4 with a transmission range of 100+meters. Zigbee operates in 2.4 GHz bandwidth. Zigbee consumes very little power and is inexpensive to use.

The term radio frequency or home radio frequency technology uses frequency hopping spread spectrum (FHSS) in the 2.4 GHz frequency bandwidth. Its nodes can travel within a 50 meter range of a wireless access point while remaining connected to the personal area network (PAN).

Personal Area Network—The term "Personal Area Network" has the full breadth of its ordinary meaning, and at least includes any of various types of computer networks used for data transmission among devices such as computers, phones, tablets and input/output devices. Bluetooth is one example of a personal area network. A personal area network is an example of a short range wireless communication technology.

The curtain lights devices embodied in the present invention can be actuated byway of a quick response code and the user's smart device having a camera. The quick response (QR) codes are matrix (two dimensional—2D) bar codes that can be read by 2D image sensors such as scanners and digital cameras. The quick reference code design allows characters to be stored in a format where the data is not identified by a single set of vertical black strips. Instead, black dots are arranged on a square grid against a white background. Data can be stored in black patterns along both the horizontal and vertical direction components. The data stored in the image is read by an imaging device, i.e., a camera in a smart device, and then a processing device interprets the image. The quick reference image allows for storage of various kinds of information such as web site addresses, mobile telephone numbers, contact cards (e.g., vCards), geographic information, plain text and images, wireless network access information, as well as other information. Digital camera technology within the smart device is used to read the quick reference codes.

The term "a first" and "a second" identifies a first curtain lights assembly and a "second" curtain lights assembly such that each of the elements of the "first" curtain lights assembly is preceded by the adjective "first" and each of the elements of the second curtain lights assembly is preceded by the adjective "second" to distinguish the first curtain lights assembly from the second curtain lights assembly. For example, the first curtain lights assembly includes a first preformed curtain; and the second curtain lights assembly includes a second preformed curtain.

Figure 2A:
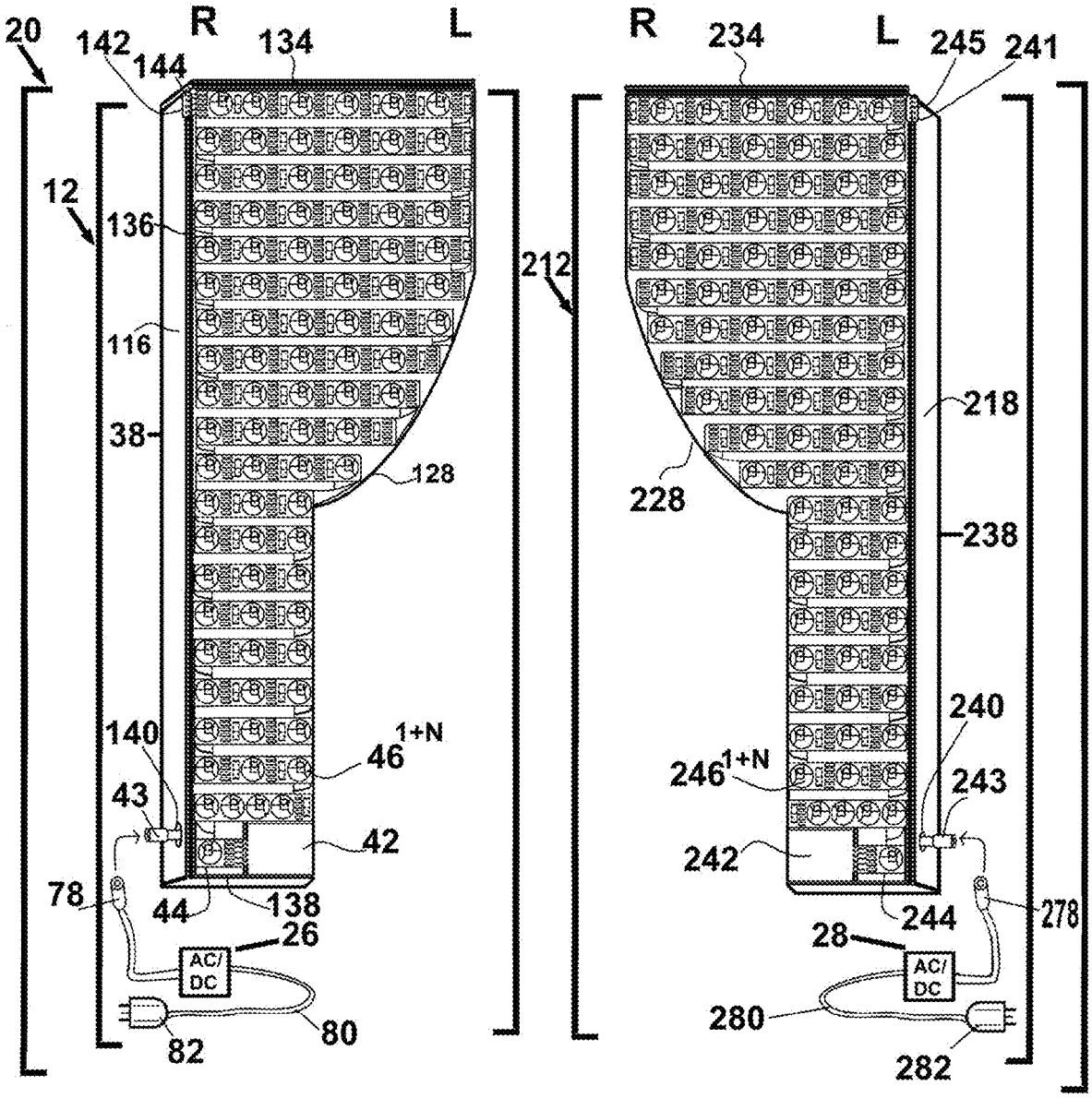
FIG. 2A illustrates a perspective front view of a set of two curtain lights assemblies, a first curtain lights assembly showing a first preformed curtain, and a first AC/DC power supply adapter, and a second curtain lights assembly showing a second preformed curtain, and a second AC/DC power supply adapter, of the curtain lights kit of FIG. 1, according to the embodiment of the present invention.

Referring to FIGS. 1-14, an exemplary embodiment of a curtain lights kit 10, is provided. FIG. 1 shows the curtain lights kit 10. The curtain lights kit 10 includes a curtain lights device 20 including a first curtain lights assembly 12 and a second curtain lights assembly 212, as shown in FIGS. 1 and 2A; a roll of magnetic polarity-A tape 14, as shown in FIGS. 1 and 3A, and a roll of magnetic polarity-B tape 16, as shown in FIGS. 1 and 3B, for releasably mounting each of the first curtain lights assembly 12 and the second curtain lights assembly 212 to a common window frame 18; one or more pin light emitting diode female to female connector cables $\mathbf{21}^{1+n}$, as shown in FIGS. 1 and 3C, one or more pin light emitting diode female to female butterfly connector cables $\mathbf{22}^{1+n}$, as shown in FIGS. 1 and 3D; one or more mateable pin light emitting diode male connectors $\mathbf{24}^{1+n}$, as shown in FIGS. 1 and 3E; a curtain lights kit/curtain lights device instruction manual 36, as shown in FIGS. 1 and 3F; a portable curtain lights storage case 500, as shown in FIGS. 1, 4A and 4D, including a variety of sizes of removable storage containers $\mathbf{32}^{1+n}$, as shown in FIGS. 1, 4B-4C.

Figure 2B:
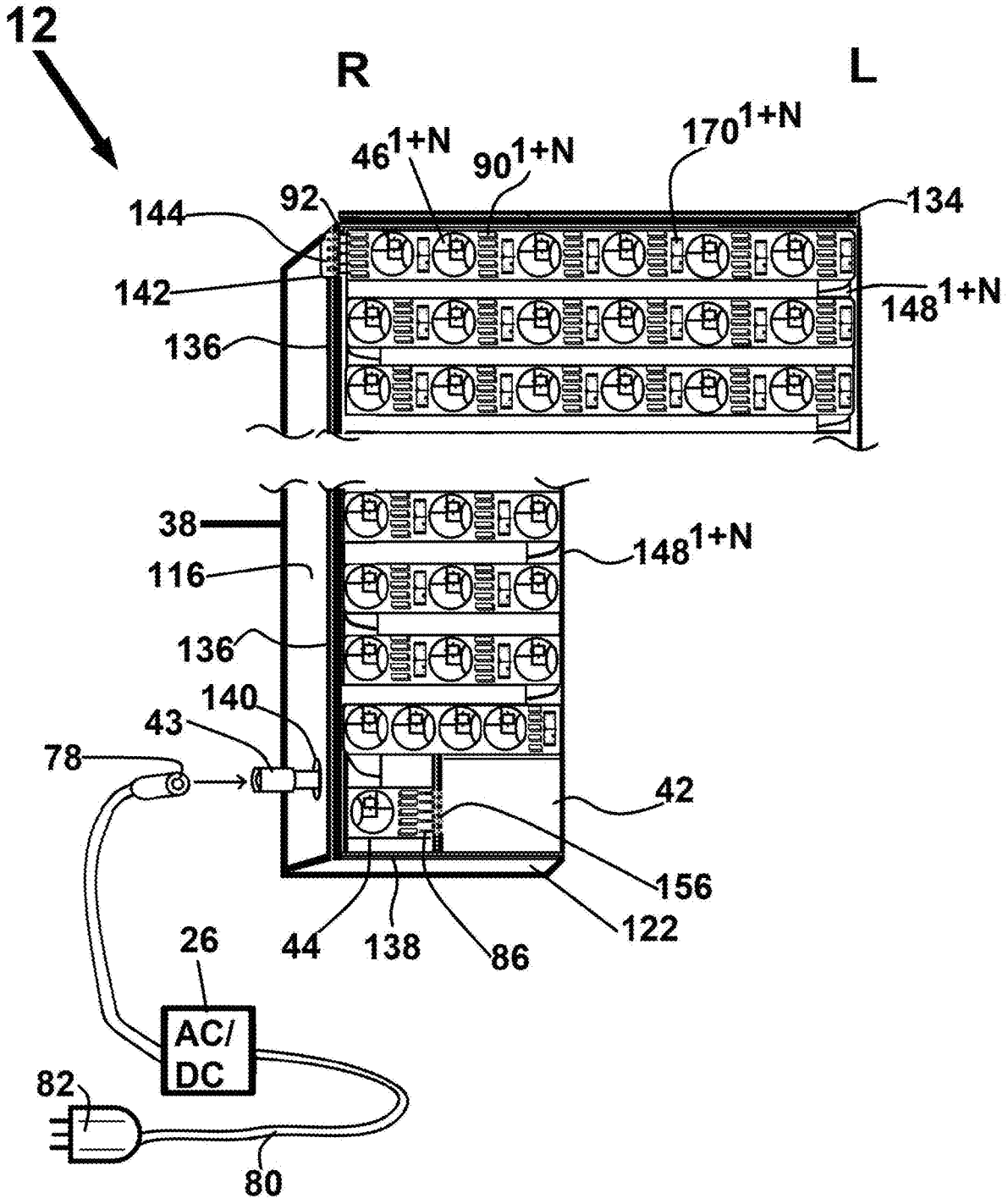
FIG. 2B illustrates an exploded sectional perspective front view of the first curtain lights assembly of FIG. 2A, according to the embodiment of the present invention.
Figure 2C:
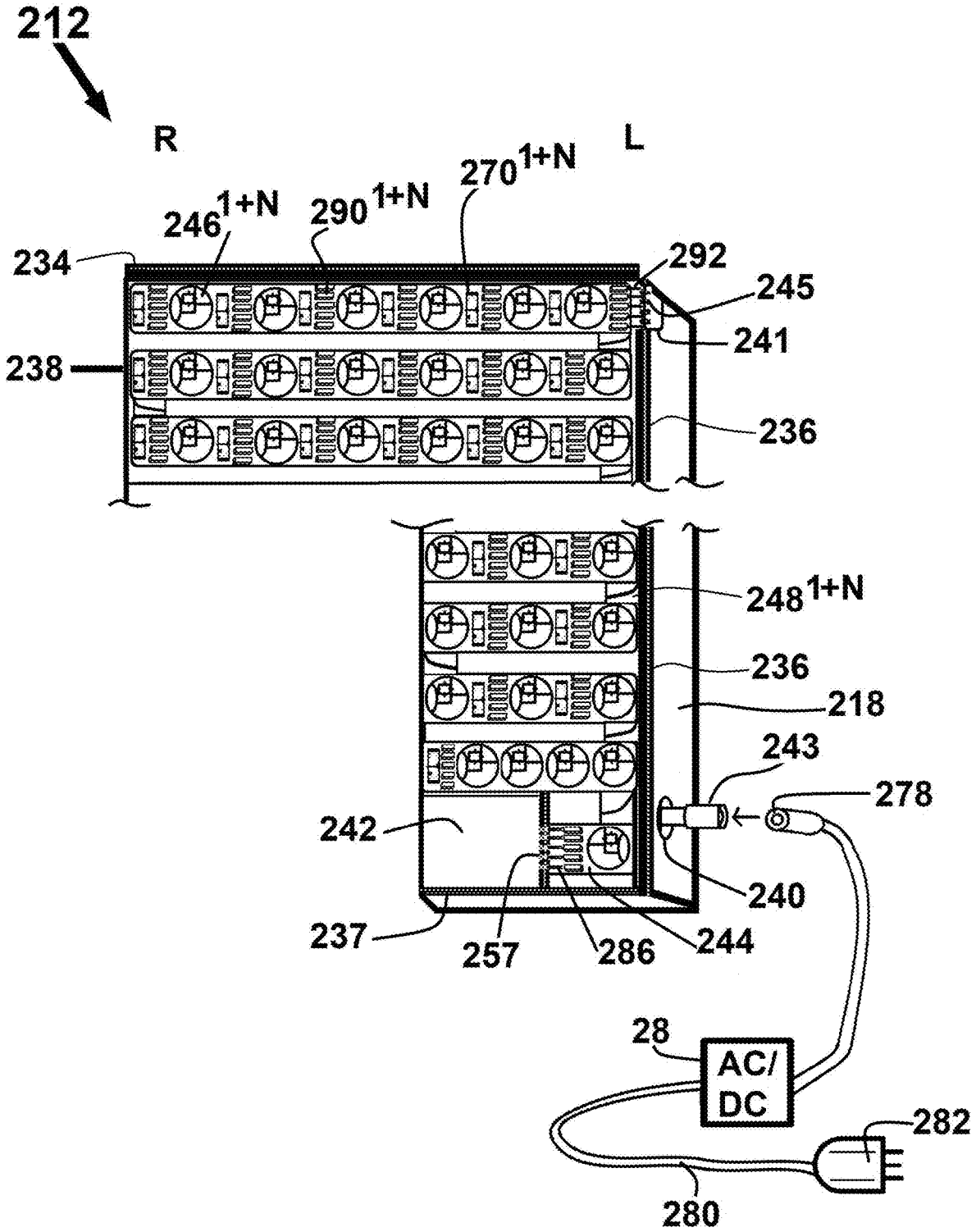
FIG. 2C illustrates an exploded sectional perspective front view of the second curtain lights assembly of FIG. 2A, according to the embodiment of the present invention.
Figure 12A:
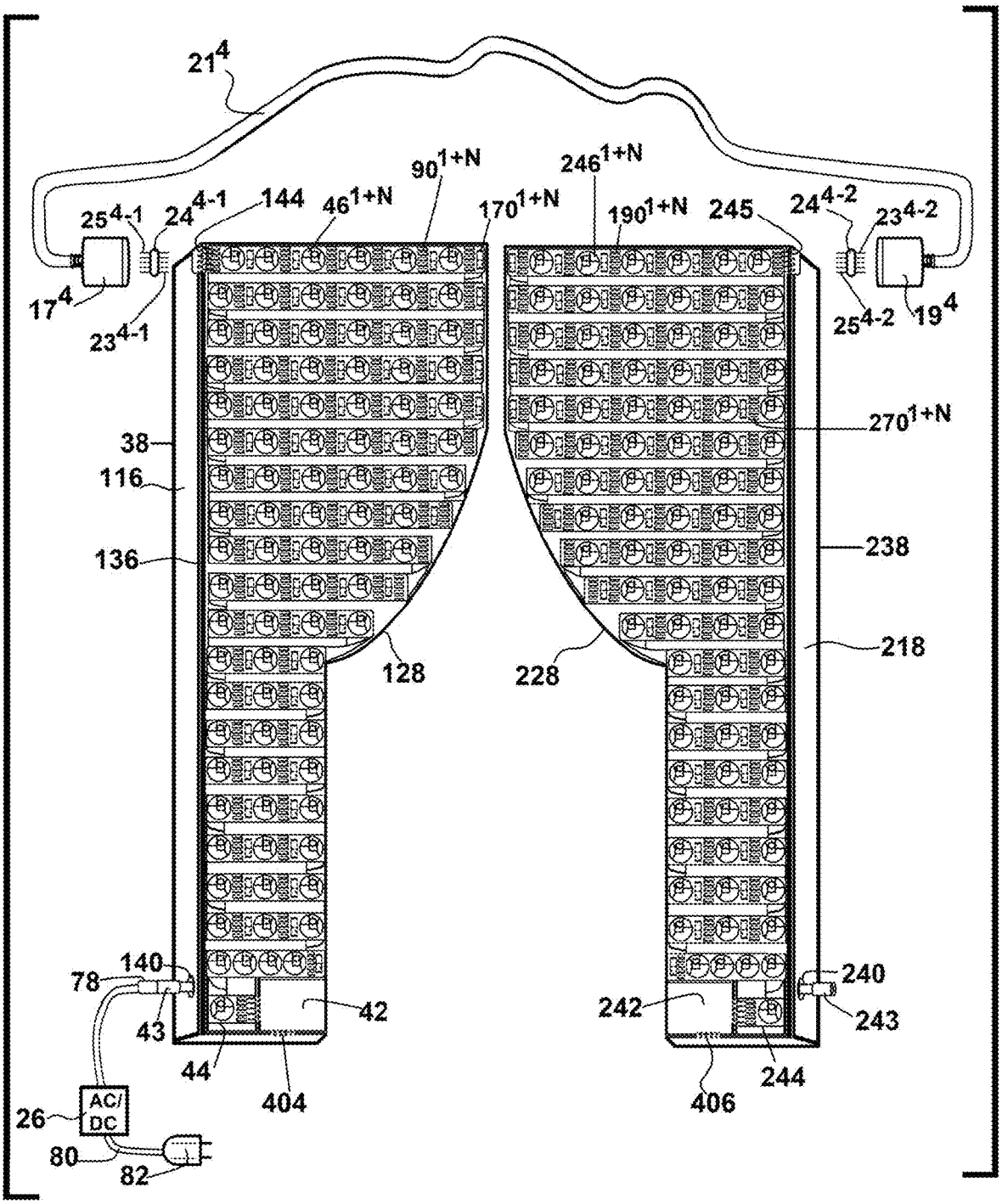
FIG. 12A illustrates a perspective front view of the first curtain lights assembly in use with a second preformed curtain of the second curtain lights assembly by way of a pin light emitting diode female to female connector cable, according to the embodiment of the present invention.
Figure 12B:
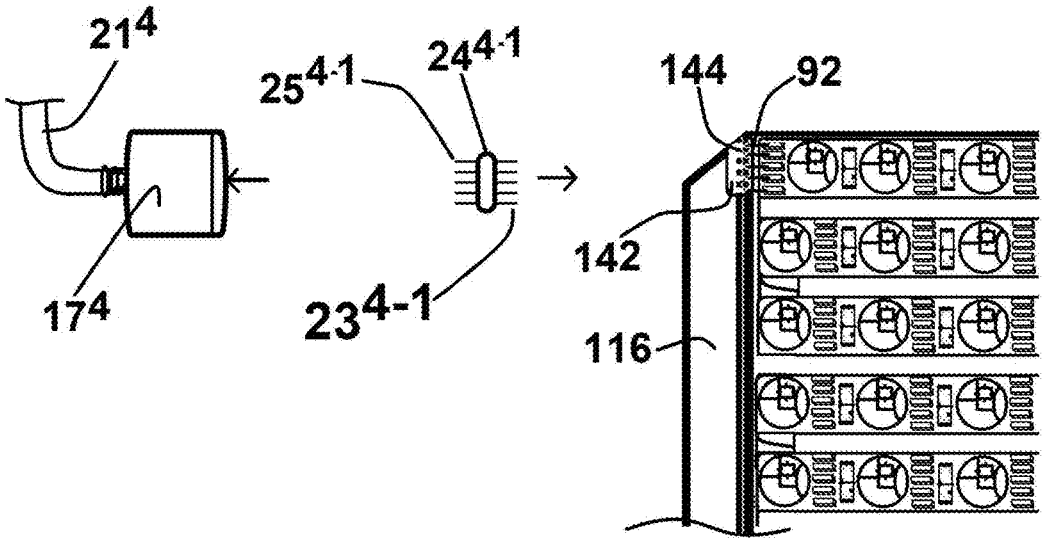
FIG. 12B illustrates an enlarged perspective view of a portion of the first curtain lights assembly of FIG. 12A showing a working operation of a first terminal female connector of a pin light emitting diode female to female connector cable, a mateable pin light emitting diode male connector, and an output pin light emitting diode female receptacle of the first preformed curtain, according to the embodiment of the present invention.
Figure 12C:
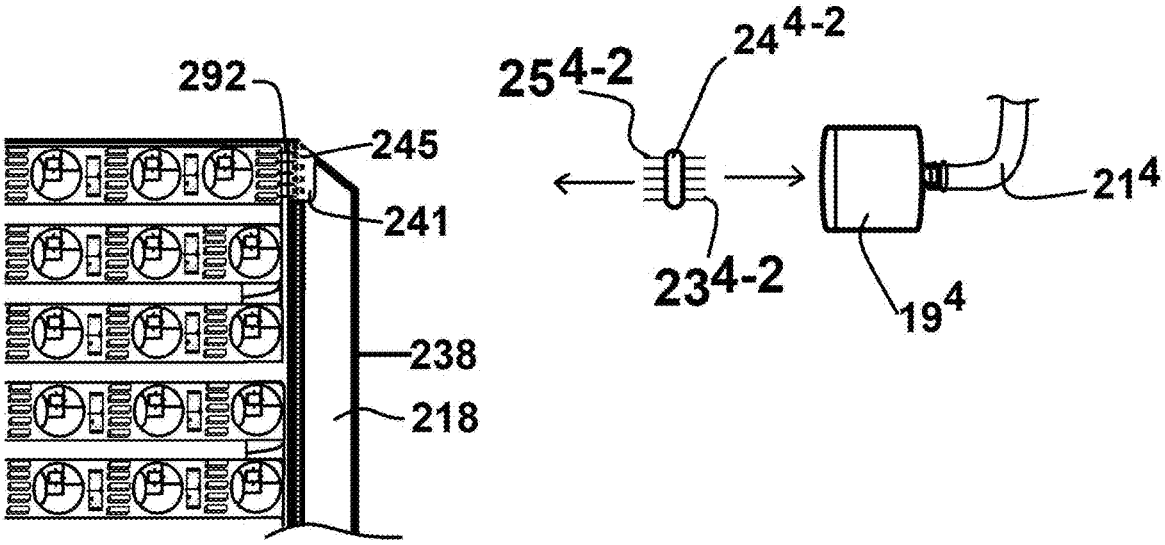
FIG. 12C illustrates an enlarged perspective view of a portion of the second curtain lights assembly of FIG. 12A showing a working operation of a second terminal female connector of the pin light emitting diode female to female connector cable, a mateable pin light emitting diode male connector, and a second output pin light emitting diode female receptacle of the second preformed curtain, according to the embodiment of the present invention.
Figure 13A:
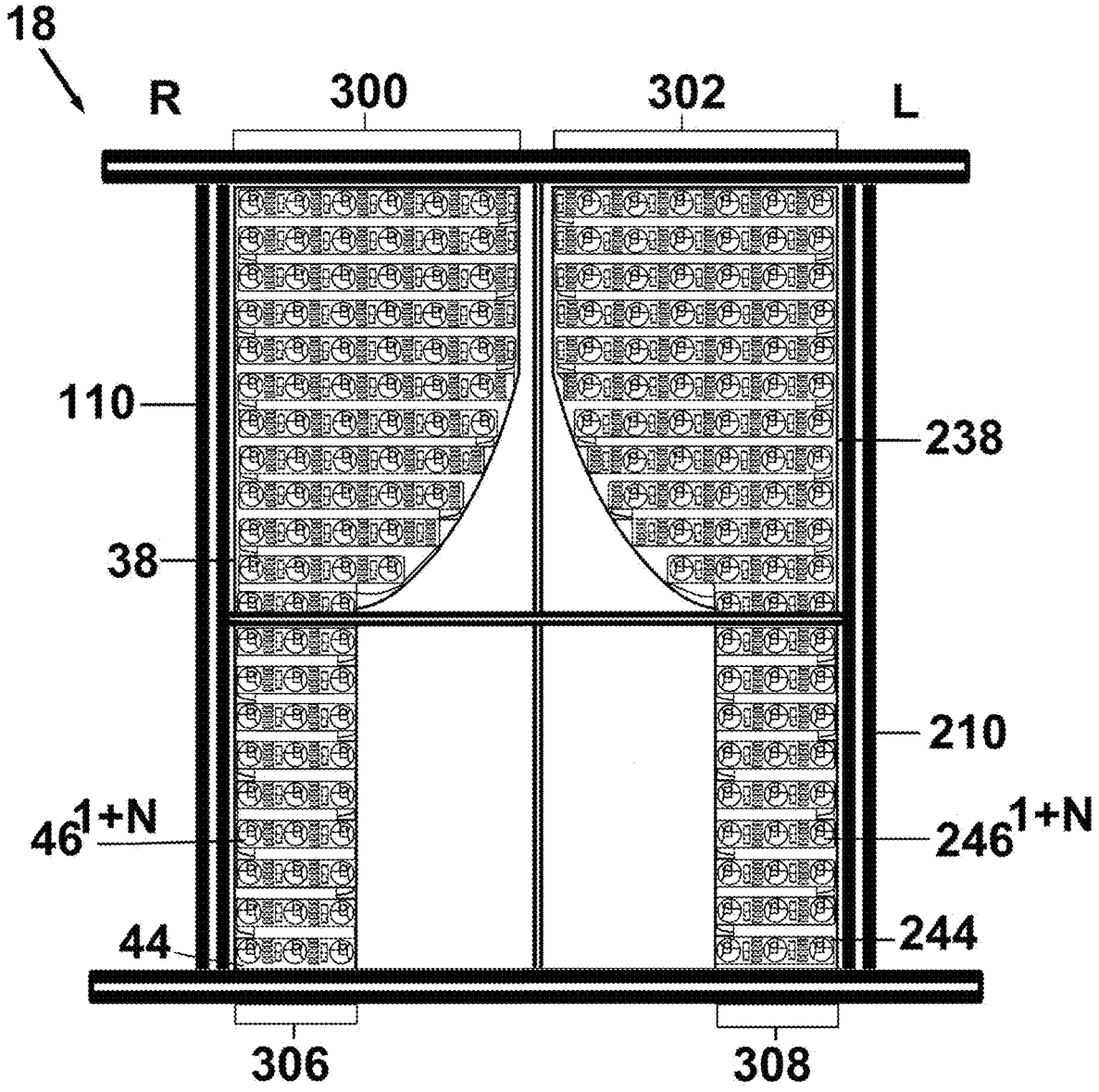
FIG. 13A illustrates a front perspective view of the first curtain lights assembly and the second curtain lights assembly in use as displayed in a common window frame, according to the embodiment of the present invention.
Figure 13B:
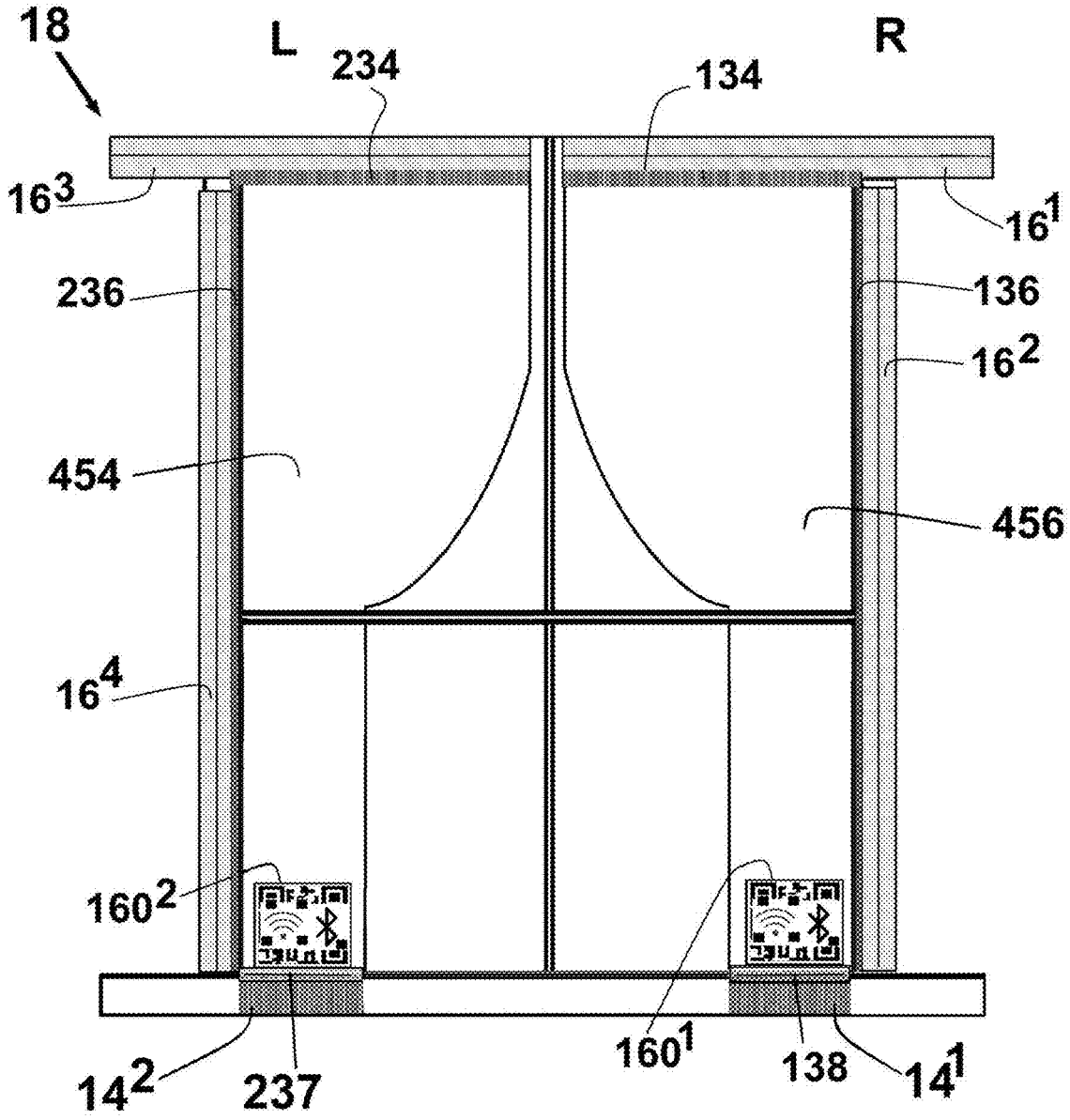
FIG. 13B illustrates a rear perspective view of the first curtain lights assembly and the second curtain lights assembly of FIG. 13A in use as displayed in the common window frame, according to the embodiment of the present invention.

The curtain lights device 20 includes a set of two curtain lights assemblies, the first curtain lights assembly 12 and the second curtain lights assembly 212, as depicted in FIGS. 1-2C and 12A-13B, for displaying in the common window frame 18, as shown in FIGS. 13A-13B. The first curtain lights assembly 12 includes a first preformed curtain 38 and a first alternate current/direct current power supply adapter 26, hereinafter, a first AC/DC power supply adapter 26, as shown in FIGS. 1, 2A-2B, and 12A, and the second curtain lights assembly 212 includes a second preformed curtain 238 and a second AC/DC power supply adapter 28, as shown in FIGS. 1, 2A and 2C.

Figure 3A:
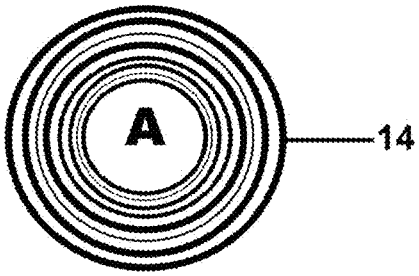
FIG. 3A illustrates a perspective top view of a roll of magnetic polarity-A tape of the curtain lights kit of FIG. 1, according to the embodiment of the present invention.
Figure 3B:
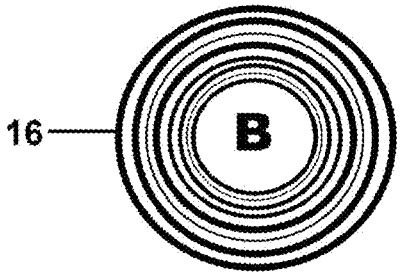
FIG. 3B illustrates a perspective top view of a roll of magnetic polarity-B tape of the curtain lights kit of FIG. 1, according to the embodiment of the present invention.
Figure 3C:
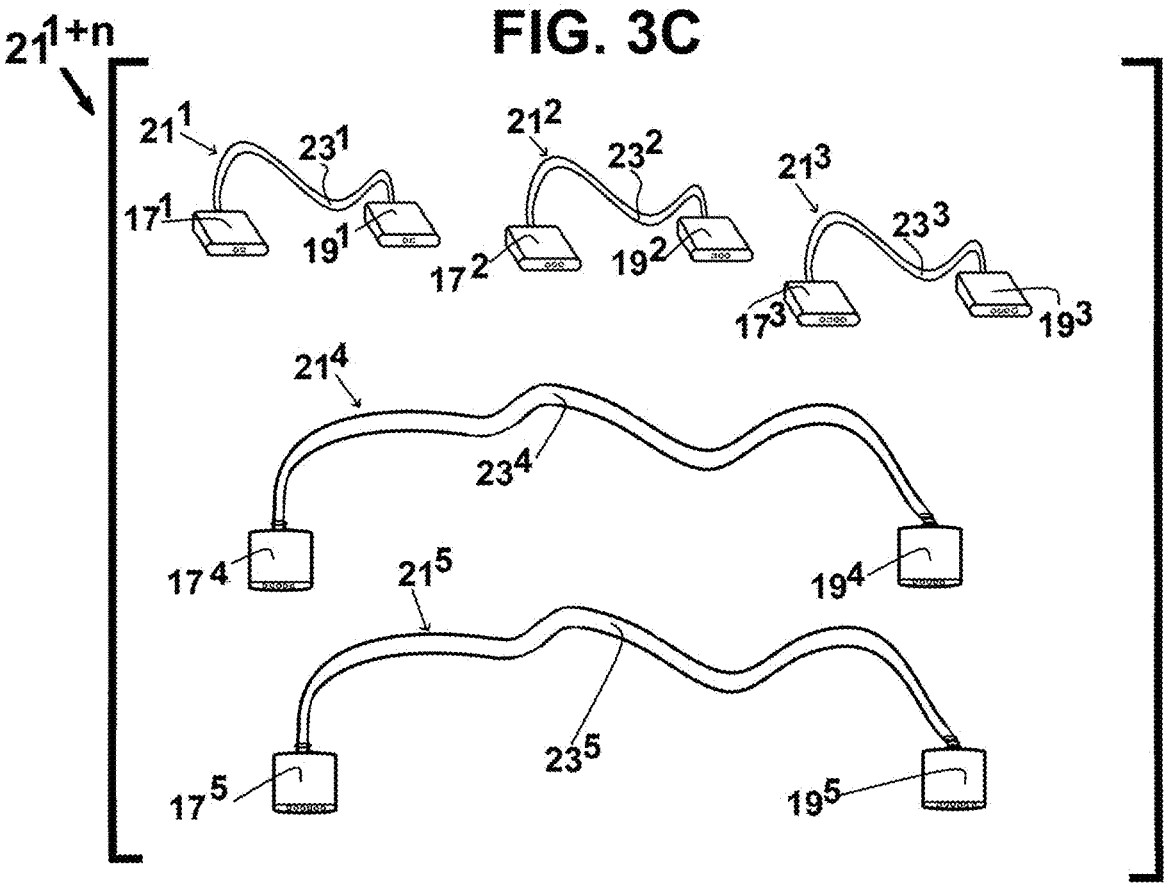
FIG. 3C illustrates a perspective view of one or more pin light emitting diode female to female connector cables of the curtain lights kit of FIG. 1, according to the embodiment of the present invention.
Figure 3D:
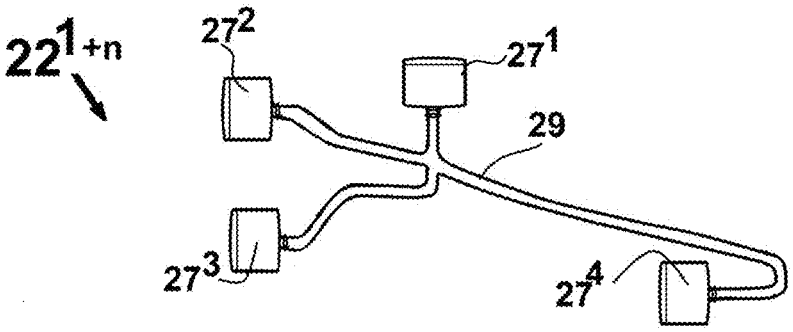
FIG. 3D illustrates a perspective view of a pin light emitting diode female to female butterfly connector cables of the curtain lights kit of FIG. 1, according to the embodiment of the present invention.
Figure 3E:
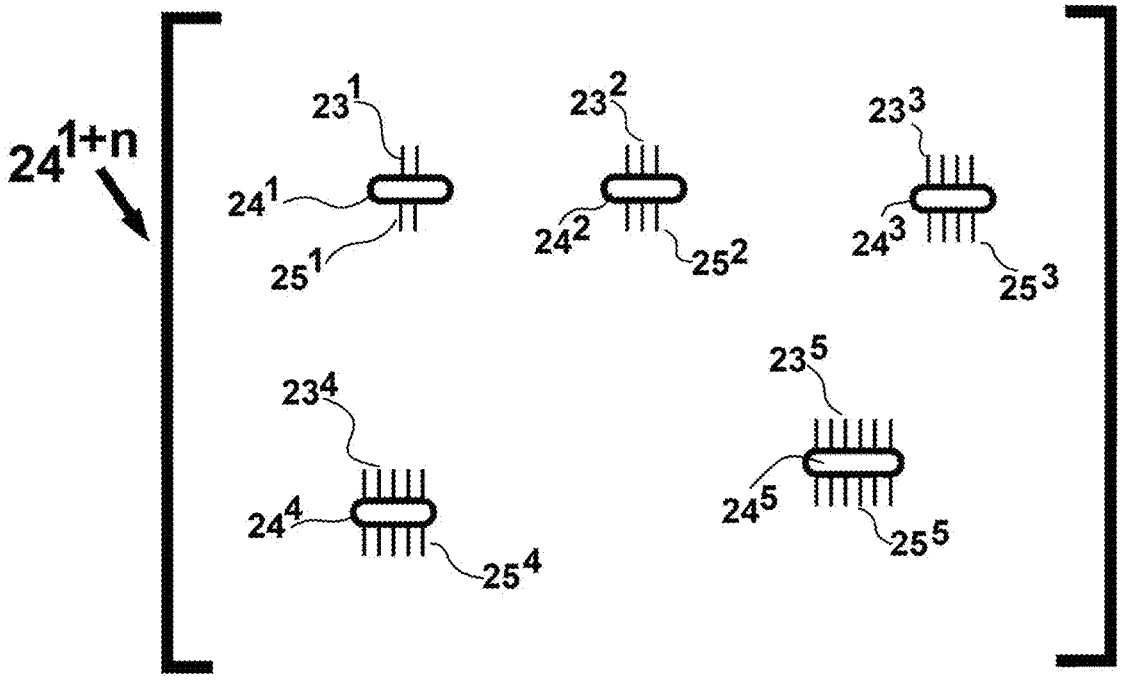
FIG. 3E illustrates a perspective view of one or more mateable pin light emitting diode male connectors, according to the embodiment of the present invention.
Figure 3F:
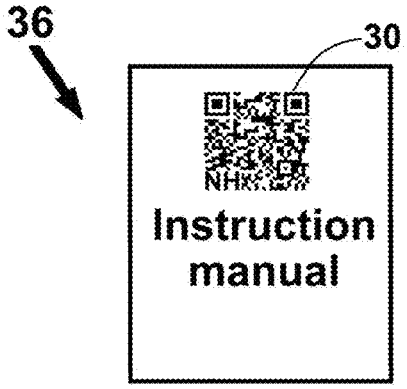
FIG. 3F illustrates a perspective view of a curtain lights kit/curtain lights device instruction manual, according to the embodiment of the present invention.
Figure 4A:
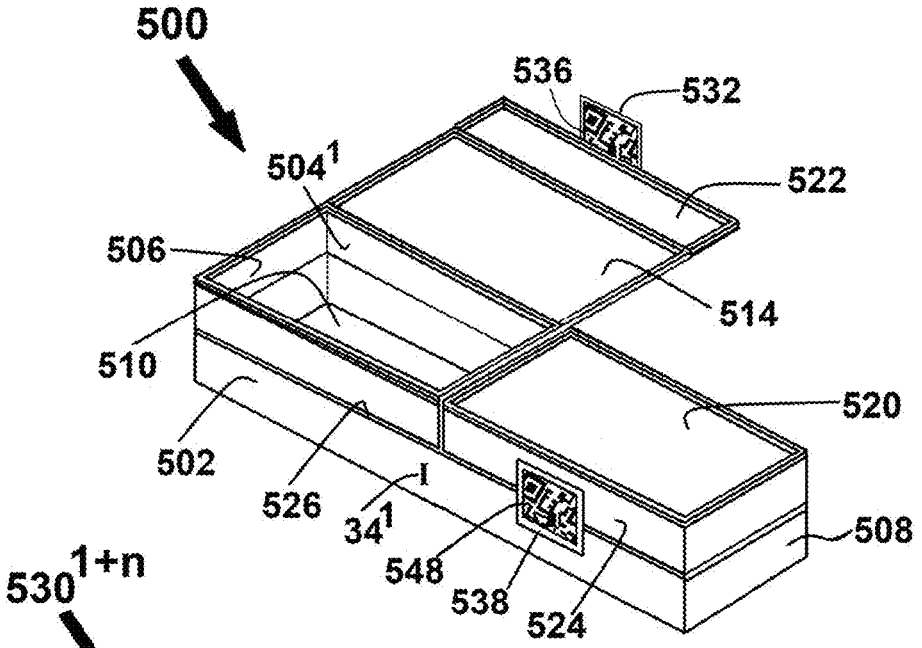
FIG. 4A illustrates a perspective view of a portable curtain lights storage case of the curtain lights kit of FIG. 1, according to the embodiment of the present invention.
Figure 4B:
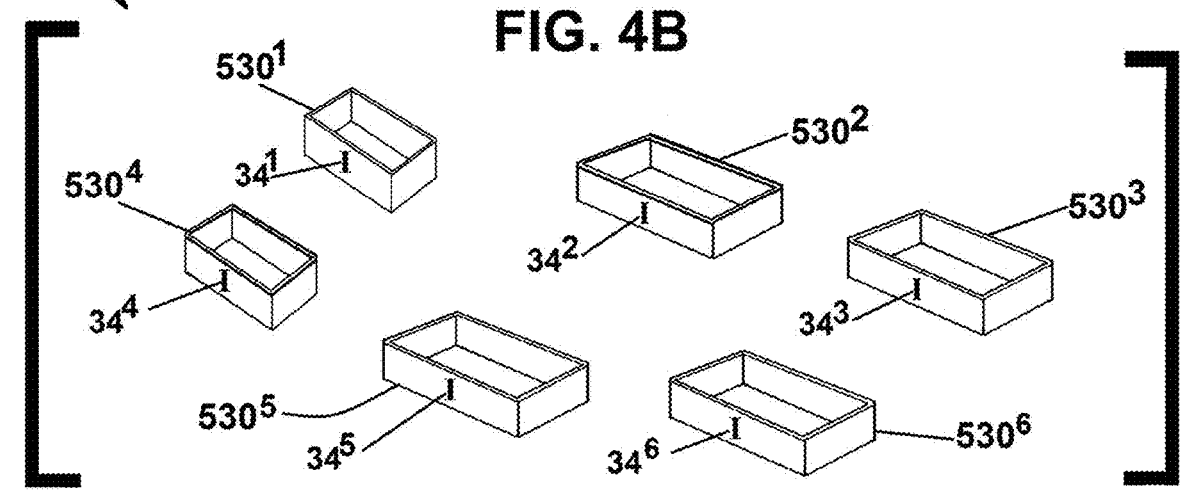
FIG. 4B illustrates a perspective view of a variety of sizes of at least two removable storage containers of the portable curtain lights storage case of FIG. 4A, according to the embodiment of the present invention.
Figure 4C:
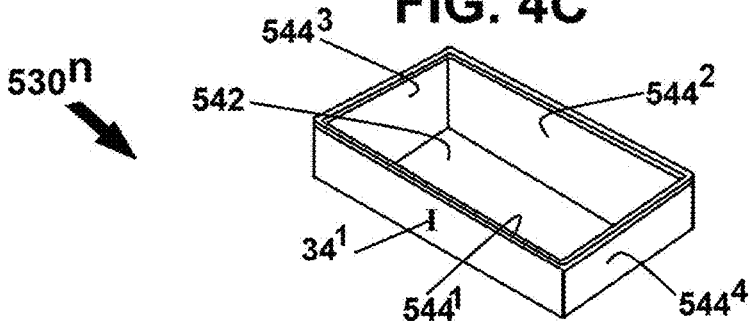
FIG. 4C illustrates a perspective view of a removable storage container of FIG. 4B, according to the embodiment of the present invention.
Figure 4D:
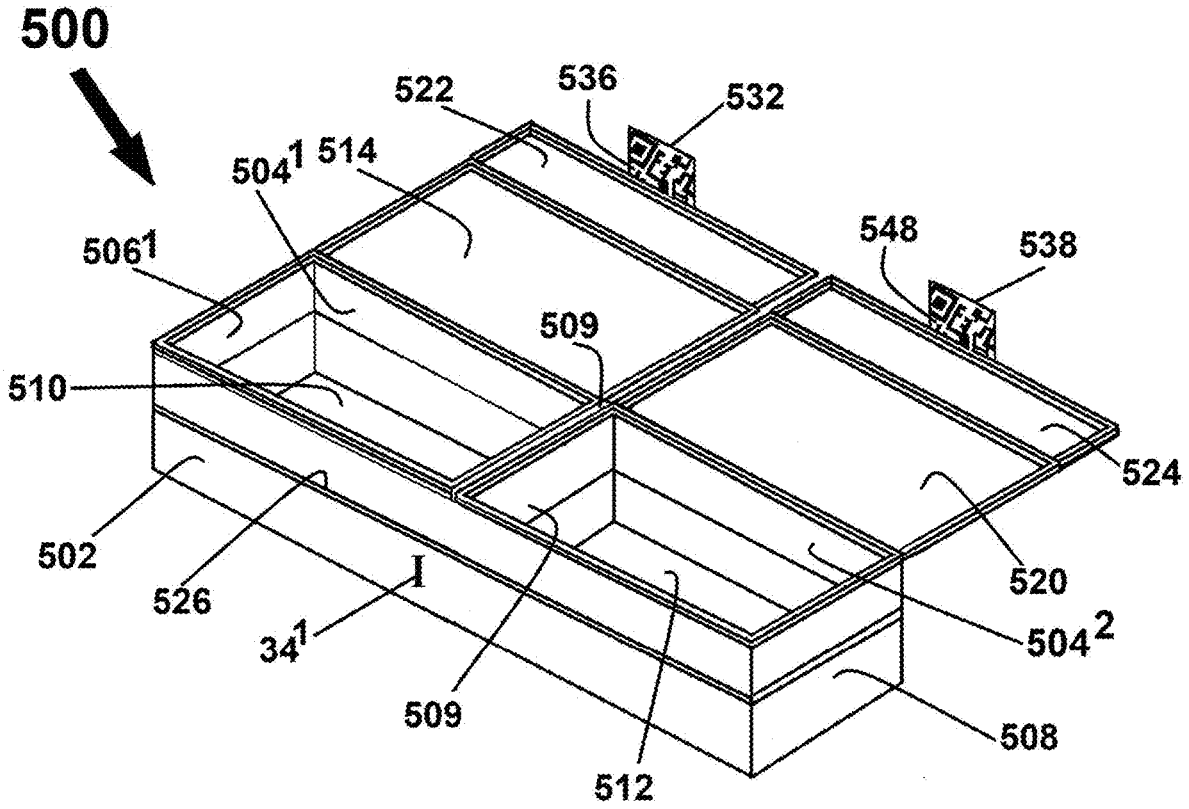
FIG. 4D illustrates an enlarged perspective view of the portable curtain lights storage case of FIG. 4A, according to the embodiment of the present invention.

The roll of magnetic polarity-A tape 14, as shown in FIGS. 1 and 3A, and the roll of magnetic polarity-B tape 16, as shown in FIGS. 1 and 3B, can be formed from any one of metals selected from the group comprising iron, nickel, cobalt. Each of the metals can be magnetized to yield each of the roll of magnetic polarity-A tape 14 and the roll of magnetic polarity-B tape 16. The roll of magnetic polarity-B tape 16 includes a groove down the center of the smooth side to distinguish the roll of magnetic polarity-B tape 16 from the roll of magnetic-A tape 14. The adhesive side of the roll of magnetic polarity-A and the adhesive side of the roll of magnetic polarity-B tape can be made from a solvent-based acrylic adhesive with a high resistance to plasticizers and is suitable for use on polyester, polymer film, polyimide, epoxy, polyurethane resins, silicone, transparent silicone, and transparent rubber, polyimide polymer, silicone, wood, plastic wood and metal. The adhesive can be selected from a polyvinyl acetate (PVA), or a polyvinyl acetate (PVA) with resin, a waterproof polyvinyl acetate, a waterproof polyvinyl acetate with resin, and a polyurethane resin.

The curtain lights kit/curtain lights device instruction manual 36, as shown in FIGS. and 3F, includes written instructions for the user to manual read to implement the curtain lights kit 10 and the curtain lights device 20. In addition, the curtain lights kit/curtain lights device instruction manual 36 includes an instruction manual quick reference code 30, for the user to scan with the user's smart device to connect to a manufacturer's defined settings including a device application including the user facing software application which can be run on a user's smart device (not shown) to enable the smart device to connect and communicate with the user's personal area network or a commercial area network or in combination of both for the use of the curtain lights device 20 in the user's home, office or business, as described in more detail below.

The portable curtain lights storage case 500, as shown in FIGS. 1 and 4A, and each of the variety of sizes of removable storage containers $\mathbf{32}^{1+n}$ includes an icon $\mathbf{34}^{n}$ as shown in FIGS. 1, 4B, selected from one or more icons $\mathbf{34}^{1+n}$ identifying each of the first curtain lights assembly 12, the second curtain lights assembly 212, the roll of magnetic polarity-A tape 14, the roll of magnetic polarity-B tape 16, the one or more pin light emitting diode female to female connector cables $\mathbf{21}^{1+n}$, the one or more pin light emitting diode female to female butterfly connector cables $\mathbf{22}^{1+n}$, the one or more mateable pin light emitting diode male connectors $\mathbf{24}^{1+n}$, the first AC/DC power supply adapter 26, the second AC/DC power supply adapter 28, and the curtain lights kit/curtain lights device instruction manual 36.

The user's smart device can be any one of the smart devices including iPhones, android phones, smartphones, mobile phones, android mobile phones, smart tablets, smart tablets, smart watches, smart glasses, computers, laptops, and iPads, iPhone operating system (OS) devices, and intelligent home and office systems.

Viewing the curtain lights device 20 including the first curtain lights assembly 12 and the second curtain lights assembly 212, from the front view, as depicted in FIGS. 1, 2A-2C, 5A-5B, 13A-13B, the first curtain lights assembly 12 is discussed first and a discussion of the second curtain lights assembly 212 follows, sequentially. While discussing the first curtain lights assembly 12 the adjective "first" will be designated to describe elements of the first curtain lights assembly 12; and, accordingly, the adjective "second" will be designated to describe elements of the second curtain lights assembly 212 to distinguish the like elements of the second curtain lights assembly from the like elements of the first curtain lights assembly 12.

Figure 5A:
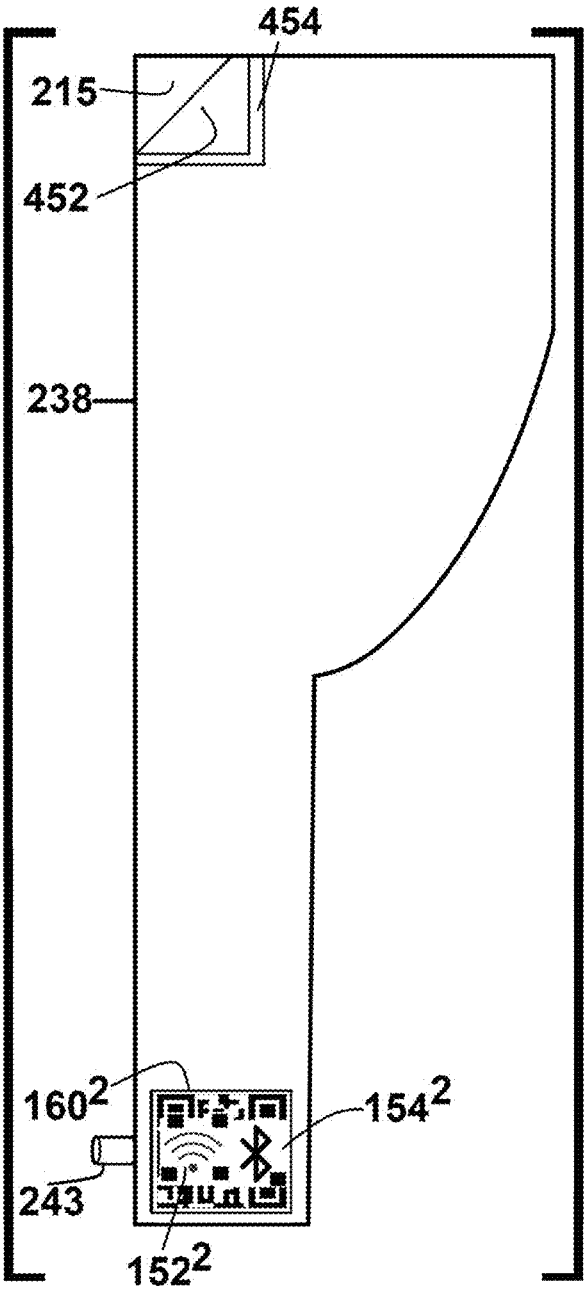
FIG. 5A illustrates a perspective rear view of the second preformed curtain of FIG. 2A, according to the embodiment of the present invention.
Figure 5B:
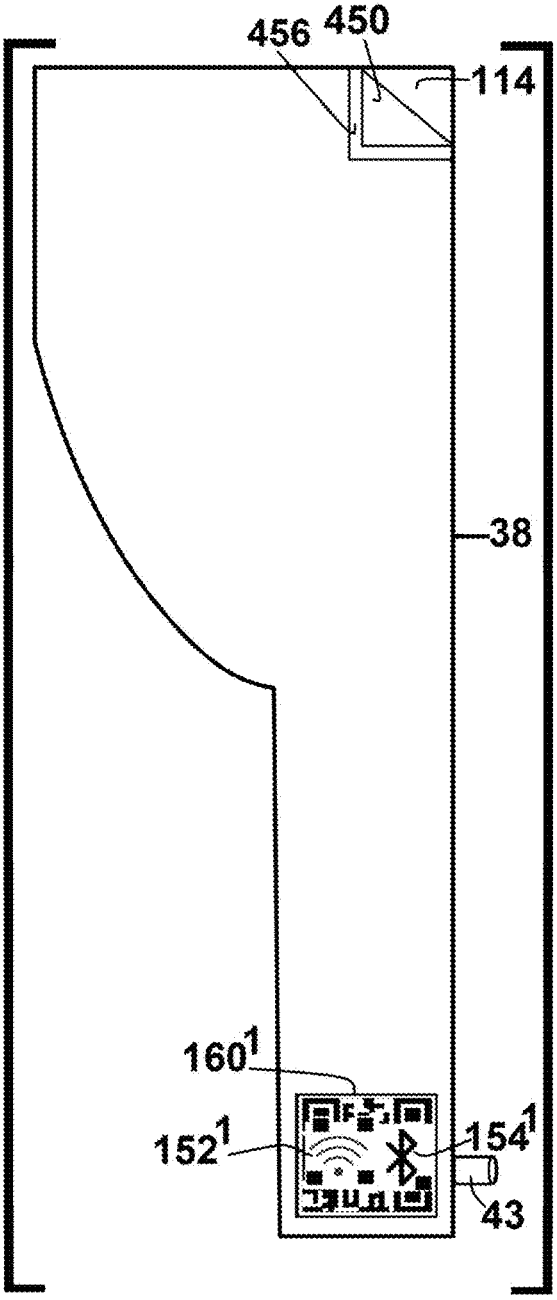
FIG. 5B illustrates a perspective rear view of the first preformed curtain of FIG. 2A, according to the embodiment of the present invention.

FIG. 2A depicts a perspective front view the curtain lights device 20 including the first curtain lights assembly 12 and the second curtain lights assembly 212. FIG. 2B depicts the first curtain lights assembly 12 showing a sectioned top portion and a bottom portion, and an enlarged view of the first curtain lights assembly 12 as shown in FIG. 2A. FIG. 2C illustrates a sectioned perspective front view of the second curtain lights assembly of FIG. 2A, according to the embodiment of the present invention. FIG. 5A illustrates a perspective rear view of the second preformed curtain 238 of the second curtain lights assembly 212, as discussed in more detail below. FIGS. 5A-5B illustrates a perspective rear view of the second preformed curtain 238 of FIG. 2A, according to the embodiment of the present invention. FIG. 5B illustrates a perspective rearview of the first preformed curtain 38 of FIG. 2A, according to the embodiment of the present invention, as discussed in more detail below. FIG. 12A illustrates a perspective front view of the first curtain lights assembly 12 in use with the second preformed curtain 238 of the second curtain lights assembly 212 by way of a pin light emitting diode female to female connector cable $\mathbf{21}^{4}$, according to the embodiment of the present invention. FIG. 13A illustrates a front perspective view of the first curtain lights assembly 12 and the second curtain lights assembly 212 in use as displayed in a common window frame, and FIG. 13B illustrates a rear perspective view of the first curtain lights assembly 12 and the second curtain lights assembly 212 in use as displayed in the common window frame, as discussed in more detail below.

Referring to FIGS. 1-2B, 5A-10B, 12A-15A, the first curtain lights assembly 12 of the curtain lights device 20 comprises a first preformed curtain 38 formed from a first transparent non-conductive substrate 40, a first wireless fidelity/short range wireless controller 42 embedded within the first transparent non-conductive substrate 40 of the first preformed curtain 38; a first preformed bendable wireless fidelity/short range wireless light emitting diode light strip 44 including the first plurality of wireless fidelity/short range wireless light emitting diodes $46^{1+N}$, a first DC power input jack male plug 43, and the first AC/DC power supply adapter 26.

FIGS. 13A and 13B shows the curtain lights device 20 in use, including the first preformed curtain 38 of the first curtain lights assembly 12 being displayed in a common window frame concomitantly with the second preformed curtain 238 of the second curtain lights assembly 212 to illuminate the common window frame 18 and its associated window with an illuminated curtain.

FIGS. 2A-2B and FIG. 12A shows the first preformed curtain 38 of the first curtain lights assembly 12 including the first preformed bendable wireless fidelity/short range wireless light emitting diode light strip 44, the first preformed bendable wireless fidelity/short range wireless light emitting diode light strip 44 comprising a first plurality of wireless fidelity/short range wireless light emitting diodes $46^{1+N}$, and a first plurality of copper pads $90^{1+N}$, and a first plurality of resistors $170^{1+N}$, mounted to a first bendable printed circuit board 162 wherein the first bendable printed circuit board 162 includes a first electrically conductive copper circuitry. The first preformed bendable wireless fidelity/short range wireless light emitting diode light strip 44 comprises a bendable substrate strip comprising the first bendable printed circuit board 162. The first bendable printed circuit board 162 comprises an electrically non-conductive material.

The wireless fidelity/short range wireless light emitting diode light strip 44 and each GHz broadband by way of the wireless fidelity/short range wireless combination controller 42, as discussed in more detail below.

The first bendable printed circuit board 162 can be formed from a non-conductive plastic, a non-conductive polyimide, a polyimide polymer. Polyimides provide excellent durability and heat resistance despite its flexibility. Thus, the polyimide material is critical in providing both flexibility and structural integrity for the first preformed bendable wireless fidelity/short range wireless light emitting diode light strip 44. The first transparent non-conductive substrate can be a clear silicone material.

The preformed bendable wireless fidelity/short range wireless light emitting diode light strip substrate is the circuit-board on top of the exterior surface of which each of the first plurality of wireless fidelity/short range wireless light emitting diodes $46^{1+N}$ are mounted. In addition to providing the physical, structural base of the first preformed bendable wireless fidelity/short range wireless light emitting diode light strip 44, the preformed bendable wireless fidelity/short range wireless light emitting diode light strip substrate, also, provides electricity supply through its electrically conductive copper circuitry, as well as a vital path for heat dissipation.

With reference to the first preformed bendable wireless fidelity/short range wireless light emitting diode light strip 44 the term "bendable" means, in the context of the present invention, that the first preformed bendable wireless fidelity/short range wireless light emitting diode light strip 44 can be bent and folded upon itself easily with minimal force and can conform to the surface shape within the first interior spatial area of the first preformed curtain 38 in which it is embedded and allow for support of each of the first plurality of wireless fidelity/short range wireless light emitting diodes $46^{1+n}$ of the first wireless fidelity/short range wireless light emitting diode light strip 44.

As shown in FIGS. 2A-2B and 12A, the first preformed curtain 38 of the first curtain lights assembly 12 of the curtain lights device, includes the first preformed bendable wireless fidelity/short range wireless light emitting diode light strip 44 comprising the first plurality of wireless fidelity/short range wireless light emitting diodes $46^{1+N}$, the first plurality of resistors $170^{1+N}$, and the first plurality of copper pads $90^{1+N}$ connected to a first electrically conductive copper circuitry of the first bendable printed circuit board 162. A first electrically conductive circuitry can, also, be provided with an aluminum electric circuitry material which is, also, a good electrically conductive material. In the embodiment of the present invention, the first electrical circuit is provided by a copper base pad which is affixed to the first bendable printed circuit board 162 of the first preformed bendable wireless fidelity/short range wireless light emitting diode light strip 44 by soldering means or by applying a bendable adhesive. The first preformed bendable wireless fidelity/short range wireless emitting diode light strip 44 and its first bendable printed circuit board 162 is protected by the first front wall 112 of the first non-conductive substrate of the first preformed curtain 38 and a first rear wall 114 of the first non-conductive substrate of the first preformed curtain 38, and a first opaque non-conductive sheet 450 of the first preformed curtain 38, as shown in FIG. 5A. In this manner the first electrically conductive copper circuitry and each of the first plurality of copper pads $90^{1+N}$ are protected from the environment, moisture, damage, and is waterproofed. The first opaque non-conductive sheet 450 can be selected from any color of opaque non-conductive substrates.

The first preformed bendable wireless fidelity/short range wireless light emitting diode light strip 44 includes a first plurality of wireless fidelity/short range wireless light emitting diodes $46^{1+N}$, wherein the first plurality of wireless fidelity/short range wireless light emitting diodes $46^{1+N}$ are each operationally electrically connected to the electric current provided by a copper base pad and to each of its first plurality of copper pads $90^{1+N}$, and operationally electrically connected to each of the first plurality of resistors $170^{1+N}$, the first plurality of resistors $170^{1+N}$ being operationally electrically connected to the copper base pad. A first primary end 48 of the first preformed bendable wireless fidelity/short range wireless light emitting diode light strip 44 includes a first wire lead 86.

Figure 8:
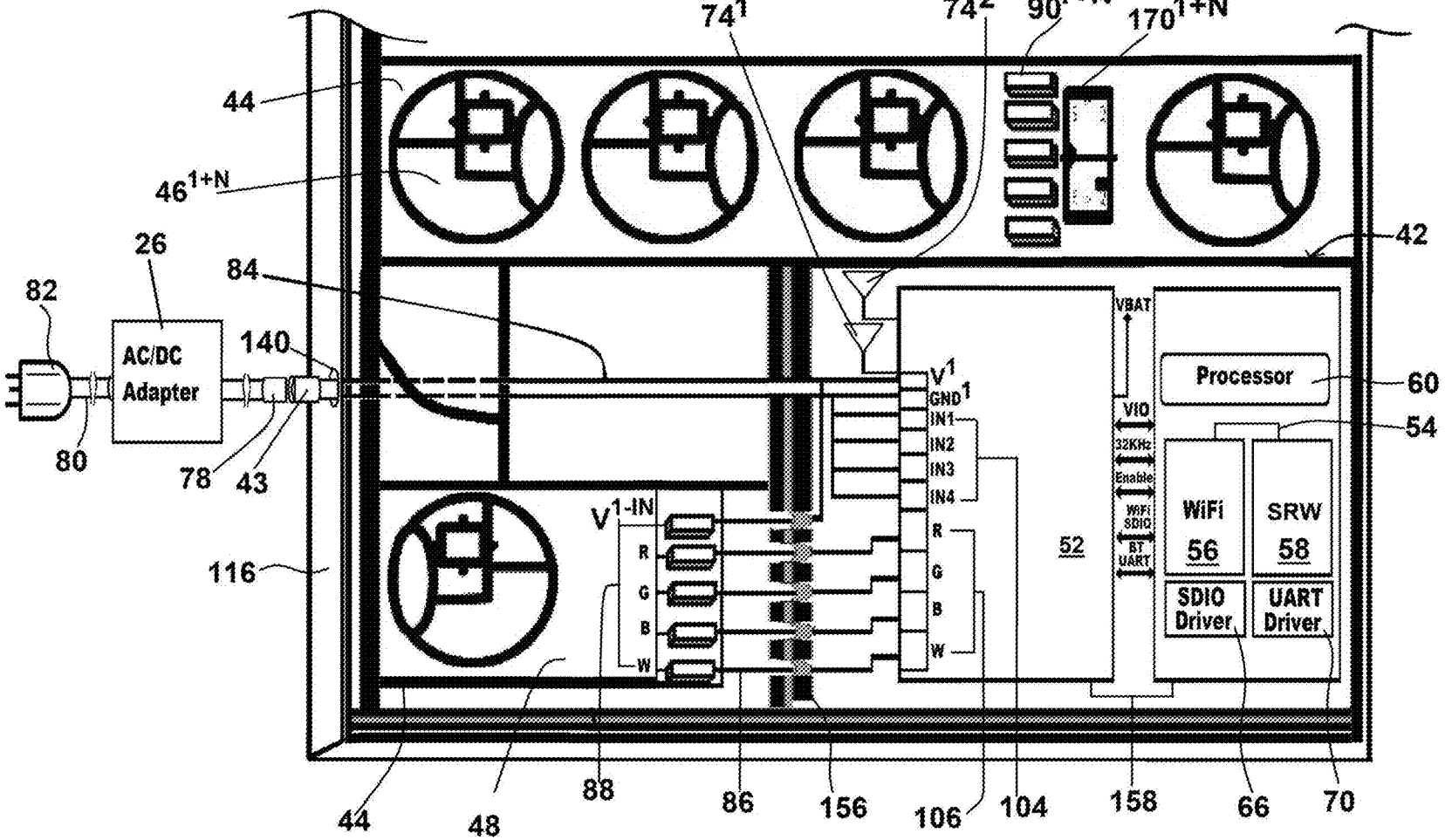
FIG. 8 illustrates a perspective front view of the first wireless fidelity/short range wireless controller of FIG. 6 showing a first wireless fidelity/short range wireless combination chip of the first curtain lights assembly, according to the embodiment of present invention.

The first wire lead 86 is accessed by way of a first output controller pin light emitting diode female receptacle 156, as shown in FIGS. 2B and 8. The first output controller pin light emitting diode female receptacle 156 includes at least two controller portals. In the exemplary embodiment the first output controller pin light emitting diode female receptacle 156 includes five controller portals. A first terminal end 50 of the first wire lead 86 includes a first back end 92 of the first wire lead 86, discussed in more detail, below. The first back end 92 of the first wire lead 86 is accessed by way of a first output pin light emitting diode female receptacle 144, as shown in FIGS. 2A and 2C. The first output pin light emitting diode female receptacle 144 includes at least two portals. In the exemplary embodiment the first output pin light emitting diode female receptacle 144 includes five portals.

The first wireless fidelity/short range wireless light emitting diode light strip 44 includes a first copper base pad which provides a substrate for the first electrically conductive copper circuitry including two copper circuit pathways (not shown) that run horizontally from the first primary end 48 to the first terminal end 50 of the first preformed bendable wireless fidelity/short range wireless light emitting diode light strip 44 configured with one positive track and on negative track. When the first curtain lights assembly 12 is connected to a power source, by way of the first AC/DC power supply adapter 26, each copper pad $\mathbf{90}^{N}$ of the first plurality of copper pads $\mathbf{90}^{1+N}$ acts as a conductor allowing electrons to flow from the first wireless fidelity/short range wireless controller 42 to the primary end 48 of the first preformed bendable wireless fidelity/short range wireless light emitting diode light strip 44 and continuously to the first terminal end 50 of the first preformed bendable wireless fidelity/short range wireless light emitting diode light strip 44 such that each of the first plurality of wireless fidelity/short range wireless light emitting diodes $\mathbf{46}^{1+N}$ receive electric current which flow from the positive conductor to the negative conductor such that each of the first plurality of wireless fidelity/short range wireless light emitting diodes $\mathbf{46}^{1+N}$ of the first preformed bendable wireless fidelity/short range wireless light emitting diode light strip 44 are illuminated.

The first primary end 48 of the first preformed bendable wireless fidelity/short range wireless light emitting diode light strip 44 includes the first wire lead 86. The first wire lead 86 leads to a first series of one or more light emitting diode input color wire leads 88 including a variety of color wires and electrically conductive copper contacts which are operationally electrically connected to the first bendable printed circuit board 162 of the first preformed bendable wireless fidelity/short range wireless light emitting diode light strip 44. The first wire lead 86 is operationally seamlessly connected to the first series of one or more light emitting diode input color wire leads 88 including a variety of color wires, including red, green, blue, white, as indicated by the letters R G B W, as shown in FIG. 8. In addition, a first main direct current input voltage wire $V^{1-IN}$, and electrically conductive copper contacts are operationally connected to the first bendable circuit board 162 of the first wireless fidelity/short range wireless light emitting diode light strip 44 by way of soldering or bendable adhesive, otherwise adhering the electrically-conductive first wire lead 86, the first series of one or more light emitting diode input color wire leads 88 and electrically conductive copper contacts to the first electrically conductive copper circuitry of the first bendable printed circuit board 162 of the first preformed bendable wireless fidelity/short range wireless light emitting diode light strip 44.

A copper base pad can be lined with a solder mask of a layer of polymer film that protects the first electrically conductive copper circuitry from unwanted connections. Flattened oval shaped areas of the copper base pad are exposed as the first plurality of copper pads $\mathbf{90}^{1+N}$. As the first electrically conductive copper circuitry current flows through each of the first plurality of wireless fidelity/short range wireless light emitting diodes $\mathbf{46}^{1+N}$ of the first preformed bendable wireless fidelity/short range wireless light emitting diode light strip 44, semiconductors within each of the first plurality of wireless fidelity/short range wireless light emitting diodes $\mathbf{46}^{1+N}$ convert the energy into photons or light. Each resistor $\mathbf{170}^{N}$ of the first plurality of resistors $\mathbf{170}^{1+N}$ serves to limit the flow of electricity along the first preformed bendable wireless fidelity/short range wireless light emitting diode light strip 44 ensuring that each of the plurality of the wireless fidelity/short range wireless light emitting diodes $\mathbf{46}^{1+N}$ receives only the optimal amount of current for illumination and longevity of illumination. Once the first AC/DC power supply adapter 26 is plugged into a power source each of the first plurality of wireless fidelity/short range wireless light emitting diodes $\mathbf{46}^{1+N}$ of the first preformed bendable wireless fidelity/short range wireless light emitting diode light strip 44 is illuminated in its designated color including red, green, blue or white.

The first plurality of wireless fidelity/short range wireless light emitting diodes $\mathbf{46}^{1+N}$ of the first preformed bendable wireless fidelity/short range wireless light emitting diode light strip 44, and a second plurality of wireless fidelity/short range wireless light emitting diodes $\mathbf{246}^{1+N}$ of a second preformed bendable wireless fidelity/short range wireless light emitting diode light strip 244 are available in a variety of colors, including without limitation, as a single source or a multi-color light source including white, neutral white, cool white, warm white, multi-color red, blue, green, yellow, lavender. Several color combinations are possible with editing and animation applications operationally connected to the user's smart device.

Each of the first plurality of wireless fidelity/short range wireless light emitting diodes $\mathbf{46}^{1+N}$ can include high brightness plastic leaded chip carrier—2 surface mounted diode, or high brightness plastic leaded chip carrier—6 surface mounted diodes. Such diodes have 120 degrees light viewing angle for even illumination. The plastic leaded chip carrier—2 surface mounted diode, or high brightness. Plastic leaded chip carrier—6 surface mounted diodes are commercially available in a variety of colors including without limitation, white, neutral white, cool white, warm white, red, yellow, blue and green. The first preformed bendable wireless fidelity/short range wireless light emitting diode light strips 44 can be configured to comprise single-color or polychromatic light emitting diode configurations.

The first preformed bendable wireless fidelity/short range wireless light emitting diode light strip 44 is embedded within the first transparent non-conductive substrate 40 of the first preformed curtain 38 congruent with the first wireless fidelity/short range wireless controller 42 whereby the first preformed bendable wireless fidelity/short range wireless light emitting diode light strip 44 can be readily operationally electrically connected to the first wireless fidelity/short range wireless controller 42.

Figure 6:
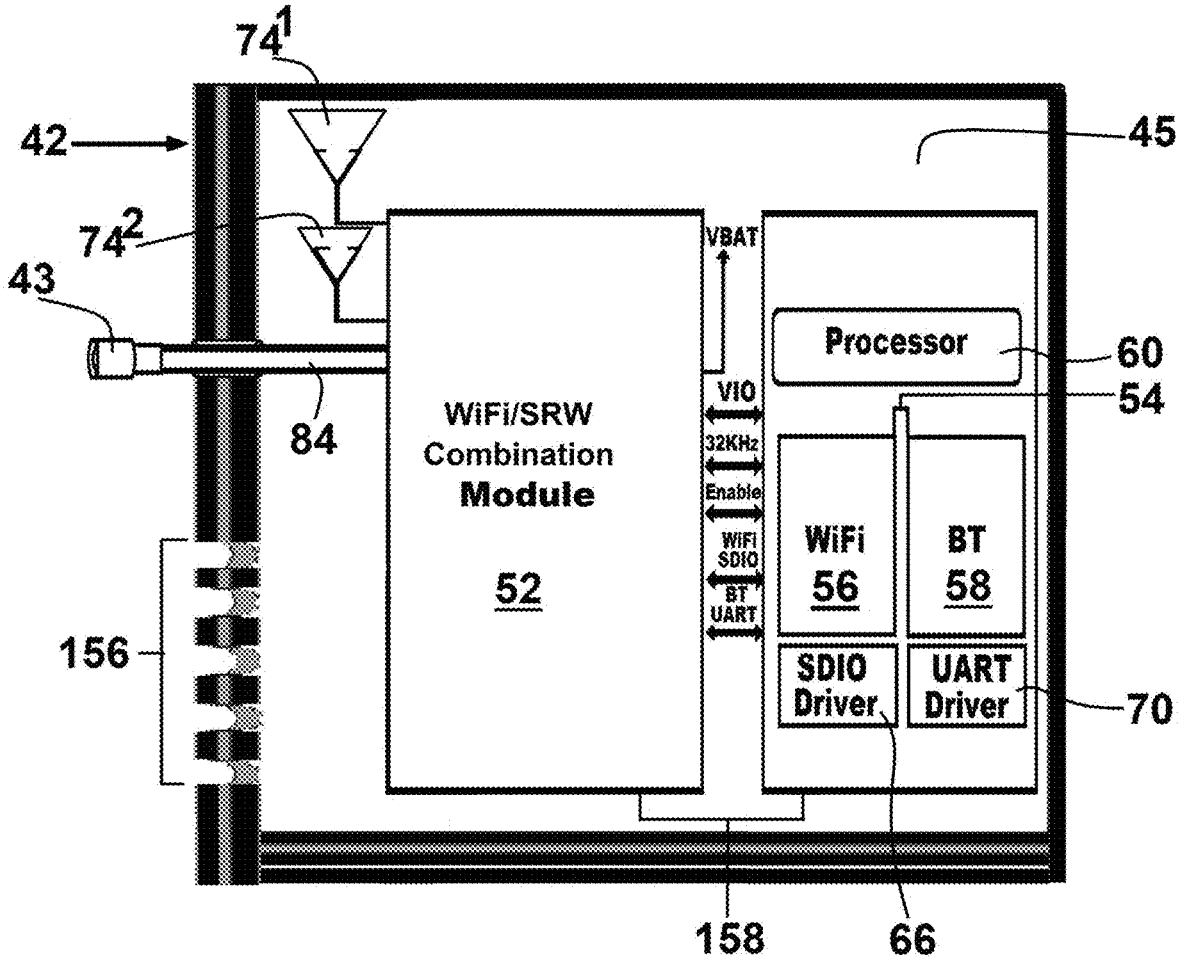
FIG. 6 illustrates a perspective front view of a first wireless fidelity/short range wireless controller of the first curtain lights assembly, according to the embodiment of the present invention.
Figure 10A:
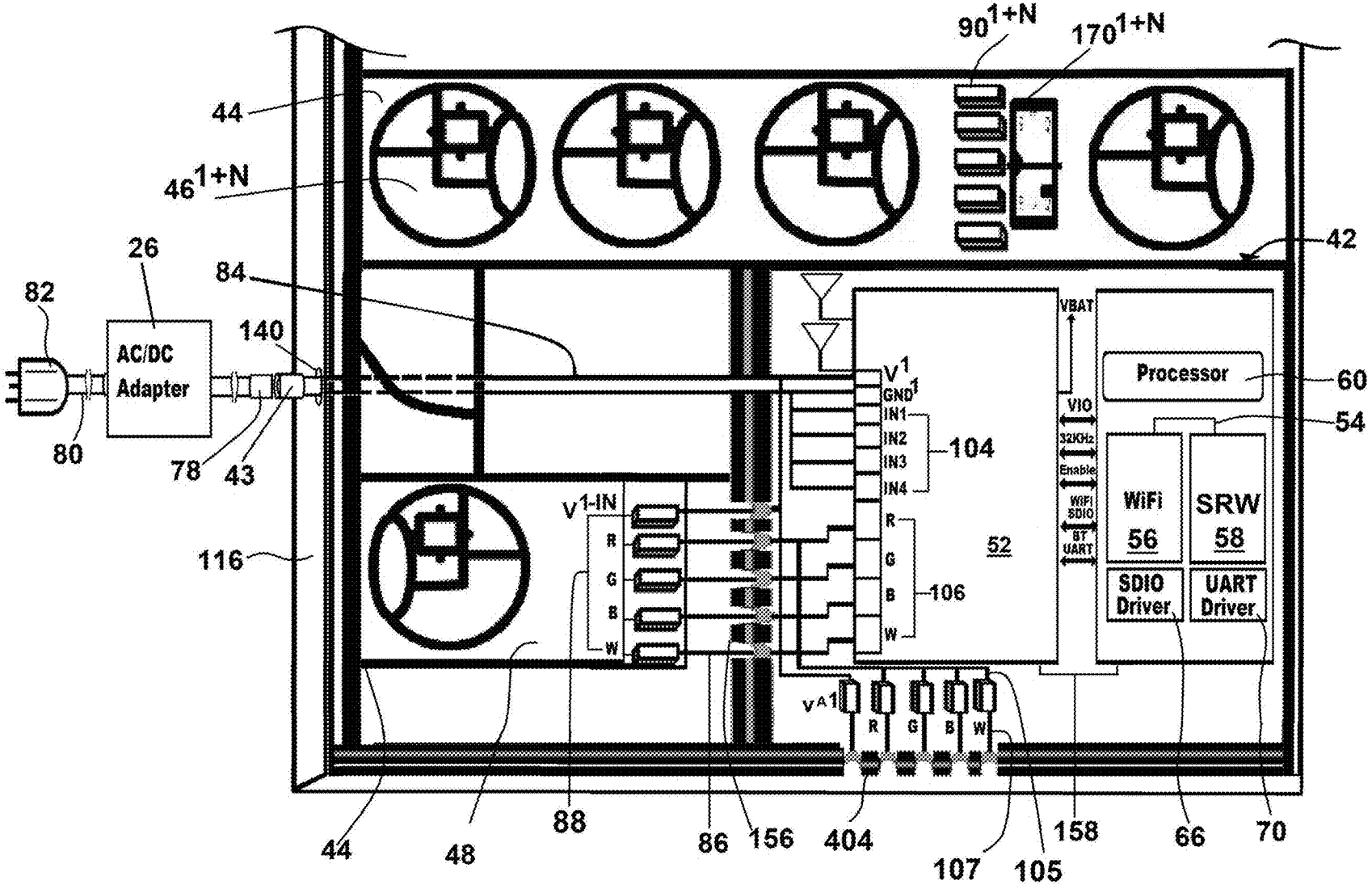
FIG. 10A illustrates a perspective front view of a first wireless fidelity/short range wireless controller, a first AC/DC power supply adapter positioned external to the first preformed curtain, a first output controller pin light emitting diode female receptacle, and a first auxiliary output controller pin light emitting diode female receptacle, according to the embodiment of the present invention.

FIG. 6, with reference to FIGS. 1, 2B, 8 and 10A, illustrates a front perspective view of the first wireless fidelity/short range wireless controller 42 of the first preformed curtain 38 of the first curtain lights assembly 12. FIGS. 2A and 2B illustrates a perspective front view of the first curtain lights assembly showing the first wireless fidelity/short range wireless controller 42 of the first preformed curtain 38 embedded in the interior spatial area of the first transparent non-conductive substrate 40 of the first preformed curtain 38 proximate to the first wire lead 86 of the first preformed bendable wireless fidelity/short range wireless light emitting diode light strip 44. FIGS. 8 and 10A show the interior working elements of the first wireless fidelity/short range wireless controller 42. FIG. 8 is perspective front view of the first wireless fidelity/short range wireless controller 42 including a first wireless fidelity/short range wireless combination chip 158 of the first curtain lights assembly 12, discussed in more detail below. FIG. 10A illustrates a perspective front view of the first wireless fidelity/short range wireless controller 42, the first AC/DC power supply adapter 26 positioned external to the first preformed curtain 38, a first output controller pin light emitting diode female receptacle 166, and a first auxiliary output controller pin light emitting diode female receptacle 404, discussed in more detail below.

Figure 10B:
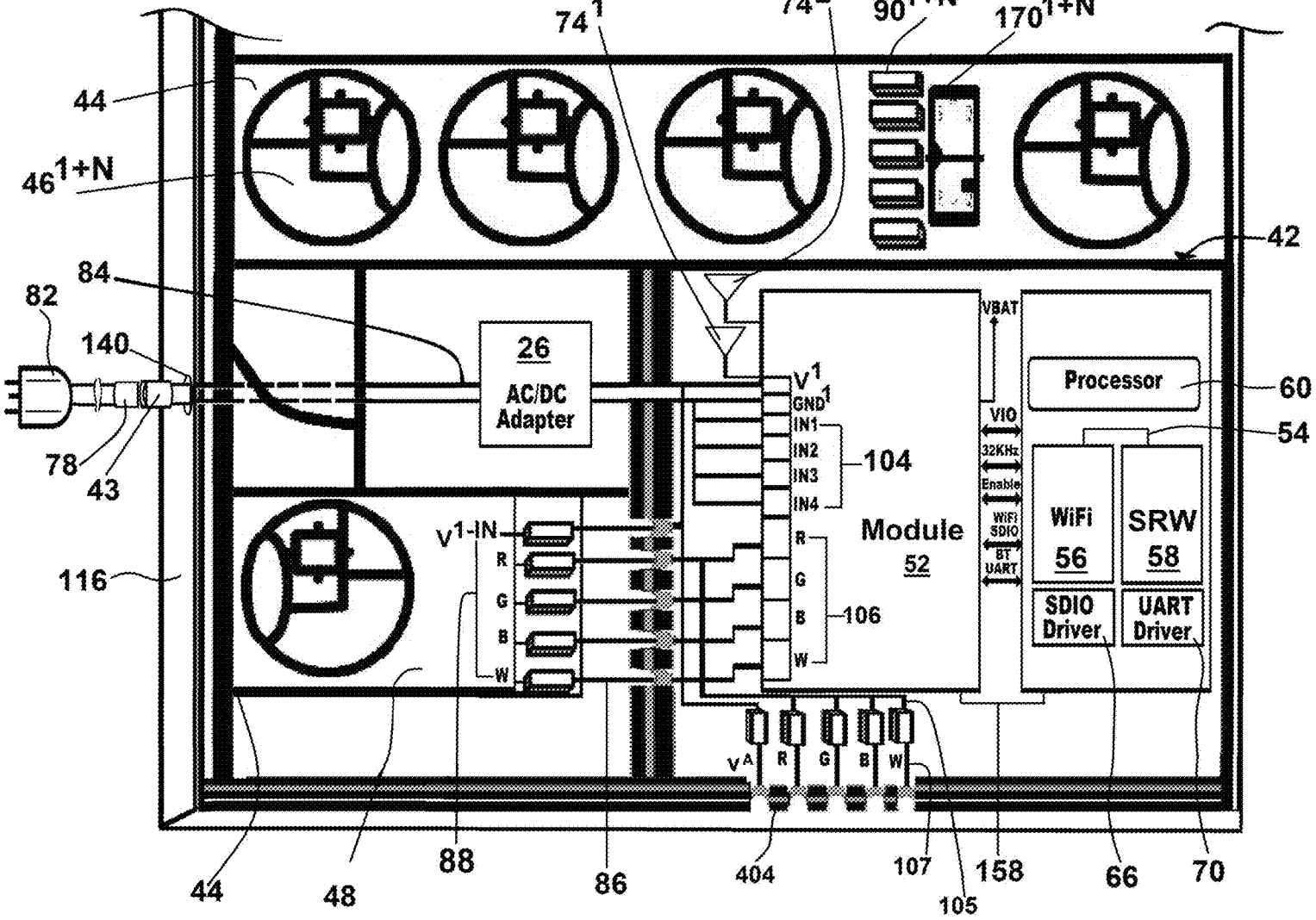
FIG. 10B illustrates a perspective front view of the wireless fidelity/short range wireless controller of FIG. 10A showing the AC/DC power supply adapter positioned internally within the first preformed curtain, according to the embodiment of the present invention.

The first wireless fidelity/short range wireless controller 42 can support an open source operating system software, and android phone operating system, and iPhone operating system (iOS), and Zigbee technology. The first wireless fidelity/short range wireless controller 42, in addition, supports features including integrates radio frequency (RF), Wireless fidelity, WLAN baseband processor, radio frequency transceiver support, 2.4 GHz for high throughput and extended range and 5 GHz diversity capable, 4-bit secure digital input output driver (SDIO) host interface support, and wireless fidelity (wireless fidelity is commercially referred to as WiFi®) direct concurrent operation, short range wireless and short range wireless low energy (short range wireless is commercially referred to as Bluetooth®), short range wireless 5.1 secure connection compliant, host controller interface (HCI) transport for short range wireless over universal asynchronous receiver transmitter (UART), power amplifiers (PAs), a clock, power management, an operating temperature of −40° C. to +/−85° C. The first wireless fidelity/short range wireless controller 42 provides high throughput and extended range along with wireless fidelity and short range wireless coexistence which is provided by the first wireless fidelity/short range wireless controller 42. The first wireless fidelity/short range wireless combination chip 158 provides a wireless fidelity dual band 2.4 GHz. In addition, the first wireless fidelity/short range wireless controller 42 includes a first pair of combination wireless fidelity/short range wireless antennae, a first combination wireless fidelity/short range wireless antenna $\mathbf{74}^1$ and a second combination wireless fidelity/short range wireless single antenna $\mathbf{74}^2$, as shown in FIGS. 8 and 10B, which provides stronger wireless connections and mitigating potential interference between the coexistence of the wireless fidelity and short range wireless networks. Thereby, by way of the first wireless fidelity/short range wireless module chip of the first wireless fidelity/short range wireless combination chip and the dual presence of the first combination wireless fidelity/short range wireless antenna $\mathbf{74}^1$ and the second combination wireless fidelity/short range wireless single antenna $\mathbf{74}^2$, the wireless fidelity/short range module chip operates on a 2.4 GHz Zigbee band network in coexistence with the wireless fidelity network and the short range wireless network coexistence whereby the dual presence of the first combination wireless fidelity/short range wireless antenna $\mathbf{74}^1$ and the second combination wireless fidelity/short range wireless single antenna $\mathbf{74}^2$ mitigates interference among the 2.4 GHz Zigbee band network, the wireless fidelity network, and the short range wireless network all being on the 2.4 GHz bandwidth.

In this exemplary embodiment, each of the first plurality of wireless fidelity/short range wireless light emitting diodes $\mathbf{46}^{1+N}$ of the first preformed bendable wireless fidelity/short range wireless light emitting diode light strip 44 can include a surface mounted diode type wireless fidelity/short range wireless light emitting diode. The first plurality of wireless fidelity/short range wireless light emitting diodes $\mathbf{46}^{1+N}$ of the first preformed bendable wireless fidelity/short range wireless light emitting diode light strip 44 can be mounted on the first bendable printed circuit board 162 which includes the copper base pad that provides the first electrically conductive copper circuitry and the bulk of the heat dissipation. The first bendable printed circuit board 162 includes the copper base pad which are exposed as the first series of copper pads $\mathbf{90}^{1+N}$, as shown in FIGS. 2B and 8, on the first preformed bendable wireless fidelity/short range wireless light emitting diode light strip 44. The first plurality of copper pads $\mathbf{90}^{1+N}$ provide electrical connection points which are configured within a first electrically conductive copper circuitry of the first bendable printed circuit board 162 of the first preformed bendable wireless fidelity/short range wireless light emitting diode light strip 44 of the first preformed curtain 38. The first bendable printed circuit board 162 of the first preformed bendable wireless fidelity/short range wireless light emitting diode light strip 44, also, includes the first plurality of resistors $\mathbf{170}^{1+N}$. The first plurality of resistors $\mathbf{170}^{1+N}$ control the current flowing through each of the first plurality of wireless fidelity/short range wireless light emitting diodes $\mathbf{46}^{1+N}$ of the first preformed bendable wireless fidelity/short range wireless light emitting diode light strip 44.

The first preformed bendable wireless fidelity/short range wireless light emitting diode light strip 44 can include surface mounted diode type light emitting diodes which are created by soldering surface mounted device light emitting diodes onto the first bendable printed circuit board 162 which generate lighting or illumination when connected to a power source. The first bendable printed circuit board 162 is bendable. As discussed above, the main components of the first preformed bendable wireless fidelity/short range wireless light emitting diode light strip 44 include the first plurality of wireless fidelity/short range wireless light emitting diodes $\mathbf{46}^{1+N}$, a first bendable printed circuit board 162, the first plurality of copper pads $\mathbf{90}^{1+N}$, and first plurality of resistors $\mathbf{170}^{1+N}$. The first plurality of wireless fidelity/short range wireless light emitting diodes $\mathbf{46}^{1+N}$ are operationally electrically connected to the first electrically conductive copper circuitry. The first plurality of resistors $\mathbf{170}^{1+N}$ control the current flowing through each of the first plurality of wireless fidelity/short range wireless light emitting diodes $\mathbf{46}^{1+N}$ of the first preformed bendable wireless fidelity/short range wireless light emitting diode light strip 44.

In another exemplary embodiment, each of the first plurality of wireless fidelity/short range wireless light emitting diodes $\mathbf{46}^{1+N}$ of the first preformed bendable wireless fidelity/short range wireless light emitting diode light strip 44 can include a chip on board type of wireless fidelity/short range wireless light emitting diode.

As well known in the art, the chip on board includes a light emitting dye is configured directly on the first bendable printed circuit board 162 of a bendable or bendable light emitting diode strip of light. The chip on board light strip may, also, be called a flip-chip. A chip on board light emitting diode light strip constant current driver is a method of driving each of the plurality of light emitting diode chips. The chip on board operates at a single current and adjust their output voltage correspondingly, ensuring that the forward current remains stable. Therefore, when constant current input is used, a current limiting resistor is not necessary.

The first preformed curtain 38 being formed from the first transparent non-conductive substrate 40 provides structural support as well as heat dissipation for the first plurality of wireless fidelity/short range wireless light emitting diodes $\mathbf{46}^{1+N}$ for the first preformed bendable wireless fidelity/short range wireless light emitting diode light strip 44 and the first wireless fidelity/short range wireless controller 42.

The first transparent non-conductive substrate 40 of the first preformed curtain 38 can be manufactured using a transparent silicone, silicone, a transparent silicone which is water resistant, heat resistant and bendable, a clear, highly heat resistant bendable polyimide material, a waterproof transparent non-conductive colloid which can be a waterproof transparent polyurethane resin, polyester, polymer film, polyimide, polyimide polymer, transparent rubber, a non-conductive plastic, a non-conductive polyimide which is water resistant, heat resistant and bendable.

In addition, the first transparent non-conductive substrate 40 of the first preformed curtain 38 causes the first wireless fidelity/short range wireless light emitting diode light strip 44, the first plurality of wireless fidelity/short range wireless light emitting diodes $\mathbf{46}^{1+N}$, the first wireless fidelity/short range wireless controller 42, to be waterproofed in their entirety where each are embedded within the first interior spatial area of the first non-conductive substrate 40 of the first preformed curtain 38. The transparent non-conductive substrate 40 provides waterproof cover for the first preformed bendable wireless fidelity/short range wireless fidelity light emitting diode light strip 44 and each of the first wireless fidelity/short range wireless emitting diodes $\mathbf{46}^{1+N}$, and the first wireless fidelity/short range wireless controller 42.

In addition, the first transparent non-conductive substrate 40 of the first preformed curtain 38 can provide a waterproof protective cover for the entirety of the first AC/DC power supply adapter 26, where in another embodiment, the first AC/DC power supply adapter 26 is disposed within the interior spatial area of the first transparent non-conductive substrate 40 of the first preformed curtain 38 proximate to the first wireless fidelity/short range wireless controller 42, as shown in FIG. 10B.

The first preformed curtain 38 is not limited to any preconfigured size or dimension or curtain shape configuration whereby the first preformed curtain 38 can be customized and configured to fit a predetermined variety of common window frame dimensions for residential building, or commercial buildings or any stable structure. Similarly, the first preformed bendable wireless fidelity/short range wireless light emitting diode light strip 44 is configured to correspond to the size and dimension of the first preformed curtain 38 so that the first preformed bendable wireless fidelity/short range wireless light emitting diode light strip 44 extends it its entirety from its first primary end 48 to its first terminal end 50 within the first interior spatial area of the first transparent non-conductive substrate 40 of the first preformed curtain 38.

In accordance with one embodiment of the present invention, as depicted in FIG. 10B, the first AC/DC power supply adapter 26 of the first curtain lights assembly 12 is embedded within the first interior spatial area of the first transparent non-conductive substrate 40 of the first preformed curtain 38 proximate to the first wireless fidelity/short range wireless controller 42. In this embodiment, the first transparent non-conductive substrate 40 of the first preformed curtain 38 can provide support for the AC/DC power supply adapter 26. As discussed above, the first transparent non-conductive substrate 40, of the first preformed curtain 38 can be manufactured from a transparent substrate selected from the group of substrates comprising transparent silicone, silicone, a transparent silicone which is water resistant, heat resistant and bendable, a clear, highly heat resistant bendable polyimide material, a waterproof transparent non-conductive colloid which can be a waterproof transparent polyurethane resin, polyester, polymer film, polyimide, polyimide polymer, transparent rubber, a non-conductive plastic, a non-conductive polyimide which is water resistant, heat resistant and bendable. In another exemplary embodiment, the group of substrates may comprise the characteristics of being highly heat resistant, water resistant, and non-bendable or rigid.

In this manner, the first AC/DC power supply adapter 26 being embedded within the first transparent non-conductive substrate 40 is waterproofed by the first transparent non-conductive substrate 40. In addition, in this manner, the first AC/DC power supply adapter 26 is operationally connected to the first DC power input jack male plug member 84 while the first DC power input jack male plug 43 can be releasably operationally attached to the first DC power output jack female connector 78 of the first AC/DC power supply adapter 26. Whereby, the first AC/DC power supply adapter 26 supplies a first flow of DC output electric current at a first main direct current voltage wire $V^1$ of the first wireless fidelity/short range wireless controller 42, and, subsequently, therethrough to the a first main direct current input voltage wire, as indicated by $V^{1-IN}$ of the first wire lead 86 of the first preformed bendable wireless fidelity/short range wireless light emitting diode light strip 44 and thereby to each of the first plurality of wireless fidelity/short range wireless light emitting diodes $\mathbf{46}^{1+N}$ of the first preformed bendable wireless fidelity/short range wireless light emitting diode light strip 44.

FIGS. 2A and 2B, and more particularly, FIGS. 6, and 8, shows the first wireless fidelity/short range wireless controller 42 of the first curtain lights assembly 12. FIGS. 2A and 2B shows the first wireless/short range wireless controller 42 is embedded within the first preformed curtain 38 proximate to the first primary end 48 of the first wireless fidelity/short range wireless light emitting light strip 44. The first wireless fidelity/short range wireless controller 42 is embedded within the first preformed curtain 38 proximate to the first primary end 48 of the first preformed bendable wireless fidelity/short range light emitting diode light strip 44 at one side and proximate to an interior wall of a first opposing left side wall 118 of the first preformed curtain 38. Looking to FIGS. 6 and 8, the first wireless fidelity/short range wireless controller 42 includes a first controller board 45, the first DC power input jack male plug 43, the first output controller pin light emitting diode female receptacle 156, the first wireless fidelity/short range wireless combination chip 158.

FIGS. 6 and 8 shows a perspective view of the operational parts of the first wireless fidelity/short range wireless controller 42. The first wireless fidelity/short range wireless combination chip 158 includes a first wireless fidelity/short range wireless module chip 52, a first processor chip 60, and a first wireless fidelity chip/short range wireless chip 54 including a first wireless fidelity chip 56 installed with a first secure digital input output driver (SDIO) 66 being in coexistence with a first short range wireless chip 58 installed with a first short range wireless universal asynchronous receiver transmitter (UART) driver 70, a first protected access driver (WPA) (not shown) a first short range wireless stack and profiles (not shown), supported by a first virtual input output core, indicated at VIO, a first pair of the combination wireless fidelity/short range wireless antennae $\mathbf{74}^1$,$\mathbf{74}^2$, a first combination wireless fidelity/short range wireless antenna $\mathbf{74}^1$ and a second combination wireless fidelity/short range wireless single antenna $\mathbf{74}^2$, wherein each of the first combination wireless fidelity/short range wireless antenna $\mathbf{74}^1$ and the second combination wireless fidelity/short range wireless single antenna 74$^2$ provides a coexistence of a first wireless fidelity antenna and a short range wireless single antenna. The first wireless fidelity/short range wireless single antenna 74$^1$ and the second wireless fidelity/short range wireless single antenna 74$^2$ is a wireless 2.4/5.8 GHz antenna. Since Bluetooth, ZigBee and Wi-Fi use the 2.4 GHz bandwidth, the coexistence interference is overcome by use of the first combination wireless fidelity/short range wireless antenna 74$^1$ and the second combination wireless fidelity/short range wireless single antenna 74$^2$ operationally electrically connected to the first wireless fidelity/short range wireless module chip 52 of the first wireless fidelity/short range wireless controller 42.

Each of the first combination wireless fidelity/short range wireless antenna 74$^1$ and the second combination wireless fidelity/short range wireless antenna combination 74$^2$ is a dual band omnidirectional wireless fidelity/short range wireless antenna having 2.4 GHz bandwidth and 5-5.8 GHz bandwidth, simultaneously. The omnidirectional wireless fidelity/short range wireless antennae are antennas that can radiate power equally in all directions in a uniform plane. Each of the first combination wireless fidelity/short range wireless 74$^1$ and the second combination wireless fidelity/short range wireless antenna 74$^2$ includes four ports for the antenna, each port included 2.4 GHz and 5-5.8 GHz band at the same time, detailed frequency range is 2400-2500 MHz and 5150-5850 MHz, and antenna gain is 4±1 dBi for 2.4 GHz and 5±1 dBi for 5.8 GHz. The dual band design of the first combination wireless fidelity/short range wireless antenna 74$^1$ and the second combination wireless fidelity/short range wireless antenna 74$^2$ provides high speed and high capacity wireless fidelity and wireless short range wireless network connections. The first combination wireless fidelity/short range wireless antenna 74$^1$ and the second combination wireless fidelity/short range wireless antenna 74$^2$ supports the 2.4/5.8 GHz wireless local area network, IEEE 802.11b.g/n, 2.4 GHz Zigbee technology, and radio frequency technology. The first processor chip 60 is capable of running open source operating systems.

The first wireless fidelity/short range wireless controller 42 can, also, be connected to an external backup voltage supplied by a battery or by another power source: this mode is called VBAT, as indicated by VBAT in FIGS. 8 and 10B. This allows to retain the content of the backup registers and real time clock (RTC) information, while suspending the non-active part of the device without any additional component needed. The first wireless fidelity/short range wireless controller 42 can be maintained in a first housing 76.

The first wireless fidelity/short range wireless controller 42 and the first processor 60 support at 2.4 GHz for high throughput, a 2.4-GHz Memory Reference Code (MRC) support for extended range and 5-5.8 GHz diversity capable, a secure digital input output driver (SDIO) host interface support, as shown in FIG. 8, wireless fidelity direct concurrent operation (multichannel, multirole), a short range wireless connection, and short range wireless low energy secure connection, a host controller interface (HCI) transport for short for short range wireless connection over universal asynchronous receiver transmitter (UART), as shown in FIG. 8, and dedicated audio processor support.

The key benefits of the first wireless fidelity/short range wireless combination chip 158 include that the first wireless fidelity/short range wireless controller 42 reduces design overhead, provides differentiated use cases by configuring wireless fidelity and short range wireless simultaneously to connect and control the movement of the first flow of DC output electric current to each of the first plurality of wireless fidelity/short range wireless light emitting diodes 46$^{1+N}$ of the first preformed bendable wireless fidelity/short range wireless light emitting diode light strips 44. In addition, the first wireless fidelity/short range wireless controller 42 having the first combination wireless fidelity/short range wireless antenna 74$^1$ and the second combination wireless fidelity/short range wireless antenna 74$^2$ coexistence can directly connect with the second preformed bendable wireless fidelity/short range wireless light emitting diode light strip 244 and to other wireless fidelity and short range wireless devices. Further, the first wireless fidelity/short range wireless controller 42 can connect with other wireless fidelity devices on different radio frequency channel, wireless fidelity networks, best-in-class wireless fidelity, with high performance audio and video streaming reference applications with a range increased by 1.4 times greater than one conventional antenna. In addition, the first wireless fidelity/short range wireless controller 42 provision methods for one or more in-home curtain lights devices connectivity to the user's personal wireless fidelity network or the user's personal short range wireless network. The first wireless fidelity/short range wireless combination chip 158, also, can work with high-level operating systems, for example, Linux® and Android®. The first wireless fidelity/short range wireless combination chip 158 can be provided by a Texas Instrument—Model 1835MOD chip.

The first wireless fidelity/short range wireless combination chip 158 of the first wireless fidelity/short range wireless controller 42 includes the first wireless fidelity/short range wireless module chip 52 which operates on the 2.4 GHz bandwidth network, a wireless fidelity network and short range wireless network coexistence, a wireless local-area network, and can integrate a radio frequency network in the user's personal area network, residential network or business network.

In this manner, the first wireless fidelity/short range wireless controller 42 enables a co-existence of wireless fidelity and short range wireless implementations in the user's personal area network or a commercial area network or in combination of both for the use of the first curtain lights assembly 12 and contemporaneously with the second curtain lights assembly 212, in the user's home, office or business.

FIGS. 1, 2A-2B, 6, 8, and 12A shows the first curtain lights assembly 12 includes the first AC/DC power supply adapter 26. FIG. 12A shows the first AC/DC power supply adapter 26 operationally electrically connected to the first DC power input jack male plug 43 of the first wireless fidelity/short range wireless controller 42. The first AC/DC power supply adapter 26 is configured to releasably operationally electrically attach to the first wireless fidelity/short range wireless controller 42. As such, the first AC/DC power supply adapter 26 includes the first DC power output jack female connector 78 on a first side of the AC/DC power supply adapter 26 where with the first DC power output jack female connector 78 is releasably operationally electrically connected to the first DC power input jack male plug 43 of the first wireless fidelity/short range wireless controller 42. A first power cable 80 with a first power plug male connector 82 is operationally disposed on an opposing second side of the first AC/DC power supply adapter 26 configured to releasably operationally connect to a female socket of a power source (not shown) to provide current to the first AD/DC power supply adapter 26 and thereby provide an electric current, more particularly, a first flow of DC output electric current channeled through a first DC power input jack male plug member 84 to the first wireless fidelity/short range controller 42 and, subsequently, to illuminate each of the first plurality of wireless fidelity/short range wireless light emitting diodes $46^{1+N}$ of the first preformed bendable wireless fidelity/short range wireless light emitting diode light strip 44.

The power source is the normal household electrical supply. As well known by a person having ordinary skill in the art, most residences can receive 120 volts from their wall outlet. However, electrical power can be typically delivered into a residential household at a nominal voltage of 240 volts. When the user plugs the first power plug male connector 82 of the first power cable 80 of the AC/DC power supply adapter 26 to the female socket of a power outlet in a residential household the outlets provide alternating current which has a frequency of 60 Hz. In addition, this provides the necessity of including the first AC/DC power supply adapter 26 to transform the alternating current to direct current. Thereby, the AC/DC power supply adapter 26 provides a first flow of DC output electric current to the first wireless fidelity/short range wireless controller 42, and, subsequently, to each of the first plurality of wireless fidelity/short range wireless light emitting diodes $46^{1+N}$ of the first preformed bendable wireless fidelity/short range wireless light emitting diode light strip 44.

The power source can, also, be a commercial power source for a business. The power source can, also, be a rechargeable battery configured with at least 12V-24V DC output current. The rechargeable battery can be embedded within the first interior spatial area of the first transparent non-conductive substrate 40 of the first preformed curtain 38.

FIGS. 2A-2B, 6, 8, and 10A shows an exemplary embodiment in which the first DC power output jack female connector 78 of the first AC/DC power supply adapter 26 is releasably operationally connected to the first DC power input jack male plug 43 of the first wireless fidelity/short range wireless controller 42. In addition, the first DC power input jack male plug 43 incudes a first DC power input jack male plug member 84, as depicted in FIGS. 6, 8 and 10A, through which the first DC output electric current actuated by the first AC/DC power supply adapter 26 is routed between the first AC/DC power supply adapter 26 and the first wireless fidelity/short range wireless controller 42 input at the first main direct current voltage wire $V^1$. It should be appreciated, however, that these embodiments may be employed together with the first AC/DC power supply adapter 26 embedded within the first transparent non-conductive substrate 40 of the first preformed curtain 38 congruent to the first wireless fidelity/short range wireless controller 42, as depicted in FIG. 10B.

In this exemplary embodiment in accordance with the present invention, as shown in FIGS. 2A-2B, 8 and 12A, the first AC/DC power supply adapter 26 is an external AC/DC power supply adapter. In another embodiment, in accordance of the present invention the first AC/DC power supply adapter 26, as discussed above, the first AC/DC power supply adapter 26 can be positioned internally within the first interior spatial area of the first transparent non-conductive substrate 40 of the first preformed curtain 38 disposed congruent with the first wireless fidelity/short range wireless controller 42, as depicted in FIG. 10B.

FIGS. 2A-2B, 8, 10A-10B and 12A shows the first wireless fidelity/short range wireless controller 42 is embedded within the first transparent conductive substrate 40 of the first preformed curtain 38 positioned proximate to the first primary end 48 of the first preformed bendable wireless fidelity/short range wireless light emitting diode light strip 44. The first primary end 48 of the first preformed bendable wireless fidelity/short range wireless light emitting diode light strip 44 includes the first wire lead 86 wherein the first wire lead 86 includes the first series of one or more light emitting diode input color wire leads 88 operationally electrically connected to the first plurality of copper pads $90^{1+N}$ configured within the first electrically conductive copper circuitry of the first bendable printed circuit board 162 of the first preformed bendable wireless fidelity/short range wireless light emitting diode light strip 44 of the first preformed curtain 38.

As shown in FIGS. 12A-12B, the first terminal end 50 of the first preformed bendable wireless fidelity/short range wireless light emitting diode light strip 44 includes the first back end 92 of the first wire lead 86. The first back end 92 of the first wire lead 86 includes the first back end 92 of each of the first series of one or more light emitting diode input color wire leads 88 of the first wire lead 86.

FIGS. 8, 10A-10B and 12A, show the first wire lead 86 is embedded within the first transparent non-conductive substrate 40 of the first preformed curtain 38 having the first series of one or more light emitting diode input color wire leads 88 congruent with the first wireless fidelity/short range wireless controller 42. The first wireless/short range wireless controller 42 is configured having the first main direct current voltage wire $V^1$, a first ground $GND^1$, a first one or more direct current input wirings 104, and a first series of one or more light emitting diode output color wirings 106 wired to the first wireless fidelity/short range wireless module chip 52 of the first wireless fidelity/short range wireless controller 42, wherein each of the first series of one or more light emitting diode output color wirings 106 includes a first predetermined forward voltage.

The forward voltage for each of the first series of the first series of one or more light emitting diode output color wirings 106 can be as follows: first main direct current voltage wire $V^1$ can be 24 Volts; ultraviolet color has a forward voltage of 3.1-4.4 Voltage; violet colors has a forward voltage of 2.8-4.0 Voltage; blue color has a forward voltage of 2.5-3.7 Voltage; green color has a forward voltage of 1.9-4.0 Voltage; yellow color has a forward voltage of 2.1-2.2 forward voltage; orange/amber has a forward voltage of 2.0-2.1 Voltage; red color has a forward voltage of 1.6-2.0 Voltage; and infrared has a forward voltage of greater than 1.9 Voltage.

With reference to FIGS. 8 and 10A-10B, each of the first series of one or more light emitting diode output color wirings 106 are electrically conductive components being copper wires leading into the first wire lead 86 of the first bendable printed circuit board 162 of the first preformed bendable wireless fidelity/short range wireless light emitting diode light strip 44. More particularly, each of the first main direct current voltage wire $V^1$, and the first series of one or more light emitting diode output color wirings 106 are each operationally electrically connected by way of soldering, or flexible adhesive, or otherwise adhering means, to each of the corresponding a first main direct current input voltage wire, as indicated by $V^{1-IN}$, and corresponding to each of the first series of one or more light emitting diode input color wire leads 88 of the first wire lead 86.

Each of the first series of the first series of one or more light emitting diode input color wire leads 88 receives a forward voltage corresponding to the first predetermined forward voltage of each of the first series of one or more light emitting diode output color wirings 106, as described above. Each of the first main direct current voltage wire $V^1$, and each of the first series of one or more light emitting diode output color wirings 106 of the first wireless fidelity/ short range wireless controller 42 are routed through the first output controller pin light emitting diode female receptacle 156. The first output controller pin light emitting diode female receptacle 156 includes at least two portals. In this exemplary embodiment the first output controller pin light emitting diode female receptacle 156 includes five portals. Each of five portals of the first output controller pin light emitting diode female receptacle 156 includes electrically conductive copper contacts and provides a portal for the first main direct current voltage wire $V^1$ of the first wireless fidelity/short range wireless controller 42 and each of the first red R, green G, blue B, white W wires of the first series of one or more light emitting diode output color wirings 106 which are then irreversibly operationally electrically connected to each of the first series of one or more light emitting diode input color wire leads 88 of the first wire lead 86 and the first main direct current input voltage wire $V^{1-IN}$ of the first wire lead 86 of the first wireless fidelity/short range wireless light emitting diode light strip 44. The electrically conductive copper contacts of the first output controller pin light emitting diode female receptacle 156 provide for an uninterrupted flow of the forward voltage from the output voltage wire and each of the first series of one or more light emitting diode input color wire leads 88.

Each of the first series of one or more light emitting diode output color wirings 106 and the first main direct current voltage wire $V^1$ of the first wireless fidelity/short range wireless controller 42 are irreversibly operationally electrically connected to the a first main direct current input voltage wire $V^{1-IN}$, and each of the first series of one or more light emitting diode input color wire leads 88, respectively, of the of the first wire lead 86 of the first bendable printed circuit board 162 of the first preformed bendable wireless fidelity/short range wireless light emitting diode light strip 44 by way of soldering or bendable adhesive, or otherwise adhering means. In this manner, continuity of the forward flow of the first DC output electric current and the predetermined forward voltage of each of the first series of one or more light emitting diode output color wirings 106 is established to provide an uninterrupted flow of the first DC output electric current to first electrically conductive copper circuitry of the first bendable printed circuit board 162 and each of the first plurality of copper pads $\mathbf{90}^{1+N}$ of the first preformed bendable wireless fidelity/short range wireless light emitting diode light strip 44 such that each of the plurality of wireless fidelity/short range wireless diodes illuminates in the color corresponding with its forward voltage.

Wherein each of the first series of one or more light emitting diode input color wire leads 88 are fluidly electrically aligned with each of the first series of one or more light emitting diode output color wirings 106 of the first wireless fidelity/short range wireless controller 42 having a first corresponding forward output voltage for providing a first direct forward flow of the first DC output electric current to each of the first plurality of wireless fidelity/short range wireless light emitting diodes $\mathbf{46}^{1+N}$ of the first preformed bendable wireless fidelity/short range wireless light emitting diode light strip 44. In this manner, when the first AC/DC power supply adapter 26 is releasably operationally electrically connected to the power source (not shown) each of the first plurality of light emitting diodes receives the first direct forward flow of the first DC output electric current to each of the first plurality of wireless fidelity/short range wireless light emitting diodes $\mathbf{46}^{1+N}$ of the first preformed bendable wireless fidelity/short range wireless light emitting diode light strip 44, thereby, generating a first visual image of a first illuminated curtain draping a right side frame 110 of the common window frame 18 wherein the first preformed curtain 38 is mounted thereon the right side frame 110 of the common window frame 18.

The first preformed curtain 38 includes a first thickness, a first coronal plane, a first transverse plane, a first median plane, a first interior spatial area enclosed by a first front wall 112 having a first outer front face, the first rear wall 114 having a first outer rear face, a first right side wall 116 having a first outer right side face, a first opposing left side wall 118 having a first outer left side face, a first top wall 120 having a first outer top face, and a first bottom wall 122 having a first outer bottom face. The first rear wall 114 includes a first rear wall thickness greater than a first front wall thickness of the first front wall 112. The first rear wall thickness of the first rear wall 114 of the first preformed curtain 38 prevents the emission of heat into a room associated with the common window frame 18 to which the first plurality of wireless fidelity/short range wireless light emitting diodes $\mathbf{46}^{1+N}$ of the first preformed bendable wireless fidelity/short range wireless light emitting diode light strip 44 is mounted and extra support and protection to the first wireless fidelity/short range wireless controller 42.

The first preformed curtain 38 is framed by a first top edge 108 horizontally orientated, a first opposing bottom edge 124 horizontally orientated parallel to the first top edge 108, the first top edge 108 having a first top edge width that is greater than a first bottom edge width of the first opposing bottom edge 124, a right side straight edge 126 vertically orientated having a right side edge length extending in a first straight line from a peripheral right side edge of the first top edge 108 to a peripheral right side edge of the first opposing bottom edge 124, a left side curvilinear edge 128 having a left side curvilinear length extending in a left curvilinear line from a peripheral left side top edge of the first top edge 108 to a peripheral left side bottom edge of the first opposing bottom edge 124.

The first top edge 108, the first opposing bottom edge 124, and the right side straight edge 126 of the first preformed curtain 38 is formed having a magnetized strip embedded therein the corresponding interior spatial area of the transparent non-conductive substrate 40 of the first preformed curtain 38. The first top edge 108 includes a first magnetized strip polarity-A providing a first magnetized polarity-A top edge 134, the right side straight edge 126 includes a first straight edge magnetized strip polarity-A providing a magnetized polarity-A right side straight edge 136, and the first opposing bottom edge 124 includes a first magnetized strip of polarity-B providing a first magnetized polarity-B opposing bottom edge 138, as depicted in FIGS. 2A-2B, 12A and 13 A-13B. FIG. 13A illustrates a front perspective view of the first curtain lights assembly 12 and the second curtain lights assembly 212 in use as being installed and displayed in the common window frame 18. FIG. 13B illustrates a rear perspective view of the first curtain lights assembly 12 and the second curtain lights assembly 212 in use as installed and displayed in the common window frame.

In this manner, by way of one or more cut magnetic polarity-A strips $\mathbf{14}^{1+N}$ and one or more cut magnetic polarity-B strips $\mathbf{16}^{1+n}$, respectively, the first preformed curtain 38 can be releasably magnetically mounted onto a right region of the common window frame 18. The roll of magnetic polarity-A tape 14 and the roll of magnetic polarity-B tape 16 can be formed from metals selected from any one of metals selected from the group comprising iron, nickel, cobalt. Each of the roll of magnetic polarity-A tape and the roll of magnetic polarity-B tape are commercially available.

With reference to FIGS. 2A-2B, 8, 10A-10B, 12A and 14, the first right side wall 116 of the first preformed curtain 38 includes a first right aperture 140 and a second right aperture 142. The first right aperture 140 is round shaped and recessed therethrough the first right side wall 116 of the first preformed curtain 38. The first right aperture 140 is configured to allow the first DC power input jack male plug 43 of the first wireless fidelity/short range wireless controller 42 to be accessed therethrough the first right aperture 140 whereby the first DC power output jack female connector 78 of the first AC/DC power supply adapter 26 can be releasably operationally connected to the first DC power input jack male plug 43 whereby the first direct forward flow of the first DC output electric current can be directed to the first wireless fidelity/short range wireless controller 42 and, subsequently, to provide the first direct forward flow of the first DC output electric current to each of the first plurality of wireless fidelity/short range wireless light emitting diodes $\mathbf{46}^{1+N}$ of the first preformed bendable wireless fidelity/short range wireless light emitting diode light strip 44.

As shown in FIGS. 2A-2B, 12A-12B, and 14, the second right aperture 142 is rectangular in shape being vertically orientated and recessed into a right side margin of the of the first right side wall 116 proximate to the top edge 108 of the first transparent non-conductive substrate 40 of the first preformed curtain 38. Here, the first output pin light emitting diode female receptacle 144 is recessed within the second right aperture 142. The first output pin light emitting diode female receptacle 144 is operationally electrically wired to the first back end 92 of the first wire lead 86 of the first preformed bendable wireless fidelity/short range wireless light emitting diode light strip 44. The first output light emitting diode female receptacle 144 includes electrically conductive components including the first back end 92 of the first wire lead 86 and electrically conductive copper contacts.

Figure 14:
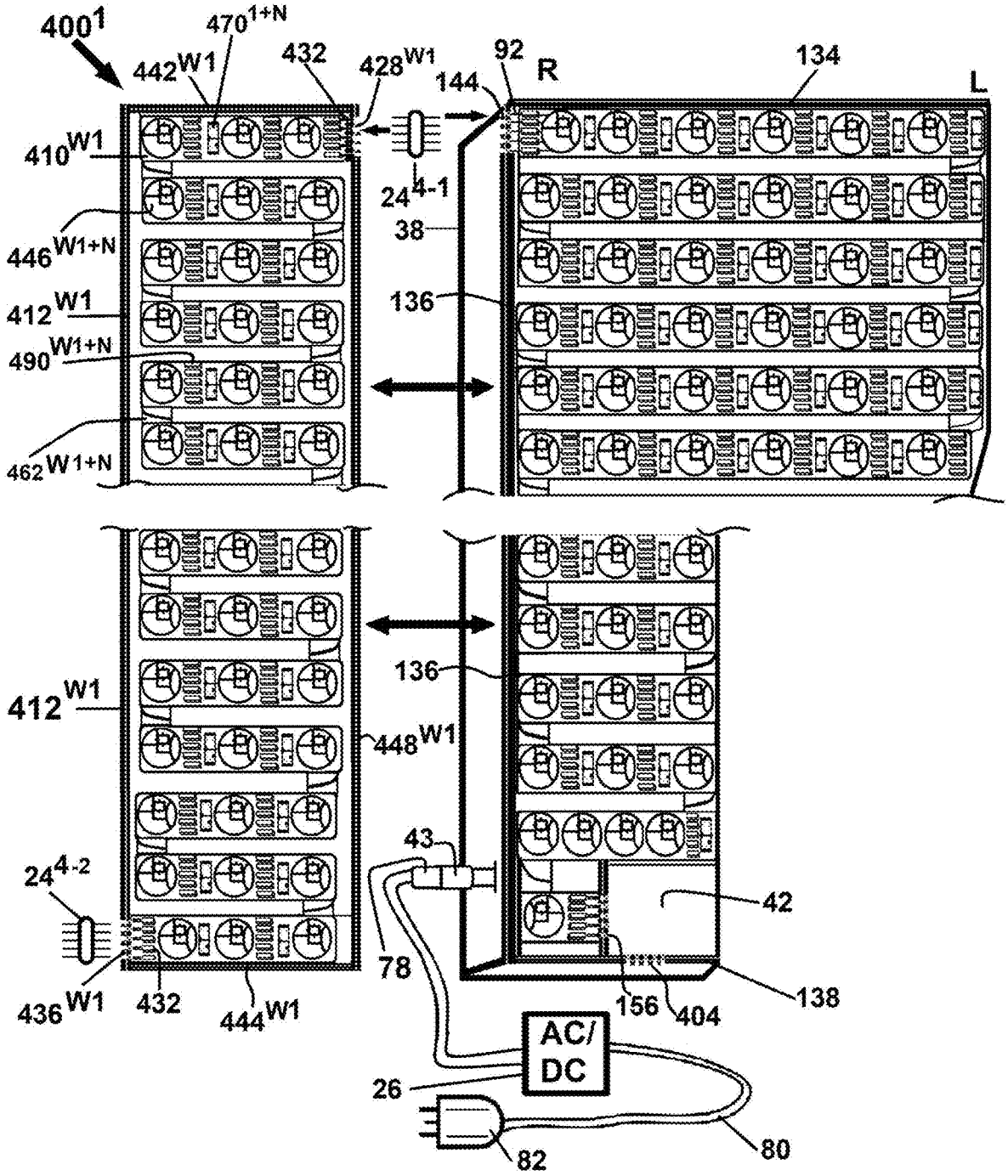
FIG. 14 illustrates a perspective view of the first curtain lights assembly of FIG. 2B in a working association with a first accessory widening curtain lights extension panel, according to the embodiment of the present invention.
Figure 15A:
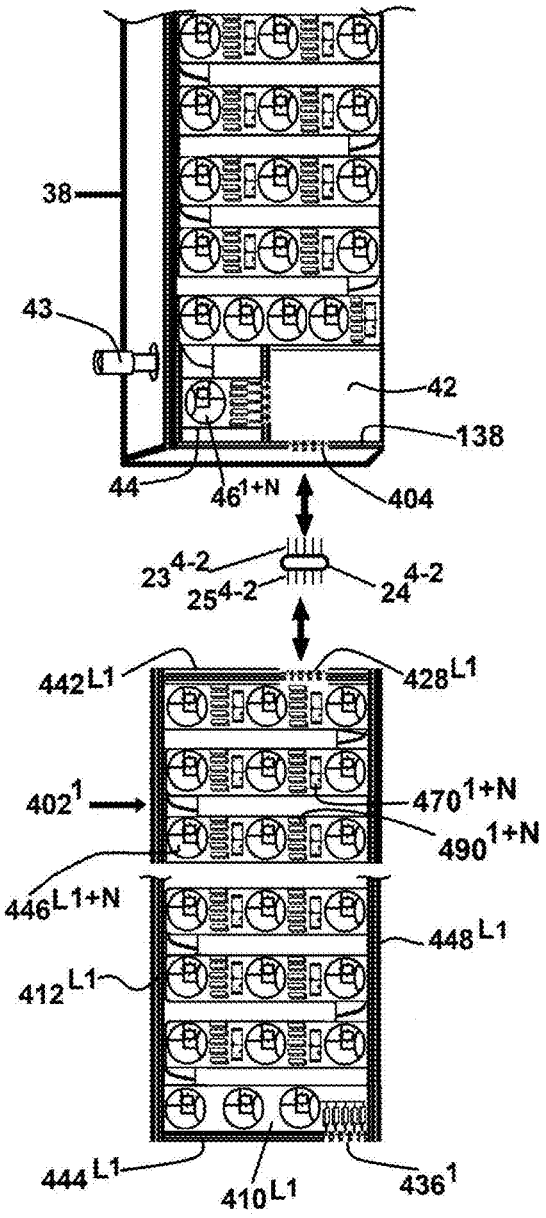
FIG. 15A illustrates a perspective view of a portion of the first preformed curtain of the first curtain lights assembly of FIG. 2B in a working association with a first accessory lengthening curtain lights extension panel, according to an embodiment of the present invention.
Figure 15B:
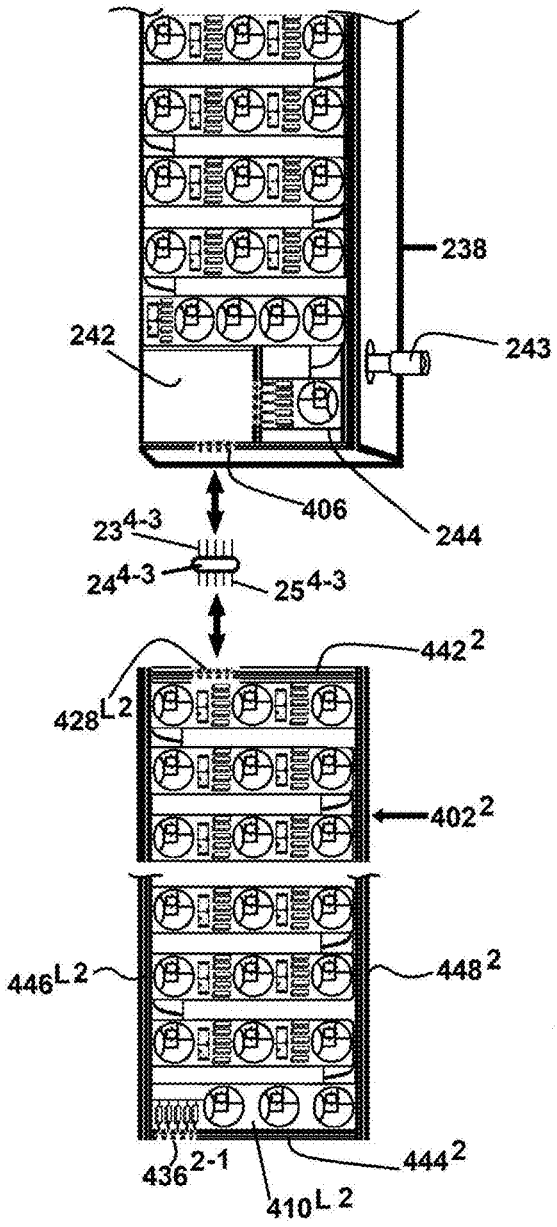
FIG. 15B illustrates a perspective view of a portion of the second preformed curtain of the second curtain lights assembly of FIG. 2B in a working association with a second lengthening accessory curtain lights extension panel, according to the embodiment of the present invention.

The first output pin light emitting diode female receptacle 144 is configured integrally formed within a top portion of the first right side wall 116 of the first preformed curtain 38 by way of soldering or bendable adhesive or otherwise adhering the electrically-conductive components, including the first back end 92 of the first wire lead 86 and electrically conductive copper contacts of the first output pin light emitting diode female receptacle 144 to the wires of the first back end 92 of the first wire lead 86 of the first electrically conductive copper circuitry of the first bendable circuit board 162 of the first preformed bendable wireless fidelity/short range wireless light emitting diode light strip 44. In this manner, the first output pin light emitting diode female receptacle 144 being operationally connected to the first electrically conductive copper circuitry of the first preformed bendable wireless fidelity/short range wireless light emitting diode light strip 44 provides for continuity in an electrical current path for the first DC output electric current from the first electrically conductive copper circuitry of the first bendable printed circuit board 162 to another electrically conductive copper circuitry of another bendable printed circuit board, for example, a second electrically conductive copper circuitry of a second bendable printed circuit board 294 of the second preformed bendable wireless fidelity/short range wireless light emitting diode light strip 244 of the second preformed curtain 238 of the second curtain lights assembly 212, as shown in FIG. 12A, or to an accessor electrically conductive copper circuitry of an accessory bendable printed circuit board 440 of one or more of accessory curtain lights extension panels, including any one of a one or more accessory widening curtain lights extension panel $\mathbf{400}^{1+N}$, or any one or more accessory lengthening curtain lights extension panels $\mathbf{402}^{1+N}$ during use, as shown in FIG. 14 and FIGS. 15A-15B, respectively, of the of the first preformed bendable wireless fidelity/short range wireless light emitting diode light strip 44 of the first curtain lights assembly 12 of the curtain lights device 20. FIG. 14 illustrates a perspective view of the first preformed curtain 38 of the first curtain lights assembly 12 in a working association with a first accessory widening curtain lights extension panel $\mathbf{400}^{1}$, as discussed in more detail below.

A silicone or rubber hinged plug (not shown) configured to be slidably inserted into the first output pin light emitting diode female receptacle 144 can be provided to encase the first output pin light emitting diode female receptacle 144 when not in use such that when inserted the hinged plug protects the first output pin light emitting diode female receptacle 144 from moisture and potential damage.

The first output pin light emitting diode female receptacle 144 is configured to be complimentary with any one of the one or more mateable pin light emitting diode male connectors $\mathbf{24}^{1-n}$.

As shown in FIGS. 12A-12B and 14, the first terminal end 50 of the first preformed bendable wireless fidelity/short range wireless light emitting diode light strip 44 includes the first back end 92 of the first wire lead 86. The first back end 92 of the first wire lead 86 includes the first back end 92 of each of the first series of one or more light emitting diode input color wire leads 88 of the first wire lead 86. The first output pin light emitting diode female receptacle 144 provides a channel to which a first male connector end $\mathbf{23}^{1}$ of any one of the one or more mateable pin light emitting diode male connectors $\mathbf{24}^{1+n}$ may releasably operationally electrically connected by operational contact to the first back end 92 of the first wire lead 86 and a second male connector end 259 of a selected mateable pin light emitting diode male connector $\mathbf{24}^{n}$ of the one or more mateable pin light emitting diode male connectors $\mathbf{24}^{1+n}$ can releasably operationally electrically connected to a mateable one of the one or more accessory curtain lights extension panel, including one of one or more accessory widening curtain lights extension panels $\mathbf{400}^{1+N}$, or a mateable pin light emitting diode female to female connector cables $\mathbf{21}^{n}$ of the one or more mateable pin light emitting diode female to female connector cables $\mathbf{21}^{1+n}$, or to a mateable pin light emitting diode female to female butterfly connector cables $\mathbf{22}^{n}$ of the one or more pin light emitting diode female to female butterfly connector cables $\mathbf{22}^{1+n}$. In this manner an uninterrupted flow of the first direct forward flow of the first DC output electric current is enabled to move from the first electrically conductive copper circuitry of the first back end 92 of the first wire lead 86 of the first preformed bendable wireless fidelity/short range wireless light emitting diode light strip 44 into the accessory electrically conductive copper circuitry of a first accessory preformed bendable wireless fidelity/short range wireless light emitting diode light strip 410 of the first accessory widening curtain lights extension panel $\mathbf{400}^{1}$ of the one of one or more accessory widening curtain lights extension panels $\mathbf{400}^{1+N}$, as shown in FIG. 14, and as such the accessory preformed bendable wireless fidelity/short range wireless light emitting diode light strip $\mathbf{410}^{W1+N}$, as shown in FIG. 14, as discussed in more detail below, being controlled by the first wireless fidelity/short range wireless controller 42. The application of the first output pin light emitting diode female receptacle 144 can be implemented with the second preformed curtain 238 of the second curtain lights assembly 212 which is discussed below.

The first preformed bendable wireless fidelity/short range wireless light emitting diode light strip 44 is embedded within the first internal spatial area of the first transparent non-conductive substrate 40 of the first preformed curtain 38 proximate to an interior wall of the first outer front face of the first preformed curtain 38, the first preformed bendable wireless fidelity/short range wireless light emitting diode light strip 44 having the first primary end 48 and the first terminal end 50, also, embedded within the first preformed bendable wireless fidelity/short range wireless light emitting diode light strip 44.

In general, as depicted in FIGS. 1, 2A-2B the main components of the first preformed bendable wireless fidelity/short range wireless light emitting diode light strip 44 is the first bendable printed circuit board 162 wherein the first bendable printed circuit board 162 includes the first plurality of wireless fidelity/short range wireless light emitting diodes $\mathbf{46}^{1+N}$, the first plurality of copper pads $\mathbf{90}^{1+N}$, and the first plurality of resistors $\mathbf{170}^{1+N}$. As discussed above, the first plurality of copper pads $\mathbf{90}^{1+N}$ provide electrical connection points which are configured within the first electrically conductive copper circuitry of the first bendable printed circuit board 162 of the first preformed bendable wireless fidelity/short range wireless light emitting diode light strip 44 of the first preformed curtain 38 and the first plurality of resistors $\mathbf{170}^{1+N}$ control the movement of the first direct forward flow of the first DC output electric current flowing through each of the first plurality of wireless fidelity/short range wireless light emitting diodes $\mathbf{46}^{1+N}$ of the first preformed bendable wireless fidelity/short range wireless light emitting diode light strip 44. The first preformed bendable wireless fidelity/short range wireless light emitting diode light strip 44 includes the first plurality of copper pads $\mathbf{90}^{1+N}$ which provide electrical connection points which are configured within the first electrically conductive copper circuitry of the first bendable printed circuit board 162 of the first preformed bendable wireless fidelity/short range wireless light emitting diode light strip 44 of the first preformed curtain 38.

As discussed above, in one embodiment in accordance with the present disclosure, the first preformed bendable wireless fidelity/short range wireless light emitting diode light strip 44 can include surface mounted diode type wireless fidelity/short range wireless light emitting diodes which are created by soldering surface mounted diode type light emitting diodes onto the first bendable printed circuit board 162 which generate lighting or illumination when connected to a power source. In another embodiment, the first preformed bendable wireless fidelity/short range wireless light emitting diode light strip 44 can include a chip on board type of light emitting diode. The chip on board includes a light emitting dye is configured directly on the first bendable printed circuit board 162 of the first preformed bendable wireless fidelity/short range wireless light emitting diode light strip 44. The chip on board light strip may, also, be called a flip-chip. A chip on board type first wireless fidelity/short range wireless light emitting diode light strip 44 include constant current drivers which are a method of driving each of the first plurality of wireless fidelity/short range wireless light emitting diodes $\mathbf{46}^{1+N}$ of the first preformed bendable wireless fidelity/short range wireless light emitting diode light strip 44. The chip on board operates at a single current and adjust their output voltage correspondingly, ensuring that the forward current remains stable. Therefore, when constant current input is used, a current limiting resistor is not necessary.

FIGS. 2B, 8, 10A-10B and 12A show the first primary end 48 of the first preformed bendable wireless fidelity/short range wireless light emitting diode light strip 44 being disposed congruent to the first wireless fidelity/short range wireless controller 42. The first preformed bendable wireless fidelity/short range wireless light emitting diode light strip 44 extends within the first interior spatial area of the first transparent non-conductive substrate 40 of the first preformed curtain 38 to the first terminal end 50 of the first preformed bendable wireless fidelity/short range wireless light emitting diode light strip 44 disposed at an interior side of the first output light emitting diode female receptacle 144 of the first preformed curtain 38.

The first preformed bendable wireless fidelity/short range wireless light emitting diode light strip 44 is arranged such that the first preformed bendable wireless fidelity/short range wireless light emitting diode light strip 44 forms a first number of symmetrically aligned rows spaced laterally from the right side straight edge 126 to the left side curvilinear edge 128 of the first pre-formed curtain 38 spanning a first full length of the first interior spatial area of the first transparent non-conductive substrate 40 of the first preformed curtain 38. The first preformed bendable wireless fidelity/short range wireless light emitting diode light strip 44 includes symmetrically spaced regions which bend in a vertical downward orientation forming a first plurality of curved end regions $\mathbf{148}^{1+N}$, as shown in FIG. 2B, seamlessly and fluidly unifying each of the first number of symmetrically aligned rows causing the first plurality of wireless fidelity/short range wireless light emitting diodes $\mathbf{46}^{1+N}$ of the first preformed bendable wireless fidelity/short range wireless light emitting diode light strip 44 being densely spanned within the first interior spatial area of the first transparent non-conductive substrate 40 of the first preformed curtain 38.

The first plurality of curved end regions $\mathbf{148}^{1+N}$ at each end of the first number of symmetrically spaced regions of each symmetrically aligned rows enable for an uninterrupted and continuous movement of the first direct forward flow of the first DC output electric current each to each of the first plurality of wireless fidelity/short range wireless light emitting diodes $\mathbf{46}^{1+N}$ in each of the first number of symmetrically aligned rows of the first preformed bendable wireless fidelity/short range wireless light emitting diode light strip 44. When forming the first plurality of curved end regions $\mathbf{148}^{1+N}$ the first preformed bendable wireless fidelity/short range wireless light emitting diode light strip 44 is flexible such that the first electrically conductive copper circuitry of the first bendable printed circuit board 162 can conform to the bent shape of each of the intended curved end regions $\mathbf{148}^{N}$ of the first plurality of curved end regions $\mathbf{148}^{1+N}$ such that the first electrical copper circuitry is not broken and interrupted within the first bendable printed circuit board 162 of the first preformed bendable wireless fidelity/short range wireless light emitting diode light strip 44.

Now turning to FIGS. 5B and 13B, a rear view of the first preformed curtain 38, with reference to FIG. 2A, is shown. FIG. 5B shows a rear vies of the first preformed curtain 38 with reference to FIG. 2A-2B. FIG. 13 B shows a rear view of the first preformed curtain 38, with reference to FIG. 13A where the first preformed curtain 38 is installed and displayed in the common window frame 18 of the window.

FIGS. 5B and 13B shows the first preformed curtain 38 includes the first rear wall 114 and a first opaque non-conductive sheet 450 disposed over the first rear wall 114 followed by another layer on top of the first opaque non-conductive sheet 450 including a first transparent non-conductive film 456 as indicated by pulling back the first transparent non-conductive film 456 and pulling back the first opaque non-conductive sheet 450 of the first preformed curtain 38. The first opaque non-conductive sheet 450 is print receptive such that the first quick reference code 160$^1$ can be printed thereon. The first opaque non-conductive sheet 450 can comprise high density polyethylene or a high density polyethylene.

The first opaque non-conductive sheet 450 is configured to prevent the first interior spatial area of the first preformed curtain 38, the first preformed bendable wireless fidelity/short range wireless light emitting diode light strip 44, and the first wireless fidelity/short range wireless controller 42 being displayed to a viewer. The first transparent non-conductive film 456 is configured to allow the user to view a first quick reference code 160$^1$ and to scan the first quick reference code 160$^1$ printed on a bottom portion of the first opaque non-conductive sheet 450 of the first preformed curtain 38, as well as to waterproof the first quick reference code 160$^1$, as depicted in FIG. 5B.

Viewing FIG. 5B, the first quick reference code 160$^1$ is printed on the first opaque sheet 450 and immediately beneath the first transparent non-conductive film 456 so that the first quick reference code 160$^1$ is visible and usable to the user. The first quick reference code 160$^1$ includes a first pattern of at least three colored squares arranged in a first square grid on a first white background, wherein the first pattern of the at least three squares are stored with data of a manufacturer's defined settings including a smart device application for instructions to use the curtain lights kit 10 and the curtain lights device 20. The first quick reference code 160$^1$ includes a center portion where a first printed image depicting a first wireless fidelity symbol 152$^1$ combined with a second printed image depicting a first short range wireless symbol 154$^1$ is displayed. In addition, the first quick reference code 160$^1$, the first wireless fidelity symbol 152$^1$, and the first short range wireless symbol 154$^1$ is molded on the first opaque non-conductive sheet 450 of the first preformed curtain 38 so that the first quick reference code 160$^1$, the first wireless fidelity symbol 152$^1$, and the first short range wireless symbol 154$^1$ are waterproofed by the first transparent non-conductive film 456 and remains clearly visible and easily recognizable by the user such that the user can easily scan the first quick reference code 160$^1$ with the user's smart device's camera to open the manufacturer's defined settings including a device application including the user facing software application to connect the first wireless fidelity/short range wireless controller 42 to the user's personal area wireless network.

The first opaque non-conductive sheet 450 can be a thin layer of white or a variety of colors of a thin silicone. The first transparent non-conductive film 456 can be made of a thin transparent silicone film.

In use, the instructions to use the curtain lights kit 10 and the curtain lights device 20 including the first curtain lights assembly 12 and the second curtain lights assembly 212 is recited in the curtain lights kit/curtain lights device instruction manual 36. In the alternative, the instructions to use the first curtain lights device 20 including the first curtain lights assembly 12 and the second curtain lights assembly 212 can be accessed through anyone of the following quick reference codes: the instruction manual quick reference code 30 fixed on the curtain lights kit/curtain lights device instruction manual 36, or the instructions of use can be accessed through any one of the following: a first latch quick reference code 536 imprinted thereon a polyethylene film comprising a releasable adhesive such that the first latch quick reference code 536 can be releaseably attached to an exterior surface of a first magnetized latch 532 of the portable curtain lights storage case 500, as shown in FIGS. 4A and 4D; a second latch quick reference code 548 imprinted thereon a polyethylene film comprising a releasable adhesive such that the second latch quick reference code 548 can be releasably attached an exterior surface of a second magnetized latch 538 of the portable curtain lights storage case 500, as shown in FIGS. 4A and 4D; the first quick reference code 160$^1$ fixed on the first opaque non-conductive sheet 450 of the first preformed curtain 38; or a second quick reference code 160$^2$ fixed on a second opaque non-conductive sheet 452 of the second preformed curtain 238. The second opaque non-conductive sheet 452 is print receptive such that the second quick reference code 160$^2$ can be printed thereon. The second opaque non-conductive sheet 452 can comprise high density polyethylene or a high density polyethylene.

With reference to FIG. 12A, the instructions of use of the curtain lights device 20 include steps for the user to perform, comprising: (1) plugging the first AC/DC power supply adapter 26 into the power source enabling each of the plurality of wireless fidelity/short range wireless light emitting diodes 46$^{1+N}$ of the first preformed bendable wireless fidelity/short range wireless light emitting diode light strip 44 to commence blinking or strobing from the color red to green to blue; (2) opening a camera on the user's smart device (not shown); scanning by way of the camera any one of the quick reference codes including the instruction manual quick reference code 30, the first latch quick reference code 536, or the second latch quick reference code 548, or the first quick reference code 160$^1$ fixed on the first opaque non-conductive sheet 450 of the first preformed curtain 38; or the second quick reference code 160$^2$ fixed on the second opaque non-conductive sheet 452 of the second preformed curtain 238; (3) opening the data link to a manufacturer-defined settings including the smart device application; (4) clicking on the add (+) device icon to enable adding the first curtain lights assembly 12 of the curtain lights device 20 to the smart device application; (5) clicking again on the add (+) device icon to enable adding the second curtain lights assembly 212 of the curtain lights device 20 to the smart device application; (6) adding the first curtain light assembly 12 of the curtain lights device 20 to the smart device application; (7) adding the second curtain lights assembly of the curtain lights device 20 to the smart device application; (8) leaving, temporarily, the manufacturer-defined settings including the smart device application; (9) finding the user's wireless fidelity network on the user's smart device; (10) adding the user's wireless fidelity network via the user's smart device; (11) finding the user's short range wireless network; (12) adding the user's short range wireless network to the user's smart device; (13) logging into the user's personal area network account; (14) opening the user's wireless fidelity setting and connecting the user's smart device to the wireless fidelity settings; (15) opening the user's short range wireless setting and connecting the user's smart device to the short range wireless settings; (16) connecting to a wireless fidelity/short range wireless signal/short range wireless signal from the first wireless fidelity/short range wireless controller 42 of the first preformed curtain 38 of the first curtain lights assembly 12, wherein the wireless fidelity/short range wireless signal can be identified as LEDNET followed by a series of letters and numbers; returning to the smart device application; (17) connecting to a wireless fidelity/short range wireless signal/ short range wireless signal from a second wireless fidelity/short range wireless controller 242 of the second preformed curtain 238 of the second curtain lights assembly 212, wherein the wireless fidelity/short range wireless signal can be identified as LEDNET followed by a series of letters and numbers; returning to the smart device application; (18) returning to the smart device application; (19) finding the user's 2.4 GHz bandwidth icon on the smart device and clicking on the 2.4 GHz bandwidth icon; (20) connecting the smart device application to the 2.4 GHz bandwidth and waiting for about one minute until the first plurality of wireless fidelity/short range wireless light emitting diodes $\mathbf{46}^{1+N}$ of the first preformed bendable wireless fidelity/short range wireless light emitting diode light strip 44 of the first preformed curtain 38 of the first curtain lights assembly 12 illuminates with a stabilized color of red or green or blue; and (21) waiting for about one minute until the second plurality of wireless fidelity/short range wireless light emitting diodes $\mathbf{246}^{1+N}$ of the second preformed bendable wireless fidelity/short range wireless light emitting diode light strip 244 of the second preformed curtain 238 of the second curtain lights assembly 212 illuminates with a stabilized color of red or green or blue.

The user by way of the smart device application can now control, edit, animate each of the first plurality of wireless fidelity/short range wireless light emitting diodes 44 of the first preformed curtain 38 of the first curtain lights assembly 12 concomitantly with controlling, editing, animating each of the second plurality of wireless fidelity/short range wireless light emitting diodes $\mathbf{246}^{1+N}$ of the second preformed curtain 238 of the second curtain lights assembly 212 when the first wireless fidelity/short range wireless controller 42 is operationally electrically connected to the second wireless fidelity/short range wireless controller 242. In the alternative, the user by way of the smart device application can now control, edit, animate the colors of each of the first plurality of wireless fidelity/short range wireless light emitting diodes 44 of the first preformed curtain 38 of the first curtain lights assembly 12 separately from controlling, editing, animating the colors of each of the second plurality of wireless fidelity/short range wireless light emitting diodes $\mathbf{246}^{1+N}$ of the second curtain lights assembly 212 of the curtain lights device 20.

In the exemplary embodiment, the smart device is any one of the smart devices including iPhone, android phones, smartphones, mobile phones, android mobile phones, smart tablets, smart phablets, smartwatches, smart glasses, computers, laptops, and iPads, iPhone operating system (OS) devices, and intelligent home systems having a smart speaker that can respond to the user's voice command to relay and transmit commands to the first wireless fidelity/short range wireless controller 42 and/or the second wireless fidelity/short range wireless controller 242 when applicable.

Now addressing, the second curtain lights assembly 212 in more detail, with reference to FIGS. 1-2A, 2C, 5B, 9, 11, 12A-12C, 13A-13B, and with reference to the exemplary embodiment of the curtain lights kit 10, as shown in FIG. 1, the second curtain lights assembly 212 of the curtain lights device 20 is implemented with one or more of the elements of the curtain lights kit 10.

With particular reference to FIGS. 1-5B, the curtain lights kit 10, as discussed above, includes the set of two curtain lights assemblies, the first curtain lights assembly 12 and the second curtain lights assembly 212, as depicted in FIGS. 1 and 2A-2C, for displaying in the common window frame 18, as depicted in FIG. 13A-13B; the roll of magnetic polarity-A tape 14 and the roll of magnetic polarity-B tape 16 for releasably mounting and displaying each of the first curtain lights assembly 12 and the second curtain lights assembly 212 assembly to the common window frame 18; the one or more pin light emitting diode female to female connector cables $\mathbf{21}^{1+n}$; the one or more pin light emitting diode female to female butterfly connector cables $\mathbf{22}^{1+n}$; the one or more mateable pin light emitting diode male connectors $\mathbf{24}^{1+n}$; the first AC/DC power supply adapter 26; the second AC/DC power supply adapter 28; the curtain lights kit/curtain lights device instruction manual 36; the portable curtain lights storage case 500 including a variety of sizes of at least two removable storage containers $\mathbf{530}^{1+n}$. Each of the at least two storage containers $\mathbf{530}^{1+n}$ includes an icon $\mathbf{34}^{n}$ of the one or more icons $\mathbf{34}^{1+n}$ identifying each of the first curtain lights assembly 12, the second curtain lights assembly 212, the roll of magnetic polarity-A tape 14, the roll of magnetic polarity-B tape 16, the one or more pin light emitting diode female to female connector cables $\mathbf{21}^{1+n}$, one or more pin light emitting diode female to female butterfly connector cables $\mathbf{22}^{1+n}$, the one or more mateable pin light emitting diode male connectors $\mathbf{24}^{1+n}$, the first AC/DC power supply adapter 26, the second AC/DC power supply adapter 28, and the curtain lights kit/curtain lights device instruction manual 36. More particularly, with reference to FIG. 4A-4B, a first removable storage container $\mathbf{530}^{1}$ includes the first icon $\mathbf{34}^{1}$; the second removable storage container $\mathbf{530}^{2}$ includes the second icon $\mathbf{34}^{2}$; the third removable storage container $\mathbf{530}^{3}$ includes the third icon $\mathbf{34}^{3}$; the fourth removable storage container $\mathbf{530}^{4}$ includes the fourth icon $\mathbf{34}^{4}$; the fifth removable storage container $\mathbf{530}^{5}$ includes the fifth icon $\mathbf{34}^{5}$; the sixth removable storage container $\mathbf{530}^{6}$ includes the sixth icon $\mathbf{34}^{6}$.

Figure 9:
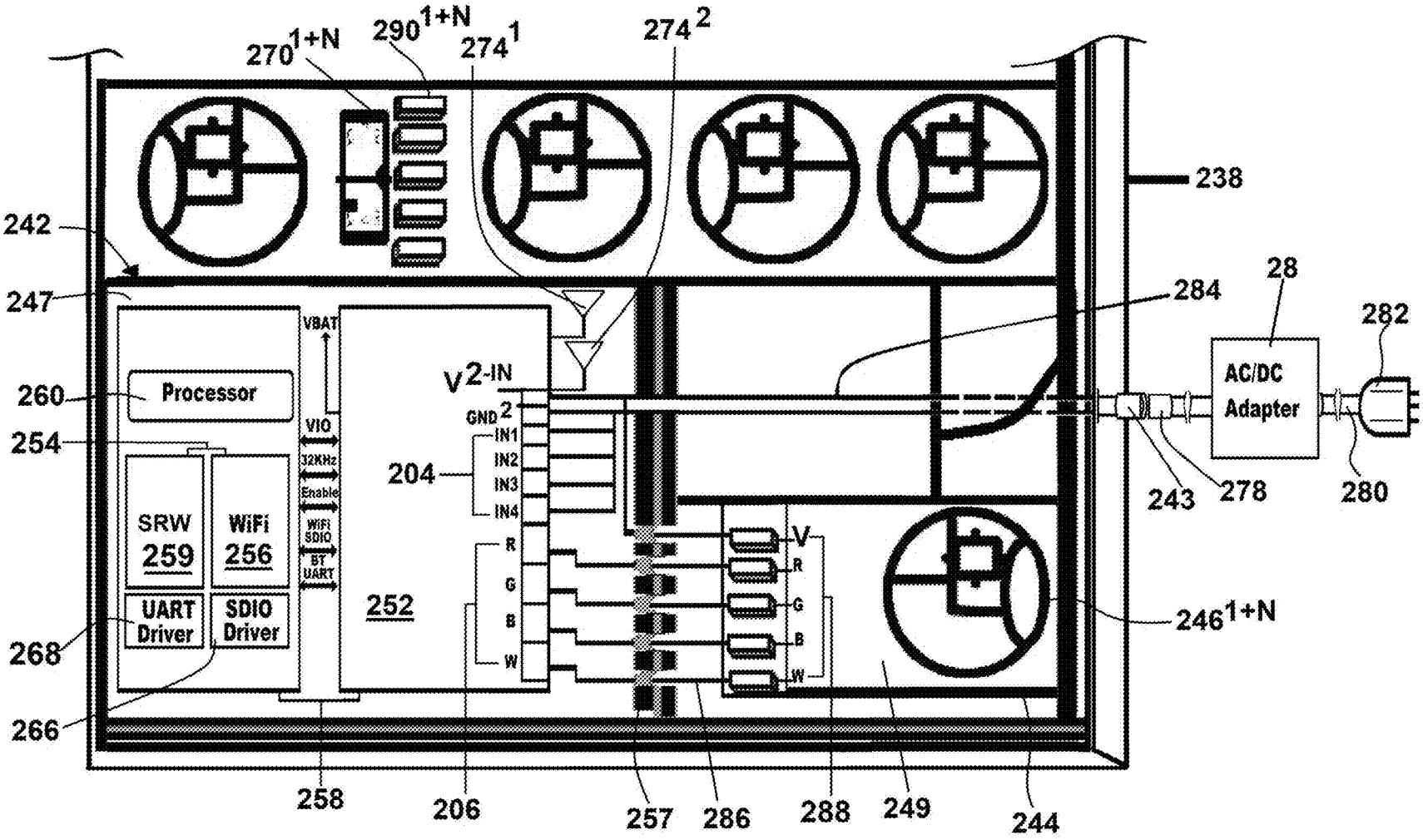
FIG. 9 illustrates a perspective front view of a second wireless fidelity/short range wireless controller showing a second wireless fidelity/short range wireless combination chip of the second curtain lights assembly, according to the embodiment of the present invention.
Figure 11:
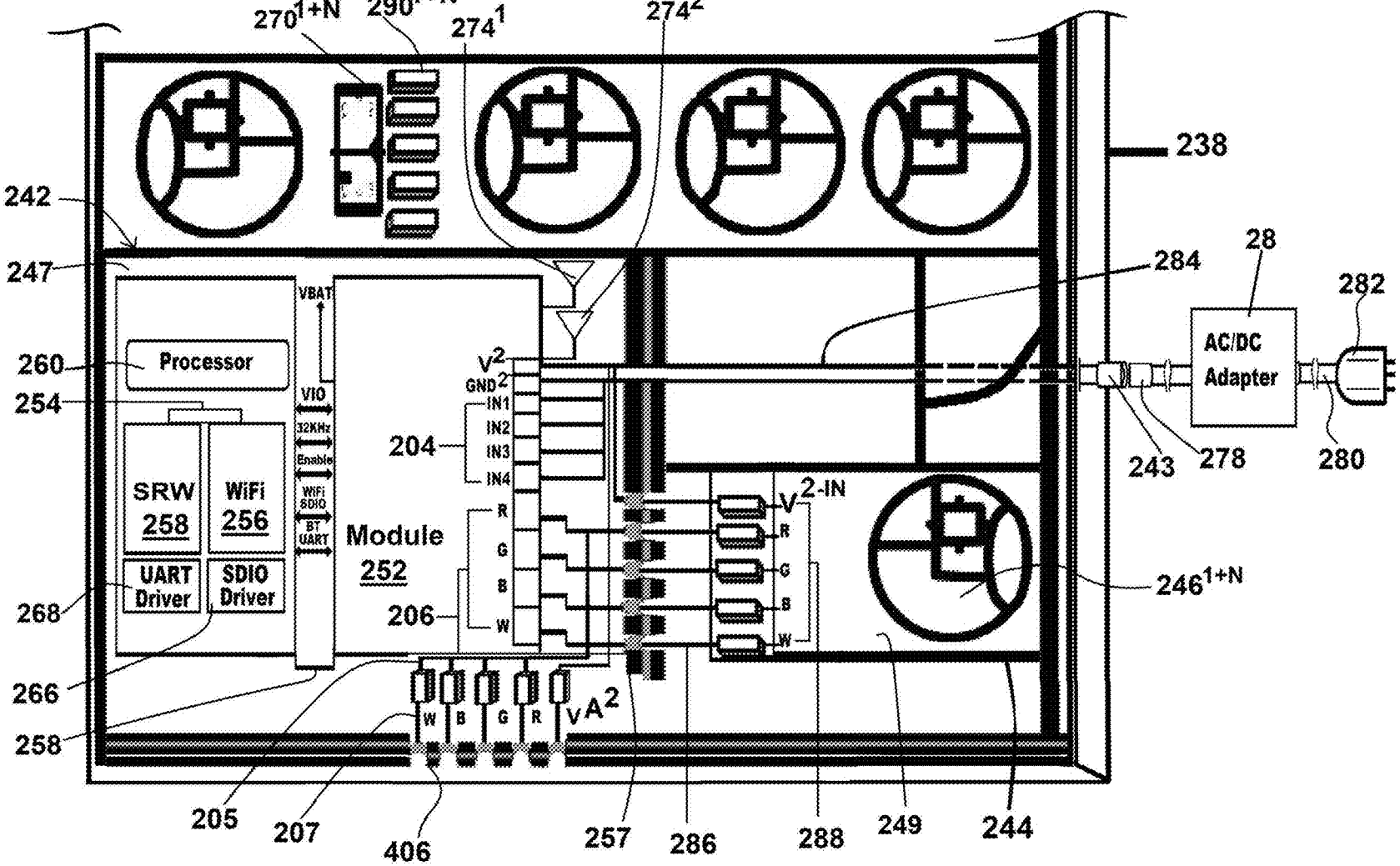
FIG. 11 illustrates a perspective front view of the second wireless fidelity/short range wireless controller of FIG. 2C showing the second AC/DC power supply adapter positioned external to the second preformed curtain, a second output controller pin light emitting diode female receptacle, and a second auxiliary output controller pin light emitting diode female receptacle, according to the embodiment of the present invention.

Viewing the second curtain lights assembly 212, from the front view, as depicted in FIGS. 1, 2A, 2C, 12A, 12C and 13A, and with reference to FIGS. 9 and 11, where FIGS. 9 and 11 show the second wireless fidelity/short range wireless controller 242, the second curtain lights assembly 212 comprises the second preformed curtain 238 formed from a second transparent non-conductive substrate 208, a second wireless fidelity/short range wireless controller 242 embedded within the second transparent non-conductive substrate 208 of the second preformed curtain 238; a second DC power input jack male plug 243, a second preformed bendable wireless fidelity/short range wireless light emitting diode light strip 244 including a second plurality of wireless fidelity/short range wireless light emitting diodes $\mathbf{246}^{1+N}$, a second AC/DC power supply adapter 28.

The second preformed bendable wireless fidelity/short range wireless light emitting diode light strip 244 includes a second primary end 249 and a second terminal end 250. The second preformed bendable wireless fidelity/short range wireless light emitting diode light strip 244 is embedded within the second transparent non-conductive substrate 208 of the second preformed curtain 238 congruent with the second wireless fidelity/short range wireless controller 242 whereby the second preformed bendable wireless fidelity/short range wireless light emitting diode light strip 244 can be readily operationally electrically connected to the second wireless fidelity/short range wireless controller 242 which is depicted more particularly in FIGS. 2A, 2C, 9, 11, and 12A. The second transparent non-conductive substrate 208 of the second preformed curtain 238 is formed from the identical transparent non-conductive substrate 208 of which the first transparent non-conductive substrate 40 of the first preformed curtain 38 is formed.

The second transparent non-conductive substrate 208 can be selected from the group of substrates comprising: transparent silicone, silicone, transparent silicone which is water resistant, heat resistant and bendable, clear, highly heat resistant bendable polyimide material, a waterproof transparent non-conductive colloid which can be a waterproof transparent polyurethane resin, polyester, polymer film, polyimide, polyimide polymer, transparent rubber, non-conductive plastic, non-conductive polyimide which is water resistant, heat resistant and bendable.

The second preformed curtain 238 formed from the second transparent non-conductive substrate 208 provides structural support as well as heat dissipation for the second plurality of wireless fidelity/short range wireless light emitting diodes $\mathbf{246}^{1+N}$ of the second preformed bendable wireless fidelity/short range wireless light emitting diode light strip 244 and the second wireless fidelity/short range wireless controller 242. The second preformed curtain 238 is not limited to any preconfigured size or dimension or curtain shape configuration whereby the second preformed curtain 238 can be customized and configured to fit a predetermined window frame dimensions.

In accordance with an embodiment of the present invention, the second preformed curtain 238 formed from the second transparent non-conductive substrate 208, additionally, can provide support for the second AC/DC power supply adapter 28 embedded within the second transparent non-conductive substrate 208 of the second preformed curtain 238. As way of example, FIG. 10B shows the first wireless fidelity/short range wireless controller 42 embedded within the first transparent non-conductive substrate 40 of the first preformed curtain 38. It can be well understood by one of ordinary skill in the art that the second wireless fidelity/short range wireless controller 242 can be embedded within the second transparent non-conductive substrate 208 of the second preformed curtain 238.

In general, the main components of the second preformed bendable wireless fidelity/short range wireless light emitting diode light strip 244, as with the first preformed bendable wireless fidelity/short range wireless light emitting diode light strip 44, are the second plurality of wireless fidelity/short range wireless light emitting diodes $\mathbf{246}^{1+N}$, the second bendable printed circuit board 294, a second plurality of copper pads $\mathbf{190}^{1+N}$, and a second plurality of resistors $\mathbf{270}^{1+N}$. The second plurality of wireless fidelity/short range wireless light emitting diodes $\mathbf{246}^{1+N}$ of the second preformed bendable wireless fidelity/short range wireless light emitting diode light strip 244 can be mounted on a second bendable printed circuit board 294 which includes a layer of copper that provides the second electrically conductive copper circuitry and the bulk of the heat dissipation. The second bendable printed circuit board 294 includes layers of copper and are exposed as a second plurality of copper pads $\mathbf{190}^{1+N}$, as shown in FIGS. 2C, 9 and 11, on the second preformed bendable wireless fidelity/short range wireless light emitting diode light strip 244.

As discussed above, regarding the first plurality of copper pads $\mathbf{90}^{1+N}$, the second plurality of copper pads $\mathbf{190}^{1+N}$ provide electrical connection points which are configured within the second electrically conductive copper circuitry of the second bendable printed circuit board 294 of the second preformed bendable wireless fidelity/short range wireless light emitting diode light strip 244 of the second preformed curtain 238. The second plurality of resistors $\mathbf{270}^{1+N}$ control the current flowing through each of the second plurality of wireless fidelity/short range wireless light emitting diodes $\mathbf{246}^{1+N}$ of the second preformed bendable wireless fidelity/short range wireless light emitting diode light strip 244. A second electrically conductive copper circuitry and a second plurality of copper pads $\mathbf{290}^{1+N}$ provide electrical connection points which are configured within the second electrically conductive copper circuitry of the second bendable printed circuit board 294 of the second preformed bendable wireless fidelity/short range wireless light emitting diode light strip 244 of the second preformed curtain 238 to provide each of the second plurality of wireless fidelity/short range wireless light emitting diodes $\mathbf{46}^{1+N}$ with a direct forward flow of a second DC output electric current from the second wireless fidelity/short range wireless controller 242 when the second AC/DC power supply adapter 28 is plugged into the power source such that the second preformed curtain 238 is illuminated. FIG. 13A depicts the second preformed curtain 238 being installed and displayed on a left side portion of the common window frame 18 concomitantly with the first preformed curtain 38 being installed on the right side portion of the common window frame 18 which provides a beautifully fully illuminated common window frame 18 and its associated window.

The second preformed bendable wireless fidelity/short range wireless light emitting diode light strip 244 comprises a bendable substrate strip comprising the second bendable printed circuit board 294. The second bendable printed circuit board 294 can comprise an electrically non-conductive material. The second bendable printed circuit board 294 can be formed from a non-conductive plastic, a non-conductive polyimide, a polyimide polymer. Polyimides provide excellent durability and heat resistance despite its flexibility. Thus, the polyimide material is critical in providing both flexibility and structural integrity for the second preformed bendable wireless fidelity/short range wireless light emitting diode light strip 244.

The second bendable printed circuit board 294 provides a flexible non-conductive substrate of which the second electrically conductive copper circuitry and the second plurality of copper pads $\mathbf{290}^{1+N}$, the second plurality of resistors $\mathbf{270}^{1+N}$, and each of the second plurality of wireless fidelity/short range wireless light emitting diodes $\mathbf{246}^{1+N}$ of the second preformed bendable wireless fidelity/short range wireless light emitting diode light strip 244 are mounted. In addition to providing the physical, structural base of the second preformed bendable wireless fidelity/short range wireless light emitting diode light strip 244, the second bendable printed circuit board 294 substrate also provides the second electrically conductive copper circuitry for the movement of the second direct forward flow of a second DC output electric current from the second wireless fidelity/short range wireless controller 242, as well as a vital path for heat dissipation.

With reference to the second preformed bendable wireless fidelity/short range wireless light emitting diode light strip 244 the term "bendable" means in the context of the present invention means is that the second preformed bendable wireless fidelity/short range wireless light emitting diode light strip 244 can be bent and folded upon itself and can conform to the surface shape within the second interior spatial area of the second preformed curtain 238 in which it is embedded. When forming a second plurality of curved end regions $\mathbf{248}^{1+N}$ the second preformed bendable wireless fidelity/short range wireless light emitting diode light strip 244 is flexible such that the second electrically conductive copper circuitry of the second bendable printed circuit board 294 can conform to the bent shape of each of the intended curved end regions $\mathbf{248}^{N}$ of the second plurality of curved end regions $\mathbf{248}^{1+N}$ such that the first electrically conductive copper circuitry is not broken and interrupted within the second bendable printed circuit board 294 of the second preformed bendable wireless fidelity/short range wireless light emitting diode light strip 244.

In the embodiment of the present invention, the second electrically conductive copper circuitry is affixed to the second bendable printed circuit board 294 by soldering means or bendable adhesive or other appropriate means. The second electrically conductive copper circuitry, the second plurality of copper pads $\mathbf{290}^{1+N}$, the second plurality of resistors $\mathbf{270}^{1+N}$, and each of the second plurality of wireless fidelity/short range wireless light emitting diodes $\mathbf{246}^{1+N}$ are protected by the second front wall 214 of the second non-conductive substrate of the second preformed curtain 238 and a second rear wall 215 of the second transparent non-conductive substrate 208 of the second preformed curtain 238, the second opaque non-conductive sheet 452 and a second transparent non-conductive film 454 of the second preformed curtain 238. In this manner the second electrically conductive copper circuitry, the second plurality of copper pads $\mathbf{290}^{1+N}$, the second plurality of resistors $\mathbf{270}^{1+N}$, and each of the second plurality of wireless fidelity/short range wireless light emitting diodes $\mathbf{246}^{1+N}$ are protected from the environment, moisture, damage, and is waterproofed. Further, the second front wall 214, the second rear wall 215, and the second opaque non-conductive sheet 452 provides the second bendable printed circuit board 294 with protection and structural integrity.

The second bendable printed circuit board 294 includes the second plurality of wireless fidelity/short range wireless light emitting diodes $\mathbf{246}^{1+N}$ of the second preformed bendable wireless fidelity/short range wireless light emitting diode light strip 244, as shown in FIGS. 2C, 9 and 11, which are operationally electrically connected to second electrically conductive copper circuitry of the second bendable printed circuit board 294. The second primary end 249 of the second preformed bendable wireless fidelity/short range wireless light emitting diode light strip 244 includes a second wire lead 286. The second wire lead 286 is accessed by way of a second output controller pin light emitting diode female receptacle 257, as shown in FIGS. 9 and 11, of the second wireless fidelity/short range wireless controller. The second terminal end 250 of the second wire lead 286 includes a second back end 292 of the second wire lead 286. The second back end 292 of the second wire lead 286 is accessed by way of the second output controller pin light emitting diode female receptacle 257 disposed on a top portion of a second opposing left side wall 218 of the second preformed curtain 238.

The second bendable printed circuit board 294 includes a second copper base pad which provides a substrate for the second electrically conductive copper circuitry including a second of two copper circuit pathways (not shown) which flow from the positive conductor to the negative conductor (not shown) that run horizontally from the second primary end 249 to the second terminal end 250 of the second preformed bendable wireless fidelity/short range wireless light emitting diode light strip 244 configured with one positive track and one negative track. When the when the second AC/DC power supply adapter 28 of the second preformed curtain 238 of the second curtain lights assembly 212 is connected to the power source, each second electrically conductive copper circuitry pathway acts as a conductor allowing electrons to flow from the second wireless fidelity/short range wireless controller 242 to the second primary end 249 and continuously to the second terminal end 250 such that each of the second plurality of wireless fidelity/short range wireless light emitting diodes $\mathbf{246}^{1+N}$ of the second preformed bendable wireless fidelity/short range light emitting diode light strip 244 receive the direct forward flow of a second DC output electric current from the second wireless fidelity/short range wireless controller 242 to illuminate each of the second plurality of wireless fidelity/short range wireless light emitting diodes $\mathbf{246}^{1+N}$ of the second preformed bendable wireless fidelity/short range wireless light emitting diode light strip 244.

The second primary end 249 of the second preformed bendable wireless fidelity/short range wireless light emitting diode light strip 244 includes the second wire lead 286. The second wire lead 286 leads to a second series of one or more light emitting diode input wire leads including a variety of color wires and electrically conductive copper contacts which are operationally electrically connected to the second bendable printed circuit board 294 of the second preformed bendable wireless fidelity/short range wireless light emitting diode light strip 244. The second wire lead 286 is operationally seamlessly connected to a second series of one or more light emitting diode input color wire leads 288 including a variety of color wires, including red, green, blue, white, as indicated by the letters R G B W, as shown in FIG. 9. In addition, a second main direct current input voltage wire, as indicated by $V^{2-IN}$, includes a variety of color wires and electrically conductive copper contacts which are operationally electrically connected to the second bendable printed circuit board 294 of the second preformed bendable wireless fidelity/short range wireless light emitting diode light strip 244. The second wire lead 286 including the variety of color wires, a second main direct current input voltage wire $V^{2-IN}$, and electrically conductive copper contacts are operationally connected to the second bendable printed circuit board 294 by way of soldering or bendable adhesive or otherwise adhering an electrically conductive copper circuitry of the second wire lead 286 and electrically conductive copper contacts to the second electrically conductive copper circuitry of the second bendable printed circuit board 294 of the second preformed bendable wireless fidelity/short range wireless light emitting diode light strip 244.

The second copper base pad can be lined with a solder mask of a layer of polymer film that protects the second electrical copper circuitry and each of the second plurality of copper pads $\mathbf{190}^{1+N}$ from unwanted connections. Flattened oval shaped areas of the copper base pad are exposed as the second plurality of copper pads $\mathbf{290}^{1+N}$. As the electric current flows from the direct forward flow of the second DC output electric current from the second wireless fidelity/short range wireless controller 242 through each of the second plurality of wireless fidelity/short range wireless light emitting diodes $\mathbf{246}^{1+N}$ of the second bendable preformed wireless fidelity/short range wireless light emitting diode light strip 244, semiconductors within each of the second plurality of wireless fidelity/short range wireless light emitting diodes $\mathbf{246}^{1+N}$ convert the energy into photons or light. Each resistor $\mathbf{270}^{N}$ of the second plurality of resistors $\mathbf{270}^{1+N}$ serves to limit the flow of electricity along the second preformed bendable wireless fidelity/short range wireless light emitting diode light strip 244 ensuring that each of the second plurality of the wireless fidelity/short range wireless light emitting diodes $\mathbf{246}^{1+N}$ receives only the optimal amount of current for illumination and longevity of illumination. Once the second AC/DC power supply adapter 28 is plugged into a power source each of the second plurality of wireless fidelity/short range wireless light emitting diodes $\mathbf{246}^{1+N}$ of the second preformed bendable wireless fidelity/short range wireless light emitting diode light strip 244 illuminates light of the preconfigured color based on the forward voltage received from the second wireless fidelity/short range wireless controller 242 by way of a second series of the second one or more light emitting diode output color wirings 206.

The forward voltage for each of the second series of the second series of the second one or more light emitting diode output color wirings 206 can be as follows: the first main direct current voltage wire $V^1$ can be 24 Volts, ultraviolet color has a forward Voltage of 3.1-4.4 Voltage; violet colors has a forward Voltage of 2.8-4.0 Voltage; blue color has a forward Voltage of 2.5-3.7 Voltage; green color has a forward Voltage of 1.9-4.0 Voltage; yellow color has a forward Voltage of 2.1-2.2 forward Voltage; orange/amber has a forward Voltage of 2.0-2.1 Voltage; red color has a forward Voltage of 1.6-2.0 Voltage; and infrared has a forward Voltage of greater than 1.9 Voltage.

Each of the second plurality of wireless fidelity/short range wireless light emitting diodes $\mathbf{246}^{1+N}$ can include high brightness plastic leaded chip carrier—2 surface mounted diode, or high brightness plastic leaded chip carrier—6 surface mounted diodes. Such wireless fidelity/short range wireless light emitting diodes have 120 degrees light viewing angle for even illumination. The plastic leaded chip carrier—2 surface mounted diode, or high brightness. Plastic leaded chip carrier—6 surface mounted diodes are commercially available in a variety of colors including without limitation, white, neutral white, cool white, warm white, red, yellow, blue and green. The second preformed bendable wireless fidelity/short range wireless light emitting diode light strips 244 can be constructed to comprise single-color or polychromatic wireless fidelity/short range wireless light emitting diode configurations.

In an exemplary embodiment, the second preformed bendable wireless fidelity/short range wireless light emitting diode light strip 244 can include surface mounted diode type wireless fidelity/short range wireless light emitting diodes which are created by soldering surface mounted device light emitting diodes onto the second bendable printed circuit board 294 which generate lighting or illumination when connected to a power source.

In another exemplary embodiment, each of the second plurality of wireless fidelity/short range wireless light emitting diodes $\mathbf{246}^{1+N}$ of the second preformed bendable wireless fidelity/short range wireless light emitting diode light strip 244 can include a chip on board type of the second plurality of wireless fidelity/short range light emitting diodes $\mathbf{246}^{1+N}$. The chip on board includes a light emitting dye which is configured directly on the second bendable printed circuit board 294 of the second preformed bendable wireless fidelity/short range wireless light emitting diode light strip 244. The chip on board light strip may, also, be called a flip-chip. A chip on board type second preformed bendable wireless fidelity/short range wireless light emitting diode light strip 44 includes constant current drivers which are a method of driving each of the second plurality of wireless fidelity/short range wireless light emitting diode chips $\mathbf{246}^{1+N}$. The chip on board type second plurality of wireless fidelity/short range wireless light emitting diodes $\mathbf{246}^{1+N}$ operate at a single current and adjust their output voltage correspondingly, ensuring that the forward current remains stable. Therefore, when constant current input is used, a current limiting resistor is not necessary.

FIG. 9 illustrates a perspective front view of a second wireless fidelity/short range wireless controller 242 showing a second wireless fidelity/short range wireless combination chip 258 of the second curtain lights assembly 212. FIG. 11 illustrates a perspective front view of the second wireless fidelity/short range wireless controller 242 showing the second AC/DC power supply adapter 28 positioned external to the second preformed curtain 238, a second output controller pin light emitting diode female receptacle 257, and a second auxiliary output controller pin light emitting diode female receptacle 406. FIG. 9 with reference to FIGS. 2A, 2C, 9 and 11, shows an exemplary embodiment in which the second wireless fidelity/short range wireless controller 242 of the second curtain lights assembly 212 includes a second controller board 247, a second DC power input jack male plug 243, a second output controller pin light emitting diode female receptacle 257, the second wireless fidelity/short range wireless combination chip 258 of the second wireless fidelity/short range wireless controller 242. The second auxiliary output controller pin light emitting diode female receptacle 406 includes at least two auxiliary portals. In the exemplary embodiment, the second auxiliary output controller pin light emitting diode female receptacle 406 includes five portals.

The second wireless fidelity/short range wireless combination chip 258 includes a second wireless fidelity/short range wireless module chip 252 and a second wireless fidelity chip/short range wireless chip 254 having a second processor chip 260, a second wireless fidelity chip 256 being in coexistence with a second short range wireless chip 259, the second wireless fidelity chip 256 being installed with a second secure digital input output driver (SDIO) 266 and the second short range wireless chip 259 being installed with a second short range wireless universal asynchronous receiver transmitter (UART) driver 268, a second wireless fidelity driver 262, a second wireless fidelity protected access driver (WPA) 264, a second short range wireless stack and profiles (not shown) 267, supported by a second virtual input output core (VIO) 272, a second pair of combination wireless fidelity/short range wireless antennae, a second controller first combination wireless fidelity/short range wireless antenna $\mathbf{274}^1$ and a second controller second combination wireless fidelity/short range wireless antenna $\mathbf{274}^2$. Each of the first controller first combination wireless fidelity/short range wireless antenna $\mathbf{274}^1$ and the second controller second combination wireless fidelity/short range wireless antenna $\mathbf{274}^2$ provides a coexistence of two single combination antennae wherein each of the two single combination antennae includes a first wireless fidelity antenna and a short range wireless antenna in a single wireless fidelity/short range wireless combination antenna. The second controller first combination wireless fidelity/short range wireless antenna $\mathbf{274}^1$ and the second controller combination second wireless fidelity/short range wireless antenna $\mathbf{274}^2$ can be a wireless 2.4/5-5.8 GHz antenna provide a means for mitigating the effects of electromagnetic signal interference.

Since the wireless fidelity and short range wireless networks, and ZigBee use the 2.4 GHz band, the coexistence interference is overcome by use of the second controller first combination wireless fidelity/short range wireless antenna $\mathbf{274}^1$ and the second controller second combination wireless fidelity/short range wireless single antenna $\mathbf{274}^2$ operationally electrically connected to the second wireless fidelity/short range wireless module chip 252.

The second processor chip 260 is capable of running open source operating systems. The second wireless fidelity/short range wireless controller 242 can, also, be connected to an external backup voltage supplied by a battery rechargeable power station configured with at least 12V DC output current, or by another power source. This mode is called VBAT, as indicated by VBAT in FIGS. 9 and 11. This allows to retain the content of the backup registers and real time clock (RTC) information, while suspending the non-active part of the device without any additional component needed.

The second wireless fidelity/short range wireless controller 242 and the second processor 260 support at 2.4 GHz for high throughput, a 2.4 GHz Memory Reference Code (MRC) support for extended range and 5-5.8 GHz diversity capable, a secure digital input output driver (SDIO) host interface support, as shown in FIG. 8, wireless fidelity direct concurrent operation (multichannel, multirole), a short range wireless connection, and short range wireless low energy secure connection, a host controller interface (HCI) transport for short for short range wireless connection over universal asynchronous receiver transmitter (UART), as shown in FIG. 8, and dedicated audio processor support.

The key benefits of the second wireless fidelity/short range wireless combination chip 258 include that the second wireless fidelity/short range wireless controller 242 reduces design overhead, provides differentiated use cases by configuring wireless fidelity and short range wireless simultaneously to connect and control the movement of the first flow of DC output electric current to each of the second plurality of wireless fidelity/short range wireless light emitting diodes $\mathbf{246}^{1+N}$ of the second preformed bendable wireless fidelity/short range wireless light emitting diode light strip 244. In addition, the second wireless fidelity/short range wireless controller 242 having the second controller first combination wireless fidelity/short range wireless antenna $\mathbf{274}^{1}$ and the second controller second combination wireless fidelity/short range wireless antenna $\mathbf{274}^{2}$ coexistence can directly connect with the second preformed bendable wireless fidelity/short range wireless light emitting diode light strip 244 and to other wireless fidelity and short range wireless devices. Further, the second wireless fidelity/short range wireless controller 242 can connect with other wireless fidelity devices on different radio frequency channel, wireless fidelity networks, best-in-class wireless fidelity, with high performance audio and video streaming reference applications with a range increased by 1.4 times greater than one conventional antenna. In addition, the second wireless fidelity/short range wireless controller 242 provision methods for one or more in-home curtain lights devices connectivity to the user's personal wireless fidelity network or the user's personal short range wireless network.

The second wireless fidelity/short range wireless combination chip 258, also, can work with high-level operating systems, for example, Linux® and Android®. The second wireless fidelity/short range wireless combination chip 258 can be provided by a Texas Instrument—Model 1835MOD chip.

The second wireless fidelity/short range wireless combination chip 258 of the second wireless fidelity/short range wireless controller 242 is the second wireless fidelity/short range wireless module chip 252 which operates on a 2.4 GHz bandwidth, a wireless fidelity network and short range wireless network coexistence, a wireless local-area network, and can integrate a radio frequency network in the user's personal area network, residential network or business network.

In this manner, the second wireless fidelity/short range wireless controller 242 enables a co-existence of wireless fidelity and short range wireless implementations in the user's personal area network or a commercial area network or in combination of both for the use of the first curtain lights assembly 12 and, contemporaneously, with the second curtain lights assembly 212, in the user's home, office or business.

FIGS. 2A, 2C, 9 and 11, shows the second AC/DC power supply adapter 28. FIG. 9 illustrates a perspective front view of the second wireless fidelity/short range wireless controller 242 showing a second wireless fidelity/short range wireless combination chip 258 of the second curtain lights assembly 212. FIG. 11 illustrates a perspective front view of the second wireless fidelity/short range wireless controller 242 showing the second AC/DC power supply adapter 242 positioned external to the second preformed curtain 238, the second output controller pin light emitting diode female receptacle 257, and the second auxiliary output controller pin light emitting diode female receptacle 406.

The second AC/DC power supply adapter 28 includes a second DC power output jack female connector 278 on a first side of the second AC/DC power supply adapter 28 and an opposing second side of the second AC/DC power supply adapter 28 having a second power cable 280 with a second power plug male connector 282 configured to releasably operationally connect to a female socket of a power source (not shown). The second DC power output jack female connector 278 of the second AC/DC power supply adapter 28 is releasably operationally connected to the second DC power input jack male plug 243 of the second wireless fidelity/short range wireless controller 242 wherein the second DC power input jack male plug 243 incudes a second DC power input jack male plug member 284 through which a second DC output electric current actuated by the second AC/DC power supply adapter 28 is routed between the second AC/DC power supply adapter 28 and the second wireless fidelity/short range wireless controller 242 and a second main direct current input voltage wire $V^2$. As discussed above, with regards to the first AC/DC power supply adapter 26 it should be appreciated, however, that these embodiments may be employed together with the second AC/DC power supply adapter 28 embedded within the second transparent non-conductive substrate 208 of the second preformed curtain 238 congruent to the second wireless fidelity/short range wireless controller 242.

The power source for the second curtain lights assembly 212, as discussed above, in regards to the first curtain lights assembly 12, is the normal household electrical supply. As well known by a person having ordinary skill in the art, most residences can receive 120 volts from their wall outlet. However, electrical power can be typically delivered into a residential household at a nominal voltage of 240 volts. When the user plugs the power cable into the female socket of an outlet in a residential household the outlets provide alternating current which has a frequency of 60 Hz. In addition, this provides the necessity of including the second AC/DC power supply adapter 28 to provide a second flow of direct DC output electric current at a second input direct current voltage wire $V^{2-IN}$ to the second wireless fidelity/short range wireless controller 242 and, thereby, to each of the second plurality of wireless fidelity/short range wireless light emitting diodes $\mathbf{246}^{1+N}$ of the second preformed bendable wireless fidelity/short range wireless light emitting diode light strip 244 of the second curtain lights assembly 212.

The power source can, also, be a rechargeable battery rechargeable power station configured with at least 12V DC output current or configured with at least 12V-24V DC output current. The rechargeable battery can be embedded within the second interior spatial area of the second transparent non-conductive substrate 208 of the second preformed curtain 238.

FIGS. 2A, 2C, 9 and 11 shows the second wireless fidelity/short range wireless controller 242 is embedded within the second transparent conductive substrate 208 of the second preformed curtain 238 positioned proximate to the second primary end 249 of the second preformed bendable wireless fidelity/short range wireless light emitting diode light strip 244. As shown in more particularity with reference to FIGS. 9 and 11, the second primary end 249 of the second preformed bendable wireless fidelity/short range wireless light emitting diode light strip 244 includes the second wire lead 286. The second wire lead 286 includes the second series of the one or more light emitting diode input color wire leads 288 operationally electrically connected to the second plurality of copper pads $\mathbf{290}^{1+N}$ configured within the second electrically conductive copper circuitry of the second bendable printed circuit board 294 of the second preformed bendable wireless fidelity/short range wireless light emitting diode light strip 244 of the second preformed curtain 238.

As shown in FIG. 2C the second terminal end 250 of the second preformed bendable wireless fidelity/short range wireless light emitting diode light strip 244 includes the second back end 292 of the second wire lead 286. The second back end 292 of the second wire lead 286 includes the back end of each of the second series of one or more light emitting diode input color wire leads 288 of the second wire lead 286.

FIGS. 2A, 2C, 12A and 16, show the second wire lead 286 is embedded within the second transparent non-conductive substrate 208 of the second preformed curtain 238 having the second series of the one or more light emitting diode input color wire leads 288 congruent with the second wireless fidelity/short range wireless controller 242. The second wireless fidelity/short range wireless controller 242 is configured having the second main direct current voltage wire $V^2$, a second ground $GND^2$, a second one or more direct current input wirings 204, and the second series of the second one or more light emitting diode output color wirings 206 wired within the second wireless fidelity/short range wireless module chip 252 of the second wireless fidelity/short range wireless controller 242, wherein each of the second series of the second one or more light emitting diode output color wirings 206 includes a second predetermined forward voltage. The second predetermined forward voltage of the second series of the one or more light emitting diode output color wirings 206 can include a forward voltage in the range of 1.9 forward voltage-4.4 forward voltage.

The predetermined forward voltage for the first series of one or more light emitting diode output color wirings 106 and the second series of the second one or more light emitting diode output color wirings 206 can be as follows: ultraviolet color has a forward voltage of 3.1-4.4 Voltage; violet colors has a forward voltage of 2.8-4.0 Voltage; blue color has a forward voltage of 2.5-3.7 Voltage; green color has a forward voltage of 1.9-4.0 Voltage; yellow color has a forward voltage of 2.1-2.2 forward voltage; orange/amber has a forward voltage of 2.0-2.1 Voltage; red color has a forward voltage of 1.6-2.0 Voltage; and infrared has a forward voltage of greater than 1.9 Voltage.

With reference to FIGS. 8 and 10A-10B, each of the second main direct current voltage wire $V^2$, and the second series of the second one or more light emitting diode output color wirings 206 are electrically conductive components being copper wires leading into the second wire lead 286 of the second bendable printed circuit board 294 of the second preformed wireless fidelity/short range wireless light emitting diode light strip 244. More particularly, the second main direct current voltage wire $V^2$, and each of the second series of one or more light emitting diode output color wirings 206 are each operationally electrically connected to each of the corresponding second input direct current voltage wire $V^{2-IN}$ and each of the corresponding second series of the one or more light emitting diode input color wire leads 288 of the second wire lead 286 of the second preformed bendable wireless fidelity/short range wireless light emitting diode light strip 244 by way of soldering or flexible adhesive, or otherwise adhering means. Each of the second series of the one or more light emitting diode input color wire leads 288 includes a forward voltage corresponding to the second predetermined forward voltage of each of the second series of the second one or more light emitting diode output color wirings 206. The second series of the one or more light emitting diode input color wire leads 288 of the second preformed bendable wireless fidelity/short range wireless light emitting diode light strip 244 are routed through the second output controller pin light emitting diode female receptacle 257. Each of five portals of the second output controller pin light emitting diode female receptacle 257 includes electrically conductive copper contacts and provides a portal for the second main direct current input voltage wire $V^2$, and each of the second red R, green G, blue B, white W, wires of the second series of the second one or more light emitting diode output color wirings 206 which come in contact with each of the corresponding second series of the one or more light emitting diode input color wire leads 288 of the second wire lead 286. The electrically conductive copper contacts provide for an uninterrupted flow of the forward voltage from each of the second series of the one or more light emitting diode input color wire leads 288 and each of the second series of the second one or more light emitting diode output color wirings 206.

Each of the of the second series of the one or more light emitting diode input color wire leads 288 and the second main direct current voltage wire $V^2$ of the second wireless fidelity/short range wireless controller 242 are connected to each of the second series of the one or more light emitting diode input color wire leads 288 of the second wire lead 286 by way of soldering or flexible adhesive or otherwise adhering means, thereby providing for the continuous movement of the flow of the second direct forward flow of the second DC output electric current to the second electrically conductive copper circuitry of the second bendable printed circuit board 294 and thereby to each of the second plurality of wireless fidelity/short range wireless light emitting diodes $\mathbf{246}^{1+N}$ of the second preformed bendable wireless fidelity/short range wireless light emitting diode light strip 244 so that each of the second plurality of wireless fidelity/short range wireless light emitting diodes $\mathbf{246}^{1+N}$ of the second preformed bendable wireless fidelity/short range wireless light emitting diode light strip 244 can be illuminated when the second AC/DC power supply adapter 28 is releasably operationally connected to the power source.

With reference to FIGS. 9 and 11, each of the second series of the one or more light emitting diode output color wirings 206 are operationally electrically connected to each of the second series of the one or more light emitting diode input color wire leads 288 of the second wire lead 286 by electrically conductive copper wirings wherein each of the second series of the one or more light emitting diode input color wire leads 288 includes a forward voltage corresponding to the second predetermined forward voltage of each of the second series of the one or more light emitting diode output color wirings 206. The second series of the one or more light emitting diode input color wire leads 288 are routed through the second output controller pin light emitting diode female receptacle 257 wherein each of the second series one or more light emitting diode input color wire leads 288 are fluidly electrically aligned with each of the second series of the one or more light emitting diode output color wirings 206 having a corresponding forward output voltage for providing a second direct forward flow of the second DC output electric current to each of the second plurality of wireless fidelity/short range wireless light emitting diodes $\mathbf{246}^{1+N}$ of the second preformed bendable wireless fidelity/short range wireless light emitting diode light strip 244. In this manner, when the second AC/DC power supply adapter 28 is releasably operationally electrically connected to the power source (not shown) thereby, generating a second visual image of a second illuminated curtain draping a left side frame 210 of the common window frame 18 wherein the second preformed curtain 238 is mounted thereon the left side frame 210 of the common window frame 18. In this manner, together with the first visual image of the first illuminated curtain draping the right side frame 110 of the common window frame 18 and the second visual image of the second illuminated curtain draping the left side frame 210 of the common window frame 18 a fully illuminated draped common window frame 18 is provided, as shown in FIG. 13A.

In this manner, and because the first preformed curtain 38 includes the first wireless fidelity/short range wireless controller 42, and the second preformed curtain 238 includes the second wireless fidelity/short range wireless controller 242, each of the first plurality of wireless fidelity/short range wireless light emitting diodes $\mathbf{46}^{1+N}$ of the first preformed bendable wireless fidelity/short range wireless light emitting diode light strip 44 of the first preformed curtain 38 and the second plurality of wireless fidelity/short range wireless light emitting diodes $\mathbf{246}^{1+N}$ of the second preformed bendable wireless fidelity/short range wireless light emitting diode light strip 244 of the second preformed curtain 238 can emit the same color or can emit a different color from each other or a variety of different colors as regulated by the flow of DC electric current by the first wireless/short range wireless controller 38 and the second wireless fidelity/short range controller 242, respectively. Similarly, the first preformed bendable wireless fidelity/short range wireless light emitting diode light strips 44 can be configured to comprise single-color or polychromatic light emitting diode configurations synchronously with the second preformed bendable wireless fidelity/short range wireless light emitting diode light strips 244, or any one of the one or more accessory widening curtain lights extension panels $\mathbf{400}^{1+N}$ or the one or more accessory lengthening curtain lights extension panels $\mathbf{402}^{1+N}$.

The power source can be the normal household electrical supply. As well known by a person having ordinary skill in the art, most residences can receive 120 volts from their wall outlet. However, electrical power can be typically delivered into a residential household at a nominal voltage of 240 volts. When the user plugs the power cable into the female socket of an outlet in a residential household the outlets provide alternating current which has a frequency of 60 Hz. The AC/DC power supply adapter provides a means to transform the alternating current into a stable direct current voltage which can then be utilized by the second wireless fidelity/short range wireless controller 242.

The power source can, also, be a rechargeable battery configured with at least 12V-24V DC output current. The rechargeable battery can be embedded within the first interior spatial area of the first transparent non-conductive substrate of the second preformed curtain 238.

As shown in FIGS. 2A, 2C, and 12A, the second preformed curtain 238 includes a second thickness, a second coronal plane, a second transverse plane, a second median plane, a second interior spatial area that are equal in dimensions and perspective to the first preformed curtain 38. The second preformed curtain 238 is enclosed by the second front wall 214 having a second outer front face, the second rear wall 215 having a second outer rear face, a second right side wall 216 having a second outer right side face, the second opposing left side wall 218 having a second outer left side face, a second top wall 219 having a second outer top face, and a second bottom wall 220 having a second outer bottom face. The second rear wall 215 includes a second rear wall thickness greater than a second front wall thickness of the second front wall 214. The second rear wall thickness of the second rear wall 215 of the second preformed curtain 238 prevents the emission of heat into a room associated with the common window frame 18 to which the second plurality of wireless fidelity/short range wireless light emitting diodes $\mathbf{246}^{1+N}$ of the second preformed bendable wireless fidelity/short range wireless light emitting diode light strip 244 is mounted and extra support and protection to the second wireless fidelity/short range wireless controller 242.

The second preformed curtain 238 is framed by a second top edge 222 horizontally orientated, a second opposing bottom edge 224 horizontally orientated parallel to the second top edge 222, the second top edge 222 having a second top edge width that is greater than a second opposing bottom edge width of the second opposing bottom edge 224, a left side straight edge 226 vertically orientated having a left side edge length extending in a second straight line from a peripheral top left side edge of the second top edge 222 to a peripheral bottom side edge of the second opposing bottom edge 224, a right side curvilinear edge 228 having a right side curvilinear length extending in a right curvilinear line from a peripheral top right side edge of the second top edge 222 of the second preformed curtain 238 to a peripheral bottom right side edge of the second opposing bottom edge 224 of the second preformed curtain 238.

As shown in FIGS. 2A and 2C, the second top edge 222, the second opposing bottom edge 224, and the left side straight edge 226 of the second preformed curtain 238 are each formed having a second core layer 230 wherein each of the second core layer 230 includes a second magnetized strip 232, wherein the second top edge 222 includes a second magnetized strip polarity-A providing a second magnetized polarity-A top edge 234, the left side straight edge 226 includes a left side straight edge magnetized strip polarity-B providing a magnetized polarity-B left side straight edge 236, and the second opposing bottom edge 224 includes a second magnetized strip polarity-B providing a second magnetized polarity-B opposing bottom edge 237. In this manner, by way of one or more cut strips of the roll of magnetic polarity-A tape $\mathbf{14}^{1+N}$ and one or more cut strips of the roll of magnetic polarity-B tape 16, respectively, the second preformed curtain 238 can be releasably magnetically mounted onto a right region of the common window frame 18 wherein corresponding cut strips of the roll of magnetic polarity-A tape $\mathbf{14}^{1+N}$ and corresponding cut strips of the roll of magnetic polarity-B tape $\mathbf{16}^{1+N}$ are releasably adhered thereon the common window frame 18, as discussed in more detail below.

The second magnetized strip 232 for each of the second magnetized polarity-A top edge 234, the magnetized polarity-B left side straight edge 236, the second magnetized polarity-B opposing bottom edge 237 can be selected from any one of metals selected from the group comprising iron, nickel, cobalt.

With reference to FIGS. 2A, 2C, 9 and 12A the second opposing left side wall 218 of the second preformed curtain 238 includes a first left aperture 240 and a second left aperture 241. The first left aperture 240 is round shaped and recessed therethrough the second opposing left side wall 218 of the second preformed curtain 238. The first left aperture 240 is configured to allow the second DC power input jack male plug 243 of the second wireless fidelity/short range wireless controller 242 to be accessed therethrough the first left aperture 240 whereby the second DC power output jack female connector 278 of the second AC/DC power supply adapter 28 can be releasably operationally connected to the second DC power input jack male plug 243 whereby the second direct forward flow of the first DC output electric current can be directed to the second wireless fidelity/short range wireless controller 242, and, subsequently, to provide the second direct forward flow of the second DC output electric current to each of the second plurality of wireless fidelity/short range wireless light emitting diodes $\mathbf{246}^{1+N}$ of the second preformed bendable wireless fidelity/short range wireless light emitting diode light strip 244.

As shown in FIGS. 2A, 2C and 12A, the second left aperture 241 is rectangular in shape being vertically orientated and recessed into a top left side margin of the of the second opposing left side wall 218 of the second transparent non-conductive substrate 208 of the second preformed curtain 238 wherein a second output pin light emitting diode female receptacle 245 is contained therein the second left aperture 241. The second output pin light emitting diode female receptacle includes at least two portals. In the exemplary embodiment the second output pin light emitting diode female receptacle 245 includes five portals.

Figure 16:
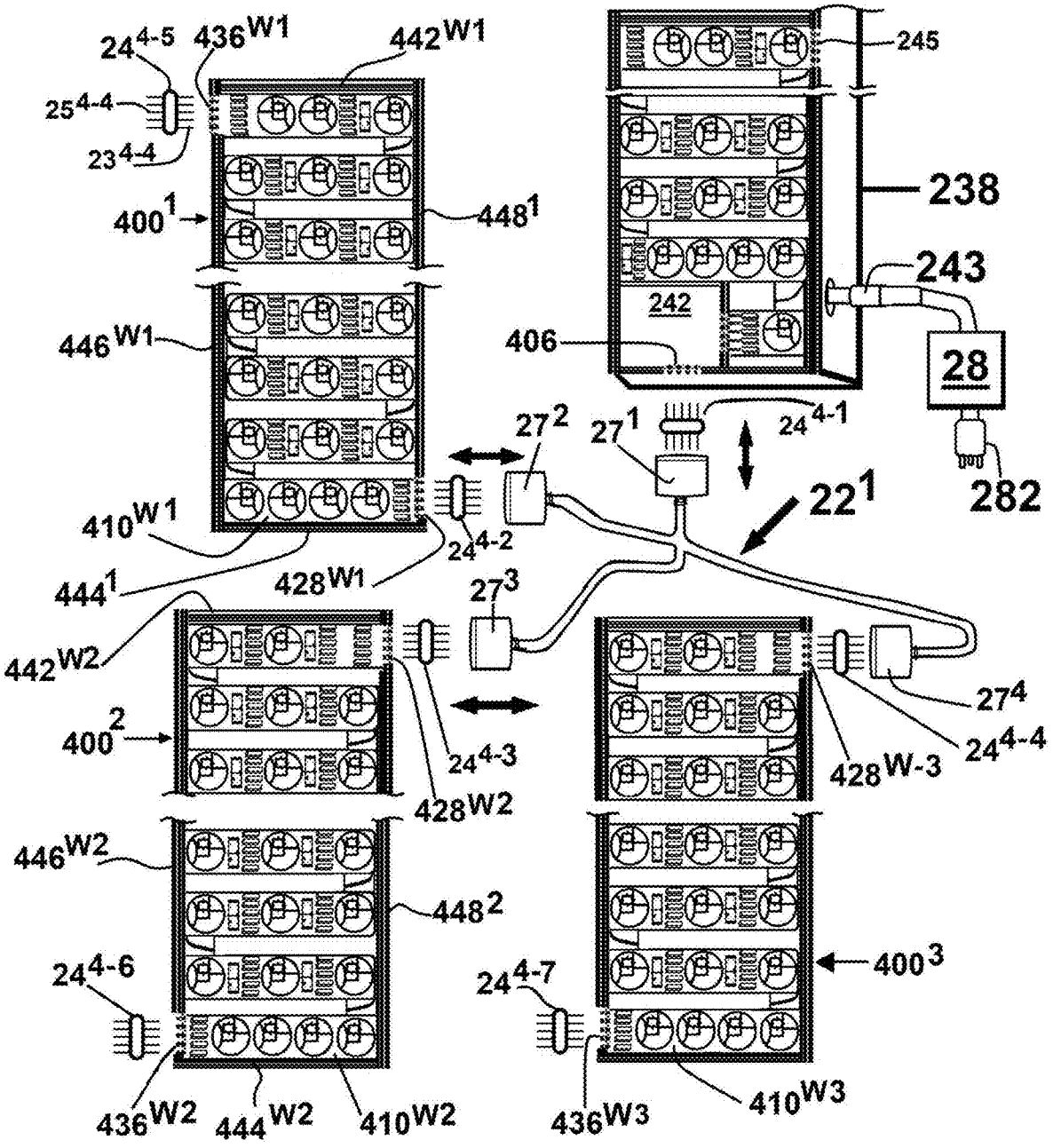
FIG. 16 illustrates a perspective view of a portion of the second preformed curtain of the second curtain lights assembly of FIG. 2B in a working association with three accessory widening curtain lights extension panels, according to the embodiment of the present invention.

The second output pin light emitting diode female receptacle 245 is operationally electrically wired to the second back end 292 of the second wire lead 286 of the second preformed bendable wireless fidelity/short range wireless light emitting diode light strip 244 such that the second preformed bendable wireless fidelity/short range light emitting diode light strip 244 of the second preformed curtain 238, or the second accessory widening curtain lights extension panel $\mathbf{400}^{2}$ of one or more accessory widening curtain lights extension panels $\mathbf{400}^{1+N}$ can be releasably operationally electrically connected thereto the second output pin light emitting diode female receptacle 245, as shown in FIGS. 2C, 12A, 16, by way of a pin light emitting diode female to female butterfly connector cable of the one or more pin light emitting diode female to female butterfly connector cables $\mathbf{22}^{1+n}$, and any one of the one or more mateable pin light emitting diode male connectors $\mathbf{24}^{1+n}$.

As shown in FIGS. 2A-2B, 12A-12B, the second left aperture 241 is rectangular in shape being vertically orientated and recessed into a top left side margin of the of the second opposing left side wall 218 of the second preformed curtain 238. Here, the second output pin light emitting diode female receptacle 245 is recessed within the second left aperture 241. The second output pin light emitting diode female receptacle 245 is operationally electrically wired to the second back end 292 of the second wire lead 286 of the second preformed bendable wireless fidelity/short range wireless light emitting diode light strip 244. The second output pin light emitting diode female receptacle 245 includes electrically conductive copper wires including the second electrically conductive copper contacts.

The second output pin light emitting diode female receptacle 245 is configured integrally formed within a top portion of the second opposing left side wall 218 of the second preformed curtain 238. The electrically conductive copper wires of the of the second back end 292 of the second wire lead 286 of the second bendable printed circuit board 294 of the second preformed bendable light emitting diode light strip 244, and the electrically conductive copper contacts are operationally electrically connected to the second output pin light emitting diode female receptacle 245 by way of soldering, or flexible adhesive, or otherwise adhering. In this manner, the second output pin light emitting diode female receptacle 245 provides an electrically conductive pathway of continuity for the uninterrupted and continuous movement of the second direct forward flow of the second DC output electric current coming from the second wireless fidelity/short range wireless controller 242. The second DC output electric current can continue to provide its second output electric current to the first electrically conductive copper circuitry of the first bendable printed circuit board 162 of the first preformed curtain 38 of the first curtain lights assembly, or an accessory bendable printed circuit board 440 of any one of the one or more accessory widening curtain lights extension panels $\mathbf{400}^{1+N}$ during use of the of the second preformed bendable wireless fidelity/short range wireless light emitting diode light strip 244 of the second curtain lights assembly 212 of the curtain lights device 20. A silicone or rubber hinged plug (not shown) can be configured to be slidably inserted into the second output pin light emitting diode female receptacle 245 to encase the second output pin light emitting diode female receptacle 245 when not in use such that when inserted the hinged plug protects the second output pin light emitting diode female receptacle 245 from moisture and potential damage.

The second output pin light emitting diode female receptacle 245 is configured to be complimentary with a mateable pin light emitting diode male connector $\mathbf{24}^{N}$ of the one or more mateable pin light emitting diode male connectors $\mathbf{24}^{1+N}$.

The second preformed bendable wireless fidelity/short range wireless light emitting diode light strip 244 is embedded within the second internal spatial area of the second transparent non-conductive substrate 208 of the second preformed curtain 238 proximate to an interior wall of the second outer front face of the second preformed curtain 238, the second preformed bendable wireless fidelity/short range wireless light emitting diode light strip 244 having the second primary end 249 and the second terminal end 250 embedded congruent with the second preformed bendable wireless fidelity/short range wireless light emitting diode light strip 244.

The second primary end 249 of the second preformed bendable wireless fidelity/short range wireless light emitting diode light strip 244 is disposed congruent to the second wireless fidelity/short range wireless controller 242. The second preformed bendable wireless fidelity/short range wireless light emitting diode light strip 244 extends within the second interior spatial area of the second transparent non-conductive substrate 208 of the second preformed curtain 238 from the second primary end 249 to the second terminal end 250 of the second preformed bendable wireless fidelity/short range wireless light emitting diode light strip 244 wherein the second terminal end 250 is disposed at a right side top marginal region of the second interior spatial area of the second transparent non-conductive substrate 208 of the second preformed curtain 238.

The second preformed bendable wireless fidelity/short range wireless light emitting diode light strip 244 is arranged such that the second preformed bendable wireless fidelity/short range wireless light emitting diode light strip 244 forms a first number of symmetrically aligned rows spaced laterally from the left side straight edge 226 to the right side curvilinear edge 228 of the second preformed curtain 238 spanning a full length of the second spatial area of the second transparent non-conductive substrate 208 of the second preformed curtain 238. The second preformed bendable wireless fidelity/short range wireless light emitting diode light strip 244 includes symmetrically spaced regions which bend in a vertical downward orientation forming the second plurality of curved end regions $\mathbf{248}^{1+N}$ seamlessly and fluidly unifying each of the second number of symmetrically aligned rows causing the second plurality of wireless fidelity/short range wireless light emitting diodes $\mathbf{246}^{1+N}$ of the second preformed bendable wireless fidelity/short range wireless light emitting diode light strip 244 being densely spanned within the second interior spatial area of the second transparent non-conductive substrate 208 of the second preformed curtain 238. The second plurality of curved end regions $\mathbf{248}^{1+N}$ at each end of the second number of symmetrically spaced regions of each symmetrically aligned rows enables for an uninterrupted and continuous movement of the second direct forward flow of the second DC output electric current each to each of the second plurality of wireless fidelity/short range wireless light emitting diodes $\mathbf{246}^{1+N}$ in each of the second number of symmetrically aligned rows of the second preformed bendable wireless fidelity/short range wireless light emitting diode light strip 244 thereby enabling the illumination of each of the second plurality of wireless fidelity/short range wireless light emitting diodes $\mathbf{246}^{1+N}$ of the second wireless fidelity/short range wireless light emitting diode light strip 244. The second direct (DC) output electric current can be a 24 Volt direct current (DC).

Referring back to FIGS. 5A-5B and 13A and 13B, the rearview of the first preformed curtain 38 and the second preformed curtain 238 is shown, as discussed above. Similarly, FIG. 5A shows the second preformed curtain 238 includes the second rear wall 215 and a second opaque non-conductive sheet 452 disposed overthe second rear wall 215 followed by another layer including the second transparent non-conductive film 454 as indicated by pulling back the second transparent non-conductive film 454 and pulling back the second opaque non-conductive sheet 452 of the second rear wall 215 of the second preformed curtain 238. The second opaque non-conductive sheet 452 is configured to prevent the second interior spatial area of the second preformed curtain 238, the second preformed bendable wireless fidelity/short range wireless light emitting diode light strip 244, and the second wireless fidelity/short range wireless controller 242 being displayed to the viewer. The second transparent non-conductive film 454 is configured to allow the user to view the second quick reference code $\mathbf{160}^2$ that is fixed on the second opaque non-conductive sheet 452. The second quick reference code $\mathbf{160}^2$ can be fixed on the second opaque non-conductive sheet 452 by a molding technique.

Referring still to FIGS. 5A and 13A, the second preformed curtain 238 of the second curtain lights assembly 212 includes the second quick reference code $\mathbf{160}^2$ which is molded, as discussed in more detail below, on an exterior facing surface of the second opaque non-conductive sheet 452 of the second rear wall 215 of the second transparent non-conductive substrate 208 of the second preformed curtain 238. The second quick reference code $\mathbf{160}^2$ is molded on the exterior facing surface of the second opaque non-conductive sheet 452 such that the second quick reference code $\mathbf{160}^2$ is waterproofed by the second transparent non-conductive film 454 and remains clearly visible for scanning with the user's smart device and easily recognizable by the user. The second quick reference code $\mathbf{160}^2$ includes a center portion where a second printed image depicting a second wireless fidelity symbol $\mathbf{152}^2$ combined with the second printed image depicting a second short range wireless symbol $\mathbf{154}^2$ is displayed. The first quick reference code $\mathbf{160}^1$ and the second quick reference code $\mathbf{160}^2$ are each customized to include a first image and a second image centered in the first white background of the first square grid and centered in the second white background of the second white square grid, respectively, wherein the first image is a wireless fidelity symbol $\mathbf{152}^1$ as shown on the first opaque non-conductive sheet 450 of the first rear wall 114 of the first preformed curtain 38, and a second wireless fidelity symbol $\mathbf{152}^2$ as shown on the second opaque non-conductive sheet 452 of the second rear wall 215 of the second preformed curtain 238, as shown in FIGS. 5A and 5B, presented in a first color and the second image is a short range wireless symbol $\mathbf{154}^1$, $\mathbf{154}^2$, respectively, presented in a second color that is different color from the first color.

The second opaque non-conductive sheet 452 can be a thin layer of white or a variety of colors of a thin silicone. The second transparent non-conductive film 454 can be made of a thin transparent silicone film.

The second quick reference code $\mathbf{160}^2$ is scanned by the camera (not shown) configured in the user's smart device (not shown). Upon scanning the second quick reference code $\mathbf{160}^2$ the smart device (not shown) reveals a data link to a manufacturer-defined settings including a smart device application which is a user facing software application run on the smart device (not shown). The second quick reference code $\mathbf{160}^2$ includes a first pattern of at least three colored squares arranged in a first square grid on a first white background, wherein the first pattern of the at least three squares are stored with data of a manufacturer's defined settings including a smart device application for instructions to use the curtain lights kit 10 and the curtain lights device 20 The user facing software application enables connection and communication of the smart device (not shown) with the second wireless fidelity/short range wireless controller 242, as discussed above reciting the steps to connect the user's personal area network to the smart device.

Figure 7:
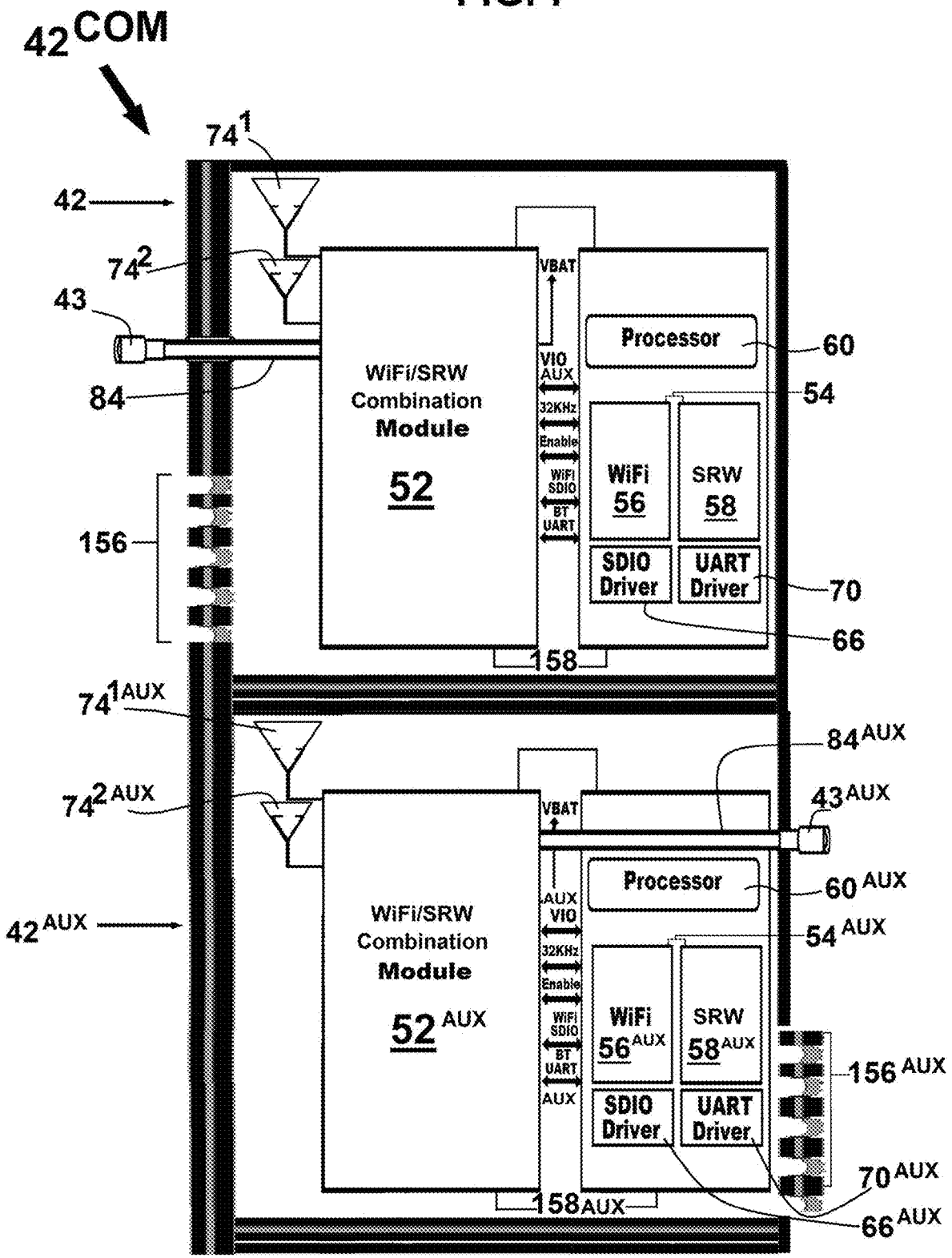
FIG. 7 illustrates a perspective front view of a compound wireless fidelity/short range wireless controller, according to an embodiment of the present invention.

In yet another embodiment, as shown in FIG. 7, the first curtain lights assembly 12 and the second curtain lights assembly 212 can each include a first compound wireless fidelity/short range wireless controller $\mathbf{42}^{COM}$ and a second compound wireless fidelity/short range wireless controller $\mathbf{42}^{COM-2}$, respectively. The first compound wireless fidelity/short range wireless controller $\mathbf{42}^{COM}$ is shown in FIG. 7. The second compound wireless fidelity/short range wireless controller is not shown, however, a person of ordinary skill in the art can realize that the second compound wireless fidelity/short range wireless controller can adapt the elements of the first compound wireless fidelity/short range wireless controller $\mathbf{42}^{COM}$ configured in a mirror image to fit into the second preformed curtain 238 of the second curtain lights assembly 212. FIG. 7 illustrates a front perspective view of the compound wireless fidelity/short range wireless controller $\mathbf{42}^{COM}$. The first compound wireless fidelity/short range wireless controller $\mathbf{42}^{COM}$ includes the first wireless fidelity/short range wireless controller 42 combined with an auxiliary wireless fidelity/short range wireless controller $42^{AUX}$. The auxiliary wireless fidelity/short range wireless controller $42^{AUX}$ is configured similar to the first wireless fidelity/short range wireless controller 42 but for a modification in the disposition of the first DC power input jack male plug 43. The auxiliary DC power input jack male plug $43^{AUX}$ which is configured being disposed in the opposite direction from the first DC power input jack male plug 43 of the first wireless fidelity/short range wireless controller 42. With this embodiment, the flow of the DC output current received from the AC/DC power supply adapter 26 connected to a power source can be directed therethrough the auxiliary DC power input jack male plug $43^{AUX}$ moving therethrough an auxiliary DC power input jack male plug member $84^{AUX}$ in an opposite direction to the second plurality of wireless fidelity/short range wireless light emitting diodes 246 of the second preformed bendable wireless fidelity/short range wireless light emitting diode light strip 244, or to any one of the one or more accessory widening curtain lights extension panels $400^{1+N}$, or any one of the one or more accessory lengthening curtain light extension panels $402^{1+N}$. As one skilled in the art will know, the auxiliary wireless fidelity/short range wireless controller $42^{AUX}$ can be configured in the second curtain lights assembly 212 of the curtain lights device 20.

As shown in FIG. 7, the auxiliary wireless fidelity/short range wireless controller $42^{AUX}$ includes an auxiliary output controller pin light emitting diode female receptacle $156^{AUX}$, an auxiliary wireless fidelity/short range wireless combination chip $158^{AUX}$, an auxiliary wireless fidelity/short range wireless module chip $52^{AUX}$, an auxiliary processor chip $60^{AUX}$, and an auxiliary wireless fidelity chip/short range wireless chip $54^{AUX}$ including an auxiliary wireless fidelity chip $56^{AUX}$ installed with an auxiliary secure digital input output driver (SDIO) $66^{AUX}$ being in coexistence with an auxiliary short range wireless chip $58^{AUX}$ installed with an auxiliary short range wireless universal asynchronous receiver transmitter (UART) driver $70^{AUX}$, the auxiliary protected access driver (WPA) (not shown) an auxiliary short range wireless stack and profiles (not shown), supported by an virtual input output core, indicated at $VIO^{AUX}$, a first pair of auxiliary combination wireless fidelity/short range wireless antennae $74^{1AUX}$, $74^{2AUX}$, a first auxiliary combination wireless fidelity/short range wireless antenna $74^{1AUX}$ and a second auxiliary combination wireless fidelity/short range wireless single antenna $74^{2AUX}$, wherein each of the first auxiliary combination wireless fidelity/short range wireless antenna $74^{1AUX}$ and the second auxiliary combination wireless fidelity/short range wireless single antenna $74^{2AUX}$ provides a coexistence of an auxiliary wireless fidelity antenna and an auxiliary short range wireless single antenna. The first auxiliary combination wireless fidelity/short range wireless single antenna $74^{1AUX}$ and the second auxiliary combination wireless fidelity/short range wireless single antenna $74^{2AUX}$ is a wireless 2.4/5-5.8 GHz antenna.

In yet another embodiment in accordance of the present invention each of the first plurality of wireless fidelity/short range wireless light emitting diodes $46^{1+N}$ of the first preformed bendable wireless fidelity/short range wireless light emitting diode light strip 44 and each of the second plurality of wireless fidelity/short range wireless light emitting diodes $246^{1+N}$ of the second preformed bendable wireless fidelity/short range wireless light emitting diode light strip 244 includes a wireless fidelity/short range wireless microchip capable of communication with the 2.4 GHz bandwidth.

The first preformed curtain 38, the second preformed curtain 238, each of the one or more accessory widening curtain lights extension panels $400^{1+N}$, each of the one or more accessory lengthening curtain lights extension panels $402^{1+N}$, can be formed by a plastic fabrication method. In addition, and a first preformed wireless fidelity/short range wireless light emitting diode curtain lights plate $604^1$, and a second preformed wireless fidelity/short range wireless light emitting diode curtain lights plate $604^2$, as described below, can, also, be formed by a plastic fabrication method.

There are several types of plastic fabrication methods that can be implemented including: plastic welding, compounding, plastic lamination, molding, plastic extrusion, thermoforming, dye cutting, pultrusion, forging, and vacuum casting. Plastic materials that can be used in the plastic fabrication process in making and forming the transparent non-conductive substrates 40 of the generally R-shape of each of the first preformed curtain 38, the second transparent non-conductive substrate 208 of the second preformed curtain 238, the first transparent non-conductive substrate of the first preformed wireless fidelity/short range wireless light emitting diode curtain lights plate $604^1$, and the second preformed wireless fidelity/short range wireless light emitting diode curtain lights plate $604^2$ and the generally rectangular shaped accessory transparent non-conductive substrates $414^W$ of each of the one or more accessory widening curtain lights extension panels $400^{1+N}$, and the generally rectangular shaped transparent non-conductive substrates $414^L$ of each of the one or more accessory lengthening curtain lights extension panels $402^{1+N}$ can be selected from the group of plastic materials comprising polyethylene terephthalate, high-density polyethylene, polyvinyl chloride, polypropylene, polystyrene, silicone, a transparent silicone, silicone gels, silicone resins, polymer, polycarbonate, polymethyl acrylate, polymethyl methacrylate, poly carbonate, polyimide, a copolymer of methyl methacrylate, styrene, polyethylene terephthalate, thermoplastic materials, which are water resistant, heat resistant and bendable, or from a clear, highly heat resistant bendable polyimide material.

The first transparent non-conductive substrate, the second transparent non-conductive substrate, and the accessory transparent non-conductive substrate may be from thermoplastic materials, polyurethanes, polyimides, high-density polyethylene, polypropylene, polystyrene, or polyvinyl chloride.

Here, for purposes of brevity, as way of example, the technique for the formation of the first transparent non-conductive substrate 40 of the first preformed curtain 38 of the first curtain lights assembly 12 of the curtain lights device 20 will be discussed. The method applied of making the first transparent non-conductive substrate 40 of the first preformed curtain 38 includes a combination of plastic fabrication techniques, compression molding, dye-cutting, vacuum casting, coating.

First step, compression molding is the fabrication technique utilized to form the mold of the first transparent non-conductive substrate 40 of the first preformed curtain 38. First, a first mold member configured with the dimensions of the generally R-shaped first transparent non-conductive substrate 40 of the first preformed curtain 38 receives a first predetermined amount of molten plastic that is transparent upon hardening. The first predetermined amount of molten plastic is poured into the first mold member and placed into a compression molding device. The first predetermined amount of molten plastic is heated and then compressed with a power presser, followed by curing to produce the desired R-shape of the first rear wall 114 of the first transparent non-conductive substrate 40 of the first preformed curtain 38. The curing provides that the first transparent non-conductive substrate 40 of the first preformed curtain 38 maintains its shape and integrity and thus does not deform.

In another embodiment, the first rear wall 112 of the first preformed curtain 38 can be formed using a molten plastic that is opaque upon drying. In this manner, the first preformed bendable wireless fidelity/short range wireless light emitting diode light strip 44, the first wireless fidelity/short range wireless controller 42, and the first AC/DC power supply adapter 26 will be hidden from view and add to the aesthetics of the rear view of the common window frame 18 in which the first preformed curtain 38 is installed.

Subsequently, the first wireless fidelity/short range wireless light emitting diode light emitting diode light strip 44 is positioned on top of the inner wall of the first rear wall 114 of the first preformed curtain 38 in the series of rows, as described above. Further, the first wireless fidelity/short range wireless controller 42 is configured atop the inner wall of the first rear wall 114 of the first preformed curtain 38 being operationally electrically connected to the first wire lead 86 of the first preformed bendable wireless fidelity/short range wireless light emitting diode light strip 44, as discussed above. Further, the first output light emitting diode female receptacle 144 is operationally electrically connected to the first back end 92 of the first wire lead 86.

For additional securing of the first wireless fidelity/short range controller 42, the first wire lead 86, the first back end 92 of the first wire lead 86 conductive adhesive and/or solder can be applied for securing the operational electrical connections. Further, the magnetic strips, the first magnetized polarity-A top edge 134, the magnetized polarity-A right side straight edge 136, the first magnetized polarity-B opposing bottom edge 138 are positioned in their respective edges atop of the inner wall of the first rear wall 114 of the first preformed curtain 38.

Further, in an embodiment, the first AC/DC power supply adapter 26 can be configured atop the inner wall of the first rear wall 114 of the first preformed curtain 38 operationally electrically connected to the first wireless fidelity/short range wireless controller 42, and, concomitantly, releasably operationally attached to the power source, as discussed above.

Second step, in a second compression molding step, a second measure of molten plastic that is transparent upon hardening is poured into a mateable second mold member configured with the dimensions of the generally R-shape of the first front wall 112 of the first transparent non-conductive substrate 40 first preformed curtain 38 which is identical to the dimensions of the first rear wall 114 of the first preformed curtain 38. The second mold member configured with the dimensions of the generally R-shaped first transparent non-conductive substrate 40 of the second preformed curtain 238 receives a second predetermined amount of molten plastic that is transparent upon hardening. The second predetermined amount of molten plastic is poured into the second mold member and placed into the compression molding device. The second predetermined amount of molten plastic is heated and then compressed with a power presser, followed by curing to produce the desired R-shape of the first rear wall 114 of the second transparent non-conductive substrate 40 of the second preformed curtain 238, followed by curing. Then, the second mold member is closed and both the first mold member and the second mold member are heated and pressed against each other. Due to the heating, the molten polymer melts and conforms to the shape of the mold, and a solidified first transparent non-conductive substrate 40 of the first preformed curtain 38 is released providing for complete embedding of the first preformed bendable wireless fidelity/short range wireless light emitting light strip 44 including each of its first plurality of first wireless fidelity/short range wireless light emitting light diodes $\mathbf{46}^{1+N}$, the first wireless fidelity/short range controller 42, the first AC/DC power supply adapter 26 within the interior spatial area of the first transparent non-conductive substrate 40 of the first preformed curtain 38. In this manner, the first preformed bendable wireless fidelity/short range wireless light emitting light strip 44 including each of its first plurality of first wireless fidelity/short range wireless light emitting light diodes $\mathbf{46}^{1+N}$, the first wireless fidelity/short range controller 42, the first AC/DC power supply adapter 26 are embedded, sealed and waterproofed.

The other parameters in the compression molding process, such as, temperature, pressure, pressing cycles, adhesives, and time duration is chosen based on the base molten polymer material and its properties. Adhesives can be used to apply the first preformed bendable wireless fidelity/short range wireless light emitting diode light emitting diode light strip 44, the first wireless fidelity/short range controller 42, the first AC/DC power supply adapter 26, and the magnetized strips to the first magnetized polarity-A top edge 134, the magnetized polarity-A right side straight edge 136, the first magnetized polarity-B opposing bottom edge 138 are positioned in their respective edges atop of the inner wall of the first rear wall 114 of the first preformed curtain 38.

The adhesive can be made from a polyvinyl acetate (PVA), or a polyvinyl acetate (PVA) with resin. The adhesive can be a waterproof polyvinyl acetate, or a waterproof polyvinyl acetate with resin, or a polyurethane resin or any other suitable adhesive that is transparent upon drying and can tolerate low and high temperature fluctuations.

An advantage of using compression molding process is that polymers with a higher molecular weight and melt viscosity can be processed using compression molding, unlike extrusion or injection molding. Another advantage of compression molding is compression molding presses tend to have a lower tonnage and power than IMMs because, although the pressure required for forming is high, it is not as high as the pressures generated during injection in the molding process. The mold closing pressure must be initially very high to form the material but this can often be reduced substantially during the curing phase. There is no need for high pressure to ensure full mold packing or to wait for gate seal. After the initial forming, the pressure requirement is simply to account for volumetric expansion as the material temperature increases. This means that motor control in the hydraulic system is critical to reducing energy use in compression molding.

Third step, the first aperture and the second aperture are stamped out, or dye-cut, or blanking out of the first transparent non-conductive substrate 40 of the first preformed curtain 38. The first aperture 140 is stamped out or dye-cut from the first right side wall 116 of the first transparent non-conductive substrate 40 of the first preformed curtain 38 configured to allow the first DC power input jack male plug 43 to readily pass therethrough. Similarly, the second right aperture 142 is stamped out or dye-cut out from the first right side wall 116 of the first transparent non-conductive substrate 40 of the first preformed curtain 38 configure to allow the first output pin light emitting diode female receptacle 144 to be maintained operationally therein.

Fourth step, the dye-cutting device is used to form the first opaque non-conductive sheet 450 which is dimensioned in the general R-shape of the first transparent non-conductive substrate 40 of the first preformed curtain 38 to be affixed onto an exterior surface area of the first rear wall 114 of the first transparent non-conductive substrate 40 of the first preformed curtain 38. The first opaque non-conductive sheet 450 can be formed using a bendable opaque polyvinyl chloride film, bendable opaque polycarbonate film, bendable opaque polyester film, and high density polyethylene plastic sheet. The first opaque non-conductive sheet 450 is joined to the exterior surface area of the first rear wall 114 of the first transparent non-conductive substrate 40 of the first preformed curtain 38 by way of a joining process. The joining process can include bringing into contact with each other and joining the exterior surface area of the first rear wall 114 of the first transparent non-conductive substrate 40 of the first preformed curtain 38 to a first side surface area of the first opaque non-conductive sheet 450 and heated by conduction with a hot sealing bar. Polyvinylchloride features a high dielectric loss that heat is often generated throughout the first opaque non-conductive sheet 450 and the first rear wall 114 of the first transparent non-conductive substrate 40 of the first preformed curtain 38 by exposure to a high-frequency high voltage field.

Fifth step, an in-mold labelling technique is implemented at this phase of manufacturing to imprint the first quick reference code $\mathbf{160}^1$ onto a bottom portion of an exterior surface area of the first opaque non-conductive sheet 450. Printing the first quick reference code $\mathbf{160}^1$ onto the first opaque non-conductive sheet 450 can be done using the any one of the following techniques: screen printing, pad printing, waterless offset, or digital thermal transfer. Before printing, the exterior surface area of the first opaque non-conductive sheet 450 is activated. Two methods of activation can include corona and flaming. Another technique to apply the first quick reference code $\mathbf{160}^1$ onto the first opaque non-conductive sheet 450 includes in-mold labels which are applied to the first opaque non-conductive sheet 450 during the dye-cutting step of forming the first opaque non-conductive sheet 450. A pre-printed quick reference code film label is applied in the mold and the quick reference code $\mathbf{160}^1$ becomes fused to the component surface of the first opaque non-conductive sheet 450 with no requirement for quick reference code label application equipment. The pre-printed quick reference code film is printed by gravure or flexographic processes.

Sixth step, dye-cutting device is utilized to form the first transparent non-conductive film 456. The first transparent non-conductive film 456 provides a protective layer to the first opaque non-conductive sheet 450 and the first quick reference code $\mathbf{160}^1$. The first transparent non-conductive film 456 is formed in the general R-shape of the first transparent non-conductive substrate 40 of the first preformed curtain 38 to be affixed onto an exterior surface area the first opaque non-conductive sheet 450 of the first transparent non-conductive substrate 40 of the first preformed curtain 38. The first transparent non-conductive film 456 can be formed using a bendable translucent polyvinyl chloride film, bendable opaque polycarbonate film, bendable opaque polyester film, and high density polyethylene plastic sheet. The first transparent non-conductive film 456 is joined to the exterior surface of the exterior surface area the first opaque non-conductive sheet 450 of the first transparent non-conductive substrate 40 of the first preformed curtain 38 by way of a joining process. The joining process can include bringing into contact with each other and joining the exterior surface area of the exterior surface area the first opaque non-conductive sheet 450 to a first side surface area of the first transparent non-conductive film 456 and heated by conduction with a hot sealing bar as described above.

Seventh step, includes a vacuum casting step. The newly formed first transparent non-conductive substrate 40 of the first preformed curtain 38 is subjected to a vacuum casting, also, referred to as polyurethane casting, using a transparent resin. The transparent resin can be selected from the polyester, epoxy, polyurethane resins, transparent silicone, and transparent rubber. Transparent silicone is commercially available as STAR-PU Transparent silicone, and transparent rubber is commercially available as STAR-PU Transparent Rubber.

The vacuum casting step provides a top quality first transparent non-conductive substrate 40 of the first preformed curtain 38 free of bubble casting with smooth surface texture and no blemishes that may have formed in the first rear wall and the first front wall of the first transparent non-conductive substrate 40 of the first preformed curtain 38 in the previous method steps.

Eighth step, includes the first preformed curtain 38 undergoing a three stage finishing process including flashing, cleaning, and coating. A deflashing process removes all the surplus materials remaining around the first preformed curtain 38. After the deflashing process the first preformed curtain 38 is cleaned of residual material remaining on the exterior surfaces of the first preformed curtain 38 to provide a spotless first preformed curtain 38.

Referring back to FIGS. 1, 3C and 12A, each one or more pin light emitting diode female to female connector cables $\mathbf{21}^{1+n}$ of the curtain lights kit 10 includes a first terminal female connector $\mathbf{17}^{1+N}$ and a second terminal female connector $\mathbf{19}^{1+N}$ joined by a connector wire cable $\mathbf{23}^{1+n}$. More particularly, a first pin light emitting diode female to female connector cable $\mathbf{21}^1$ includes a first terminal female connector $\mathbf{17}^1$ and a second terminal female connector $\mathbf{19}^1$ joined by a first connector wire cable $\mathbf{23}^1$ wherein each of the first terminal female connector $\mathbf{17}^1$ and each of the second terminal female connector $\mathbf{19}^1$ includes two ports configured to receive a mateable pin light emitting diode male connector $\mathbf{24}^N$ of the one or more mateable pin light emitting diode male connectors $\mathbf{24}^{1+N}$. A second pin light emitting diode female to female connector cable $\mathbf{21}^2$ includes a first terminal female connector $\mathbf{17}^2$ and a second terminal female connector $\mathbf{19}^2$ joined by a second connector wire cable $\mathbf{23}^2$ wherein each of the first terminal female connector $\mathbf{17}^2$ and the second terminal female connector $\mathbf{19}^2$ of the second pin light emitting diode female to female connector cable $\mathbf{21}^2$ includes three ports configured to receive a mateable pin light emitting diode male connector $\mathbf{24}^N$ of the one or more mateable pin light emitting diode male connectors $\mathbf{24}^{1+N}$. A third pin light emitting diode female to female connector cable $\mathbf{21}^3$ includes a first terminal female connector $\mathbf{17}^3$ and a second terminal female connector $\mathbf{19}^3$ joined by a third connector wire cable $\mathbf{23}^3$ wherein each of the first terminal female connector $\mathbf{17}^3$ and the second terminal female connector $\mathbf{19}^3$ of the third pin light emitting diode female to female connector cable $\mathbf{21}^3$ includes four ports configured to receive a mateable pin light emitting diode male connector $\mathbf{24}^3$ of the one or more mateable pin light emitting diode male connectors $\mathbf{24}^{1+n}$, as show in FIG. 3E, having a first male connector end $\mathbf{23}^3$ having a first series of four pins and a second male connector end $\mathbf{25}^3$ having a second series of four pins. More particularly, as shown in FIGS. 12A-12C, the light emitting diode female to female connector cable $\mathbf{21}^1$ includes a first terminal female connector $\mathbf{17}^4$ and a second terminal female connector $\mathbf{19}^4$ joined by a fourth connector wire cable $\mathbf{23}^4$ wherein each of the first terminal female connector $17^4$ and the second terminal female connector $19^4$ of the fourth pin light emitting diode female to female connector cable $21^4$ includes five ports configured to receive a mateable pin light emitting diode male connector $24^4$ having a first male connector end $23^4$ having a first series of five pins (5-pins) and a second male connector end $25^4$ having a second series of five pins (5-pins). A fifth pin light emitting diode female to female connector cable $21^1$ includes a first terminal female connector $17^5$ and a second terminal female connector $19^5$ joined by a fifth connector wire cable $23^5$ wherein each of the first terminal female connector $17^5$ and the second terminal female connector $19^5$ of the fifth pin light emitting diode female to female connector cable $21^5$ includes six ports configured to receive a mateable pin light emitting diode male connector $24^5$ having a first male connector end $23^5$ having a first series of six pins and a second male connector $25^5$ having a second series of six pins of the one or more mateable pin light emitting diode male connectors $24^{1+n}$.

The one or more pin light emitting diode female to female butterfly connector cables $22^{1+n}$ includes one or more butterfly female end connectors $27^{1+n}$ joined by a butterfly connector cable 29. FIG. 3 D shows an exemplary embodiment of a pin light emitting diode female to female butterfly connector cable $22^n$ of the one or more pin light emitting diode female to female butterfly connector cable $22^{1+n}$ including a butterfly connector cable 29 having four butterfly female terminal connectors $27^{1+4}$. The butterfly connector cable 29 includes a first butterfly female terminal connector $27^1$, a second butterfly female terminal connector $27^2$, a third butterfly female terminal connector $27^3$, and a fourth butterfly female terminal connector $27^4$. Each of the first butterfly terminal connectors $27^1$, $27^2$, $27^3$, $27^4$ can include the same number of receptacles configured therein or two to six receptacles configured therein to receive the prongs of a mateable pin light emitting diode male connector $24^n$ of the one or more mateable pin light emitting diode male connectors $24^{1+n}$.

The one or more pin light emitting diode female to female connector cables $21^{1+n}$, the one or more pin light emitting diode female to female butterfly connector cables $22^{1+n}$, provides a way to continue the layout of a series of first curtain lights assembly 12 and the second curtain lights assembly 212, and the one or more accessory widening curtain lights extension panels $400^{1+N}$ and one or more accessory lengthening curtain lights extension panels $402^{1+N}$ in windows or other stable structures throughout the user's home or business. The first terminal female connector $17^{1+N}$ and the second terminal female connector $19^{1+n}$ of the one or more pin light emitting diode female to female connector cables $21^{1+n}$ and the four butterfly female terminal connectors $27^{1+n}$ of the one or more pin light emitting diode female to female butterfly connector cables $22^{1+n}$ is configured to fit securely within a mateable output pin light emitting diode female receptacle, for example, the first output pin light emitting diode female receptacle 144 of the first preformed curtain 38, and the second output pin light emitting diode female receptacle 245 of the second preformed curtain 238, as shown in FIGS. 12A, 12B, and 12C, and thereby provides quick access for establishing connections.

By default, the connector is female on both ends, but can be changed to a male connector end by adding a mateable pin light emitting diode male connector $24^n$ of the one or more mateable pin light emitting diode male connectors $24^{1+n}$ as an add on to switch between different applications as shown in FIG. 12A-12C.

FIG. 12A-12C shows the first preformed curtain 38 of the first curtain lights assembly 12 is releasably operationally electrically connected to the second preformed curtain 238 of the second curtain lights assembly 212 by way of the pin light emitting diode female to female connector cable $21^4$ of the one or more pin light emitting diode female to female connectors $21^{1+n}$. In this exemplary embodiment, the first curtain lights assembly 12 shows the first AC/DC power supply adapter 26 connected to the first DC power input jack male plug 43 where the second AC/DC power supply adapter 28 is not being utilized in the second curtain lights assembly. In this manner, the first power plug male connector 82 when connected to the power socket of the power source provides the first direct forward flow of the first DC output electric current to each of the first plurality of wireless fidelity/short range wireless light emitting diodes $46^{1+N}$ of the first preformed bendable wireless fidelity/short range wireless light emitting diode light strip 44, and further to each of the second plurality of wireless fidelity/short range wireless light emitting diodes $246^{1+N}$ of the second preformed bendable wireless fidelity/short range wireless light emitting diode light strip 244 of the second preformed curtain 238 of the second curtain lights assembly 212 such that each of the first plurality of wireless fidelity/short range wireless light emitting diodes $46^{1+N}$ of the first preformed bendable wireless fidelity/short range wireless light emitting diode light strip 44, and each of the second plurality of wireless fidelity/short range wireless light emitting diodes $246^{1+N}$ of the second wireless fidelity/short range wireless light emitting diode light strip 244 are illuminated. Thereby, only one power source is required to illuminate the first plurality of wireless fidelity/short range wireless light emitting diodes $46^{1+N}$ of the first preformed bendable wireless fidelity/short range wireless light emitting diode light strip 44 and, synchronously, to illuminate the second plurality of wireless fidelity/short range wireless light emitting diodes $246^{1+N}$ of the second preformed bendable wireless fidelity/short range wireless light emitting diode light strip 244.

In this exemplary embodiment, as shown in FIG. 12A, the fourth pin light emitting diode female to female connector cable $21^4$ selected from the one or more pin light emitting diode female to female connector cables $21^{1+n}$ includes 5-pin holes configured in the first terminal female connector $17^5$ and the second terminal female connector $19^5$ which are compatible with selected two of the mateable pin light emitting diode male connectors $24^{4-1}$ and $24^{4-2}$ each of which have five (5) pins. Hereinafter, the fourth pin light emitting diode female to female connector cable $21^4$ is, also, referred to as the 5-pin light emitting diode female to female connector cable $21^4$. A first mateable pin light emitting diode male connector $24^{4-1}$ having a series of 5-pins by way of the first male connector end $23^{4-1}$ and a second series of 5-pins of the second male connector end $25^{4-1}$ releasably operationally electrically connects the first female connector end 17 of the 5-pin light emitting diode female to female connector cable $21^1$ to the first output pin light emitting diode female receptacle 144 of the first performed curtain 38 of the first curtain lights assembly 12. A second mateable 5-pin light emitting diode male connector $24^{4-2}$ by way of a second male connector end $25^{4-2}$ releasably operationally electronically connects the second terminal female connector $19^4$ of the 5-pin light emitting diode female to female connector cable $21^4$ to the second output pin light emitting diode female receptacle 245 of the second preformed curtain 238 of the second curtain lights assembly 212.

The curtain lights device 20 including the first preformed curtain 38 of the first curtain lights assembly 12 and the second preformed curtain 238 of the second curtain lights assembly 212 can be installed in the common window frame 18 to drape the common window frame with the illuminated first preformed curtain 38 and the illuminated second preformed curtain 238, as shown in FIGS. 13A and 13B to illuminate the window associated with the common window frame 18. The common window frame 18 can vary in size, width, and length among a variety of windows. Therefore, the curtain lights device 20 further includes one or more curtain lights extension panels to accommodate the variety of sizes, widths and lengths of windows in a household or business.

Each of the first preformed bendable wireless fidelity/short range wireless light emitting diode light strip 44 and the second preformed bendable wireless fidelity/short range wireless light emitting diode light strip 244 can be manufactured in any length configured to accommodate the substantial area of the interior spatial area of the first transparent non-conductive substrate 40 of the first preformed curtain 38 and the substantial area of the interior spatial area of the second transparent non-conductive substrate 208 of the second preformed curtain 238 where the first preformed curtain 38 and the second preformed curtain 238 is configured to fit the common window frame of a variety of sizes.

The common window frame 18 can include standard windows, sliding glass door windows, with a variety of heights and widths, sash sizes and sash depths. The curtain lights device can be implemented with a variety of sizes and types of window frames including: (1) Double hung and single hung standard windows dimensioned, 2 feet wide by 3 feet high; 2 feet wide by 4 feet, 4 inches high; 2 feet, 8 inches wide by 4 feet high; 2 feet, 8 inches wide by 5 feet, 2 inches high; and 4 feet wide by 6 feet high; (2) Sliding window standard sizes are always wider than they are tall or are square. Slider windows range from 36 inches to 84 inches wide. Heights range from 24 inches to 60 inches. Size combinations commonly found: 3 feet wide by 2 feet high; 3 feet wide by 3 feet wide; 5 feet wide by 3 feet high; 6 feet wide by 4 feet high; and 7 feet wide by 4 feet high. (3) Casement window standard sizes including widths of casement windows commonly start at 17 inches and range up to 41 inches. Common heights range from 16 inches up to 33 inches; 1-foot, 7 inches wide by 1-foot, 4 inches high; 1-foot, 7 inches wide by 2 feet, 5 inches high; 2 feet, 3 inches wide by 2 feet, 3 inches high; 2 feet, 9 inches wide by 2 feet, 9 inches high; and 3 feet, 5 inches wide by 2 feet, 5 inches high. (4) Custom window sizes where standard window sizes work for most homes, there may be common window frames that require windows that don't fall into these prescribed categories. Therefore, the curtain lights devices can be custom made to accommodate the size of the common window frame required by the user. The custom or special sizes that window manufacturers offer sometimes have a greater size range than with standard windows.

FIGS. 14-16 depicts one or more curtain lights extension panels, particularly, one or more accessory widening curtain lights extension panels $\mathbf{400}^{1+N}$ and one or more accessory lengthening curtain lights extension panels $\mathbf{402}^{1+N}$. FIG. 14 depicts a perspective view of the first preformed curtain 38 of the first curtain lights assembly 12 in a working association with a first accessory widening curtain lights extension panel $\mathbf{400}^{1}$. FIG. 15A depicts a perspective view of a portion of the first preformed curtain 38 of FIG. 14 of the first curtain lights assembly 12 in a working association with a first accessory lengthening curtain lights extension panel $\mathbf{402}^{1}$. FIG. 15B depicts a perspective view of a portion of the second preformed curtain 238 of the second curtain lights assembly of FIG. 2B in a working association with a second accessory lengthening curtain lights extension panel $\mathbf{402}^{1}$. FIG. 16 depicts a perspective view of a portion of the second preformed curtain 238 of the second curtain lights assembly 212 of FIG. 2B in a working association with three accessory widening curtain lights extension panels $\mathbf{400}^{1-3}$.

Each of the one or more accessory widening curtain lights extension panels $\mathbf{400}^{1+N}$ further comprises an accessory widening preformed bendable wireless fidelity/short range wireless light emitting diode light strip $\mathbf{410}^{W1+N}$, and each of the accessory widening preformed bendable wireless fidelity/short range wireless light emitting diode light strip $\mathbf{410}^{W1+N}$ includes a first plurality of widening wireless fidelity/short range wireless light emitting diodes $\mathbf{446}^{W1+N}$. Each of the accessory widening preformed bendable wireless fidelity/short range wireless light emitting diode light strip $\mathbf{410}^{W1+N}$ includes a plurality of accessory widening curved end regions $\mathbf{462}^{W1+N}$ so that the accessory widening preformed wireless fidelity/short range wireless emitting diode light strip $\mathbf{410}^{W1+N}$ is embedded therein an accessory widening transparent non-conductive substrate $\mathbf{414}^{W}$ in a series of parallel rows allowing for a continuous movement of the electric current from the first wireless fidelity/short range wireless controller 42. Further, each of the accessory widening preformed bendable wireless fidelity/short range wireless light emitting diode light strip $\mathbf{410}^{W1+N}$ includes an accessory bendable printed circuit board 440, a plurality of accessory resistors $\mathbf{470}^{1+N}$, and a plurality of accessory copper pads $\mathbf{490}^{1+N}$, similarly, as described above, in the first preformed bendable wireless fidelity/short range wireless light emitting diode light strip 44 of the first preformed curtain 38.

The accessory widening preformed bendable wireless fidelity/short range wireless light emitting diode light strip $\mathbf{410}^{W1+N}$ is embedded with an accessory transparent non-conductive substrate 414 of each of the accessory widening curtain lights extension panels $\mathbf{400}^{1+N}$. Further, each of the accessory widening curtain lights extension panels $\mathbf{400}^{1+N}$ and each of the accessory lengthening curtain lights extension panels $\mathbf{402}^{1+N}$ is configured with one or more input pin light emitting diode female receptacle 428 and one or more output pin light emitting diode female receptacle 436. Each of the one or more input pin light emitting diode female receptacle 428 and one or more output pin light emitting diode female receptacle 436 includes at least two portals. In the exemplary embodiment, each of the one or more input pin light emitting diode female receptacle 428 and one or more output pin light emitting diode female receptacle 436 includes five portals.

The accessory transparent non-conductive substrate 414 is of the type of the first transparent non-conductive substrate 40 and the second transparent non-conductive substrate 208 of the of the first preformed curtain 38 and the second preformed curtain 238, respectively, and having the same thickness. The accessory transparent non-conductive substrate 414 can be manufactured using a transparent silicone, silicone, a transparent silicone which is water resistant, heat resistant and bendable, a clear, highly heat resistant bendable polyimide material, a waterproof transparent non-conductive colloid which can be a waterproof transparent polyurethane resin, polyester, polymer film, polyimide, polyimide polymer, transparent rubber, a non-conductive plastic, a non-conductive polyimide which is water resistant, heat resistant and bendable.

As shown in FIGS. 14 and 16, each of the one or more of the accessory widening curtain lights extension panels $400^{1+N}$ is configured in a rectangular shape framed by a top wall 416, a bottom wall 418, a first side wall 420 and a second side wall 422. The accessory widening preformed bendable wireless fidelity/short range wireless light emitting diode light strip $410^{W1+N}$ is embedded therein the accessory transparent non-conductive substrate 414 and begins at a primary lead end 424 and terminating at a terminal lead end 426 arranged in a multitude of continuous symmetrical rows extending from a top corner to a bottom corner within an accessory interior spatial area of the each of the one or more accessory curtain lights extension panels, and more particularly within an interior spatial area of the one or more accessory widening curtain lights extension panels $400^{W(1+N)}$ and an interior spatial area of the one or more accessory lengthening curtain lights extension panels $402^{L(1+N)}$.

FIGS. 14 and 16, the primary lead end 424 of a first accessory widening preformed bendable wireless fidelity/short range wireless light emitting diode light strip $410^{W1}$ is operationally electrically connected to a first input pin light emitting diode female receptacle $428^{W1}$. The primary lead end of the first accessory widening preformed bendable wireless fidelity/short range wireless light emitting diode light strip $410^{W1}$ includes an accessory wire lead 430 operationally electrically connected to an accessory circuit board, wherein the accessory wire lead includes an accessory main direct current voltage wire 431 and two or more accessory color wire leads 432.

The first input pin light emitting diode female receptacle $428^{W1}$ can be accessed through a first cut away opening 434 recessed within a first wall region of the first widening accessory curtain lights extension panels $400^1$ in which the input pin light emitting diode female receptacle $428^{W1}$ is fixed. The terminal lead end 426 of the first accessory widening preformed bendable wireless fidelity/short range wireless light emitting diode light strip $410^{W1}$ includes a first accessory output pin light emitting diode female receptacle $436^{W1}$ which is operationally electronically connected to a second end of the first accessory wire lead $430^1$ including the first one or more accessory color wire leads $432^1$ wherein the first accessory output pin light emitting diode female receptacle $436^{W1}$ can be accessed through a second cut away opening 438 recessed within a second wall region of the first accessory widening curtain lights extension panels $400^1$ in which the first accessory output pin light emitting diode female receptacle $436^{W1}$ is fixed.

As shown in particularly, in FIG. 14, a first accessory widening curtain lights extension panel $400^1$ of the one or more accessory widening curtain lights extension panels $400^{1+n}$ can be releasably operationally electrically connected to a first preformed curtain 38 of the first curtain lights assembly 12. Referring in particular to FIG. 14, it is noteworthy that the one or more mateable pin light emitting diode male connectors are reusable and recyclable in the various applications of the curtain lights device 20. FIG. 14 shows a first accessory widening curtain lights extension panel $400^1$ can be releasably operationally electrically connected to the first terminal end 50 of the first preformed bendable wireless fidelity/short range wireless light emitting diode light strip 44 of the first preformed curtain 38 by way of the first mateable pin light emitting diode male connector $24^1$, having five pins (5-pins), of the one or more mateable pin light emitting diode male connectors $24^{1+n}$. The first series of five pins (5-pins) of the first male connector end $23^4$ of the mateable pin light emitting diode male connector $24^4$ is releasably operationally electrically connected to a series of five portals of the first output pin light emitting diode female receptacle 144 of the first preformed curtain 38. Concomitantly, the second series of five pins (5-pins) of the second male connector end $25^4$ of the first mateable pin light emitting diode male connector $24^4$ is releasably operationally electrically connected to five portals of the first accessory input pin light emitting diode female receptacle $428^{W1}$ recessed in an upper region of the first side wall 420 of the of the first accessory widening curtain lights extension panel $400^1$. In this manner, movement of the first DC output electric current from the first wireless fidelity/short range wireless controller 42 is directed to each of the first accessory plurality of wireless fidelity/short range wireless light emitting diodes $446^{1+N}$ of the first accessory widening preformed bendable wireless fidelity/short range wireless light emitting diode light strip $410^{W1}$ of the first accessory widening curtain lights extension panel $400^1$.

In addition, as further shown in FIG. 14, a second mateable pin light emitting male connector $24^{4-2}$, also, having five pins (5-pins), can be releasably operationally electrically connected to a first accessory output pin light emitting diode female receptacle $436^{W1}$ whereby a second accessory widening curtain lights extension panel $400^2$ can be operationally electrically connected to the first accessory widening curtain lights extension panel $400^1$. In this manner, the first power plug male connector 82 when connected to the power socket of the power source provides the first direct forward flow of the first DC output electric current flowing from the first wireless fidelity/short range wireless controller 42 to each of the first plurality of wireless fidelity/short range wireless light emitting diodes $46^{1+N}$ of the first preformed bendable wireless fidelity/short range wireless light emitting diode light strip 44, and, synchronously, to the first accessory plurality of wireless fidelity/short range wireless light emitting diodes $446^1$ of the first accessory widening preformed bendable wireless fidelity/short range wireless light emitting diode light strip $410^{W1}$ of the first accessory widening curtain lights extension panel $400^1$, and further to a second accessory plurality of wireless fidelity/short range wireless light emitting diodes $446^2$ of the second accessory widening preformed bendable wireless fidelity/short range wireless light emitting diode light strip $410^{W2}$ of the second accessory widening curtain lights extension panel $400^2$.

Referring to FIG. 16, the second curtains lights assembly 212 is shown including the second preformed curtain 238, the second auxiliary output controller pin light emitting diode female receptacle 406 disposed on a bottom edge of the second wireless fidelity/short range wireless controller 242, the second AC/DC power supply adapter 28 releasably operationally electrically connected to the second DC power input jack male plug 243, and. Further, FIG. 16 shows a first pin light emitting diode female to female butterfly connector cable $22^1$ being implemented to releasably operationally electrically connect three accessory widening curtain lights extension panels $400^{1-3}$, a first accessory widening curtain lights extension panel $400^1$, a second accessory widening curtain lights extension panel $400^2$, and a third accessory widening curtain lights extension panel $400^3$. Each of the first accessory widening curtain lights extension panel $400^1$, the second accessory widening curtain lights extension panel $400^2$, and the third accessory widening curtain lights extension panel $400^3$ includes an input pin light emitting diode female receptacle $428^{W1\text{-}3}$, respectively.

FIG. 16 illustrates three accessory widening curtain lights extension panels $400^1$, $400^2$, $400^3$, first accessory widening curtain lights extension panel $400^1$, the second accessory widening curtain lights extension panel $400^2$, and the third first accessory widening curtain lights extension panel $400^3$, releasably operationally electrically connected to the second auxiliary output controller pin light emitting diode female receptacle 406 of the second wireless fidelity/short range controller 242. As known to the person of ordinary skill in the art this exemplary embodiment can, also, be applied to the first auxiliary output controller pin light emitting diode female receptacle 404 of the first wireless fidelity/short range wireless controller 42. The first pin light emitting diode female to female butterfly connector cable $\mathbf{22}^1$ includes four pin light emitting diode butterfly female terminal connectors, a first pin light emitting diode butterfly female terminal connector $\mathbf{27}^1$, a second pin light emitting diode butterfly female terminal connector $\mathbf{27}^2$, a third pin light emitting diode butterfly female terminal connector 273, a fourth pin light emitting diode butterfly female terminal connector $\mathbf{27}^4$. Each of the four pin light emitting diode butterfly female terminal connectors $\mathbf{27}^{1+4}$ are configured with a corresponding number of ports to receive the pins of the mateable pin light emitting diode male connector $\mathbf{24}^4$ of the one or more mateable pin light emitting diode male connectors $\mathbf{24}^{1+n}$. The mateable pin light emitting diode male connectors $\mathbf{24}^{1+n}$ include two or more pins as shown in FIG. 3E. In this exemplary embodiment, each of the four pin light emitting diode butterfly female terminal connectors $\mathbf{27}^{1+n}$ includes five (5) ports that are configured to receive mateable five pins (5-pins) of each of the mateable 5-pin light emitting diode male connector $\mathbf{24}^4$ of the one or more mateable pin light emitting diode male connectors $\mathbf{24}^{1+n}$. Noteworthy, the mateable pin light emitting diode male connectors are reusable and recyclable, and thereby can be used in one or more applications of the embodiments of the present invention. As shown in FIG. 16, the five ports of the first pin light emitting diode butterfly female terminal connector $\mathbf{27}^1$ are configured to receive the second male connector end $\mathbf{25}^4$ of the first 5-pin mateable pin light emitting diode male connector $\mathbf{24}^{4-1}$, and the five portals of the second auxiliary output controller pin light emitting diode female receptacle 406 of the second wireless fidelity/short range wireless controller 242 is configured to receive the five pins (5-pins) of the first male connector end $\mathbf{23}^4$ of the first 5-pin mateable pin light emitting diode male connector $\mathbf{24}^{4-1}$.

The second auxiliary output controller pin light emitting diode female receptacle 406 is integrally formed with the second wireless fidelity/short range wireless controller 242 includes electrically-conductive wires and electrically conductive copper contacts soldered to the second auxiliary one or more direct current input wirings 205 of the second wireless fidelity/short range wireless controller 242 which, as discussed above, is operationally electrically connected to the second bendable printed circuit board 294. In this manner, the electric current of the second main direct current voltage wire $V^2$ from the second wireless fidelity/short range controller 242 provided by the second AC/DC power supply adapter 28 is capable of continuity from the second wireless fidelity/short range wireless controller 242 to the accessory bendable printed circuit board $\mathbf{440}^L$, thereby, providing a continuous electric current movement of the second DC output electric current flowing from the second wireless fidelity/short range wireless controller 242 to each of the first accessory widening curtain lights extension panel $\mathbf{400}^1$, the second accessory widening curtain lights extension panel $\mathbf{400}^2$, and the third first accessory widening curtain lights extension panel $\mathbf{400}^3$.

Further, in this exemplary embodiment, the second pin light emitting diode butterfly female terminal connector $\mathbf{27}^2$ is releasably operationally electrically connected to the first male connector end $\mathbf{23}^{4-2}$ of a second 5-pin mateable pin light emitting diode male connector $\mathbf{24}^{4-2}$ and the second male connector end $\mathbf{25}^{4-2}$ of the second mateable pin light emitting diode male connector $\mathbf{24}^{4-2}$ is releasably operationally electrically connected to a first input light emitting diode female receptacle $\mathbf{428}^{W1}$ of the first accessory widening curtain lights extension panel $\mathbf{400}^1$. Similarly, the third pin light emitting diode butterfly female terminal connector $\mathbf{27}^3$ is releasably operationally electrically connected to the first male connector end $\mathbf{23}^{4-3}$ of the third mateable pin light emitting diode male connector $\mathbf{24}^{4-3}$ and the second male connector end $\mathbf{25}^{4-3}$ of the third mateable pin light emitting diode male connector $\mathbf{24}^{4-3}$ is releasably operationally electrically connected to a first input light emitting diode female receptacle $\mathbf{428}^{W2}$ of the second accessory widening curtain lights extension panel $\mathbf{400}^2$. Similarly, the fourth pin light emitting diode butterfly female terminal connector $\mathbf{27}^4$ is releasably operationally electrically connected to the first male connector end $\mathbf{23}^{4-4}$ of the fourth mateable pin light emitting diode male connector $\mathbf{24}^{-4}$ and the second male connector end $\mathbf{25}^{5-4}$ of the fourth mateable pin light emitting diode male connector $\mathbf{24}^4$ is releasably operationally electrically connected to a first input light emitting diode female receptacle $\mathbf{428}^{W3}$ of the third accessory widening curtain lights extension panel $\mathbf{400}^3$.

Each of the first input light emitting diode female receptacle $\mathbf{428}^{W1}$ of the first accessory widening curtain lights extension panel $\mathbf{400}^1$, the first input light emitting diode female receptacle $\mathbf{428}^{W2}$ of the second accessory widening curtain lights extension panel $\mathbf{400}^2$, and the first input light emitting diode female receptacle $\mathbf{428}^{W3}$ of the third accessory widening curtain lights extension panel $\mathbf{400}^3$ includes electrically conductive components including electrically conductive copper wires and electrically conductive copper contacts operationally electrically connected to each of an accessory bendable printed boards $\mathbf{440}^{1-3}$ configured therein each of the accessory widening preformed bendable wireless fidelity/short range wireless light emitting diode light strip $\mathbf{410}^{1-3}$, respectively.

In this manner, movement of the second DC output electric current flowing from the second wireless fidelity/short range wireless controller 242 of the second curtain lights assembly 212 is directed to each of the accessory plurality of wireless fidelity/short range wireless light emitting diodes $\mathbf{446}^{1+N}$ of the first accessory widening preformed bendable wireless fidelity/short range wireless light emitting diode light strip $\mathbf{410}^{W1}$ of the first accessory widening curtain lights extension panels $\mathbf{400}^1$, and directed to each of the second accessory plurality of wireless fidelity/short range wireless light emitting diodes $\mathbf{446}^{2-1+N}$ of the second accessory widening preformed bendable wireless fidelity/short range wireless light emitting diode light strip $\mathbf{410}^{W2}$ of the second accessory widening curtain lights extension panels $\mathbf{400}^2$, and to each of the third accessory plurality of wireless fidelity/short range wireless light emitting diodes $\mathbf{446}^{3-1+N}$ of the third accessory widening preformed bendable wireless fidelity/short range wireless light emitting diode light strip $\mathbf{410}^{W3}$ of the third accessory widening curtain lights extension panels $\mathbf{400}^3$.

FIG. 16, further, shows each of the first accessory widening curtain lights accessory panel $\mathbf{400}^1$, the second accessory widening curtain lights accessory panel $\mathbf{400}^2$, and the third accessory widening curtain lights accessory panel $\mathbf{400}^3$, includes the first accessory output pin light emitting diode female receptacle $\mathbf{436}^{W1}$, a second accessory output pin light emitting diode female receptacle $\mathbf{436}^{W2}$ and a third accessory output pin light emitting diode female receptacle $\mathbf{436}^{W3}$, respectively. Each of the first accessory output pin light emitting diode female receptacle 436$^{W1}$, the second accessory output pin light emitting diode female receptacle 436$^{W2}$ and the third accessory output pin light emitting diode female receptacle 436$^{W3}$ is compatible with any one of the one or more mateable pin light emitting diode male connectors 24$^{1+n}$ thereby enabling any one of the one or more accessory widening curtain lights accessory panels 400$^{1+N}$ to be releasably operationally electrically connected thereto. In addition, any one of the one or more accessory lengthening curtain lights accessory panels 402$^{1+N}$ can be releasably operationally releasably connected thereto the respective accessory widening accessory curtain lights panels 400$^{1+N}$.

FIG. 15A, with reference to FIGS. 2B and 10A shows the first preformed curtain 38 of the first curtain lights assembly 12 operationally electrically connected to a first accessory lengthening curtain lights extension panels 402$^{1}$ of the one or more one or more accessory lengthening curtain lights extension panels 402$^{1+N}$. Each of the one or more accessory lengthening curtain lights extension panels 402$^{1+N}$ further comprises an accessory lengthening preformed bendable wireless fidelity/short range wireless light emitting diode light strip 410$^{L}$ wherein each of the accessory lengthening preformed bendable wireless fidelity/short range wireless light emitting diode light strips 410$^{L1+N}$ includes an accessory lengthening plurality of wireless fidelity/short range wireless light emitting diodes 446$^{L1+N}$. Each of the accessory lengthening preformed bendable wireless fidelity/short range wireless light emitting diode light strips 410$^{L+N}$ includes a plurality of accessory widening curved end regions 462$^{L1+N}$ so that the accessory lengthening preformed wireless fidelity/short range wireless emitting diode light strip 410$^{L}$ is embedded therein an accessory lengthening transparent non-conductive substrate 414$^{L}$ in a series of parallel rows allowing for a continuous movement of the electric current from the first wireless fidelity/short range wireless controller 42. Further, each of the accessory lengthening preformed bendable wireless fidelity/short range wireless light emitting diode light strip 410$^{L}$ includes an accessory preformed printed circuit board 440$^{L}$, the plurality of accessory resistors 470$^{L1+N}$, and the plurality of accessory copper pads 490$^{L1+N}$, similarly, as implemented and described above, in the first preformed bendable wireless fidelity/short range wireless light emitting diode light strip 44 of the first preformed curtain 38.

Further, each of the of the one or more one or more accessory lengthening curtain lights extension panels 402$^{1+N}$ includes an accessory lengthening input light emitting diode female receptacle 428$^{L1+N}$, and an accessory output pin light emitting diode female receptacle 436$^{L1+N}$. Each of the accessory input light emitting diode female receptacle 428$^{1+N}$, and the accessory output pin light emitting diode female receptacle 436$^{1+N}$ is configured with two or more portals to receive a mateable pin light emitting diode male connector 24$^{N}$ including two or more corresponding pins of the one or more mateable pin light emitting diode male connector 24$^{1+n}$.

As discussed above, the first auxiliary output controller pin light emitting diode female receptacle 404 is disposed on a first bottom edge of the first controller board 45 of the first wireless fidelity/short range wireless controller 42 wherein the first auxiliary output controller pin light emitting diode female receptacle 404 is operationally electrically wired to the first wireless fidelity/short range wireless module chip 52 of the first wireless fidelity/short range wireless controller 42 by way of a first auxiliary direct current voltage wire $V^{A1}$, a first auxiliary series of one or more direct current input wirings 105, and a first auxiliary series of one or more light emitting diode output color wirings 107 wherein the first auxiliary output controller pin light emitting diode female receptacle 404 is accessed through a first bottom aperture 405 recessed in a cut away region of the first bottom wall 122 of the first preformed curtain 38 disposed proximate to the first auxiliary output controller pin light emitting diode female receptacle 404. The first auxiliary output controller pin light emitting diode female receptacle 404 includes at least two auxiliary portals. In the exemplary embodiment, the first auxiliary output controller pin light emitting diode female receptacle 404 includes five portals.

Turning to FIG. 15A, with reference to FIGS. 2B and 10A, a first accessory lengthening curtain lights extension panel 402$^{1}$ of the one or more accessory lengthening curtain lights extension panels 402$^{1+N}$ can be operationally electrically connected to the first preformed bendable wireless fidelity/short range wireless light emitting diode light strip 44 of the first preformed curtain 38 by way of another first mateable pin light emitting diode male connector 24$^{4}$ of the one or more mateable pin light emitting diode male connectors 24$^{1+n}$ releasably operationally electrically connecting the first accessory lengthening curtain lights extension panel 402$^{1}$ to the first preformed curtain 38 of the first curtain lights assembly 12 of the curtain lights device 20.

FIG. 15A shows the first male connector end 23$^{4-2}$ of a second mateable pin light emitting diode male connector 24$^{4-2}$ selected from the one or more mateable pin light emitting diode male connectors 24$^{1+n}$ includes five pins (5-pins) that are received into the mateable five ports of the first auxiliary output controller pin light emitting diode female receptacle 404, and the second male connector end 25$^{4-2}$ of the second five pin (5-pins) mateable pin light emitting diode male connector 24$^{4-2}$ is releasably operationally electrically connected to a first lengthening accessory input light emitting diode receptacle 428$^{L1}$ of the first accessory lengthening curtain lights extension panels 402$^{1}$ recessed in a region of a first top wall 416$^{1}$ of the first accessory lengthening curtain lights extension panel 402$^{1}$. In this manner, movement of the first DC output electric current flowing from the first wireless fidelity/short range wireless controller 42 is directed to each of a first accessory plurality of wireless fidelity/short range wireless light emitting diodes 446$^{L1}$ of the first accessory lengthening curtain lights extension panel 402$^{1}$ of the one or more accessory lengthening curtain lights extension panels 402$^{1+N}$ thereby providing the first DC output electric current to illuminate each of the first accessory plurality of wireless fidelity/short range wireless light emitting diodes 446$^{L1}$ of the first accessory lengthening curtain lights extension panel 402$^{1}$ synchronously with each of the first plurality of wireless fidelity/short range wireless light emitting diodes 46$^{1+N}$ of the first preformed bendable wireless fidelity/short range wireless light emitting diode light strip 44 of the first preformed curtain 38 of the first curtain lights assembly 12.

In the exemplary embodiment, with reference to FIG. 10A, the first wireless fidelity/short range wireless controller 42 is configured being wired with the first main direct current voltage wire $V^{1}$, the first one or more direct current input wirings 104, and the first series of one or more light emitting diode output color wirings 106 wired within the first wireless fidelity/short range wireless module chip 52 of the first wireless fidelity/short range wireless controller 42 are bifurcated into a first auxiliary direct current voltage wire $V^{A}$, a first auxiliary one or more direct current input wirings 105, and a first auxiliary series of one or more light emitting diode output color wirings 107, whereby movement of the first DC output electric current can flow through the first auxiliary output controller pin light emitting diode female receptacle 404 of the first wireless fidelity/short range wireless controller 42 therethrough to each of the first auxiliary direct current voltage wire $V^{A}$, the first plurality of wireless fidelity/short range wireless light emitting diodes $\mathbf{446}^{L-1}$ of the first accessory widening curtain lights extension panel $\mathbf{400}^{1}$.

FIG. 15B, with reference to FIGS. 2C and 11, shows a second accessory lengthening curtain lights extension panel $\mathbf{402}^{2}$ of the one or more accessory lengthening curtain lights extension panels $\mathbf{402}^{1+N}$ is implemented in association with the second wireless fidelity/short range wireless controller 242 of the second preformed curtain 238 of the second curtain lights assembly 212. The second auxiliary output controller pin light emitting diode female receptacle 406 is disposed on the second bottom edge of the second wireless fidelity/short range wireless controller 242 wherein the second auxiliary output controller pin light emitting diode female receptacle 406 is operationally electrically wired to the second wireless fidelity/short range wireless module chip 252 of the second wireless fidelity/short range wireless controller 242 by way of an auxiliary second direct current voltage wire $V^{A2}$, a second auxiliary one or more direct current input wirings 205, and a second auxiliary series of one or more light emitting diode output color wirings 207 of the second wireless fidelity/short range wireless controller 242.

The second auxiliary output controller pin light emitting diode female receptacle 406 is accessed through a second bottom aperture 408 recessed in a cut away region of the second bottom wall of the second preformed curtain 238 disposed proximate to the second auxiliary output controller pin light emitting diode female receptacle 406.

FIG. 15B, with reference to FIGS. 2A, 2C and 11, a second accessory lengthening curtain lights extension panel $\mathbf{402}^{2}$ of the one or more accessory lengthening curtain lights extension panels $\mathbf{402}^{1+N}$ can be operationally electrically connected to the second wireless fidelity/short range wireless controller 242 of the second preformed curtain 238 of the second curtain lights assembly 212 by way of a third mateable pin light emitting diode male connector $\mathbf{24}^{4-3}$ selected from the one or more mateable pin light emitting diode male connectors $\mathbf{24}^{1+N}$. Again, it is noted that the one or more mateable pin light emitting diode male connectors $\mathbf{24}^{1+N}$ are recycled throughout the embodiments of the present invention. Here, in this exemplary embodiment a third five pin (5-pin) mateable pin light emitting diode male connector $\mathbf{24}^{4-3}$ includes five pins that are mateable with the five ports of the second auxiliary output controller pin light emitting diode female receptacle 406 of the second wireless fidelity/short range wireless controller 242.

In a similar manner, turning to FIG. 15B with reference to FIGS. 11 and 12B, the second accessory lengthening curtain lights extension panel $\mathbf{402}^{2}$ of the one or more accessory lengthening curtain lights extension panels $\mathbf{402}^{1+n}$ can be releasably operationally connected to the second wireless fidelity/short range wireless controller 242 of the second preformed curtain 238 of the second curtain lights assembly 212. The second preformed curtain 238 includes the second series of the one or more light emitting diode input color wire leads 288 congruent with the second wireless fidelity/short range wireless controller 242. The second wireless fidelity/short range wireless module chip 252 of the second wireless fidelity/short range wireless controller 242 is configured having the second main direct current input voltage wire $V^{2}$, the second ground $GND^{2}$, the second one or more direct current input wirings 204, and the second series of the one or more light emitting diode output color wirings 206 wired to the second wireless fidelity/short range wireless module chip 252 of the second wireless fidelity/short range wireless controller 242 wherein each of the second series of the one or more light emitting diode output color wirings 206 includes a second predetermined forward voltage which is directed in a forward flow through the second output pin light emitting diode female receptacle second auxiliary output controller pin light emitting diode female receptacle 406 and therethrough a second accessory input light emitting diode female receptacle $\mathbf{428}^{L2}$ configured withing the top edge $\mathbf{428}^{L}$ of the second magnetized top margin of polarity-A $\mathbf{442}^{2}$.

In the exemplary embodiment, as shown in FIG. 11, the second wireless fidelity/short range wireless controller 242 includes the second auxiliary output controller pin light emitting diode female receptacle 406 which is configured at a bottom edge of the second controller board 247 of the second wireless fidelity/short range wireless controller 242. The short range wireless controller is configured having the second wireless fidelity/short range wireless module chip 252 including the second main direct current voltage wire $V^{2}$, second one or more direct current input wirings 204, and the second series of the one or more light emitting diode output color wirings 206 being bifurcated into an auxiliary second direct current voltage wire $V^{A2}$, a second auxiliary one or more direct current input wirings 205, and a second auxiliary series of one or more light emitting diode output color wirings 207, whereby, movement of the second DC output electric current can flow through the second auxiliary output controller pin light emitting diode female receptacle 406 of the second wireless fidelity/short range wireless controller 242 to the first preformed curtain 38, or another preformed curtain in a series of preformed curtains, or the one or more accessory widening curtain lights extension panels $\mathbf{400}^{1+N}$ and the one or more accessory lengthening curtain lights extension panels $\mathbf{402}^{1+N}$.

In this manner, the third mateable 5-pin light emitting diode male connector $\mathbf{24}^{4-3}$ is provided whereby a first male connector end $\mathbf{23}^{4-3}$ of the third mateable 5-pin light emitting male connector $\mathbf{24}^{4-3}$ is releasably operationally electrically connected to the corresponding five ports of the second output controller pin light emitting diode female connector 406 of the second wireless fidelity/short range wireless controller 242, and the second male connector end $\mathbf{25}^{4-3}$ of the third mateable 5-pin light emitting diode male connector $\mathbf{24}^{4-3}$ is releasably operationally electrically connected to corresponding five ports of the second accessory input light emitting diode female receptacle $\mathbf{428}^{L2}$ recessed in a region of a top wall $\mathbf{416}^{2}$ of the of the second accessory lengthening curtain lights extension panel $\mathbf{402}^{2}$. In this manner, movement of the second DC output electric current can flow through the second output controller pin light emitting diode female connector 406 of the second wireless fidelity/short range wireless controller 242 being directed to each of a second accessory plurality of wireless fidelity/short range wireless light emitting diodes $\mathbf{446}^{2}$ of a second accessory lengthening preformed bendable wireless fidelity/short range wireless light emitting diode light strip $\mathbf{410}^{L2}$ of the second accessory lengthening curtain lights extension panel $\mathbf{402}^{2}$.

In addition, as shown in FIG. 5A, the first accessory lengthening curtain lights extension panel $\mathbf{402}^{1}$ includes a first accessory output pin light emitting diode female receptacle $\mathbf{436}^{L1}$ configured to receive a mateable pin light emitting diode male connector $\mathbf{24}^{N}$ whereby an additional accessory lengthening curtain lights extension panel can be releasably operationally electrically connected to the first accessory lengthening curtain lights extension panel 402$^{1}$, in the same manner as described above, to accommodate a larger length of a larger common window frame.

In addition, the second accessory lengthening curtain lights extension panel 402$^{2}$ includes a first accessory output pin light emitting diode female receptacle 436$^{L2}$ configured to receive a mateable pin light emitting diode male connector 24$^{N}$ whereby an additional accessory lengthening curtain lights extension panel 402$^{N}$ of the one or more accessory lengthening curtain lights extension panel 402$^{1+N}$ can be releasably operationally electrically connected to the second accessory lengthening curtain lights extension panel 402$^{2}$, in the same manner as described above, to accommodate a selected larger length of a larger common window frame.

As shown in FIGS. 14, 15A-15B and 16, each of the one or more accessory curtain lights extension panels, including the one or more accessory widening curtain lights extension panels 400$^{1+N}$ and the one or more accessory lengthening curtain lights extension panels 402$^{1+N}$, further, includes one or more magnetized margins including a magnetized top margin of polarity-A 442, a magnetized bottom margin of polarity-B 444, a magnetized side margin of polarity-A 412, and a magnetized side margin of polarity-B 448, such that any one of the one or more one or more accessory lengthening curtain lights extension panels 402$^{1+N}$ and any one of the one or more accessory lengthening curtain lights extension panels 402$^{1+N}$ can be releasably magnetically attached to the first preformed curtain 38, and the second preformed curtain 238 by way of the first magnetized polarity-A top edge 134, the first magnetized polarity-B opposing bottom edge 138 of the first preformed curtain 38, and the second magnetized polarity-A top edge 234, the second magnetized polarity-B opposing bottom edge 237 of the second preformed curtain 238, or to each other of the one or more accessory widening curtain lights extension panels 400$^{1+N}$ and the one or more accessory lengthening curtain lights extension panels 402$^{1+N}$ by way of each of the magnetized top margin of polarity-A 442.

As shown in FIGS. 14 and 16, the first accessory widening curtain lights extension panel 400$^{1}$ includes a first top magnetized top margin of polarity-A 442$^{W1}$, a first magnetized bottom margin of polarity-B 444$^{W1}$, a first magnetized side margin of polarity-A 412$^{W1}$, and a first magnetized side margin of polarity-B 448$^{W1}$. Similarly, as shown in FIG. 16 the second accessory widening curtain lights extension panel 400$^{2}$ includes a second top magnetized top margin of polarity-A 442$^{W2}$, a second magnetized bottom margin of polarity-B 444$^{W2}$, a second magnetized side margin of polarity-A 412$^{W2}$, and a second magnetized side margin of polarity-B 448$^{W2}$; and the third accessory widening curtain lights extension panel 400$^{3}$ includes a third top magnetized top margin of polarity-A 442$^{W3}$, a third magnetized bottom margin of polarity-B 444$^{W3}$, a third magnetized side margin of polarity-A 412$^{W3}$, and a third magnetized side margin of polarity-B 448$^{W3}$.

Similarly, FIGS. 15A and 15B shows that the first accessory lengthening curtain lights extension panel 402$^{1}$ and the second accessory lengthening curtain lights extension panel 402$^{2}$ includes magnetized edges. FIG. 15A shows the first accessory lengthening curtain lights extension panel 402$^{1}$ includes a first top magnetized top margin of polarity-A 442$^{L1}$, a first magnetized bottom margin of polarity-B 444$^{L1}$, a first magnetized side margin of polarity-A 412$^{L1}$, and a first magnetized side margin of polarity-B 448$^{L1}$ and a first bottom margin of polarity-B 444$^{L1}$. In the same manner, FIG. 15B shows the second accessory lengthening curtain lights extension panel 402$^{1}$ includes a second top magnetized top margin of polarity-A 442$^{L2}$, a second magnetized bottom margin of polarity-B 444$^{L2}$, a second magnetized side margin of polarity-A 412$^{L2}$, and a second magnetized side margin of polarity-B 448$^{L2}$ and a first bottom margin of polarity-B 444$^{L2}$.

It can be appreciated, that the one or more accessory widening curtain lights extension panels 400$^{1+N}$ and the one or more accessory lengthening curtain lights extension panels 402$^{1+N}$ can be arranged and/or installed together with a plurality of preformed curtains, as disclosed in the first preformed curtain 38 and the second preformed curtain 238, having the first AC/DC power supply adapter 26 connected to the power source and the second AC/DC power supply adapter 28 connected to the same or a different power source, or the second curtain light assembly not connected to the second AC/DC power supply adapter 28 thereby being dependent on the first AC/DC power supply adapter 26 of the first curtain lights assembly 12, as depicted in FIG. 12A. In addition, once the one or more accessory widening curtain lights extension panels 400$^{1+N}$ and the one or more accessory lengthening curtain lights extension panels 402$^{1+N}$ can be installed to any one of the one or more of the plurality of the preformed curtains, including the first preformed curtain 38 and the second preformed curtain 238, as described above, each of the adjacently positioned accessory widening curtain lights extension panels 400$^{1+N}$ can be installed to each other, and each of adjacently positioned accessory lengthening curtain lights extension panels 402$^{1+N}$ can be installed to each other in a daisy chaining fashion.

The process of installing the first preformed curtain 38 of the first curtain lights assembly 12 and installing the second preformed curtain 238 of the second curtain lights assembly 212 onto the common window frame, as shown in FIGS. 13A-13B, includes one or more cut magnetic polarity-A strips 14$^{1+N}$ of the roll of magnetic polarity-A tape 14 and one or more cut magnetic polarity-B strips 16$^{1+N}$ of the roll of magnetic polarity-B tape 16. Each of the one or more cut magnetic polarity-A strips 14$^{1+N}$ of the roll of magnetic polarity-A tape 14 and one or more cut magnetic polarity-B strips 16$^{1+N}$ of the roll of magnetic polarity-B tape 16 includes an adhesive side and a smooth side. Each of the one or more cut magnetic polarity-B strips 16$^{1+N}$ includes the smooth side having a groove 16*a* lined down a center region of each of the one or more cut magnetic-B strips 16$^{1+N}$ of the magnetic polarity-B tape 16. The groove 16*a* lined down the center region of each of the one or more cut magnetic polarity-B strips 16$^{1+N}$ of the magnetic polarity-B tape 16 is a means to differentiate the one or more cut magnetic polarity-A strips 14$^{1+N}$ from the one or more cut magnetic polarity-B strips 16$^{1+N}$.

The one or more cut magnetic polarity-A strips 14$^{1+N}$ of the roll of magnetic polarity-A tape 14$^{1+N}$ are magnetically attracted to the one or more cut magnetic polarity-B strips 16$^{1+N}$ of the roll of magnetic polarity-B tape 16. In addition, each of the one or more cut magnetic polarity-A strips 14$^{1+n}$ is magnetically attracted to the first magnetized polarity-B opposing bottom edge 138 of the first preformed curtain 38 and to the second magnetized polarity-B opposing bottom edge 237 of the second preformed curtain 238. Similarly, each of the cut magnetic polarity-B strips 16$^{1+N}$ are attracted to the first magnetized polarity-A top edge 134 of the first preformed curtain 38 and, similarly, to the second magnetized polarity-A top edge 234 of the second preformed curtain 238.

In this manner, as shown in FIGS. 13A-13B, the user can mount the first preformed curtain 38 to a right side portion of a head region 300 of the common window fame 18. A first cut magnetic polarity-B strip $\mathbf{16}^{1}$ of the magnetic polarity-B tape $\mathbf{16}^{1+N}$ by way of its adhesive side can be releasably adhered thereon the right side portion of the head region 300 of the common window frame 18 and a second cut magnetic polarity-B strip $\mathbf{16}^{2}$ can be releasably adhered thereon a right side jamb of the common window frame 18, and a first cut magnetic polarity-A strip $\mathbf{14}^{1}$ of the roll of magnetic polarity-A tape 14 by way of its adhesive side can be releasably adhered thereon a right side portion of a stool region 306 of the common window frame 18. Thereby, the user can releasably magnetically attach the first preformed curtain 38 to the right side portion of the head region 300 of the common window frame 18 such the first magnetized polarity-Atop edge 134 of the first preformed curtain 38 is releasably magnetically attached to the smooth side of the first cut magnetic polarity-B strip $\mathbf{16}^{1}$, the magnetized polarity-A right side straight edge 136 is releasably magnetically attached to the second cut magnetic polarity-B strip, and the first magnetized polarity-B opposing bottom edge 138 of the first preformed curtain is magnetically attracted to the smooth side of the first cut magnetic polarity-A strip $\mathbf{14}^{1}$. Now the first preformed curtain 38 is mounted and installed on the right side portion of the head region 300 of the common window frame 18 having the first AC/DC power supply adapter 26 releasably electrically connected to the power source the first preformed curtain 38 is illuminated in the window associated with the common window frame 18.

Continuing with the mounting of the second preformed curtain 238 to the common window frame 18, referring still to FIGS. 13A and 13B, a third cut magnetic polarity-B strip $\mathbf{16}^{3}$ of the magnetic polarity-B tape 16 by way of its adhesive side can be releasably adhered thereon a left side of the head portion 302 of the common window frame 18, and a fourth cut magnetic polarity-B strip $\mathbf{16}^{4}$ can be releasably adhered, by way of its adhesive side, thereon the left side jamb of the common window frame 18, and a second cut magnetic polarity-A strip $\mathbf{14}^{2}$ of the roll of magnetic polarity-A tape $\mathbf{14}^{1+N}$ by way of its adhesive side can be releasably adhered thereon a left side portion of the stool region 308 of the common window frame 18. The user can now mount and install the second preformed curtain 238 to the left side of the head portion 302 of the common window pane 18 such that the second magnetized polarity-A top edge 234 of the second preformed curtain 238 can be releasably magnetically attached to the smooth side of the second cut magnetic polarity-B tape $\mathbf{16}^{2}$ which is releasably adhered on the left side of the head portion 302 of the common window frame 18, the magnetized polarity-B left side straight edge 236 of the second preformed curtain 238 can be releasably magnetically attached to the fourth cut magnetic polarity-B strip $\mathbf{16}^{4}$, and whereby the second magnetized polarity-B opposing bottom edge 237 of the second preformed curtain 238 is releasably magnetically attached to the smooth side of the second cut magnetic polarity-B strip $\mathbf{16}^{2}$ which is releasably adhered on the left side portion of the stool region 308 of the common window frame 18. Whereby, the second preformed curtain 238 is releasably magnetically mounted to the left side frame 210 of the common window frame 18. In this manner the second preformed curtain 238 of the second curtain lights assembly 212 is now installed on the left side of the head portion 302 of the common window frame 18 concomitantly with the first preformed curtain 38 being installed on the right side portion of the head region 300 of the common window frame 18 such that a fully draped common window frame 18 is provided whereby the window associated with the common window frame 18 is illuminated with the first preformed curtain 38 and the second preformed curtain 238.

Whereby, as shown in FIG. 13A, the user and viewers can see the first curtain lights assembly 12 and the second curtain lights assembly 212 displayed in the common window frame 18 and having the power source connected to the first AC/DC power source adapter 26 and/or to the second AC/DC power source adapter 28 the first plurality of wireless fidelity/short range wireless light emitting diodes $\mathbf{46}^{1+N}$ of the first preformed bendable wireless fidelity/short range wireless light emitting diode light strip 44 of the first preformed curtain 38 of the first curtain lights assembly 12 are illuminated, and, synchronously, the second plurality of wireless fidelity/short range wireless light emitting diodes $\mathbf{246}^{1+N}$ of the second preformed bendable wireless fidelity/short range wireless light emitting diode light strip 244 of the second preformed curtain 238 of the second curtain lights assembly 12 are illuminated. FIG. 13B shows the rear perspective view of FIG. 13A showing the rear side of the first preformed curtain 38 and the rear side of the second preformed curtain 238. Looking to FIG. 13B, with reference to FIG. 5B, first quick reference code $\mathbf{160}^{1}$ is visible to the user. The first transparent non-conductive film 456 is configured to allow the user to view the first quick reference code $\mathbf{160}^{1}$ and to scan the first quick reference code $\mathbf{160}^{1}$ printed on the bottom portion of the first opaque non-conductive sheet 450 of the first preformed curtain 38.

FIGS. 1 and 4A-4D shows the portable curtain lights storage case 500, as disclosed above. The portable curtain lights storage case 500 includes the variety of sizes of the at least two removable storage containers $\mathbf{530}^{1+n}$. Each of the variety of sizes of the at least two removable storage containers $\mathbf{530}^{1+n}$ includes an icon $\mathbf{34}^{n}$ of the one or more icons $\mathbf{34}^{1+n}$ identifying each of the first curtain lights assembly 12, the second curtain lights assembly 212, the roll of magnetic polarity-A tape 14, the roll of magnetic polarity-B tape 16, the one or more pin light emitting diode female to female connector cables $\mathbf{21}^{1+n}$, one or more pin light emitting diode female to female butterfly connector cables $\mathbf{22}^{1+n}$, the one or more mateable pin light emitting diode male connectors $\mathbf{24}^{1+n}$, the first AC/DC power supply adapter 26, the second AC/DC power supply adapter 28, and the curtain lights kit/curtain lights device instruction manual 36.

The portable curtain lights storage case 500 is formed from a rigid transparent non-conductive substrate rectangular in shape having a front wall 502, a rear wall 504, a first side wall 506, an opposing second side wall 508, a bottom wall 507, and a shared center wall 509 forming two storage bodies, a first storage body 510 and a second storage body 516 and forming a first portion of the rear wall $\mathbf{504}^{1}$ and a second portion of the rear wall $\mathbf{504}^{2}$ disposed therein the portable curtain lights storage case 500. The first storage body 510 includes a first interior cavity 512 having a first lid 514 and the second storage body 516 includes a second interior cavity 518 having a second lid 520. The first lid 514 includes a first apron 522 and the second lid 520 includes a second apron 524.

Each of the variety of sizes of the at least two removable containers $\mathbf{530}^{1+n}$ is configured to hold and store each element of the curtain lights device 20, as identified above. Each of the variety of sizes of removable containers 53 includes a base floor 542 joined by four vertically orientated side walls, a first vertical side wall $\mathbf{544}^{1}$, a second vertical side wall $\mathbf{544}^{2}$, a third vertical side wall $\mathbf{544}^{3}$, a fourth vertical side wall $\mathbf{543}^{4}$, to provide a protective frame to an exposed interior space. In this way the user has quick access to the contents contained therein each of the variety of sizes of the at least two removable containers 530$^{1+n}$. In another embodiment, the each of the removable container can include a releasable lid (not shown). The each of the variety of sizes of the at least two removable containers 530$^{1+n}$ are made from a rigid silicone material.

As shown in FIGS. 4A-4D, a central portion of the front wall 502 of the portable curtain lights storage case 500 includes a magnetized strip 526 extending from the first side wall 506 to the opposing second side wall 508. The first lid 514 extends from the first portion of the rear wall 504$^{1}$ of the portable curtain lights storage case 500. The first lid 514 is configured to bend towards a first portion of the front wall 502 of the portable curtain lights storage case 500 in a closed position and bend towards a first portion of the rear wall 504$^{1}$ of the portable curtain lights storage case 500 in an open position.

As shown in FIGS. 4A-4D, the first apron 522 extends from a front linear edge 528 of the first lid 514 and is configured to bend downward against a first area of the magnetized strip 526 of the front wall 502 of the first storage body 510 such that the first magnetized latch 532 affixed on a centralized front portion of the first apron 522 is releasably magnetically attached to the first area of the magnetized strip 526 of the front wall 502 of the portable curtain lights storage case 500 to magnetically releasably fasten the first lid 514 in the closed position.

The first magnetized latch 532 includes the first latch quick reference code 536 imprinted thereon an exterior surface of the first magnetized latch 532. The first latch quick reference code 536 includes data providing the link to the manufacturer's-defined settings including the device application including the user facing software application which can be run on the user's smart device to enable the smart device (not shown) to connect and communicate with the first wireless fidelity fidelity/short range wireless controller 42, the second wireless fidelity/short range wireless controller 242 and to communicate with the 2.4 GHz bandwidth, the wireless fidelity network, the short range wireless network, and the radio frequency network.

The second lid 520 of the portable curtain lights storage case 500 extends from a second portion of the rear wall 504$^{2}$ of the portable curtain lights storage case 500. The second lid 520 is configured to bend towards a second portion of the front wall 502 of the portable curtain lights storage case 500 in the closed position and bend towards a second portion of the rear wall 504$^{2}$ of the portable curtain lights storage case 500 in the open position. The second apron 524 extends from a second front linear edge of the second lid 520 and is configured to bend downward against a second area of the magnetized strip 526 of the front wall 502 of the second storage body 516 such that the second magnetized latch 538 affixed on a centralized front portion of the second apron 524 is releasably magnetically attached to the magnetized strip 526 of the front wall 502 of the portable curtain lights storage case 500 to magnetically releasably fasten the second lid 520 in the closed position.

As shown in FIGS. 4A-4D, the second magnetized latch 538 includes a second latch quick reference code 548 imprinted thereon a top exterior surface of the second magnetized latch 538. The second latch quick reference code 548 includes data providing the link to the manufacturer's-defined settings including the device application including the user facing software application which can be run on the user's smart device to enable the smart device to connect the first wireless fidelity/short range wireless controller 42, the second wireless fidelity/short range wireless controller 242 and to communicate with the 2.4 GHz bandwidth, the wireless fidelity network, the short range wireless network, and the radio frequency network whereby the user can add the curtain lights device 20 to the device application as directed by commands from the user software application and, thereby, can control the movement of the flow of the first DC output electric current to each of the first plurality of wireless fidelity/short range wireless light emitting diodes 46$^{1+N}$ of the first preformed bendable wireless fidelity/short range wireless light emitting diode light strip 44 of the first preformed curtain 38, whereby each of the first plurality of wireless fidelity/short range wireless light emitting diodes 46$^{1+n}$ of the first preformed bendable wireless fidelity/short range wireless light emitting diode light strip 44 of the first preformed curtain 38 are illuminated, and, in the same manner, the user can control the movement of the flow of the second DC output electric current to each of the second plurality of wireless fidelity/short range wireless light emitting diodes 246$^{1+N}$ of the second preformed bendable wireless fidelity/short range wireless light emitting diode light strip 244 and thereby illuminate each of the second plurality of wireless fidelity/short range wireless light emitting diodes 246$^{1+N}$ of the second preformed bendable wireless fidelity/short range wireless light emitting diode light strip 244 of the second preformed curtain 238.

The portable curtain lights storage case 500 includes the variety of sizes of the at least two removable storage containers 530$^{1+n}$. The portable curtain lights storage case 500 Each of the variety of sizes of the at least two removable storage containers 530$^{1+n}$ is labelled with an icon 34$^{n}$ selected from the one or more icons 34$^{1+n}$ identifying each of the elements of the curtains lights device 20 including the first curtain lights assembly 12, the second curtain lights assembly 212, the roll of magnetic polarity-A tape 14, the roll of magnetic polarity-B tape 16, one or more pin light emitting diode female to female connector cables 21$^{1+n}$; one or more pin light emitting diode female to female butterfly connector cables 22$^{1+n}$; one or more mateable pin light emitting diode male connectors 24$^{1+n}$; the first AC/DC power supply adapter 26; the second AC/DC power supply adapter 28, and the curtain lights kit/curtain lights device instruction manual 36. With reference to FIG. 4A a first icon 34$^{1}$ is shown on the front wall 502 of the portable curtain lights storage case 500. The icons 34$^{1+n}$ can be applied to each of the variety of sizes of the at least two removable storage containers 530$^{1+n}$ by way of a preprinted label or preprinted film with the identifying icon 34$^{n}$ printed thereon. High quality printed films can be produced by gravure or flexographic processes. The preprinted label with the identifying icon 34$^{1+n}$ can be applied with a heat sensitive adhesive or film such as polypropylene.

The common window frame 18 can include standard windows, sliding glass door windows, with a variety of heights and widths, sash sizes and sash depths. The curtain lights device can be implemented with a variety of sizes and types of window frames including: (1) Double hung and single hung standard windows dimensioned, 2 feet wide by 3 feet high; 2 feet wide by 4 feet, 4 inches high; 2 feet, 8 inches wide by 4 feet high; 2 feet, 8 inches wide by 5 feet, 2 inches high; and 4 feet wide by 6 feet high; (2) Sliding window standard sizes are always wider than they are tall or are square. Slider windows range from 36 inches to 84 inches wide. Heights range from 24 inches to 60 inches. Size combinations commonly found: 3 feet wide by 2 feet high; 3 feet wide by 3 feet wide; 5 feet wide by 3 feet high; 6 feet wide by 4 feet high; and 7 feet wide by 4 feet high. (3)

Casement window standard sizes including widths of casement windows commonly start at 17 inches and range up to 41 inches. Common heights range from 16 inches up to 33 inches; 1-foot, 7 inches wide by 1-foot, 4 inches high; 1-foot, 7 inches wide by 2 feet, 5 inches high; 2 feet, 3 inches wide by 2 feet, 3 inches high; 2 feet, 9 inches wide by 2 feet, 9 inches high; and 3 feet, 5 inches wide by 2 feet, 5 inches high. (4) Custom window sizes where standard window sizes work for most homes, there may be common window frames that require windows that don't fall into these prescribed categories. Therefore, the curtain lights devices can be custom made to accommodate the size of the common window frame required by the user. The custom or special sizes that window manufacturers offer sometimes have a greater size range than with standard windows.

Figure 17A:
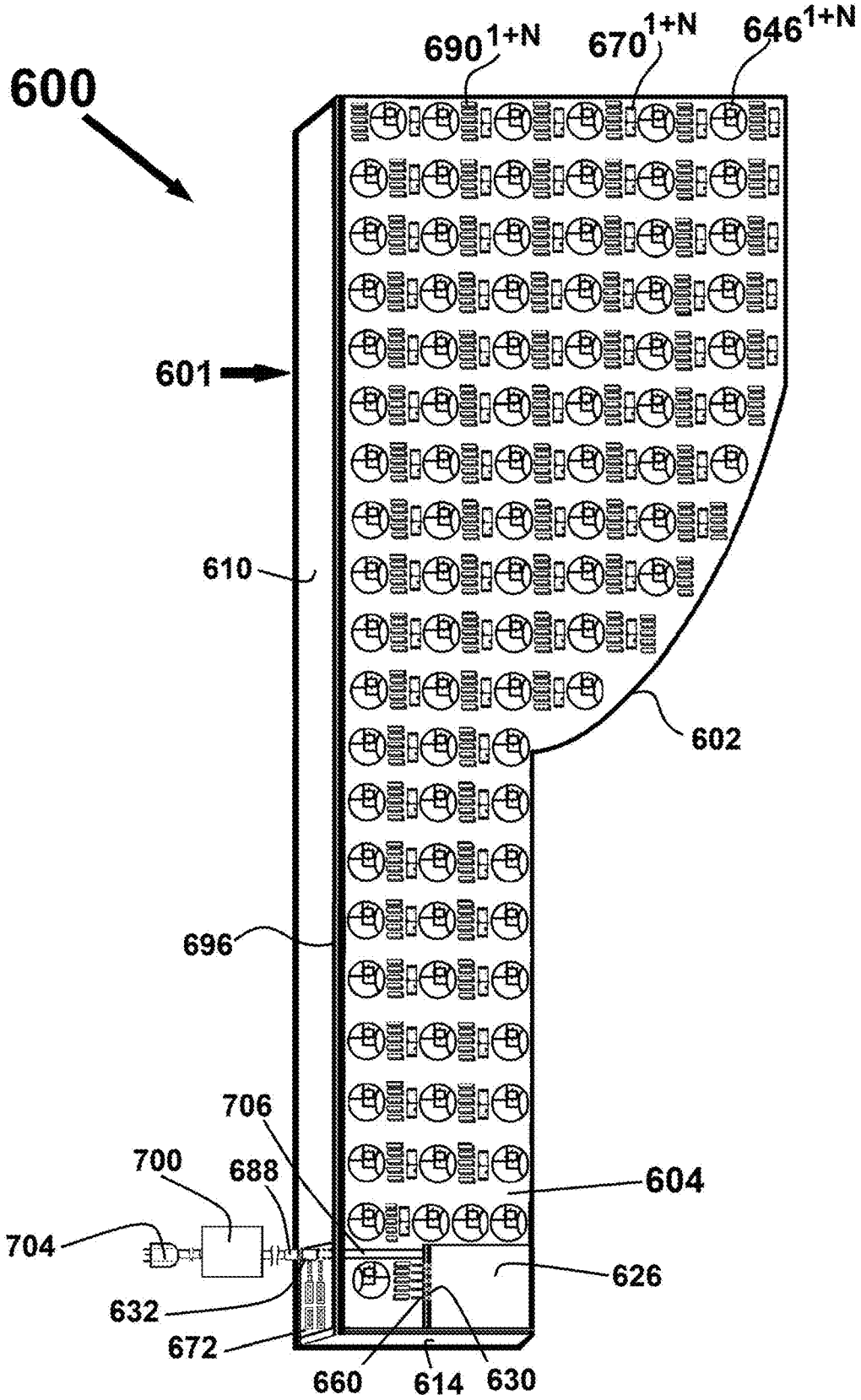
FIG. 17A illustrates a perspective view of a curtain lights device showing a docking station according to another embodiment of the present disclosure.

FIGS. 17A-20 depicts another embodiment in accordance with the disclosure of the present invention, including a curtain lights device 600. FIG. 17A illustrates a perspective view of the curtain lights device 600. The curtain lights device 600 comprises a preformed curtain lights panel 601 including a preformed wireless fidelity/short range wireless light emitting diode curtain lights plate 604, a docking station 672 and an AC/DC power supply adapter 700. The preformed curtain lights panel 601 is molded in a generally 'R" shape and molded using a transparent non-conductive substrate. In the exemplary embodiment, the transparent non-conductive substrate can be silicone.

Figure 17B:
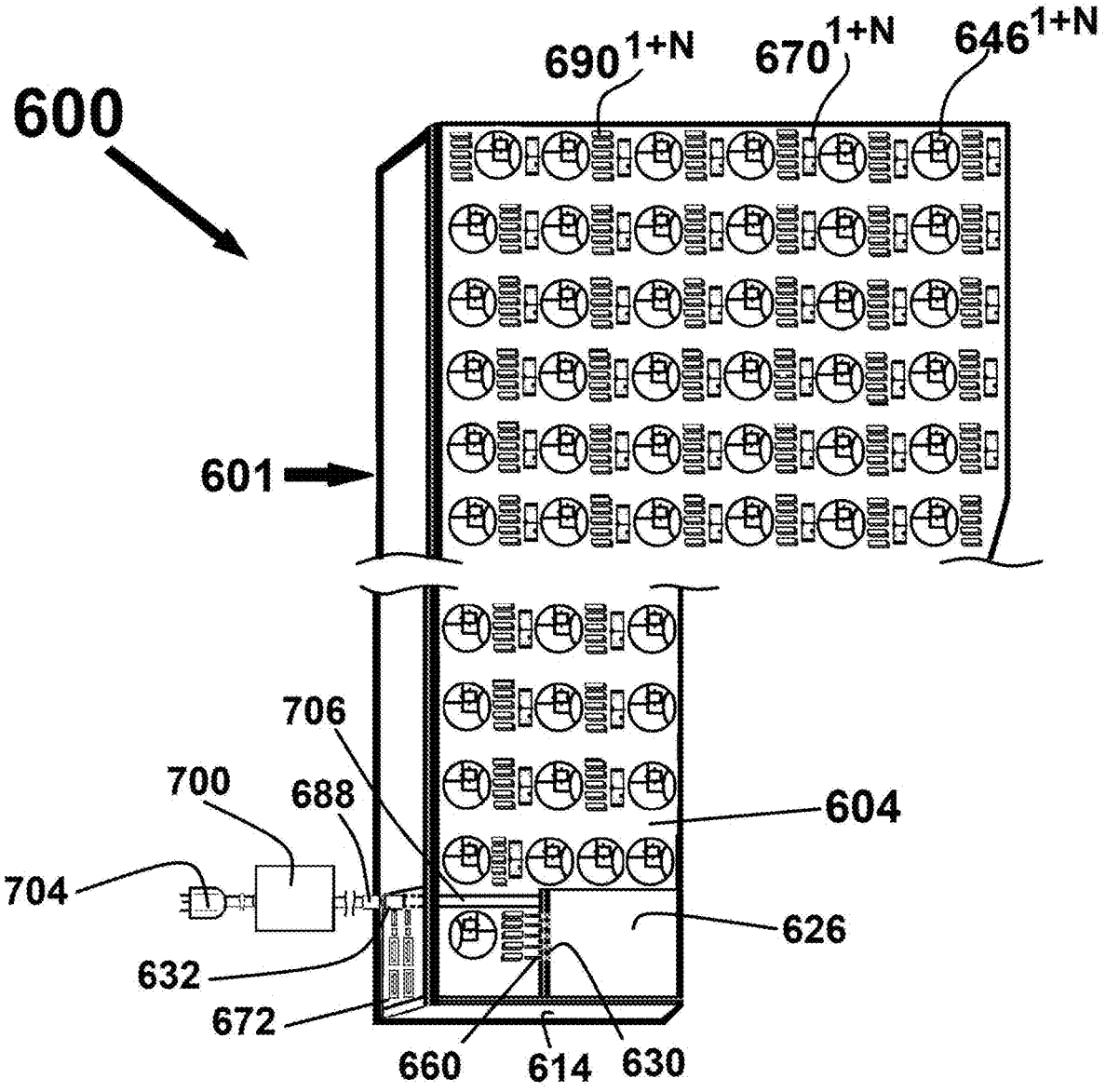
FIG. 17B illustrates an enlarged view of FIG. 17A showing a partial view of a preformed curtain lights panel of the curtain lights device, according to the embodiment of the present invention.
Figure 18A:
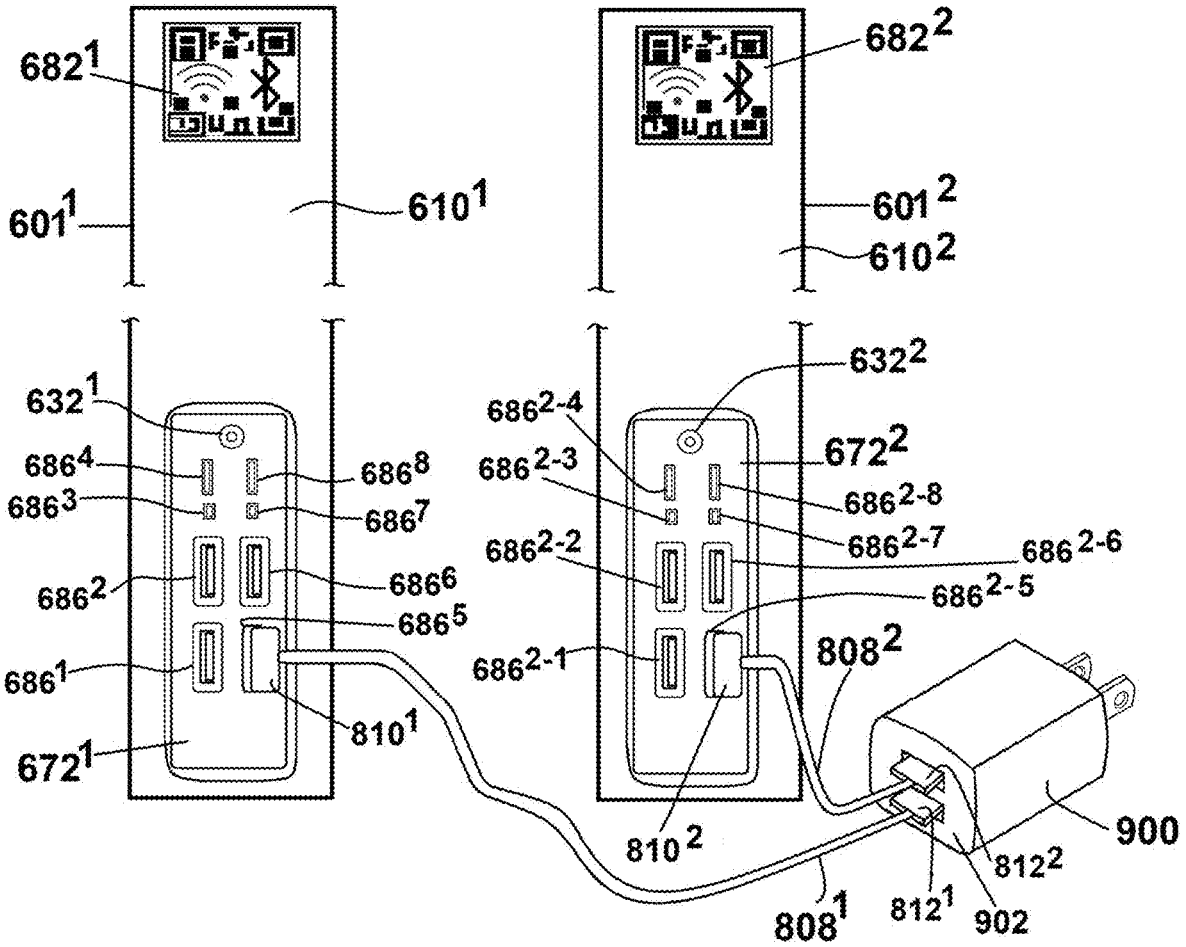
FIG. 18A illustrates a perspective side view of a first preformed curtain lights panel of a first curtain lights device having a first docking station and a first quick reference code, and a perspective side view of a second preformed curtain lights panel of a second curtain lights device having a second docking station and a second quick reference code, showing the first docking station in a working association with the second docking station by way of an AC/DC power supply adapter outlet extender and a first male to male universal serial bus cable and a second male to male universal serial bus cable, according to the embodiment of the present invention.

FIG. 17B illustrates a perspective view of an enlarged view of FIG. 17A showing a sectional view of the preformed curtain lights panel 601 including the preformed wireless fidelity/short range wireless light emitting diode curtain lights plate 604 of the curtain lights device 600 and the first docking station 672. FIG. 18A illustrates a perspective side view of the curtain lights device 600 showing a first preformed curtain lights panel $\mathbf{601}^1$ including a first docking station $\mathbf{672}^1$, and a first quick reference code $\mathbf{682}^1$, and a perspective side view of a second preformed curtain lights panel $\mathbf{601}^2$ having a second docking station $\mathbf{672}^2$, and a second quick reference code $\mathbf{682}^2$, showing the first docking station $\mathbf{672}^1$ in a working association with the second docking station $\mathbf{672}^2$ by way of an AC/DC power supply adapter outlet extender 900 and a first male to male universal serial bus cable $\mathbf{808}^1$ and a second male to male universal serial bus cable $\mathbf{808}^2$.

The first preformed curtain lights panel $\mathbf{601}^1$ includes the first preformed wireless fidelity/short range wireless light emitting diode curtain lights plate $\mathbf{604}^1$ and the second preformed curtain lights panel $\mathbf{601}^2$ includes the second preformed wireless fidelity/short range wireless light emitting diode curtain lights plate $\mathbf{604}^2$. The first preformed wireless fidelity/short range wireless light emitting diode curtain lights plate $\mathbf{604}^1$ is molded using a transparent non-conductive substrate and embedded within the first transparent non-conductive substrate of the first preformed curtain lights panel $\mathbf{601}^1$. Similarly, the second preformed wireless fidelity/short range wireless light emitting diode curtain lights plate $\mathbf{604}^2$ is molded using the transparent non-conductive substrate and embedded within the second transparent non-conductive substrate of the second preformed curtain lights panel $\mathbf{601}^2$ during a molding technique including the combination of the plastic fabrication technique, the compression molding technique, the dye-cutting technique, the vacuum casting, the coating technique, as described above for the first preformed curtain 38 and the second preformed curtain 238 of the first curtain lights assembly 12 and the second curtain lights assembly 212. Here, in the exemplary embodiment, the first preformed curtain lights panel $\mathbf{601}^1$, the first preformed wireless fidelity/short range wireless light emitting diode curtain lights plate $\mathbf{604}^1$, the second preformed curtain lights panel $\mathbf{601}^2$, and the second preformed wireless fidelity/short range wireless light emitting diode curtain lights plate $\mathbf{604}^2$ is molded using silicone.

Figure 18B:
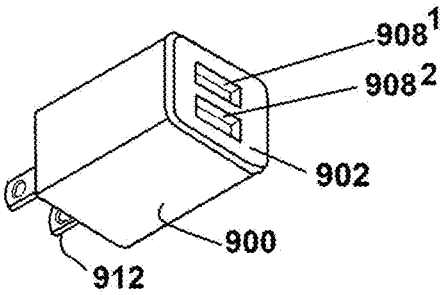
FIG. 18B illustrates a perspective view of the AC/DC power supply adapter of FIG. 18A, according to the embodiment of the present invention.
Figure 18C:
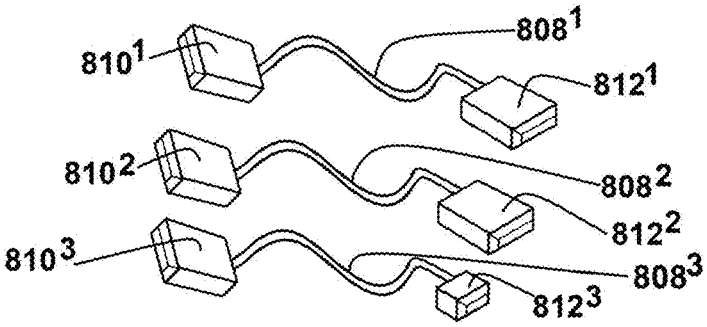
FIG. 18C illustrates a perspective view of one or more male to male universal serial bus cables, according to the embodiment of the present disclosure.

FIG. 18B illustrates a perspective view of the AC/DC power supply adapter of FIG. 18A, according to the embodiment of the present invention. FIG. 18C illustrates a perspective view of one or more male to male universal serial bus cables $\mathbf{808}^{1+N}$ implemented to connect the first docking station $\mathbf{672}^1$ to the second docking station $\mathbf{672}^2$ by way of the AC/DC power supply adapter outlet extender 900. FIG. 18 C shows a first male to male universal serial bus cable $\mathbf{808}^1$ including a first mateable terminal male plug $\mathbf{810}^1$ and a second mateable terminal male plug $\mathbf{812}^1$; a second male to male universal serial bus cable $\mathbf{808}^2$ including a first mateable terminal male plug $\mathbf{810}^2$ and a second mateable terminal male plug $\mathbf{812}^2$; and a third male to male universal serial bus cable $\mathbf{808}^3$ including a first mateable terminal male plug $\mathbf{810}^3$ and a second mateable terminal male plug $\mathbf{812}^3$.

Figure 19:
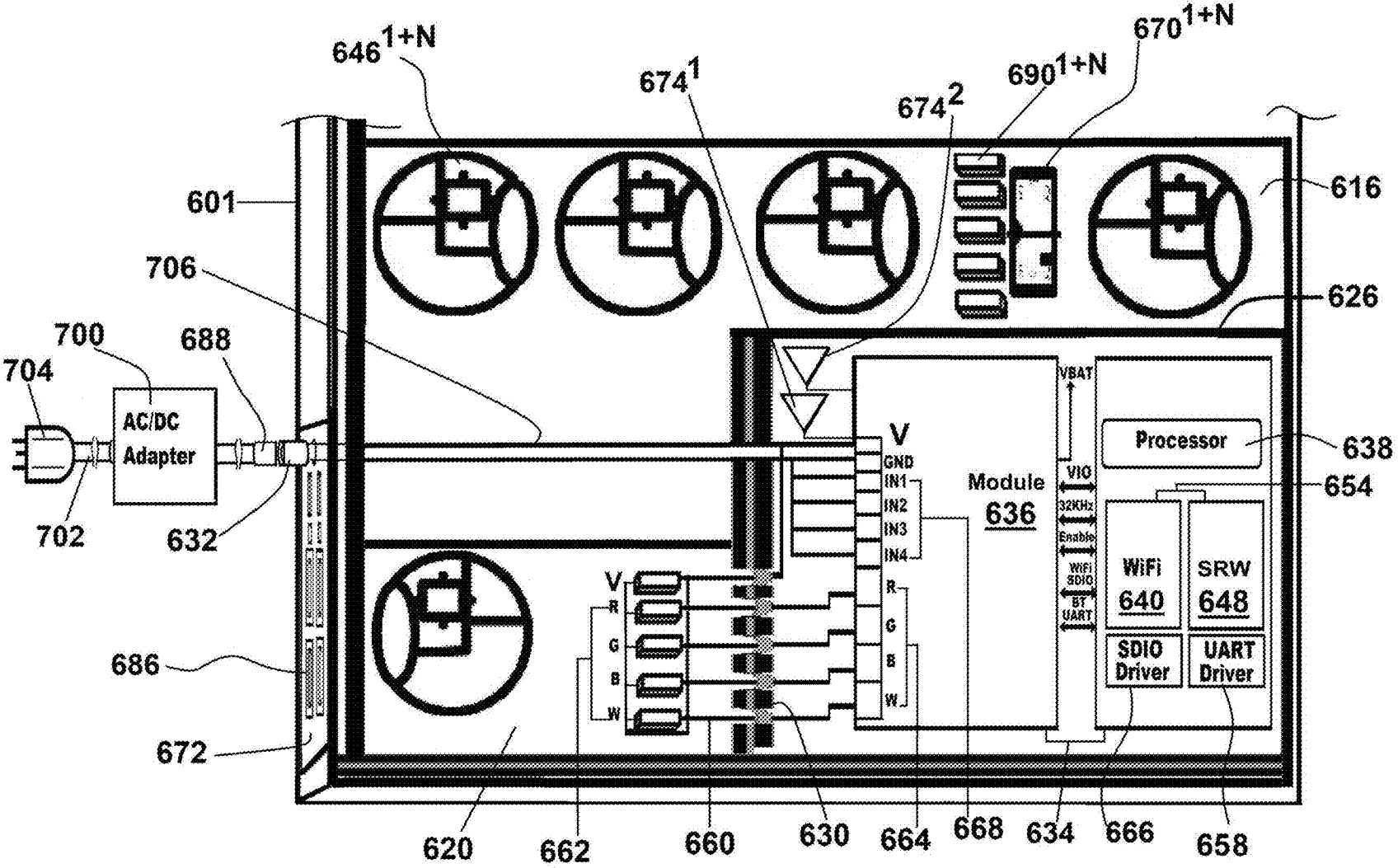
FIG. 19 illustrates a perspective view of a wireless fidelity/short range wireless controller in working association with the docking station of FIG. 17A, according to the embodiment of the present invention.
Figure 20:
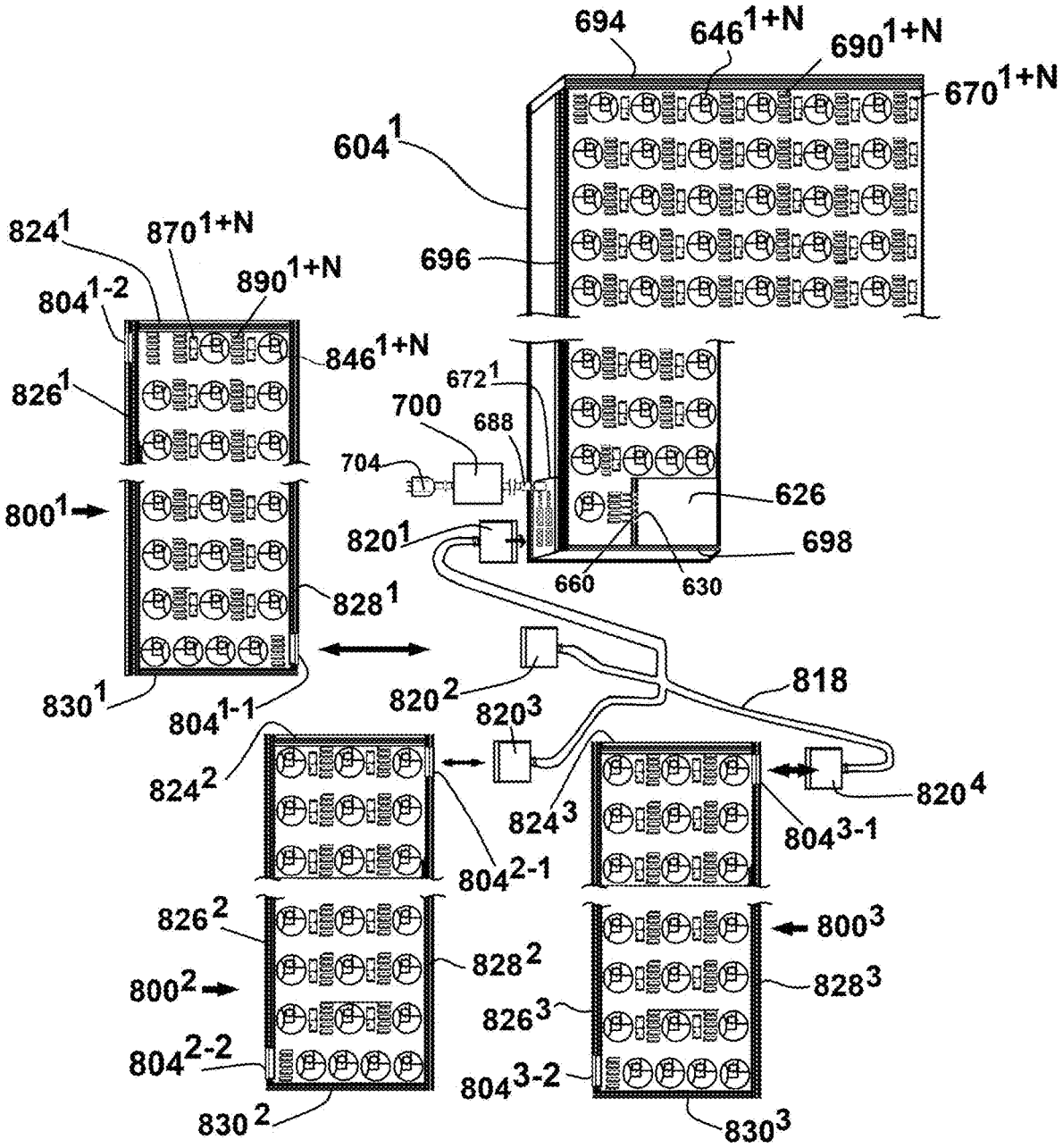
FIG. 20 illustrates a perspective view of the curtain lights device of FIG. 17A in working association with three curtain extension panels by way of a male to male butterfly universal serial bus cable, according to the embodiment of the present invention.

FIG. 19 illustrates a perspective view of the wireless fidelity/short range wireless controller 626 in a working association with the docking station 672 of the preformed curtain lights panel 601. FIG. 20 illustrates a perspective view of the curtain lights device 600 in working association with three curtain extension panels $\mathbf{800}^{1-3}$ of one or more curtain extension panels $\mathbf{800}^{1+N}$ by way of a male to male butterfly universal serial bus cable 818, discussed in more detail below.

In the exemplary embodiment, there can be one or more curtain lights devices $\mathbf{600}^{1+N}$ that are configured to be utilized in synchrony with each other of the one or more curtain lights devices $\mathbf{600}^{1+N}$ and any one of the one or more curtain extension panels $\mathbf{800}^{1+N}$. Each of the curtain lights devices $\mathbf{600}^{1+N}$ comprises a preformed wireless fidelity/short range wireless light emitting diode curtain lights plate 604. Each of one or more of the preformed wireless fidelity/short range wireless light emitting diode curtain lights plate 604 includes a transparent non-conductive substrate 603 having an interspatial area. Each of the preformed wireless fidelity/short range wireless curtain lights plate 604 includes a preformed printed circuit board 616, the wireless fidelity/short range wireless controller 626, a docking station 672, an alternate current (AC)/direct current (DC) power supply adapter, hereinafter, the AC/DC power supply adapter 700. The AC/DC power supply adapter 700 can be positioned exterior to the preformed wireless fidelity/short range wireless curtain lights plate 604. In another embodiment, the AC/DC power supply adapter 700 can be embedded within an internal spatial area of the preformed wireless fidelity/short range wireless curtain lights plate 604 proximate to the wireless fidelity/short range wireless controller 626.

The preformed printed circuit board 616 includes electrically conductive copper circuitry, a plurality of wireless fidelity/short range wireless light emitting diodes $\mathbf{646}^{1+n}$, a plurality of copper pads $\mathbf{690}^{1+N}$, a plurality of resistors $\mathbf{670}^{1+N}$ all of which are operationally electrically connected to the electrically conductive copper circuitry of the preformed printed circuit board 616. In the exemplary embodiment, the preformed circuit board 616, the wireless fidelity/short range wireless controller 626 are embedded within the transparent non-conductive substrate of the preformed wireless fidelity/short range wireless curtain lights plate 604.

FIG. 17A-17B shows each of the preformed curtain wireless fidelity/short range wireless curtain lights plate 604 includes the plurality of wireless fidelity/short range wireless light emitting diodes $646^{1+n}$ arranged in a symmetrically aligned array of rows wherein each of the plurality of wireless fidelity/short range wireless light emitting diodes $646^{1+n}$ are irreversibly operationally electrically connected to the preformed printed circuit board panel 616 by way of copper traces operationally electrically interconnected to the electrically conductive copper circuitry, the plurality of copper pads $690^{1+N}$, and the plurality of resistors $670^{1+N}$.

The preformed wireless fidelity/short range wireless curtain lights plate 604 can be formed from a transparent silicone being shaped in generally a R-shape wherein the preformed wireless fidelity/short range wireless curtain lights plate 604 includes a front curtain wall 606, a rear curtain wall 608, a linearly straight side curtain wall 610, a curvilinear side curtain wall 602, a top curtain wall 612, and a bottom curtain wall 614.

The preformed wireless fidelity/short range wireless curtain lights plate 604 can, also, be formed from a non-conductive substrate selected from the group comprising silicone, a transparent silicone which is water resistant, heat resistant and bendable, a clear, highly heat resistant bendable polyimide material, a waterproof transparent non-conductive colloid which can be a waterproof transparent polyurethane resin, polyester, polymer film, polyimide, polyimide polymer, transparent rubber, a non-conductive plastic, a non-conductive polyimide which is water resistant, heat resistant and bendable.

The preformed wireless fidelity/short range wireless curtain lights plate 604 includes a length along a median axis of the preformed wireless fidelity/short range wireless curtain lights plate 604, a varying width across the median axis of the preformed wireless fidelity/short range wireless curtain lights plate 604, and a thickness. The preformed printed circuit board 616 including the plurality of wireless fidelity/short range wireless light emitting diodes $646^{1+n}$, the plurality of copper pads $690^{1+N}$, the plurality of resistors $670^{1+N}$, the wireless fidelity/short range wireless controller 626, are each embedded within an interior spatial area of the transparent silicone of the preformed wireless fidelity/short range wireless curtain lights plate 604. The docking station 672 is substantially embedded within an interior spatial area of the transparent silicone of the preformed wireless fidelity/short range wireless curtain lights plate 604, as described in more detail below. The AC/DC power supply adapter 700, in another embodiment, can be embedded within the interior spatial area of the transparent silicone of the preformed wireless fidelity/short range wireless curtain lights plate 604 proximate to the wireless fidelity/short range wireless controller 626. The transparent silicone provides a waterproof substrate for the preformed printed circuit board 616 including the plurality of wireless fidelity/short range wireless light emitting diodes $646^{1+n}$, the plurality of copper pads $690^{1+N}$, the plurality of resistors $670^{1+N}$, the wireless fidelity/short range wireless controller 626, and protection against harm and disconnection the electrically conductive copper circuitry of the preformed printed circuit board 616 including the plurality of wireless fidelity/short range wireless light emitting diodes $646^{1+n}$, the plurality of copper pads $690^{1+N}$, the plurality of resistors $670^{1+N}$, the wireless fidelity/short range wireless controller 626.

Each of the preformed wireless fidelity/short range wireless curtain lights plate 604 is configured with the wireless fidelity/short range wireless controller 626 embedded within the transparent silicone of the preformed wireless fidelity/short range wireless curtain lights plate 604 being positioned proximate to a primary end 620 of the plurality of wireless fidelity/short range wireless light emitting diodes $646^{1+n}$ of the preformed wireless fidelity/short range wireless curtain lights plate 604.

The wireless fidelity/short range wireless controller 626 as shown in FIG. 19, includes a controller board 628, a controller pin light emitting diode female receptacle 630, a DC power input jack male plug 632, a wireless fidelity/short range wireless combination chip 634. The wireless fidelity/short range wireless controller 626 including the wireless fidelity/short range wireless combination chip 634. The wireless fidelity/short range wireless combination chip 634 enables a co-existence of wireless fidelity and short range wireless implementations in the user's personal area network or a commercial area network or in combination of both for the use of the preformed wireless fidelity/short range wireless curtain lights plate 604 in the user's home, office or business. The controller pin light emitting diode female receptacle 630 includes at least two portals. In the exemplary embodiment, the controller pin light emitting diode female receptacle 630 includes five portals.

The wireless fidelity/short range wireless controller 626 can be implemented to control movement of a DC output electric current flowing from the wireless fidelity/short range wireless controller 626 to one or more preformed wireless fidelity/short range wireless curtain lights plates 604 by way of the user's smart device and the manufacturer's scan with a camera of the user's smart device to connect to a manufacturer's defined settings including a device application including the user facing software application which can be run on a user's smart device (not shown) to enable the smart device to connect and communicate with the user's personal area network or a commercial area network or in combination of both for the use of the curtain lights devices $600^1$ in the user's home, office, 3w or business, as described in more detail below.

The preformed wireless fidelity/short range wireless curtain lights plate 604, also, includes a magnetized top margin polarity-A 694, a magnetized side margin polarity-A 696, and a magnetized bottom margin polarity-B 698, as depicted in FIG. 17B. In this manner, a curtain lights extension panel of one or more curtain lights extension panels $800^{1+n}$ can be releasably magnetically attached to the preformed wireless fidelity/short range wireless curtain lights plate 604, as disclosed in more detail, below.

FIG. 19 shows the wireless fidelity/short range wireless controller 626 includes the wireless fidelity/short range wireless combination chip 634. The wireless fidelity/short range wireless combination chip 634 includes a wireless fidelity/short range wireless module chip 636, a processor chip 638, a wireless fidelity chip/short range wireless chip 654 having a wireless fidelity chip 640 operationally installed with a secure digital input output driver (SDIO) 666, a short range wireless chip 648 operationally installed with a universal asynchronous receiver transmitter (UART) driver 658, a wireless fidelity protected access driver (WPA) 642, a short range wireless stack and profiles 650, supported by a virtual input output core (VIO), a first pair of combination wireless fidelity/short range wireless antennae, a first combination wireless fidelity/short range wireless antenna $674^1$, and a second combination wireless fidelity/short range wireless antenna $674^2$ to provide a combination wireless fidelity/short range wireless antennae coexistence. The first combination wireless fidelity/short range wireless antenna $674^1$, and the second combination wireless fidelity/short range wireless antenna $674^2$ can be a combination wireless fidelity/short range wireless antennae 2.4/5-5.8 GHz antenna. The wireless fidelity/short range wireless controller 626, also, is operationally connected to a backup voltage or VBAT. The wireless fidelity/short range wireless controller 626 can be connected to an external backup voltage supplied by the user's home, or business power source or by a battery or a rechargeable power station. This mode is called VBAT as indicated in FIG. 19. This allows to retain the content of the backup registers and RTC information while suspending the non-active part of the wireless fidlelity/short range controller without any additional component needed.

The wireless fidelity/short range wireless controller 626 is configured having a direct current (DC) voltage wiring V in FIG. 19, wherein the direct current (DC) voltage wiring V receives the flow of direct current from the AC/DC power supply adapter being operationally electrically connected to the power source, a ground GND, one or more direct current input wirings, as indicated by IN1, IN2, IN3, IN4, and one or more light emitting diode output color wirings, as indicated by R G B W 664 wired within the wireless fidelity/short range wireless module chip 636 of the wireless fidelity/short range wireless controller 626. Each of the one or more light emitting diode output color wirings R G B W 664 includes a predetermined forward voltage.

The forward voltage for the one or more light emitting diode output color wirings R G B W 664 for can be as follows: ultraviolet color has a forward voltage of 3.1-4.4 Voltage; violet colors has a forward voltage of 2.8-4.0 Voltage; blue color has a forward voltage of 2.5-3.7 Voltage; green color has a forward voltage of 1.9-4.0 Voltage; yellow color has a forward voltage of 2.1-2.2 forward voltage; orange/amber has a forward voltage of 2.0-2.1 Voltage; red color has a forward voltage of 1.6-2.0 Voltage; and infrared has a forward voltage of greater than 1.9 Voltage.

The wireless fidelity/short range wireless module chip 636 of the wireless fidelity/short range wireless controller 626 is a 2.4 GHz module chip. The wireless fidelity/short range wireless controller 626 operates on a 2.4 GHz bandwidth network, a wireless fidelity network and short range wireless network coexistence, a wireless local-area network, and can integrate a radio frequency network.

Referring to FIGS. 17A-17B and 19-20, the primary end 620 of the plurality of wireless fidelity/short range wireless light emitting diodes $\mathbf{646}^{1+n}$ of the preformed wireless fidelity/short range wireless curtain lights plate 604 includes an input direct current voltage wire $V^{IN}$, and a wire lead 660 wherein the wire lead 660 includes a series of one or more color light emitting diode input wire leads 662 providing the flow of DC output electric current from the wireless fidelity/short range wireless controller 626 and, thereby, the forward voltage to the electrical copper circuitry of the preformed printed circuit board 616 including to each of the plurality of copper pads $\mathbf{690}^{1+N}$ of the preformed printed circuit board 616 of the preformed wireless fidelity/short range wireless curtain lights plate 604 to provide electricity to illuminate each of the plurality of wireless fidelity/short range wireless light emitting diodes.

Each of the one or more light emitting diode output wires R G B W 664 are channeled through each of a corresponding port of the controller pin light emitting diode female receptacle 630 of the wireless fidelity/short range wireless controller 626 to be operationally electrically connected to the series of one or more color light emitting diode input wire leads 662. In this manner, the flow of DC output electric current from the wireless fidelity/short range wireless controller 626 is directed to each of the plurality of the wireless fidelity/short range wireless light emitting diodes $\mathbf{646}^{1+n}$, thereby, illuminating the wireless fidelity/short range wireless curtain lights plate 604 when the AC/DC power supply is releasably attached to the power source. The wireless fidelity/short range wireless curtain lights plate 604, and as known to one skilled in the art, a second preformed wireless fidelity/short range wireless curtain lights plate 604 can be mounted onto a common window frame of a window, or a stable structure in the user's home or office to provide a festive illuminated curtain of a variety of colors.

As shown in FIGS. 17A-18C, the curtain lights device 600, also, includes a first docking station $\mathbf{672}^1$. The first docking station $\mathbf{672}^1$ is embedded within a first preformed wireless fidelity/short range wireless curtain lights plate $\mathbf{604}^1$ of a first curtain lights device $\mathbf{600}^1$. The first docking station $\mathbf{672}^1$ is substantially embedded within a cut away region of a first linearly straight side wall $\mathbf{610}^1$ of the first preformed wireless fidelity/short range wireless curtain lights plate $\mathbf{604}^1$ congruent with a first wireless fidelity/short range wireless controller $\mathbf{626}^1$, as shown particularly in FIG. 18A. The first docking station $\mathbf{672}^1$ includes a body having a front wall $\mathbf{643}^1$ and a rear wall $\mathbf{644}^1$, a top wall 6751, a bottom wall $\mathbf{676}^1$, an interior facing side wall $\mathbf{678}^1$ and an opposing exterior facing side wall $\mathbf{680}^1$. The interior facing side wall $\mathbf{678}^1$ is vertically orientated in a first direction facing towards the first wireless fidelity/short range wireless controller $\mathbf{626}^1$ and the opposing exterior facing side wall $\mathbf{680}^1$ is vertically orientated in a second direction congruent with a vertical cutaway region longitudinally orientated on a lower portion of the first linearly straight side wall $\mathbf{610}^1$ of the first preformed wireless fidelity/short range wireless curtain lights plate $\mathbf{604}^1$.

The second docking station $\mathbf{672}^2$ is embedded within the second preformed wireless fidelity/short range wireless curtain lights plate $\mathbf{604}^2$ of a second curtain lights device $\mathbf{600}^2$. The second docking station $\mathbf{672}^2$ is substantially embedded within a cut away region of the second linearly straight side wall $\mathbf{610}^2$ of the second preformed wireless fidelity/short range wireless curtain lights plate $\mathbf{604}^2$ congruent with a second wireless fidelity/short range wireless controller $\mathbf{626}^2$. The second docking station $\mathbf{672}^2$ includes a body having a front wall $\mathbf{643}^2$ and a rear wall $\mathbf{644}^2$, a top wall $\mathbf{675}^2$, a bottom wall $\mathbf{676}^2$, an interior facing side wall $\mathbf{678}^2$ and an opposing exterior facing side wall 6802. The interior facing side wall $\mathbf{678}^2$ is vertically orientated in a first direction facing towards the second wireless fidelity/short range wireless controller $\mathbf{626}^2$ and the opposing exterior facing side wall $\mathbf{680}^2$ is vertically orientated in a second direction congruent with a vertical cutaway region longitudinally orientated on a lower portion of the second linearly straight side wall $\mathbf{610}^2$ of the second preformed wireless fidelity/short range wireless curtain lights plate $\mathbf{604}^2$.

The interior facing side wall $\mathbf{678}^1$ of the first docking station $\mathbf{672}^1$ includes a first multiplicity of types of interior facing female receptacles $\mathbf{684}^{1+N}$ and the opposing exterior facing side wall 680 of the first docking station $\mathbf{672}^1$ is exposed therethrough the vertical cutaway region of the preformed wireless fidelity/short range wireless curtain lights plate 604 such that a second multiplicity of types of exterior facing female receptacles $\mathbf{686}^{1+n}$ are exposed therethrough the vertical cutaway region whereby the second multiplicity of types of exterior facing female receptacles $\mathbf{686}^{2(1+n)}$ are made available to a user.

In addition, the DC power input jack male plug 632 is disposed therethrough the opposing exterior facing side wall 680 of the docking station 672 so that the DC power input jack male plug 632 can be operationally electrically connected to the AC/DC power supply adapter 700, as shown in FIG. 17A-17B, by way of a DC power output jack female connector 688. In this manner, when the AC/DC power supply adapter 700 by way of its male pronged power plug 704 is operationally connected to the power source a DC current can move to the wireless fidelity/short range wireless controller 626 and inputted at the main direct current voltage wire at V, as shown in FIG. 19.

The term "substantially" as used in connection with the description of the embodiment of the first docking station 672$^1$ substantially embedded within a cut away region of the first linearly straight side wall 610$^1$ of the first preformed wireless fidelity/short range wireless curtain lights plate 604$^1$ is meant to include that a body portion of the first docking station 672$^1$ including the top wall 675, the bottom wall 676 and the interior facing side wall 678 is fully embedded within the cut away area of the interior spatial area of the first preformed wireless fidelity/short range wireless curtain lights plate 604$^1$ and the first docking station's 672$^1$ opposing exterior facing side wall 680 is exposed through the cut away region of the first opposing exterior facing side wall 6801 of the first preformed curtain lights panel 601$^1$ whereby a user can access the second multiplicity of types of exterior facing female receptacles 686$^{2(1+n)}$ that are recessed within the first opposing exterior side wall 6801.

The AC/DC power supply adapter 700 of the curtain lights device 600 is shown in FIGS. 17A-17B, 19-20. The AC/DC power supply adapter 700 includes a first side having the DC power output jack female connector 688 and an opposing second side having a power cable 702 connected to the male pronged power plug 704 configured to releasably operationally connect to a female socket to a power source (not shown).

The DC power output jack female connector 688 of the AC/DC power supply adapter 700 is releasably operationally electrically connected to the DC power input jack male plug 632 of the first docking station's 672.

The DC power input jack male plug 632 fluidly connects into a DC power input jack male member 706 extending from the interior facing side wall 678 of the docking station 672 through which a DC output electric current actuated by the AC/DC power supply adapter 700 is routed between the first AC/DC power supply adapter 700 and the wireless fidelity/short range wireless controller 626 whereby, a flow of DC output electric current is directed to each of the plurality of the wireless fidelity/short range wireless light emitting diodes 646$^{1+n}$, thereby, illuminating the wireless fidelity/short range wireless curtain lights plate 604, wherein the male pronged power plug 704 of the AC/DC power supply adapter 700 is releasably operationally connected to the power source.

As shown in FIG. 18A-18C, with reference to FIGS. 17A-17B, according to an embodiment of the present invention, there can be one or more curtain light devices 600. In particular, as shown in FIG. 18A, there are two preformed wireless fidelity/short range wireless curtain lights plate 601$^1$, 601$^2$, a first preformed curtain lights panel 601$^1$ and a second preformed curtain lights panel 601$^2$ which are operationally electrically connected to each other by way of two universal serial bus (USB) cables 808$^1$ and 808$^2$, a first universal serial bus cable 808$^1$ and a second universal serial bus cable 808$^2$. As shown in FIG. 18A, the first docking station 672$^1$ includes a DC power input jack male plug 632$^1$, and the one or more of the first multiplicity of female exterior facing receptacles 686$^{1+n}$ of the first docking station 672$^1$ including, a first female exterior facing receptacle 686$^1$, a second female exterior facing receptacle 686$^2$, a third female exterior facing receptacle 686$^3$, a fourth female exterior facing receptacle 686$^4$, a fifth female exterior facing receptacle 686$^5$, a sixth female exterior facing receptacle 686$^6$, a seventh female exterior facing receptacle 686$^7$, and an eight female exterior facing receptacle 686$^8$.

Similarly, FIG. 18A shows the second preformed curtain lights panel 601$^2$ including the second docking station 672$^2$ including a second one or more the one or more of the second multiplicity of female exterior facing receptacles 686$^{2(1+N)}$ of the first docking station 672$^2$ including, a first female exterior facing receptacle 686$^{2-1}$, a second female exterior facing receptacle 686$^{2-2}$, a third female exterior facing receptacle 686$^{2-3}$, a fourth female exterior facing receptacle 686$^{2-2}$, a fifth female exterior facing receptacle 686$^{2-5}$, a sixth female exterior facing receptacle 686$^{2-4}$, a seventh female exterior facing receptacle 686$^{2-7}$, and an eight female exterior facing receptacle 686$^{2-8}$.

FIG. 18C shows one or more universal serial bus cable 808$^{1+N}$ including the first universal serial bus cable 808$^1$, the second universal serial bus cable 808$^2$, and a third universal serial bus cable 808$^3$ configured with a variety of types of mateable male terminal plugs 810$^{1+n}$ disposed on one terminal end of the universal serial bus cables 808$^1$, 808$^2$, and 808$^3$, and a variety of types of mateable male terminal plugs 812$^{1+N}$, disposed on a second end of each of the universal serial bus cables 808$^1$, 808$^2$ and 808$^3$. Each of the universal serial bus cables 808$^1$, 808$^2$, and 808$^3$, are each operationally electrically connected to an AC/DC power supply adapter outlet extender 900 of the one or more AC/DC power supply adapter outlet extenders 900$^{1+N}$.

In addition, any one of the one or more universal serial bus cables 808$^{1+n}$ of the variety of types of mateable male terminal plugs 810$^{1+N}$ are selected from the group comprising universal serial bus type C standard plug, USB 3.1 type C plug, a universal serial bus type A plug, a universal serial bus 1.1 type A plug, a universal serial bus 2.0 type A plug, a universal serial bus 3.0 type plug, a universal serial bus type B plug, a universal serial bus 3.0 type B plug, universal serial bus 1.1 type B plug, universal serial bus type 2.0 plug, universal serial bus 3.0 type B plug, universal serial bus 4 plug, universal serial bus 3.2 Gen 2×2, universal serial bus 3.2 Gen 2, universal serial bus 3.2 Gen 1, and universal serial bus 1.1.

With reference to FIGS. 18A-18C, the curtain lights device 600 can further include an AC/DC power supply adapter outlet extender 900. The AC/DC power supply adapter outlet extender can include an output of 5 Volts to use with the curtain lights device 600 including the preformed wireless fidelity/short range wireless light emitting diode curtain lights plate 604 only requiring a 5 Volt output. The AC/DC power supply adapter outlet extenders 900 includes a protective housing 901 having a top side 902 and a bottom side 904 joined by four side walls 906$^{1-4}$. FIGS. 18A-18B shows the top side 902 of each of the AC/DC power supply adapter outlet extenders 900 includes at least two universal serial bus female receptacles 908, including a first universal serial bus female receptacle 908$^1$ and a second universal serial bus female receptacle 908$^2$, and the bottom side 904 includes a pronged power male plug 912. In another embodiment, the AC/DC power supply adapter 700 can include the at least two universal serial bus female receptacles 908$^{1+N}$.

In this exemplary embodiment, as shown in FIGS. 18A-18C, a first universal serial bus female receptacle 908$^1$ of the AC/DC power supply adapter outlet extender 900 can receive a second mateable male terminal plug 812$^1$ of the first male to male USB cable 808$^1$ of the one or more universal serial bus cables 808$^{1+n}$ of the variety of types of mateable male terminal plugs 810$^{1+N}$, and wherein the first mateable terminal male plug 810$^{1}$ of the first male to male universal serial bus cable 808$^{1}$ of the variety of types of mateable male terminal plugs 810$^{1+N}$ can be releasably operationally electronically connected to a first mateable exterior facing female receptacle 686$^{5}$, as shown in FIG. 18A, of the one or more of the first multiplicity of female exterior facing receptacles 686$^{1+n}$ of the opposing exterior facing side wall 680 of the first docking station 672$^{1}$ of the first preformed curtain lights panel 601$^{1}$. And further, a second universal serial bus female receptacle 908$^{2}$ of the AC/DC power supply adapter outlet extenders 900 can receive a second mateable male terminal plug 812$^{2}$ of the second male to male universal serial bus cable 808$^{2}$ and the first mateable male terminal end 810$^{2}$ of the second male to male universal serial bus cable 808$^{2}$ can be releasably operationally electronically connected to a first mateable exterior facing female receptacle 686$^{2-5}$ of the second multiplicity of female exterior facing receptacles 686$^{2(1+N)}$ disposed within the second opposing exterior facing side wall 680$^{2}$ of the second docking station 672$^{2}$ of the second preformed curtain lights panel 601$^{2}$.

In this manner, when the male pronged power male plug 912 of the AC/DC power supply adapter outlet extender 900 being releasably operationally electrically connected to the female power socket (not shown) causes a flow of the alternate current (AC) input electric current whereby the AC/DC power supply adapter outlet extender 900 which transforms the alternate current (AC) input electric current into a flow of direct current (DC) output electric current to the wireless fidelity/short range wireless controller 626 at V as shown in FIG. 19 which provides a first flow of a first DC output electric current to illuminate each of the first plurality of the wireless fidelity/short range wireless light emitting diodes 646$^{1}$ of a first preformed wireless fidelity/short range wireless curtain lights plate 604$^{1}$ whereby the first preformed wireless fidelity/short range wireless curtain lights plate 604$^{1}$ is illuminated; and, synchronously, for providing a second flow of a second DC output electric current to illuminate each of a second plurality of wireless fidelity/short range wireless light emitting diodes 646$^{2(1+N)}$ of a second preformed wireless fidelity/short range wireless curtain lights plate 604$^{2}$ operationally electrically connected to the first mateable interior facing female receptacle 684$^{2-1}$ of the second docking station 672$^{2}$ which is releasably operationally electrically connected to the AC/DC power supply adapter outlet extender 900.

Referring to FIG. 20, the curtain lights device 600 further includes one or more curtain lights extension panels 800$^{1+n}$. FIG. 20 illustrates a first curtain lights extension panel 800$^{1}$, a second curtain lights extension panel 800$^{2}$, a third curtain lights extension panel 800$^{3}$. Each of the one curtain lights extension panels 800$^{1}$, 800$^{2}$, 800$^{3}$, is configured in a rectangular shape having four side walls 806$^{1-4}$ formed from the transparent silicone used to manufacture the first preformed wireless fidelity/short range wireless curtain lights plate 604$^{1}$ and the second preformed wireless fidelity/short range wireless curtain lights plate 604$^{2}$. Each of the curtain lights extension panels 800$^{1}$, 800$^{2}$, 800$^{3}$, has a thickness equal to the thickness of the preformed wireless fidelity/short range wireless curtain lights plate 604, a length equal to a length of the first linearly straight side curtain wall 610$^{1}$ of the first preformed curtain wireless fidelity/short range wireless curtain lights plate 604$^{1}$ and a length of the second linearly straight side curtain wall 610$^{2}$ of the second preformed wireless fidelity/short range wireless curtain lights plate 604$^{2}$. In addition, each of the curtain lights extension panels 800$^{1}$, 800$^{2}$, 800$^{3}$, includes an auxiliary preformed circuit board 802 embedded therein each of the one or more curtain lights extension panels 800$^{1}$, 800$^{2}$, 800$^{3}$, and one or more pin light emitting diode female receptacles 804$^{1+n}$ recessed into any one of the four side walls 806$^{1+4}$ of each of the one or more curtain lights extension panels 800$^{1}$, 800$^{2}$, 800$^{3}$.

The first curtain lights extension panel 800$^{1}$ includes a first pin light emitting diode female receptacle 804$^{1-1}$ and a second pin light emitting diode female receptacle 804$^{1-2}$; the second curtain lights extension panel 800$^{2}$ includes a first pin light emitting diode female receptacle 804$^{2-1}$ and a second pin light emitting diode female receptacle 804$^{2-2}$; a third curtain lights panel 800$^{3}$ includes a first pin light emitting diode female receptacle 804$^{3-1}$ and a second pin light emitting diode female receptacle 804$^{3-2}$.

The auxiliary preformed printed circuit board 802 of each of the one or more curtain lights extension panels 800$^{1+N}$ includes an auxiliary plurality of light wireless fidelity/short range wireless light emitting diodes 846$^{1+N}$, an auxiliary plurality of copper pads 890$^{1+N}$, an auxiliary plurality of resistors 870$^{1+N}$. Each of the one or more curtain extension panels 800$^{1+N}$ includes a top edge magnetized polarity-A 824, a first side edge magnetized polarity-A 826, a second side edge magnetized polarity-B 828, a bottom edge magnetized polarity-B 830. The top edge magnetized polarity-A 824, the first side edge magnetized polarity-A 826, the second side edge magnetized polarity-B 828, the bottom edge magnetized polarity-B 830 provides a mechanism to releasably magnetically attach any one of the one or more curtain lights extension panels 800$^{1+N}$, to the first preformed curtain lights panel 601$^{1}$, or to the second preformed curtain lights panel 601$^{2}$, or to anyone of one or more preformed curtain lights panel 601$^{1+N}$.

FIG. 20 shows a first curtain lights extension pane 800$^{1}$ includes a first top edge magnetized polarity-A 824$^{1}$, a first side edge magnetized polarity-A 826$^{1}$, a second side edge magnetized polarity-B 828$^{1}$, a bottom edge magnetized polarity-B 830$^{1}$; a second curtain lights extension panel 800$^{2}$ includes a first side edge magnetized polarity-A 826$^{2}$, a second side edge magnetized polarity-B 828$^{2}$, a bottom edge magnetized polarity-B 830$^{2}$; a third curtain lights extension panel 800$^{3}$ includes a first side edge magnetized polarity-A 826$^{3}$, a second side edge magnetized polarity-B 8283, a bottom edge magnetized polarity-B 830$^{3}$.

In this manner, a second side edge magnetized polarity-B 828$^{1}$ of the first curtain lights extension panel 800$^{1}$ can be releasably magnetically attached to the magnetized side margin polarity-A 696 of the first preformed curtain lights panel 601$^{1}$. In addition, a bottom edge magnetized polarity-B 830$^{1}$ of the first curtain lights extension panel 800$^{1}$ can be releasably magnetically attached to a top edge magnetized polarity-A 824$^{2}$ of the second curtain lights extension panel 800$^{2}$. Similarly, a second side edge magnetized polarity-B 828$^{2}$ of the second curtain light extension panel 800$^{2}$ can be releasably magnetically attached to a first side edge magnetized polarity-A 826$^{3}$ of the third curtain lights extension panel 800$^{3}$. In this manner, the curtain lights device 600 can be implemented with a variety of sizes of common window frames 18 associated with a variety of sizes of windows.

In addition, FIG. 20 shows a male to male butterfly universal cable 818 operationally electrically connected to one or more preformed curtain lights extension panels 800 in particular to the three preformed curtain extension panels, a first preformed curtain lights extension panel 800$^{1}$, a second preformed curtain lights extension panel 800$^{2}$ and a third curtain lights extension panel 800$^{3}$ to be operationally electrically connected to a single preformed wireless fidelity/short range wireless curtain lights plate 604.

As shown in FIG. 20, the male to male butterfly universal serial bus cable 818 includes four power connector ends, a first power connector male end $\mathbf{820}^1$, a second power connector end $\mathbf{820}^2$, a third power connector end $\mathbf{820}^3$, a fourth power connector end $\mathbf{820}^4$. The first power connector male end $\mathbf{820}^1$ can be releasably operationally electrically connected to a first mateable exterior facing female receptacle $\mathbf{686}^1$ of the first multiplicity of types of exterior facing female receptacles $\mathbf{686}^{1(1+N)}$ of the first docking station $\mathbf{672}^1$ of the first preformed curtain lights panel $\mathbf{604}^1$. The second power connector end $\mathbf{820}^2$ of the male to male butterfly universal serial bus cable 818 is releasably operationally electrically connected to the first pin light emitting diode female receptacle $\mathbf{804}^{1-1}$ of a first curtain lights extension panel $\mathbf{800}^1$, wherein the first pin light emitting diode female receptacle $\mathbf{804}^{1-1}$ is wired to a first auxiliary wire lead $\mathbf{86}^{1AUX}$ of a first auxiliary preformed printed circuit board $\mathbf{801}^{AUX}$ of the first curtain lights extension panel $\mathbf{800}^1$. The third power connector end 820, of the male to male butterfly universal serial bus cable 818 is releasably operationally electrically connected to a first pin light emitting diode female receptacle $\mathbf{804}^{2-1}$ of the second curtain lights extension panel $\mathbf{800}^2$ wherein the second pin light emitting diode female receptacle $\mathbf{804}^{2-1}$ is wired to a second auxiliary wire lead $\mathbf{86}^{2AUX}$ of a second auxiliary preformed printed circuit board $\mathbf{803}^2$ of the second curtain lights extension panel $\mathbf{800}^2$. The fourth power connector end $\mathbf{820}^4$ of the male to male butterfly universal serial bus cable 818 is releasably operationally connected to a first pin light emitting diode female receptacle $\mathbf{804}^{3-1}$ of the third curtain lights extension panel $\mathbf{800}^3$ wherein the first pin light emitting diode female receptable $\mathbf{804}^{3-1}$ is wired to a third auxiliary wire lead $\mathbf{86}^{3AUX}$ of a preformed printed circuit board of the third curtain lights extension panel $\mathbf{800}^3$.

In this manner, when the male pronged power plug 704 of the AC/DC power supply adapter outlet extender 900 is releasably operationally electrically connected to the female power socket (not shown) a forward flow of the alternate current (AC) is transformed into a forward flow of direct current (DC) output electric current to the wireless fidelity/short range wireless controller 626 at V, as shown in FIG. 19, which provides a first forward flow of a first DC output electric current to illuminate each of a first auxiliary plurality of the wireless fidelity/short range wireless light emitting diodes $\mathbf{646}^{A1(1+N)}$ of a first auxiliary preformed wireless fidelity/short range wireless curtain lights plate $\mathbf{604}^{A1}$ of the first curtain lights extension panel $\mathbf{800}^1$ whereby each of the first auxiliary plurality of the wireless fidelity/short range wireless light emitting diodes $\mathbf{646}^{A1(1+N)}$ of the first auxiliary preformed wireless fidelity/short range wireless curtain lights plate $\mathbf{604}^{A1}$ is illuminated; and, synchronously, the first DC output electric current is directed to each of a second auxiliary plurality of wireless fidelity/short range wireless light emitting diodes $\mathbf{646}^{A2(1+N)}$ of a second auxiliary preformed wireless fidelity/short range wireless curtain lights plate $\mathbf{604}^{A2}$ of the second curtain lights extension panel $\mathbf{800}^2$; and, synchronously, the first DC output electric current is directed to each of a third auxiliary plurality of wireless fidelity/short range wireless light emitting diodes $\mathbf{646}^{A3(1+N)}$ of a third auxiliary preformed wireless fidelity/short range wireless curtain lights plate $\mathbf{604}^{A3}$ of the third curtain lights extension panel 80.

The instructions of use of the curtain lights device 600 with the user's smart device (not shown) include steps for the user to perform to activate the wireless fidelity/short range wireless controller 626 to provide energy flowing to illuminate each of the first plurality of the wireless fidelity/short range wireless light emitting diodes $\mathbf{646}^{1+N}$ of a first preformed wireless fidelity/short range wireless curtain lights plate $\mathbf{604}^1$. With reference to FIG. 18A, the instructions include the steps, comprising: (1) operationally electrically connecting the first docking station $\mathbf{672}^1$ to the second docking station $\mathbf{672}^2$ to the AC/DC power supply adapter outlet extender 900 by way of the first male to male universal serial bus cable $\mathbf{808}^1$ and the second male to male universal serial bus cable $\mathbf{808}^2$; (2) plugging the AC/DC power supply adapter outlet extender 900 into the power source by way of its pronged power male plug 912 enabling each of the first plurality of wireless fidelity/short range wireless light emitting diodes $\mathbf{646}^{1+N}$ of the first preformed wireless fidelity/short range wireless curtain lights plate $\mathbf{604}^1$ and enabling each of a second plurality of wireless fidelity/short range wireless light emitting diodes $\mathbf{646}^{2(1+N)}$ of a second preformed wireless fidelity/short range wireless curtain lights plate $\mathbf{604}^2$ to commence blinking or strobing from the color red to green to blue; (2) opening a camera on the user's smart device (not shown); scanning by way of the camera any one of the quick reference codes including the first quick reference code $\mathbf{682}^1$ or the second quick reference code $\mathbf{682}^2$ fixed on the side wall of the first and the side wall of the first preformed wireless fidelity/short range wireless curtain lights plate $\mathbf{604}^1$ and the side wall of the second preformed wireless fidelity/short range wireless curtain lights plate $\mathbf{604}^2$; (3) opening the data link to a manufacturer-defined settings including the smart device application; (4) clicking on the add (+) device icon to enable adding the first curtain lights device $\mathbf{600}^1$ to the smart device application; (5) clicking again on the add (+) device icon to enable adding the second curtain lights device $\mathbf{600}^2$ to the smart device application; (6) adding the first curtain lights device $\mathbf{600}^1$ to the smart device application; (7) adding the second curtain lights device $\mathbf{600}^2$ to the smart device application; (8) leaving, temporarily, the manufacturer-defined settings including the smart device application; (9) finding the user's wireless fidelity network on the user's smart device; (10) adding the user's wireless fidelity network via the user's smart device; (11) finding the user's short range wireless network; (12) adding the user's short range wireless network to the user's smart device; (13) logging into the user's personal area network account; (14) opening the user's wireless fidelity setting and connecting the user's smart device to the wireless fidelity settings; (15) opening the user's short range wireless setting and connecting the user's smart device to the short range wireless settings; (16) connecting to a wireless fidelity/short range wireless signal/short range wireless signal from the first wireless fidelity/short range wireless controller $\mathbf{626}^1$ of the first preformed wireless fidelity/short range wireless curtain lights plate $\mathbf{604}^1$ of the first curtain lights device $\mathbf{600}^1$, wherein the wireless fidelity/short range wireless signal can be identified as LEDNET followed by a series of letters and numbers; (17) connecting to a wireless fidelity/short range wireless signal/short range wireless signal from the second wireless fidelity/short range wireless controller $\mathbf{626}^2$ of the second preformed wireless fidelity/short range wireless curtain lights plate $\mathbf{604}^2$ of the second curtain lights device $\mathbf{600}^2$, wherein the wireless fidelity/short range wireless signal can be identified as LEDNET followed by a series of letters and numbers; (18) returning to the smart device application; (19) returning to the smart device application; (20) finding the user's 2.4 GHz bandwidth wireless fidelity network; (21) connecting the smart device application to the 2.4 GHz bandwidth wireless fidelity network and waiting for about one minute until the first plurality of wireless fidelity/short range wireless light emitting diodes $\mathbf{646}^{1+N}$ of the first plurality of wireless fidelity/short range wireless light emitting diodes $\mathbf{646}^{1+N}$ of the first preformed wireless fidelity/short range wireless curtain lights plate $\mathbf{604}^{1}$ of the first preformed curtain lights panel $\mathbf{601}^{1}$ illuminates with a stabilized color of red or green or blue; and (22) waiting for about one minute until the second plurality of wireless fidelity/short range wireless light emitting diodes $\mathbf{646}^{2(1+N)}$ preformed wireless fidelity/short range wireless curtain lights plate $\mathbf{604}^{2}$ of the of the second preformed curtain lights panel $\mathbf{601}^{2}$ illuminates with a stabilized color of red or green or blue.

As implemented in the exemplary embodiment, the smart device is any one of the smart devices including iPhone, android phones, smartphones, mobile phones, android mobile phones, smart tablets, smart phablets, smartwatches, smart glasses, computers, laptops, and iPads, iPhone operating system (OS) devices, and intelligent home systems having a smart speaker that can respond to the user's voice command to relay and transmit commands to the first wireless fidelity/short range wireless controller $\mathbf{626}^{1}$ and/or the second wireless fidelity/short range wireless controller $\mathbf{626}^{2}$ when applicable.

What is claimed is:

1. A curtain lights kit, comprising:

a curtain lights device;

the curtain lights device including a set of two curtain lights assemblies, a first curtain lights assembly and a second curtain lights assembly for displaying in a common window frame;

a roll of magnetic polarity-A tape;

a roll of magnetic polarity-B tape;

one or more pin light emitting diode female to female connector cables;

one or more pin light emitting diode female to female butterfly connector cables;

one or more mateable pin light emitting diode male connectors;

a first AC/DC power supply adapter;

a second AC/DC power supply adapter;

a curtain lights kit/curtain lights device instruction manual;

a portable curtain lights storage case including at least two removable storage containers;

wherein the first curtain lights assembly, comprises:

a first preformed curtain formed from a first transparent non-conductive substrate including a first interior spatial area;

a first wireless fidelity/short range wireless controller embedded within the first interior spatial area of the first transparent non-conductive substrate of the first preformed curtain;

a first preformed bendable wireless fidelity/short range wireless light emitting diode light strip including a first plurality of wireless fidelity/short range wireless light emitting diodes, a first bendable printed circuit board including a first electrically conductive copper circuitry, a first plurality of copper pads, and a first plurality of resistors, wherein the first preformed bendable wireless fidelity/short range wireless light emitting diode embedded within the first interior spatial area of the first transparent non-conductive substrate of the first preformed curtain;

the first AC/DC power supply adapter;

a first quick reference code;

wherein the first wireless fidelity/short range wireless controller is embedded within the first interior spatial area of the transparent non-conductive substrate of the first preformed curtain oriented congruent to a first primary end of the first preformed bendable wireless fidelity/short range wireless light emitting diode light strip;

wherein the first wireless fidelity/short range wireless controller includes a first controller board, a first DC power input jack male plug, a first output controller pin light emitting diode female receptacle, a first wireless fidelity/short range wireless combination chip allowing for a co-existence of a wireless fidelity 2.4 GHz bandwidth and a short range wireless 2.4 GHz bandwidth, a first combination wireless fidelity/short range wireless antenna, and a second combination wireless fidelity/short range wireless antenna, the first wireless fidelity/short range wireless controller;

wherein the first wireless fidelity/short range wireless combination chip includes a first wireless fidelity module chip, a first processor chip, a first wireless fidelity chip/short range wireless chip having a first wireless fidelity chip being in coexistence with a first short range wireless chip, the first wireless fidelity chip installed with a first secure digital input output driver (SDIO), the first short range wireless chip installed with a first wireless short range universal asynchronous receiver transmitter (UART) driver, a first short range wireless stack and profiles, supported by a first virtual input output core;

wherein the first wireless fidelity/short range wireless module chip of the first wireless fidelity/short range wireless combination chip is a first 2.4 GHz wireless fidelity/short range wireless module chip whereby the first wireless fidelity/short range wireless controller operates on a 2.4 GHz bandwidth, which supports a wireless fidelity network in coexistence with a short range wireless network coexistence, a wireless local-area network, and can integrate a radio frequency network;

wherein a first DC power output jack female connector of the first AC/DC power supply adapter is releasably operationally connected to the first DC power input jack male plug of the first wireless fidelity/short range wireless controller wherein the first DC power input jack male plug incudes a first DC power input jack male plug member through which a first DC output electric current actuated by the first AC/DC power supply adapter, being releasably operationally electrically connected to a power source, is routed between the first AC/DC power supply adapter and the first wireless fidelity/short range wireless controller;

wherein the first wireless fidelity/short range wireless controller is configured having a first main direct current voltage wire, a first ground, a first one or more direct current input wirings, and a first series of one or more light emitting diode output color wirings wired to the first wireless fidelity/short range wireless module chip of the first wireless fidelity/short range wireless combination chip of the first wireless fidelity/short range wireless fidelity/short range wireless controller, wherein each of the first series of the one or more light emitting diode output color wirings includes a first predetermined forward voltage;

wherein the first preformed curtain includes a first thickness, a first front wall, a first rear wall, a first right side wall, a first opposing left side wall, a first top wall, and a first bottom wall, wherein the first preformed curtain is framed by a first top edge horizontally oriented, a first opposing bottom edge horizontally oriented parallel to the first top edge, the first top edge having a first top edge width that is greater than a first bottom edge width of the first opposing bottom edge, a first right side straight edge vertically oriented having a right side edge length extending in a first straight line from a peripheral right side edge of the first top edge to a peripheral right side edge of the first opposing bottom edge, a left side curvilinear edge having a left side curvilinear length extending in a left curvilinear line from a peripheral left side edge of the first top edge to a peripheral left side edge of the first opposing bottom edge;

wherein the first primary end of the first preformed bendable wireless fidelity/short range wireless light emitting diode light strip includes a first wire lead wherein the first wire lead includes a first main direct current input voltage wire, a first series of one or more light emitting diode input color wire leads operationally electrically connected to a first bendable printed circuit board of the first preformed bendable wireless fidelity/short range wireless light emitting diode strip of the first preformed curtain, and wherein a first terminal end of the first preformed bendable wireless fidelity/short range wireless light emitting diode light strip includes a first back end of the first wire lead, wherein the first terminal end of the first preformed bendable wireless fidelity/short range wireless light emitting diode strip is oriented congruent with a first output light emitting diode female receptacle of the first preformed curtain, wherein the first preformed bendable wireless fidelity/short range wireless light emitting diode light strip being arranged such that the first preformed bendable wireless fidelity/short range wireless light emitting diode light strip forms a first number of symmetrically aligned rows spaced laterally from the first right side wall to the first opposing left side wall of the first preformed curtain spanning a first full length of the first interior spatial area of the first transparent non-conductive substrate of the first preformed curtain;

wherein a first plurality of curved end regions seamlessly and fluidly unify each of the first number of symmetrically aligned rows allowing for a continuous movement of a first forward flow of the first DC output electric current to each of the first plurality of wireless fidelity/short range light emitting diodes in each of the first number of symmetrically aligned rows of the first wireless fidelity/short range wireless light emitting diode strip by way of the first electrically conductive copper circuitry of the first bendable printed circuit board of the first preformed bendable wireless fidelity/short range wireless light emitting diode light strip;

wherein the first top edge, the right side straight edge, and the first opposing bottom edge, of the first preformed curtain are each formed having a first core layer wherein each first core layer includes a first magnetized strip, wherein the first top edge includes a first magnetized strip polarity-A providing a first magnetized polarity-A top edge, the right side straight edge includes a first straight edge magnetized strip polarity-A providing a magnetized polarity-A right side straight edge, and the first opposing bottom edge includes a first magnetized strip polarity-B providing a first magnetized polarity-B opposing bottom edge whereby by way of one or more cut strips of the magnetic polarity-A tape and one or more cut strips of the magnetic polarity-B tape, respectively, the first preformed curtain can be releasably magnetically mounted onto the right side portion of the common window frame;

wherein the first right side wall of the first preformed curtain includes a first right aperture and a second right aperture;

wherein the first right aperture being round shaped and recessed therethrough the first right side wall of the first preformed curtain provides access to the first DC power input jack male plug of the first wireless fidelity/short range wireless controller;

wherein the second right aperture is rectangular in shape being vertically oriented and recessed therethrough a top margin of the first right side wall of the first preformed curtain wherein a first output pin light emitting diode female receptacle is installed therein, wherein the first output pin light emitting diode female receptacle is configured with a first array of five portals, wherein each of the first array of the five portals is fixed with electrically conductive copper contacts being operationally electrically wired to the first back end of the first wire lead of the first bendable circuit board of the first preformed bendable wireless fidelity/short range wireless light emitting diode light strip whereby the second preformed curtain of the second curtain lights assembly or a first accessory curtain lights extension panel of one or more accessory curtain lights extension panels can be releasably operationally electrically connected thereto;

wherein each of the first main direct current voltage wire and the first series of the one or more light emitting diode output color wirings of the first wireless fidelity/short range wireless controller is routed therethrough each of a corresponding portal of the first array of the five portals of the first output controller pin light emitting diode female receptacle of the first wireless fidelity/short range wireless controller such that each of the first main direct current voltage wire and the first series of the one or more light emitting diode output color wirings is irreversibly operationally electrically connected to the first main direct current input voltage wire and each of the first series of one or more light emitting diode input color wire leads, respectively, of the first bendable printed circuit board of the first preformed wireless fidelity/short range wireless light emitting diode light strip, whereby a first forward flow of the first DC output electric current moves therethrough to the first main direct current input voltage wire, and the first predetermined forward voltage of each of the first series of the one or more light emitting diode output color wirings moves therethrough to each of the first series of the one or more light emitting diode input color wire leads to provide the first predetermined forward voltage to each of the first plurality of wireless fidelity/short range wireless light emitting diodes of the first wireless fidelity/short range wireless light emitting diode light strip, whereby each of the first plurality of wireless fidelity/short range wireless light emitting diodes can be illuminated in a color corresponding to its received predetermined forward voltage, and thereby, generating a first visual image of a first illuminated preformed curtain draping a right side of the portion of the common window frame whereon the first preformed curtain is mounted;

wherein first quick reference code is fixed on a first opaque non-conductive sheet molded to the first rear wall of the first preformed curtain wherein the first quick reference code is protected and waterproofed by a first transparent non-conductive film molded to the first opaque non-conductive sheet;

wherein the first quick reference code includes a first pattern of at least three colored squares arranged in a first square grid on a first white background, wherein the first pattern of the at least three squares are stored with data of a manufacturer's defined settings including a smart device application for instructions to use the curtain lights kit and the curtain lights device, wherein the first quick reference code being scanned by a camera configured in a user's smart device reveals a data link to the manufacturer-defined settings including the smart device application which is a user facing software application run on the user's smart device to enable connection and communication of the smart device with a 2.4 GHz bandwidth of the user's personal area network in operation with the first wireless fidelity/short range wireless controller of the first curtain lights assembly and a second wireless fidelity/short range wireless controller of the second curtain lights assembly wherein the first wireless fidelity wireless/short range wireless controller is operationally electrically connected to the second wireless fidelity/short range wireless controller;

wherein the second curtain lights assembly, comprising:

a second preformed curtain formed from a second transparent non-conductive substrate including a second interior spatial area, wherein the second transparent non-conductive substrate is of a type identical to the first transparent non-conductive substrate of the first preformed curtain;

a second wireless fidelity/short range wireless controller embedded within the second interior spatial area of the second transparent non-conductive substrate of the second preformed curtain;

a second preformed bendable wireless fidelity/short range wireless light emitting diode light strip including a second plurality of wireless fidelity/short range wireless light emitting diodes, a second bendable printed circuit board including a second electrically conductive copper circuitry, a second plurality of copper pads, and a second plurality of resistors, wherein the second preformed bendable wireless fidelity/short range wireless light emitting diode light strip is embedded within second interior spatial area of the second transparent non-conductive substrate of the second preformed curtain;

the second AC/DC power supply adapter;

a second quick reference code;

wherein the second wireless fidelity/short range wireless controller is embedded within the second transparent conductive substrate of the second preformed curtain positioned proximate to a second primary end of the second preformed bendable wireless fidelity/short range wireless light emitting diode light strip;

wherein the second wireless fidelity/short range wireless controller includes a second controller board, a second DC power input jack male plug, a second output controller pin light emitting diode female receptacle, a second wireless fidelity/short range wireless combination chip allowing for a co-existence of the wireless fidelity 2.4 GHz bandwidth and the short range wireless 2.4 GHz bandwidth, a second controller first combination wireless fidelity/short range wireless antenna, and a second controller second combination wireless fidelity/short range wireless antenna;

wherein the second wireless fidelity/short range wireless combination chip includes a second wireless fidelity module chip, a second processor chip, a second wireless fidelity chip/short range wireless chip having a second wireless fidelity chip being in coexistence with a second short range wireless chip, the second wireless fidelity chip installed with a second secure digital input output driver (SDIO), the second short range wireless chip installed with a second wireless short range universal asynchronous receiver transmitter (UART) driver, a second short range wireless stack and profiles, supported by a second virtual input output core;

wherein the second wireless fidelity/short range wireless module chip of the second wireless fidelity/short range wireless combination chip is a second 2.4 GHz wireless fidelity/short range wireless module chip whereby the second wireless fidelity/short range wireless controller operates on the 2.4 GHz bandwidth, which supports the wireless fidelity network and the short range wireless network coexistence, the wireless local area network, and can integrate the radio frequency network;

wherein a second DC power output jack female connector of the second AC/DC power supply adapter is releasably operationally connected to the second DC power input jack male plug of the second wireless fidelity/short range wireless controller wherein the second DC power input jack male plug incudes a second DC power input jack male plug member through which a second DC output electric current actuated by the second AC/DC power supply adapter, being releasably operationally electrically connected to the power source, is routed between the second AC/DC power supply adapter and the second wireless fidelity/short range wireless controller;

wherein the second wireless/short range wireless controller is configured having a second direct current voltage wiring, a second ground, a second one or more direct current input wirings, and a second series of one or more light emitting diode output color wirings wired to the second wireless fidelity/short range wireless module chip of the second wireless fidelity/short range wireless combination chip of the second wireless fidelity/short range wireless controller, wherein each of the second series of the one or more light emitting diode output color wirings include a second predetermined forward voltage;

wherein the second preformed curtain includes a second thickness, a second front wall, a second rear wall, a second right side wall, a second opposing left side wall, a second top wall, and a second bottom wall, wherein the second preformed curtain is framed by a second top edge horizontally oriented, a second opposing bottom edge horizontally oriented parallel to the second top edge, the second top edge having a second top edge width that is greater than a second bottom edge width of the second opposing bottom edge, a left side straight edge vertically oriented having a left side edge length extending in a second straight line from a peripheral left side edge of the second top edge to a peripheral left side edge of the second opposing bottom edge, a right side curvilinear edge having a right side curvilinear length extending in a right curvilinear line from a peripheral right side edge of the second top edge to a peripheral right side edge of the opposing bottom edge;

wherein the second primary end of the second preformed bendable wireless fidelity/short range wireless light emitting diode light strip includes a second wire lead wherein the second wire lead includes a second main direct current input voltage wire, a second series of one or more light emitting diode input color wire leads operationally electrically connected to a second bendable printed circuit board of the second preformed bendable wireless fidelity/short range wireless light emitting diode strip of the second preformed curtain, and wherein a second terminal end of the second preformed bendable wireless fidelity/short range wireless light emitting diode light strip includes a second back end of the second wire lead, wherein the second terminal end of the second preformed bendable wireless fidelity/short range wireless light emitting diode strip is oriented congruent with a second output light emitting diode female receptacle of the second preformed curtain, wherein the second preformed bendable wireless fidelity/short range wireless light emitting diode light strip being arranged such that the second preformed bendable wireless fidelity/short range wireless light emitting diode light strip forms a second number of symmetrically aligned rows spaced laterally from the second right side wall to the second opposing left side wall side of the second preformed curtain spanning a second full length of the second interior spatial area of the second transparent non-conductive substrate of the second preformed curtain;

wherein a second plurality of curved end regions seamlessly and fluidly unify each of the second number of symmetrically aligned rows allowing for a continuous movement of a second forward flow of the second DC output electric current to each of the second plurality of wireless fidelity/short range light emitting diodes in each of the second number of symmetrically aligned rows of the second wireless fidelity/short range wireless light emitting diode strip by way of the second electrically conductive copper circuitry of the second bendable printed circuit board of the second preformed bendable wireless fidelity/short range wireless light emitting diode light strip;

wherein the second top edge, the left side straight edge, and the second opposing bottom edge, of the second preformed curtain are each formed having a second core layer wherein each second core layer includes a second magnetized strip, wherein the second top edge includes a second magnetized strip polarity-A providing a second magnetized polarity-A top edge, the left side straight edge includes a second straight edge magnetized strip polarity-A providing a magnetized polarity-A left side straight edge, and the second opposing bottom edge includes a second magnetized strip polarity-B providing a second magnetized polarity-B opposing bottom edge whereby by way of one or more cut strips of the magnetic polarity-A tape and one or more cut strips of the magnetic polarity-B tape, respectively, the second preformed curtain can be releasably magnetically mounted onto a left side portion of the common window frame;

wherein the second opposing left side wall of the second preformed curtain includes a first left aperture and a second left aperture;

wherein the first left aperture being round shaped and recessed therethrough the second opposing left side wall of the second preformed curtain provides access to the second DC power input jack male plug of the second wireless fidelity/short range wireless controller;

wherein the second left aperture is rectangular in shape being vertically oriented and recessed therethrough a top margin of the second opposing left side wall of the second preformed curtain wherein a second output pin light emitting diode female receptacle is installed therein, wherein the second output pin light emitting diode female receptacle is configured with a second array of five portals wherein each of the second array of five portals is fixed with electrically conductive copper contacts being operationally electrically wired to the second back end of the second wire lead of the second bendable printed circuit board of the second preformed bendable wireless fidelity/short range wireless light emitting diode light strip whereby the first preformed curtain of the first curtain lights assembly or a second accessory curtain lights extension panel of one or more accessory curtain lights extension panels to be releasably operationally electrically connected thereto;

wherein each the second main direct current voltage wire of the second series of the one or more light emitting diode output color wirings of the second wireless fidelity/short range wireless controller is routed therethrough each of a corresponding portal of the second array of five portals of the second output controller pin light emitting diode female receptacle of the second wireless fidelity/short range wireless controller such that each of the second main direct current voltage wire and the second series of the one or more light emitting diode output color wirings is irreversibly operationally electrically connected to the second input direct current voltage wire and each of the second series of the one or more light emitting diode input color wire leads of the second wire lead, respectively, of the second bendable circuit board of the second preformed bendable wireless fidelity/short range wireless light emitting diode strip whereby a second forward flow of the DC output electric current move therethrough to the second main direct current input voltage wire, and the first predetermined forward voltage of each of the second series of the one or more light emitting diode output color wiring moves therethrough to each of the second series of the one or more light emitting diode input color wire leads to provide the second predetermined forward voltage to each of the second plurality of wireless fidelity/short range wireless light emitting diodes of the second preformed bendable wireless fidelity/short range wireless light emitting diode strip, whereby each of the second plurality of wireless fidelity/short range wireless light emitting diodes of the second wireless fidelity/short range wireless light emitting diode light strip can illuminate in a color corresponding to its forward voltage, and, thereby, generating a second visual image of a second illuminated preformed curtain draping a left side portion of the common window frame whereon the second preformed curtain is mounted;

wherein the second quick reference code is fixed on a second opaque non-conductive sheet molded to the second rear wall of the second preformed curtain wherein the second quick reference code is protected and waterproofed by a second transparent non-conductive film molded to the second opaque non-conductive sheet; and wherein the second quick reference code includes a second pattern of at least three colored squares arranged in a second square grid on a first white background, wherein the second pattern of the at least three squares is identical to the first pattern of the at least three colored squares of the first quick reference code, wherein the second pattern of the at least three colored squares is stored with the data of the manufacturer's defined settings including the smart device application for the instructions to use the curtain lights kit and the curtain lights device, wherein the second quick reference code being scanned by the camera configured in the user's smart device reveals the data link to the manufacturer-defined settings including the smart device application which is the user facing software application run on the user's smart device to enable connection and communication of the smart device with a 2.4 GHz bandwidth of the user's personal area network in operation with the second wireless fidelity/short range wireless controller of the second curtain lights assembly and a second wireless fidelity/short range wireless controller of the second curtain lights assembly wherein the first wireless fidelity wireless/short range wireless controller is operationally electrically connected to the second wireless fidelity/short range wireless controller.

2. The curtain lights kit, according to claim 1, wherein the first wireless fidelity/short range wireless combination chip, further, operates with a 2.4 GHz Zigbee band network.

3. The curtain light kit, according to claim 1, wherein each of the first combination wireless fidelity/short range wireless antenna and the second combination wireless fidelity/short range wireless antenna combination is a dual band omnidirectional wireless fidelity/short range wireless antenna having a 2.4 GHz bandwidth and a 5-5.8 GHz bandwidth, simultaneously, such that each of the first combination wireless fidelity/short range wireless antenna and the second combination wireless fidelity/short range wireless antenna can radiate power equally in all directions in a uniform plane.

4. The curtain lights kit, according to claim 1, wherein the first quick reference code and the second quick reference code are each customized to include a first image and a second image centered in the first white background of the first square grid and centered in the second white background of the second white square grid, respectively, wherein the first image is a wireless fidelity symbol presented in a first color and the second image is a short range wireless symbol presented in a second color that is different color from the first color.

5. The curtain lights kit, according to claim 1, further comprising:

a first auxiliary wireless fidelity/short range wireless controller compounded with the first wireless fidelity/short range wireless controller; and a second auxiliary wireless fidelity/short range wireless controller compounded with the second wireless fidelity/short range wireless controller.

6. The curtain lights kit, according to claim 1, wherein the predetermined forward voltage can include a forward voltage in the range of 1.9 forward voltage-4.4 forward voltage.

7. The curtain lights kit, according to claim 1, wherein the first wireless fidelity/short range wireless controller and the second wireless fidelity/short range wireless controller each supports an open source operating system software, an android phone operating system, and internetwork operating system.

8. The curtain lights kit, according to claim 1, wherein the AC/DC power supply adapter is operationally electrically connected to a rechargeable power station configured with at least 12V DC output current.

9. The curtain lights kit, according to claim 1, wherein:

the first AC/DC power supply adapter can be a first internal AC/DC power supply adapter embedded within the first interior spatial area of the first transparent non-conductive substrate of the first preformed curtain; and the second AC/DC power supply adapter can be a second internal AC/DC power supply adapter embedded within the second interior spatial area of the second transparent non-conductive substrate of the second preformed curtain.

10. The curtain lights kit, according to claim 1, wherein the smart device can be selected from the group of smart devices, comprising internetwork operating system phones, operating system smart phones, android phones, smartphones, smart mobile phones, android mobile phones, smart tablets, smart phablets, smartwatches, smart glasses, computers, laptops, smart internet operating systems, and intelligent home systems.

11. The curtain lights kit, according to claim 1, wherein each of the first plurality of wireless fidelity/short range wireless light emitting diodes of the first preformed bendable wireless fidelity/short range wireless light emitting diode light strip and each of the second plurality of wireless fidelity/short range wireless light emitting diodes of the second preformed bendable wireless fidelity/short range wireless light emitting diode light strip includes a wireless fidelity/short range wireless microchip capable of communication with the 2.4 GHz bandwidth.

12. The curtain lights kit, according to claim 1, wherein:

the one or more cut strips of the magnetic polarity-A tape and one or more cut strips of the magnetic polarity-B tape each includes an adhesive side and a smooth side, wherein each of the adhesive side includes an adhesive and each of the smooth side of the one or more cut strips of magnetic polarity-B tape includes a groove lined down a center region of each of the one or more cut strips of the magnetic polarity-B tape to distinguish the one or more cut strips of the magnetic polarity-B tape from the one or more cut strips of the magnetic polarity-A tape;

a first cut strip of the magnetic polarity-B tape of the one or more cut strips of the magnetic polarity-B tape by way of its adhesive side can be releasably adhered thereon a right side portion of a head region of the common window fame, and a first cut strip of magnetic polarity-A tape of the one or more cut strips of the magnetic polarity-A tape by way of its adhesive side can be releasably adhered thereon a right side portion of a stool region of the common window frame such that the first magnetized polarity-A top edge of the first preformed curtain is releasably magnetically attached to the smooth side of the first cut strip of the magnetic polarity-B tape and the first magnetized polarity-B opposing bottom edge of the first preformed curtain is releasably magnetically attached to the smooth side of the first cut strip of the magnetic polarity-A tape whereby the first preformed curtain is releasably magnetically mounted to the right side portion of the common window frame; and a second cut strip of the magnetic polarity-B tape of the one or more cut strips of the magnetic polarity-B tape by way of its adhesive side can be releasably adhered thereon a left side portion of the head region of the common window frame, and a second cut strip of magnetic polarity-A tape of the one or more cut strips of the magnetic polarity-A tape by way of its adhesive side can be releasably adhered thereon a left side portion of the stool region of the common window frame such that the second magnetized polarity-A top edge of the second preformed curtain is releasably magnetically attached to the smooth side of the second cut strip of the magnetic polarity-B tape, and the second magnetized polarity-B opposing bottom edge of the second preformed curtain is releasably magnetically attached to the smooth side of the second cut strip of the magnetic polarity-B tape whereby the second preformed curtain is releasably magnetically mounted to the left side of the common window frame such that an illuminated fully draped common window frame is provided wherein the first curtain lights assembly and/or the second curtain lights assembly is operationally electrically connected to a power source.

13. The curtain lights kit, according to claim 1, further comprising:

a first auxiliary output controller pin light emitting diode female receptacle disposed on a first bottom edge of the first controller board of the first wireless fidelity/short range controller wherein the first auxiliary output controller pin light emitting diode female receptacle is operationally electrically wired to the first wireless fidelity/short range wireless module chip of the first wireless fidelity/short range wireless controller by way of a first auxiliary direct current voltage wire, a first auxiliary one or more direct current input wirings, and a first auxiliary series of one or more light emitting diode output color wirings; and a second auxiliary output controller pin light emitting diode female receptacle disposed on a second bottom edge of the second controller board of the second wireless fidelity/short range controller wherein the second auxiliary output controller pin light emitting diode female receptacle is operationally electrically wired to the second wireless fidelity/short range wireless module chip of the second wireless fidelity/short range wireless controller by way of a second auxiliary direct current voltage wire, a second auxiliary one or more direct current input wirings, and a second auxiliary series of one or more light emitting diode output color wirings.

14. The curtain lights kit, according to claim 1, wherein each of the accessory curtain lights extension panels of the one or more accessory curtain lights extension panels further comprising:

a rectangular shape framed by a top wall, a bottom wall, a first side wall and a second side wall;

an accessory preformed bendable wireless fidelity/short range wireless light emitting diode light strip having an accessory plurality of wireless fidelity/short range wireless light emitting diodes embedded therein an accessory transparent non-conductive substrate wherein the accessory transparent non-conductive substrate is of the type of the first transparent non-conductive substrate of the first preformed curtain and the second transparent non-conductive substrate of the second preformed curtain;

wherein the accessory preformed bendable wireless fidelity/short range wireless light emitting diode light strip begins at a primary lead end and terminating at a terminal lead end, wherein the accessory preformed bendable wireless fidelity/short range wireless light emitting diode strip is arranged in a multitude of continuous symmetrical rows extending from a top corner to a bottom corner within an accessory interior spatial area of the accessory curtain lights extension panel;

an input pin light emitting diode female receptacle which is operationally electronically connected to an accessory primary end of an accessory wire lead operationally electrically connected to an accessory bendable circuit board, the accessory wire lead including an accessory main direct current voltage wire and two or more accessory color wire leads, wherein the input pin light emitting diode female receptacle can be accessed through a first cut away opening recessed within a region of the first side wall of the curtain lights extension panel;

an accessory output pin light emitting diode female receptacle which is operationally electronically connected to an accessory back end of the accessory wire lead wherein the accessory output pin light emitting diode female receptacle can be accessed through a second cut away opening recessed within a region of the second side wall of the curtain lights extension panel;

whereby a first accessory curtain lights extension panel can be releasably operationally electrically connected to the first curtain lights assembly by way of a first mateable pin light emitting diode male connector of the one or more mateable pin light emitting diode male connectors, wherein a first male connector end of the first mateable pin light emitting male connector is releasably operationally electrically connected to the first output pin light emitting diode female receptacle of the first preformed curtain and a second male connector end of the first mateable pin light emitting diode male connector is releasably operationally electrically connected to the accessory input pin light emitting diode female receptacle of the first accessory curtain lights extension panel whereby movement of the first DC output electric current flowing from the first wireless fidelity/short range wireless controller is directed to each of a first accessory plurality of wireless fidelity/short range wireless light emitting diodes of the first accessory preformed bendable wireless fidelity/short range wireless light emitting diode light strip of the first accessory curtain lights extension panel; and whereby a second accessory curtain lights extension panel can be releasably operationally electrically connected to a second terminal end of the second wireless fidelity/short range wireless light emitting diode light strip of the second preformed curtain by way of a second mateable pin light emitting diode male connector of the one or more mateable pin light emitting diode male connectors, wherein a first male connector end of the second mateable pin light emitting male connector is releasably operationally electrically connected to the second auxiliary output controller light emitting diode female receptor of the second wireless fidelity/short range wireless controller and a second male connector end of the second mateable pin light emitting diode male connector is releasably operationally electrically connected to a second input light emitting diode female receptacle recessed in an upper region of a second side wall of the of the second accessory curtain lights extension panel whereby movement of the second DC output electric current flowing from the second wireless fidelity/short range wireless controller is directed to each of a second accessory plurality of wireless fidelity/short range wireless light emitting diodes of the second accessory preformed bendable wireless fidelity/short range wireless light emitting diode strip of the second accessory curtain lights extension panel.

15. The curtain lights kit, according to claim 1, wherein each of the accessory curtain lights extension panels of the one or more accessory curtain lights extension panels, further comprising:

one or more magnetized margins including a magnetized top margin of polarity-A, a magnetized bottom margin of polarity-B, a first magnetized side margin of polarity-A and a second magnetized side margin of polarity-B such that any one of the one or more one or more accessory curtain lights extension panels can be releasably magnetically attached to the first preformed curtain and/or the second preformed curtain by way of the first magnetized polarity-A top edge, the magnetized polarity-A right side straight edge, the first magnetized polarity-B opposing bottom edge of the first preformed curtain, and the second magnetized polarity-A top edge, the magnetized polarity-A left side straight edge, the second magnetized polarity-B opposing bottom edge of the second preformed curtain, or to each other of the one or more accessory lights extension panels, by way of each of the magnetized top margin of polarity-A, the magnetized bottom margin of polarity-B, the first magnetized side margin of polarity-A, and the second magnetized side margin of polarity-B of each of the accessory curtain lights extension panels of the one or more accessory curtain lights extension panels.

16. The curtain lights kit, according to claim 1, wherein one or more of the accessory curtain lights extension panels can be releasably operationally electrically connected to each of the first auxiliary output controller pin light emitting diode female receptacle of the first wireless fidelity/short range controller and/or to the second auxiliary output controller pin light emitting diode female receptacle of the second wireless fidelity/short range controller by way of any one of the one or more pin light emitting diode female to female butterfly connectors utilizing one or more mateable pin light emitting diode male connectors wherein a first male connector end of a first mateable pin light emitting diode male connector is releasably operationally electrically connected to the first auxiliary output controller pin light emitting diode female receptacle and the second male connector end of the first mateable pin light emitting diode male connector is releasably operationally electrically connected to a first pin light emitting diode butterfly female terminal connector of a first pin light emitting diode female to female butterfly connector, a first male connector end of a second mateable pin light emitting diode male connector is releasably operationally electrically connected to a second pin light emitting diode butterfly female terminal connector of the first pin light emitting diode female to female butterfly connector and the second male connector end of the second mateable pin light emitting diode male connector is releasably operationally electrically connected to a first input light emitting diode female receptacle of a first accessory curtain lights extension panel, a first male connector end of a third mateable pin light emitting diode male connector is releasably operationally electrically connected to a third pin light emitting diode butterfly female terminal connector of the first pin light emitting diode female to female butterfly connector and the second male connector end of the third mateable pin light emitting diode male connector is releasably operationally electrically connected to a first input light emitting diode female receptacle of a second accessory curtain lights extension panel, and a first male connector end of a fourth mateable pin light emitting diode male connector is releasably operationally electrically connected to a fourth pin light emitting diode butterfly female terminal connector of the first pin light emitting diode female to female butterfly connector and the second male connector end of the fourth mateable pin light emitting diode male connector is releasably operationally electrically connected to a first input light emitting diode female receptacle of a third accessory curtain lights extension panel.

17. The curtain lights kit, according to claim 1, wherein the roll of magnetic polarity-A tape and a roll of magnetic polarity-B tape, can comprise a metal capable of being magnetized selected from the group of metals comprising iron, nickel, and cobalt.

18. The curtain lights kit, according to claim 1, wherein each of the first plurality of wireless fidelity/short range wireless light emitting diodes of the first preformed bendable wireless fidelity/short range wireless light emitting diode light strip and each of the second plurality of the wireless fidelity/short range wireless light emitting diodes of the second preformed bendable wireless fidelity/short range wireless light emitting diode light strip includes a surface mounted diode type wireless fidelity/short range wireless light emitting diode.

19. The curtain lights kit, according to claim 1, wherein each of the first plurality of wireless fidelity/short range wireless light emitting diodes of the first preformed bendable wireless fidelity/short range wireless light emitting diode light strip and each of the second plurality of the wireless fidelity/short range wireless light emitting diodes of the second preformed bendable wireless fidelity/short range wireless light emitting diode light strip includes a chip on board type diode.

20. The curtain lights kit, according to claim 1, wherein the first preformed curtain and the second preformed curtain can be preconfigured in size, dimension or curtain shape configuration whereby the first preformed curtain and the second preformed curtain can be customized and configured to fit a variety of dimensions of a variety of common window frames.

21. The curtain lights kit, according to claim 1, wherein each of the first plurality of wireless fidelity/short range wireless light emitting diodes of the first preformed bendable wireless fidelity/short range wireless light emitting diode light strip and the second plurality of wireless fidelity/short range wireless light emitting diodes of the second preformed bendable wireless fidelity/short range wireless light emitting diode light strip emit the same color.

22. The curtain lights kit, according to claim 1, wherein each of the first plurality of wireless fidelity/short range wireless light emitting diodes of the first preformed bendable wireless fidelity/short range wireless light emitting diode light strip emits a first color and each of the second plurality of wireless fidelity/short range wireless light emitting diodes of the second preformed bendable wireless fidelity/short range wireless light emitting diode light strip emit a second color different from the first color emitted from each of the first plurality of wireless fidelity/short range wireless light emitting diodes of the first preformed bendable wireless fidelity/short range wireless light emitting diode light strip.

23. The curtain lights kit, according to claim 1, wherein:

the first preformed bendable wireless fidelity/short range wireless light emitting diode light strip and the first wireless fidelity/short range wireless controller each being embedded within the first interior spatial area of the first transparent non-conductive substrate of the first preformed curtain are waterproofed; and the second wireless fidelity/short range wireless light emitting diode light strip and the second wireless fidelity/short range wireless controller each being embedded within the second interior spatial area of the second transparent non-conductive substrate of the second preformed curtain are waterproofed.

24. The curtain lights kit, according to claim 1, wherein the first transparent non-conductive substrate and the second transparent substrate can be selected from the group of substrates comprising, transparent silicone, silicone, transparent silicone, polyimide, colloid, polyurethane resin, polyester, polymer film, polyimide, polyimide polymer, transparent rubber.

25. The curtain lights kit, according to claim 24, wherein any one of the group of substrates comprises the characteristics of being water resistant, heat resistant, and bendable.

26. The curtain lights kit, according to claim 24, wherein any one of the group of substrates comprises the characteristics of being water resistant, heat resistant, and non-bendable.

27. The curtain lights kit, according to claim 1, wherein the first preformed curtain and the second preformed curtain is made by way of a molding technique including a combination of a plastic fabrication technique, a compression molding technique, a dye-cutting technique, a vacuum casting, coating technique.

28. The curtain lights kit, according to claim 1, wherein the portable curtain lights storage case further comprises:

a rigid transparent non-conductive substrate rectangular in shape having a front wall, a rear wall, a first side wall and an opposing second side wall enclosing two storage bodies, a first storage body and a second storage body disposed therein the portable curtain lights storage case;

the first storage body including a first interior cavity having a first lid including a first apron, and the second storage body including a second interior cavity having a second lid including a second apron;

wherein a central portion of the front wall of the portable curtain lights storage case includes a magnetized strip extending from the first side wall to the opposing second side wall;

wherein the first lid extends from a first portion of the rear wall of the portable curtain lights storage case, the first lid configured to bend towards a first portion of the front wall of the portable curtain lights storage case in a closed position and bend towards a first portion of the rear wall of the portable curtain lights storage case in an open position;

wherein the first apron extends from a first front linear edge of the first lid and is configured to bend downward against a first area of the magnetized strip such that a first magnetized latch affixed on a front centralized portion of the first apron is releasably magnetically attached to the first area of the magnetized strip of the front wall of the portable curtain lights storage case to magnetically releasably fasten the first lid in the closed position;

wherein the first magnetized latch includes a first latch quick reference code imprinted thereon an exterior surface of the first magnetized latch, wherein the first latch quick reference code includes the data providing the link to the manufacturer's defined settings including a smart device application for instructions to use the curtain lights kit and the curtain lights device;

wherein the second apron extends from a second front linear edge of the second lid and is configured to bend downward against a second area of the magnetized strip such that a second magnetized latch affixed on a front centralized portion of the second apron is releasably magnetically attached to the second area of the magnetized strip of the front wall of the portable curtain lights storage case to magnetically releasably fasten the second lid in the closed position;

wherein the second magnetized latch includes a second latch quick reference code imprinted thereon an exterior surface of the second magnetized latch, wherein the second latch quick reference code includes the data providing the link to the manufacturer's defined settings including a smart device application for instructions to use the curtain lights kit and the curtain lights device; and wherein each of the at least two storage containers is labelled with an icon identifying each of the first curtain lights assembly, the second curtain lights assembly, the roll of magnetic polarity-A tape, the roll of magnetic polarity-B tape, the one or more pin female to female connector cables, the one or more pin female to female butterfly connector cables, the one or more mateable pin light emitting diode male connectors, the first AC/DC power supply adapter, the second power supply adapter, the curtain lights device instruction manual to categorically store the first curtain lights assembly and the second curtain lights assembly.

29. The curtain lights kit, according to claim 1, wherein the first opaque non-conductive sheet and the second opaque non-conductive sheet is print receptive.

30. The curtain lights kit, according to claim 1, wherein the first opaque non-conductive sheet and the second opaque non-conductive sheet comprises a high density polyethylene.

31. The curtain lights kit, according to claim 1, wherein the first opaque non-conductive sheet and the second opaque non-conductive sheet comprises a butyl rubber.

32. The curtain lights kit, according to claim 1, wherein:

the first latch quick reference code is imprinted on a polyethylene film comprising a releasable adhesive such that the first latch quick reference code can be releaseably attached to an exterior surface of the first magnetized latch of the portable curtain lights storage case; and the second latch quick reference code is imprinted thereon a polyethylene film comprising the releasable adhesive such that the second latch quick reference code can be releasably attached an exterior surface of the second magnetized latch quick reference code can be releaseably attached an exterior surface of the second magnetized latch of the portable curtain lights storage case.

33. A curtain lights device, comprising:

a preformed curtain lights panel formed from a transparent silicone substrate being molded in a generally R-shape wherein the preformed curtain lights panel includes a front curtain wall, a rear curtain wall, a linearly straight side curtain wall, a curvilinear side curtain wall, a top curtain wall, and a bottom curtain wall, wherein the preformed curtain lights panel includes a length along a median axis of the preformed curtain lights panel, a varying width across the median axis of the preformed curtain lights panel, and a thickness;

a preformed wireless fidelity/short range wireless light emitting diode plate molded in the generally R-shape of the preformed curtain lights panel, wherein the preformed wireless fidelity/short range wireless light emitting diode plate is embedded within an interior spatial area of the transparent silicone substrate of the preformed curtain lights panel;

a wireless fidelity/short range wireless controller embedded within the transparent silicone substrate of the preformed curtain lights panel congruent with the preformed wireless fidelity/short range wireless light emitting diode plate;

a docking station;

an AC/DC power supply adapter;

wherein the preformed wireless fidelity/short range wireless light emitting diode plate includes a preformed printed circuit board including an electrically conductive copper circuitry irreversibly electrically connected to a plurality of wireless fidelity/short range wireless light emitting diodes, a plurality of copper pads, a plurality of resistors, arranged in a symmetrically aligned array of rows along the length of the transparent silicone substrate of the curtain lights panel;

wherein the preformed wireless fidelity/short range wireless light emitting diode plate includes a primary end and a terminal end, wherein the primary end includes a wire lead, wherein the wire lead includes a main direct current input voltage wire, a series of one or more light emitting diode input color wire leads extending from the electrically conductive copper circuitry of the preformed printed circuit board of the preformed wireless fidelity/short range wireless light emitting diode plate;

wherein the wireless fidelity/short range wireless controller includes a controller board, a DC power input jack male plug, a controller pin light emitting diode female receptacle, a wireless fidelity/short range wireless combination chip allowing for a co-existence of a wireless fidelity 2.4 GHz bandwidth and a short range wireless 2.4 GHz bandwidth;

wherein the wireless fidelity/short range wireless combination chip includes a wireless fidelity module chip, a processor chip, a wireless fidelity chip/short range wireless chip having a wireless fidelity chip being in coexistence with a short range wireless chip, the wireless fidelity chip installed with a secure digital input output driver (SDIO), the short range wireless chip installed with a wireless short range universal asynchronous receiver transmitter (UART) driver, a short range wireless stack and profiles, supported by a virtual input output core, a first combination wireless fidelity/short range wireless antenna, and a second combination wireless fidelity/short range wireless antenna;

wherein the wireless fidelity/short range wireless module chip of the wireless fidelity/short range wireless combination chip is a first 2.4 GHz wireless fidelity/short range wireless module chip whereby the wireless fidelity/short range wireless controller operates on a 2.4 GHz bandwidth, which supports a wireless fidelity network and a short range wireless network coexistence, a wireless local-area network, and can integrate a radio frequency network;

wherein the docking station includes a front wall, a rear wall, top wall, a bottom wall, an interior facing side wall and an opposing exterior facing side wall, wherein the interior facing side wall is vertically oriented in a first direction facing towards the wireless fidelity/short range wireless controller and the opposing exterior facing side wall is vertically oriented in a second direction being exposed therethrough a vertical cutaway region longitudinally oriented on a lower portion of the linearly straight side curtain wall of the preformed curtain lights panel;

wherein the interior facing side wall of the docking station includes a first multiplicity of types of interior facing female receptacles and wherein the opposing exterior facing side wall of the docking station includes a second multiplicity of types of exterior facing female receptacles being exposed therethrough the vertical cutaway region whereby the second multiplicity of types of exterior facing female receptacles are made available to a user;

wherein the AC/DC power supply adapter includes a first side including a DC power output jack female connector and an opposing second side having a power cable connected to a male power plug connector configured to releasably operationally connect to a female socket of a power source;

wherein the DC power output jack female connector of the AC/DC power supply adapter is releasably operationally electrically connected to the DC power input jack male plug of the wireless fidelity/short range wireless controller, wherein the DC power input jack male plug can be accessed by way of the opposing exterior facing side wall of the docking station;

wherein the wireless fidelity/short range wireless controller is configured having a main direct current voltage wire, a ground, one or more direct current input wirings, and a series of one or more light emitting diode output color wirings wired to the wireless fidelity/short range wireless module chip of the wireless fidelity/short range wireless combination chip of the wireless fidelity/short range wireless fidelity/short range wireless controller, wherein each of the series of the one or more light emitting diode output color wirings includes a predetermined forward voltage; and wherein each of the main direct current voltage wire and each of the of the one or more light emitting diode output color wirings of the wireless fidelity/short range wireless controller are routed therethrough each of a corresponding portal of five portals of the controller pin light emitting diode female receptacle of the wireless fidelity/short range wireless controller to be irreversibly operationally electrically connected to each of the main direct current input voltage wire of the wire lead and each of the one or more light emitting diode input color wire leads of the wire lead of the wireless fidelity/short range wireless light emitting diode plate, respectively, wherein the main direct current voltage wire receives a forward flow of the first DC output electric current actuated by the AC/DC power supply adapter, and each of the series of the one or more light emitting diode input color wire leads receives the predetermined forward voltage corresponding from each of the one or more light emitting diode output color wirings, whereby each of the plurality of wireless fidelity/short range wireless light emitting diodes of the preformed wireless fidelity/short range wireless light emitting diode plate of the preformed curtain lights panel is illuminated in a color corresponding to its received predetermined forward voltage, and, thereby, wherein the curtain lights panel is mounted on a side of a common window frame a visual image of an illuminated preformed curtain lights panel draping the side of the common window frame is generated.

34. The curtain lights device, according to claim 33, wherein:

each of the first combination wireless fidelity/short range wireless antenna, and the second combination wireless fidelity/short range wireless antenna of the first wireless fidelity/short range wireless controller and each of the second controller first combination wireless fidelity/short range wireless antenna, and the second controller second combination wireless fidelity/short range wireless antenna is a dual band omnidirectional wireless fidelity/short range wireless antenna having a 2.4 GHz bandwidth and a 5-5.8 GHz bandwidth, simultaneously, such that each of the first combination wireless fidelity/short range wireless antenna and the second combination wireless fidelity/short range wireless antenna can radiate power equally in all directions in a uniform plane.

35. The curtain lights device, according to claim 33, further comprising:

one or more AC/DC power supply adapter outlet extenders;

wherein each of the one or more AC/DC power supply adapter outlet extenders includes a protective housing having a top side and a bottom side joined by four side walls;

wherein the top side includes at least two universal serial bus female receptacles, and the bottom side includes a male pronged power plug;

wherein a first universal serial bus female receptacle of the at least two universal serial bus receptacles can receive a first mateable male terminal plug of a first universal serial bus cable of one or more universal serial bus cables of a variety of types of male to male terminal plugs and wherein a second mateable male terminal plug of the first universal serial bus cable can be releasably operationally electronically connected to a first mateable exterior facing female receptacle of a first opposing exterior side wall of a first docking station of a first preformed curtain lights panel;

wherein a second universal serial bus female receptacle of the at least two AC/DC power supply adapter outlet extenders can receive a first mateable male terminal plug of a second universal serial bus cable and a second mateable male terminal end of the second universal serial bus cable can be releasably operationally electronically connected to a second mateable exterior facing female receptacle of a second opposing exterior side wall of a second docking station of a second preformed lights curtain panel; and wherein the first AC/DC power supply adapter outlet extender when connected to a power source provides a flow of a direct current output electric current to each of a first plurality of wireless fidelity/short range wireless light emitting diodes of a first preformed wireless fidelity/short range wireless light emitting diode plate of the first preformed lights curtain panel and to each of a second plurality of wireless fidelity/short range wireless light emitting diodes of a second preformed wireless fidelity/short range wireless light emitting diode plate of the second preformed lights curtain panel and, thereby, each of the first plurality of wireless fidelity/short range wireless light emitting diodes of the first preformed wireless fidelity/short range wireless light emitting diode plate and each of the second plurality of wireless fidelity/short range wireless light emitting diodes of the second preformed wireless fidelity/short range wireless light emitting diode plate are illuminated providing a first illuminated preformed wireless fidelity/short range wireless light emitting diode plate of the first preformed curtain lights panel and a second illuminated preformed wireless fidelity/short range wireless light emitting diode plate of the second curtain lights panel.

36. The curtain lights device, according to claim 33, further comprising:

one or more curtain lights extension panels;

wherein each of the one or more curtain lights extension panels includes a rectangular shape having four side walls formed from the transparent silicone substrate, an auxiliary preformed wireless fidelity/short range wireless light emitting diode plate embedded therein, and one or more pin light emitting diode female receptacles recessed into any one of the four side walls of each of the one or more curtain lights extension panel, one or more universal serial bus cables including a variety of types of male to male terminal plugs; and wherein each of the one or more universal serial bus cables includes a first terminal male plug and a second terminal male plug and a length of cable therebetween, wherein each of the first terminal male plug is mateable with one or more of the first multiplicity of the exterior female receptacles of the opposing exterior side wall of the docking station and the second terminal male plug is mateable with one or more pin light emitting diode female receptors recessed into one or more side walls of each of one or more extension curtain lights panels whereby by way of a mateable USB cable any one of the one or more curtain lights extension panels can be operationally electrically connected to the preformed curtain lights panel.

37. The curtain lights device, according to claim 33, wherein the preformed curtain lights panel, and the preformed wireless fidelity/short range wireless light emitting diode plate can be manufactured by way of a molding technique including a combination of a plastic fabrication technique, a compression molding technique, a dye-cutting technique, a vacuum casting, coating technique.

38. The curtain lights device, according to claim 33, wherein the preformed curtain lights panel, and the preformed wireless fidelity/short range wireless light emitting diode plate can be bendable.

39. The curtain lights device, according to claim 33, wherein the preformed curtain lights panel, and the preformed wireless fidelity/short range wireless light emitting diode plate can be non-bendable.

* * * * *